US012582879B2

(12) United States Patent
Greaney et al.

(10) Patent No.: US 12,582,879 B2
(45) Date of Patent: Mar. 24, 2026

(54) MULTI-PIECE GOLF CLUB HEAD

(71) Applicant: Taylor Made Golf Company, Inc., Carlsbad, CA (US)

(72) Inventors: Mark Greaney, Vista, CA (US); Stephen Kraus, Kaohsiung City (TW); Bryan Cheng, Kaohsiung City (TW); Kevin Cheng, Kaohsiung City (TW); Matthew Greensmith, Carlsbad, CA (US); Christopher Harbert, Carlsbad, CA (US); Todd Beach, San Diego, CA (US); Matthew D. Johnson, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 1007 days.

(21) Appl. No.: 17/564,077

(22) Filed: Dec. 28, 2021

(65) Prior Publication Data

US 2022/0184469 A1 Jun. 16, 2022

Related U.S. Application Data

(63) Continuation-in-part of application No. 17/505,511, filed on Oct. 19, 2021, which is a continuation-in-part (Continued)

(51) Int. Cl.
*A63B 53/04* (2015.01)
*A63B 53/06* (2015.01)

(52) U.S. Cl.
CPC ..... *A63B 53/0433* (2020.08); *A63B 53/0408* (2020.08); *A63B 53/0437* (2020.08);

(Continued)

(58) Field of Classification Search
CPC ..... A63B 53/0433; A63B 53/0437; A63B 53/0408; A63B 53/0466; A63B 53/0454;

(Continued)

(56) References Cited

U.S. PATENT DOCUMENTS 3,897,066 A 7/1975 Belmont
4,214,754 A 7/1980 Zebelean (Continued)

FOREIGN PATENT DOCUMENTS

GB 20747 A 9/1910
JP 2006320493 11/2006

OTHER PUBLICATIONS

Hopley, "Nike Vapor Flex 440 Driver Review," Golfalot.com, Dec. 10, 2015, available at https://www.golfalot.com/equipment-reviews/nike-vapor-flex-440-driver-review-3384.aspx (retrieved Nov. 5, 2021).

(Continued)

*Primary Examiner* — Sebastiano Passaniti
(74) *Attorney, Agent, or Firm* — Klarquist Sparkman, LLP

(57) ABSTRACT

A golf club head has a cast cup including a forward portion of a crown and a forward portion of a sole of the golf club head. A polymeric rear ring is coupled to heel and toe portions of the cast cup to form a club head body defining a crown opening and a sole opening. A crown insert is coupled to the crown opening, and a sole insert coupled to the sole opening. The club head has an inertia generator including an outwardly extending protrusion formed in the sole and a rear weight positioned at an aft end of the protrusion, the sole insert defining at least a portion of the protrusion of the inertia generator. The sole insert includes a composite material having a thickness between 0.45 mm and 1 mm, and a plurality of ribs positioned along an internal surface, and at least one rib is inside the inertia generator.

19 Claims, 49 Drawing Sheets

Related U.S. Application Data of application No. 17/389,167, filed on Jul. 29, 2021, now abandoned, and a continuation-in-part of application No. 17/124,134, filed on Dec. 16, 2020, now Pat. No. 12,121,780.

(52) U.S. Cl.
CPC ..... *A63B 53/0454* (2020.08); *A63B 53/0466* (2013.01); *A63B 2053/0491* (2013.01); *A63B 53/06* (2013.01); *A63B 2209/02* (2013.01)

(58) Field of Classification Search
CPC ..... A63B 53/06; A63B 2209/02; A63B 2053/0491
USPC ..... 473/324–350, 287–292
See application file for complete search history.

(56) References Cited

U.S. PATENT DOCUMENTS 5,080,366 A 1/1992 Okumoto et al.
5,447,309 A 9/1995 Vincent
5,547,427 A 8/1996 Rigal et al.
5,624,331 A 4/1997 Lo et al.
5,669,827 A 9/1997 Nagamoto
5,935,020 A 8/1999 Stites et al.
5,997,415 A 12/1999 Wood
6,123,627 A 9/2000 Antonious
6,146,571 A 11/2000 Vincent et al.
6,254,494 B1 7/2001 Hasebe et al.
6,277,032 B1 8/2001 Smith
6,325,728 B1 * 12/2001 Helmstetter ..... A63B 53/04 473/328
6,612,968 B1 9/2003 Alvaro
6,648,773 B1 11/2003 Evans
6,663,503 B1 12/2003 Kenmi
6,824,860 B2 11/2004 Edwards et al.
6,872,152 B2 3/2005 Beach et al.
6,929,565 B2 8/2005 Nakahara et al.
6,939,247 B1 9/2005 Schweigert et al.
6,945,876 B2 9/2005 Nakahara et al.
6,991,558 B2 1/2006 Beach et al.
6,991,560 B2 1/2006 Tseng
7,041,189 B2 5/2006 Caldwell et al.
7,063,629 B2 6/2006 Nakahara et al.
7,108,612 B2 9/2006 Nakahara et al.
7,147,577 B2 12/2006 Nakahara et al.
7,166,040 B2 1/2007 Chao et al.
7,166,041 B2 1/2007 Evans
7,169,064 B2 1/2007 Nakahara et al.
7,198,575 B2 4/2007 Beach et al.
7,214,142 B2 5/2007 Meyer et al.
7,217,199 B2 5/2007 Nakahara et al.
7,273,423 B2 9/2007 Imamoto
7,303,487 B2 12/2007 Kumamoto
7,306,527 B2 12/2007 Williams et al.
7,344,667 B2 3/2008 Honma et al.
7,371,191 B2 5/2008 Sugimoto
7,530,901 B2 5/2009 Imamoto et al.
7,559,853 B2 7/2009 Hirano
7,572,193 B2 8/2009 Yokota
7,611,424 B2 11/2009 Nagai et al.
7,651,414 B2 1/2010 Rae et al.
7,691,008 B2 4/2010 Oyama
7,713,142 B2 5/2010 Hoffman et al.
7,749,101 B2 7/2010 Imamoto et al.
7,758,453 B2 7/2010 Horacek et al.
7,775,905 B2 8/2010 Beach et al.
7,824,280 B2 11/2010 Yokota
7,887,431 B2 2/2011 Beach et al.
7,887,436 B2 2/2011 Hirano
7,954,526 B2 6/2011 Chen
7,993,216 B2 8/2011 Lee
8,012,038 B1 9/2011 Beach et al.
8,016,694 B2 9/2011 Llewellyn et al.
8,017,233 B2 9/2011 Miyazono et al.
8,029,385 B2 10/2011 Horacek et al.
8,192,303 B2 6/2012 Ban
8,226,500 B2 7/2012 Yamamoto et al.
8,226,501 B2 7/2012 Stites et al.
8,298,096 B2 10/2012 Stites et al.
8,353,783 B2 1/2013 Soracco
8,354,156 B2 1/2013 Taketa et al.
8,425,349 B2 4/2013 Dawson et al.
8,430,763 B2 4/2013 Beach et al.
8,435,137 B2 5/2013 Hirano
8,444,505 B2 5/2013 Beach et al.
8,535,763 B2 9/2013 Inoue et al.
8,550,934 B2 10/2013 Evans
8,579,722 B1 11/2013 Beach et al.
8,608,591 B2 12/2013 Chao et al.
8,651,975 B2 2/2014 Soracco
8,678,948 B2 3/2014 Wada et al.
8,696,491 B1 4/2014 Myers
8,708,838 B2 4/2014 Ferguson et al.
8,734,271 B2 5/2014 Beach et al.
8,747,251 B2 6/2014 Hayase et al.
8,758,153 B2 6/2014 Sargent et al.
8,758,874 B2 6/2014 Taketa et al.
8,764,579 B2 7/2014 Ban
8,771,097 B2 7/2014 Bennett et al.
8,821,312 B2 9/2014 Burnett et al.
8,834,294 B1 9/2014 Seluga et al.
8,858,363 B2 10/2014 Wada et al.
8,864,604 B2 10/2014 Matsunaga
8,870,678 B2 10/2014 Beach et al.
8,870,679 B2 10/2014 Oldknow
8,882,609 B2 11/2014 Boyd et al.
8,900,069 B2 12/2014 Beach et al.
8,926,450 B2 1/2015 Takahashi et al.
8,979,671 B1 3/2015 DeMille et al.
9,003,619 B2 4/2015 Kawabe
9,089,747 B2 7/2015 Boyd et al.
9,101,811 B1 8/2015 Goudarzi et al.
9,162,120 B2 10/2015 Jertson et al.
9,168,430 B2 10/2015 Mizutani
9,168,435 B1 10/2015 Boggs et al.
9,174,096 B2 11/2015 Sargent et al.
9,180,349 B1 11/2015 Seluga et al.
9,199,145 B1 12/2015 Myers
9,211,449 B2 12/2015 Demille et al.
9,211,452 B2 12/2015 Bennett et al.
9,211,453 B1 12/2015 Foster et al.
9,216,332 B1 12/2015 Ehlers et al.
9,238,162 B2 1/2016 Breier et al.
9,238,336 B2 1/2016 Ishibashi et al.
9,259,625 B2 2/2016 Sargent et al.
9,265,994 B2 2/2016 Mizutani
9,272,194 B2 3/2016 Oldknow
9,278,262 B2 3/2016 Sargent et al.
9,283,449 B1 3/2016 Demille et al.
9,289,660 B1 3/2016 Myers
9,314,676 B2 4/2016 Cole et al.
9,381,406 B2 7/2016 Boggs
9,393,471 B2 7/2016 Beno et al.
9,421,438 B2 8/2016 Beno et al.
9,481,601 B2 11/2016 Kobayashi et al.
9,481,789 B2 11/2016 Ichino et al.
9,522,488 B2 12/2016 Lee et al.
9,561,413 B2 2/2017 Nielson et al.
9,636,556 B2 5/2017 Beck et al.
9,700,768 B2 7/2017 Cole et al.
9,744,412 B2 8/2017 Boggs et al.
9,746,354 B2 8/2017 Martin et al.
9,757,630 B2 9/2017 Mata et al.
9,764,210 B2 9/2017 Curtis et al.
9,770,634 B2 9/2017 Oldknow
9,873,029 B1 * 1/2018 Sillies ..... A63B 60/02
9,914,027 B1 3/2018 Harbert et al.
9,972,847 B2 5/2018 Utsunomiya et al.
10,004,954 B2 * 6/2018 Chen ..... A63B 53/0466
10,005,905 B2 6/2018 Imai et al.
10,023,737 B2 7/2018 Imai et al.
10,076,688 B1 9/2018 Harbert et al.

(56) References Cited

U.S. PATENT DOCUMENTS 10,118,075 B2 11/2018 Cole et al.
10,132,937 B2 11/2018 Tanino et al.
10,183,202 B1 1/2019 Harbert et al.
10,184,034 B2 1/2019 Nakayama et al.
10,207,160 B2 2/2019 Johnson et al.
10,256,477 B2 4/2019 Utsunomiya et al.
10,300,354 B2 5/2019 Morales et al.
10,411,269 B2 9/2019 Tanimura et al.
10,420,989 B2 9/2019 Parsons et al.
10,427,012 B2 10/2019 Cole et al.
10,449,424 B2 10/2019 Cole et al.
10,463,929 B2 11/2019 Willett et al.
10,472,498 B2 11/2019 Imai et al.
10,556,158 B1 2/2020 Harbert et al.
10,593,956 B2 3/2020 Sode et al.
10,613,439 B2 4/2020 Hashimoto et al.
10,637,069 B2 4/2020 Sode et al.
10,651,477 B2 5/2020 Inoue et al.
10,675,787 B2 6/2020 Hattori et al.
10,680,250 B2 6/2020 Hashimoto et al.
10,688,352 B2 6/2020 Harbert et al.
10,688,734 B2 6/2020 Miyoshi et al.
10,716,974 B2 7/2020 Mizutani
10,741,298 B2 8/2020 Fujioka et al.
10,808,091 B2 10/2020 Taketa et al.
10,828,540 B2 11/2020 Beach et al.
10,850,173 B2 12/2020 Cole et al.
10,854,887 B2 12/2020 Tanimura et al.
10,874,917 B2 12/2020 Cole et al.
10,918,334 B2 2/2021 Tsukada et al.
10,940,374 B2 3/2021 Milleman et al.
10,981,086 B2 4/2021 Suzuki
10,994,510 B2 5/2021 Takebe et al.
11,007,675 B2 5/2021 Miyoshi et al.
11,077,340 B2 8/2021 Martens et al.
11,167,183 B2 11/2021 Harbert et al.
11,179,608 B2 * 11/2021 Greaney ..... A63B 60/00
11,219,803 B2 * 1/2022 Greaney ..... A63B 53/0433
11,305,163 B2 * 4/2022 Johnson ..... A63B 53/04
11,331,547 B2 5/2022 Hoffman et al.
11,517,799 B2 * 12/2022 Jertson ..... A63B 53/0437
11,707,651 B2 * 7/2023 Parsons ..... A63B 53/04 29/592
12,179,076 B2 * 12/2024 Ogg ..... A63B 60/006
2002/0160854 A1 10/2002 Beach et al.
2003/0175520 A1 9/2003 Grutta et al.
2003/0236132 A1 12/2003 Burrows
2004/0116207 A1 6/2004 De Shiell et al.
2004/0121853 A1 6/2004 Caldwell et al.
2005/0049073 A1 * 3/2005 Herber ..... A63B 53/0466 473/328
2005/0096154 A1 5/2005 Chen
2005/0159243 A1 7/2005 Chuang
2005/0221913 A1 10/2005 Kusumoto
2005/0250596 A1 11/2005 Chuang
2006/0052177 A1 3/2006 Nakahara et al.
2006/0122004 A1 6/2006 Chen et al.
2006/0135281 A1 6/2006 Palumbo et al.
2006/0229141 A1 10/2006 Galloway
2007/0049416 A1 3/2007 Shear
2008/0051218 A1 2/2008 Rae et al.
2008/0113827 A1 5/2008 Werner et al.
2008/0139334 A1 6/2008 Willett et al.
2008/0139339 A1 6/2008 Cheng
2008/0153624 A1 6/2008 Ban et al.
2008/0188322 A1 * 8/2008 Anderson ..... A63B 60/00 29/527.4
2008/0261715 A1 10/2008 Carter
2009/0291278 A1 11/2009 Kawabe et al.
2010/0016097 A1 * 1/2010 Albertsen ..... A63B 53/0466 473/345
2010/0075773 A1 3/2010 Casati, Jr.
2010/0125000 A1 5/2010 Lee
2010/0137074 A1 6/2010 Gilbert et al.
2010/0144461 A1 6/2010 Ban
2010/0234125 A1 * 9/2010 Aoyama ..... A63B 37/0076 473/409
2010/0292027 A1 11/2010 Beach et al.
2011/0159986 A1 6/2011 Chao et al.
2011/0263350 A1 * 10/2011 Lee ..... A63B 53/0466 473/349
2011/0312437 A1 12/2011 Sargent et al.
2012/0094781 A1 4/2012 Breier et al.
2012/0108358 A1 5/2012 Sugimoto
2012/0122601 A1 5/2012 Beach et al.
2012/0172147 A1 7/2012 McDonnell et al.
2012/0220387 A1 8/2012 Beach et al.
2012/0295504 A1 11/2012 Miyauchi et al.
2012/0302369 A1 11/2012 Ban
2012/0316007 A1 * 12/2012 Burnett ..... A63B 53/0466 473/327
2013/0130831 A1 5/2013 Morales et al.
2013/0178306 A1 7/2013 Beno et al.
2013/0184098 A1 7/2013 Boyd et al.
2013/0288822 A1 10/2013 Boyd et al.
2013/0344976 A1 12/2013 Stites
2014/0057737 A1 2/2014 Solheim et al.
2014/0066224 A1 * 3/2014 Albertsen ..... A63B 53/0466 473/327
2014/0080617 A1 3/2014 Llewellyn et al.
2014/0080628 A1 3/2014 Sargent et al.
2014/0080629 A1 3/2014 Sargent et al.
2014/0113742 A1 4/2014 Zimmerman et al.
2014/0162809 A1 6/2014 Soracco
2015/0031468 A1 1/2015 Matsunaga et al.
2015/0038258 A1 2/2015 Beach et al.
2015/0057101 A1 2/2015 Sander
2015/0094166 A1 * 4/2015 Taylor ..... A63B 53/045 473/335
2015/0119165 A1 4/2015 Sander
2015/0297961 A1 10/2015 Voshall et al.
2015/0306473 A1 10/2015 Breier et al.
2015/0321055 A1 11/2015 Golden et al.
2015/0367189 A1 * 12/2015 Boggs ..... A63B 53/04 473/336
2016/0001146 A1 1/2016 Sargent et al.
2016/0008687 A1 1/2016 Sargent et al.
2016/0067569 A1 3/2016 Bennett et al.
2016/0136490 A1 5/2016 Sargent et al.
2016/0287954 A1 10/2016 Sargent et al.
2016/0303443 A1 10/2016 Boggs et al.
2016/0310809 A1 10/2016 Boggs
2016/0346643 A1 12/2016 Akiyama
2017/0087429 A1 3/2017 Nielson et al.
2017/0232312 A1 * 8/2017 Schweigert ..... A63B 53/04 473/345
2017/0326418 A1 11/2017 Parsons et al.
2018/0071590 A1 3/2018 Oldknow
2019/0046845 A1 * 2/2019 Greensmith ..... A63B 53/06
2019/0232120 A1 8/2019 Johnson et al.
2019/0336834 A1 * 11/2019 Greaney ..... A63B 53/0412
2019/0344134 A1 11/2019 Stites et al.
2020/0001146 A1 1/2020 Morales et al.
2020/0139208 A1 5/2020 Johnson et al.
2020/0324177 A1 10/2020 Harbert et al.
2022/0088446 A1 3/2022 Harbert et al.

OTHER PUBLICATIONS

Nike News, "Vapor Fly Clubs", Nike.com, Dec. 10, 2015, available at https://news.nike.com/news/vapor-fly-clubs (retrieved Nov. 5, 2021).
Bond Laminates, "Advanced thermoplastic composites—Tepex", Oct. 2013, pp. 1-7.
Covey, "Exposed: Peek Inside 9 of the Hottest Drivers in Golf," Truth Digest: MyGolfSpy, Aug. 2, 2016, https://mygolfspy.com/a-look-inside-9-drivers/ (9 pages).

* cited by examiner

MULTI-PIECE GOLF CLUB HEAD

CROSS REFERENCE TO RELATED APPLICATIONS

The present application is a continuation-in-part of U.S. patent application Ser. No. 17/505,511, filed Oct. 19, 2021, which is a continuation-in-part of U.S. patent application Ser. No. 17/389,167, filed Jul. 29, 2021. U.S. patent application Ser. No. 17/505,511 is also a continuation-in-part of U.S. patent application Ser. No. 17/124,134, filed Dec. 16, 2020. The entire contents of each of U.S. patent application Ser. No. 17/505,511, U.S. patent application Ser. No. 17/389,167, and U.S. patent application Ser. No. 17/124,134 are incorporated herein by reference in their entirety.

In addition to the incorporations discussed further herein, other patents and patent applications concerning golf clubs, such as U.S. Publication No. 2021/0113896 are incorporated herein by reference in their entirety.

FIELD

This disclosure relates generally to golf clubs, and more particularly to a golf club head constructed of multiple parts adhesively bonded together.

BACKGROUND

In the early history of golf, golf club heads were made primarily of a single material, such as wood. Subsequently, golf club heads progressed away from a construction made primarily from wood to one made primarily of metal. Initial golf club heads made of metal were made of steel alloys. Over time, golf club heads started to be made of titanium alloys. Some, but not all, golf club head manufacturers have transitioned away from use of a single material to a multi-material and multi-piece construction. The multiple pieces of a multi-piece golf club head can be bonded together in a variety of ways, such as adhesive bonding and welding.

Often, the strength of the bond between bonded pieces of a multi-piece golf club head affects the durability of the golf club head and thus the performance of the golf club head over time. A weak bond tends to accelerate degradation of the bond as the golf club head is used to impact golf balls. Degradation in a bond between bonded pieces can lead to a diminution of the performance of the golf club head, such as via a reduction in stiffness and lack of proper load transfer, at best, and complete failure of the golf club head, at worst. Typically, the strike face of a driver-type golf club head undergoes several thousand collisions with a golf ball through its life-cycle. Each collision imparts a force onto the strike face in the range of 10,000 to 20,000 g, where g is equal to the force per unit mass due to gravity. Repeated impacts, at such high forces, tends to cause degradation of the bonds forming the golf club head. Accordingly, a strong initial and durable bond between bonded pieces of a golf club head is desired.

Because welding generally provides a stronger initial bond and can exhibit a higher durability compared to other bonding techniques, the pieces of many conventional multi-piece golf club heads utilize materials, such as compatible metals, that are conducive to welding. However, many metals used to construct multi-piece golf club heads have a higher mass than non-metallic materials. Therefore, the mass available for distribution around such golf club heads (otherwise known as discretionary mass), which can be utilized for promoting the performance of golf club heads, can be limited. For this reason, providing a multi-piece golf club head that has strong and durable bonds between the pieces of the golf club head and that promotes an increase in discretionary mass can be difficult.

Regarding the total mass of the golf club head as the club-head's mass budget, at least some of the mass budget must be dedicated to providing adequate strength and structural support for the club head. This is termed "structural" mass. Any mass remaining in the budget is called "discretionary" or "performance" mass, which can be distributed within the club head to address performance issues, for example. Thus, the ability to reduce the structural mass of the club head without compromising strength and structural support provides the potential for increasing discretionary mass and hence improved club performance.

One opportunity to reduce the total mass of the club head is to lower the mass of the face plate by reducing its thickness; however, opportunities to do this are somewhat limited given that the face absorbs the initial impact of the ball and thus has quite rigorous requirements on its physical and mechanical properties. Another opportunity to reduce mass comes from providing the club head body with relatively large crown and sole openings that can be covered by relatively large, lightweight inserts. However, such inserts tend to display relatively large amplitude, low frequency mode vibrations when striking a golf ball. These vibration modes can weaken the attachment between the inserts and the club head body, resulting in premature failure of the golf club head. Accordingly, there exists a need for golf club heads with improved vibration characteristics.

SUMMARY

The subject matter of the present application has been developed in response to the present state of the art, and in particular, in response to the shortcomings of golf club heads with relatively large, fiber-reinforced composite sole inserts coupled to fiber-reinforced polymer rear rings, that have not yet been fully solved. Accordingly, the subject matter of the present application has been developed to provide a golf club head that overcomes at least some of the above-discussed shortcomings of conventional golf club heads.

In a representative embodiment, a golf club head comprises a cast cup comprising a forward portion of the golf club head, including a hosel, a forward portion of a crown of the golf club head, and a forward portion of a sole of the golf club head, wherein the cast cup comprises a metal alloy. A face plate is received in a forward opening of the cast cup. A rear ring formed separately from the cast cup is coupled to heel and toe portions of the cast cup to form a club head body, the club head body defining a hollow interior region, a crown opening, and a sole opening, the rear ring comprising a polymeric material. A crown insert coupled to the crown opening, and a sole insert coupled to the sole opening. An inertia generator comprising an outwardly extending protrusion is formed in the sole of the golf club head and a rear weight is positioned at an aft end of the protrusion, the sole insert defining at least a portion of the protrusion of the inertia generator, wherein the sole insert comprises a fiber-reinforced composite material having a thickness between 0.45 mm and 1 mm, and a plurality of ribs positioned along an internal surface of the sole insert and at least one of the plurality of ribs is positioned inside the protrusion of the inertia generator and extends into the hollow interior region of the golf club head.

In any or all of the disclosed embodiments, at least a portion of a first rib of the plurality of ribs is positioned rearward of a center of gravity of the golf club head and at least a portion of a second rib of the plurality of ribs is positioned forward of a center of gravity of the golf club head.

In any or all of the disclosed embodiments, at least the first rib of the plurality of ribs extends across the protrusion of the inertia generator and at least the second rib of the plurality of ribs extends from a toe portion to a heel portion of the golf club head.

In any or all of the disclosed embodiments, the first rib does not intersect the second rib.

In any or all of the disclosed embodiments, the plurality of ribs further comprises a third rib and the third rib connects to the first rib and the second rib.

In any or all of the disclosed embodiments, each of the first rib, the second rib, and the third rib have a height between 2 mm and 8 mm, and an aspect ratio of rib height to a minimum rib thickness is at least 2:1.

In any or all of the disclosed embodiments, the inertia generator has a lower rear edge where a lower surface of the inertia generator meets a rear-facing surface of the inertia generator, the rear ring defines a crown-to-skirt transition region, and a center vertical plane is defined in a fore-and-aft direction passing through a center of the rear-facing surface of the inertia generator. The center vertical plane passes through a crown apex point on the crown of the golf club head that is the apex of the crown along the center vertical plane. The center vertical plane passes through an inertia generator point on the lower rear edge of the inertia generator. The center vertical plane passes through a crown-to-skirt transition point on the crown-to-skirt transition region that is the farthest point on the crown-to-skirt transition region from the face plate in the center vertical plane along a y-axis extending in the fore-and-aft direction. A vertical distance D is defined between the crown apex point and the inertia generator point along a z-axis extending between the crown and the sole perpendicular to a ground plane. A vertical distance E is defined between the inertia generator point and the crown-to-skirt transition point along the z-axis. A vertical distance F is defined between the crown-to-skirt transition point and the crown apex point along the z-axis, and a ratio E/F is 80% to 100%.

In any or all of the disclosed embodiments, a ratio E/D is 40% to 60%.

In any or all of the disclosed embodiments, when the golf club head is at address, the crown-to-skirt transition point is above a center face location along the z-axis.

In any or all of the disclosed embodiments, a point on the crown-to-skirt transition region that is 10 mm heelward of the crown-to-skirt transition point as measured along an x-axis extending in a heel-to-toe direction is above the center face location along the z-axis, and a point on the crown-to-skirt transition region that is 10 mm toe-ward of the crown-to-skirt transition point as measured along the x-axis is above the center face location along the z-axis.

In any or all of the disclosed embodiments, the rear-facing surface of the inertia generator is at least partially defined by the rear weight.

In another representative embodiment, a golf club head comprises a cast cup comprising a forward portion of the golf club head, including a hosel, a forward portion of a crown of the golf club head, and a forward portion of a sole of the golf club head, wherein the cast cup comprises a metal alloy. A face plate is received in a forward opening of the cast cup. A rear ring formed separately from the cast cup is coupled to heel and toe portions of the cast cup to form a club head body, the club head body defining a hollow interior region, a crown opening, and a sole opening, the rear ring comprising a polymeric material and defining a crown-to-skirt transition region. A crown insert is coupled to the crown opening, and a sole insert coupled to the sole opening. An inertia generator comprising an outwardly extending protrusion is formed in the sole of the golf club head and a rear weight positioned at an aft end of the protrusion, the sole insert defining at least a portion of the protrusion of the inertia generator. An x-axis extends in a heel-to-toe direction from a heel of the golf club head to a toe of the golf club head, a y-axis extends in a fore-and-aft direction from the face plate to a rear of the golf club head, and a z-axis extends between the crown and the sole perpendicular to the x-axis and the y-axis. A center vertical plane is defined in the fore-and-aft direction passing through a center of a rear-facing surface of the inertia generator. The center vertical plane passes through a crown-to-skirt transition point on the crown-to-skirt transition region that is the farthest point on the crown-to-skirt transition region from the face plate in the center vertical plane along the y-axis. The crown-to-skirt transition point is above a center face location along the z-axis. A point on the crown-to-skirt transition region that is 10 mm heelward of the crown-to-skirt transition point as measured along the x-axis is above the center face location along the z-axis, and a point on the crown-to-skirt transition region that is 10 mm toe-ward of the crown-to-skirt transition point as measured along the x-axis is above the center face location along the z-axis.

In any or all of the disclosed embodiments, the inertia generator has a lower rear edge where a lower surface of the inertia generator meets the rear-facing surface of the inertia generator, the center vertical plane passes through a crown apex point on the crown of the golf club head that is the apex of the crown along the center vertical plane and the center vertical plane passes through an inertia generator point on the lower rear edge of the inertia generator. A vertical distance D is defined between the crown apex point and the inertia generator point along the z-axis. A vertical distance E is defined between the inertia generator point and the crown-to-skirt transition point along the z-axis, and a vertical distance F is defined between the crown-to-skirt transition point and the crown apex point along the z-axis. A ratio $$\frac{E}{F}$$

is 80% to 100%.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The following describes examples of golf club heads in the context of a driver-type golf club head having a multi-piece construction, but the principles, methods and designs described may be applicable, in whole or in part, to fairway wood golf club heads, utility golf club heads (also known as hybrid golf club heads), iron-type golf club heads, and the like, because such golf club heads can also be made to have a multi-piece construction.

In some examples disclosed herein, the golf club head has a strike face formed of a non-metallic material, such as a fiber-reinforced polymeric material. A breakdown of the adhesive joint formed between a body of the golf club head and a non-metallic strike plate can cause characteristic time (CT) creep. USGA regulations require the CT of a golf club head to remain within the regulated limit regardless of the number of impacts the golf club head has with a golf ball. The CT of conventional driver-type golf club heads tends to increase after multiple impacts with a golf ball. The increase of CT due to impacts with a golf ball is known as CT creep. In certain examples disclosed herein, the golf club heads are configured to strengthen the adhesive joint formed between the body of the golf club heads and the non-metallic strike plate, such as by optimizing the surface structure of the golf club head for stronger adhesive bonds.

U.S. Patent Application Publication No. 2014/0302946 A1 ('946 application), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 7:
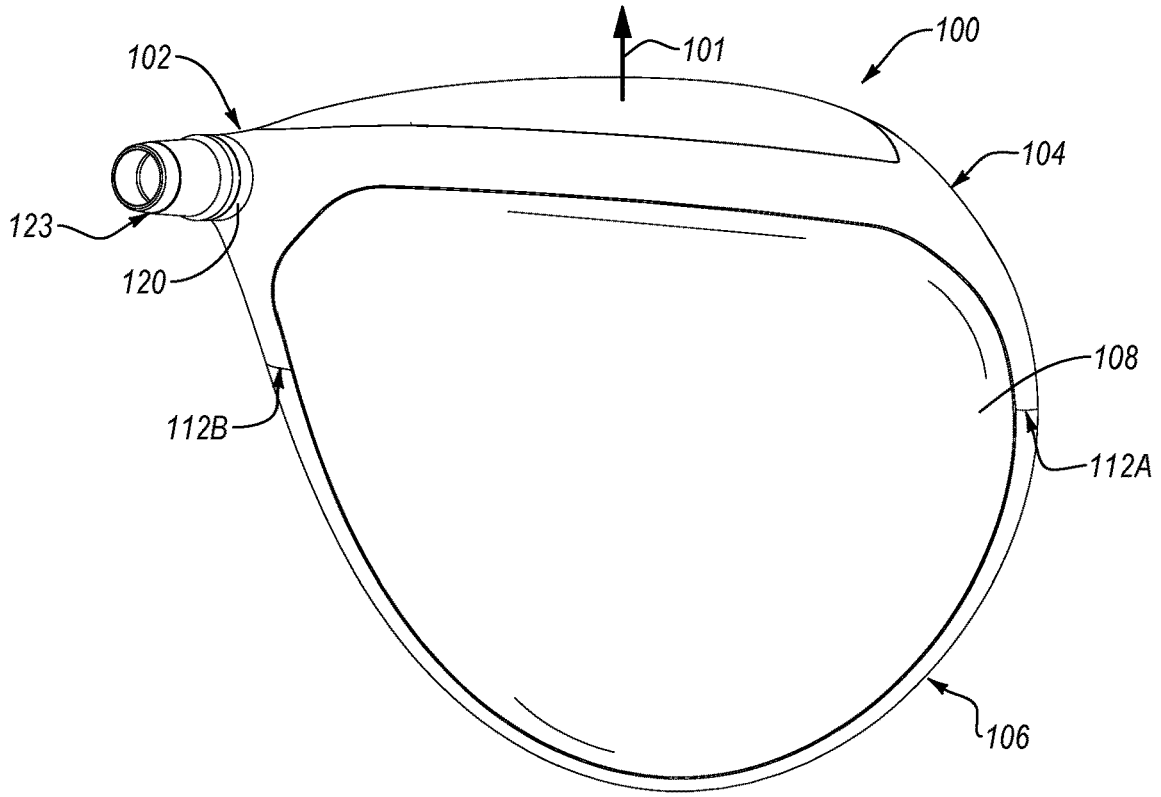
Figure 8:
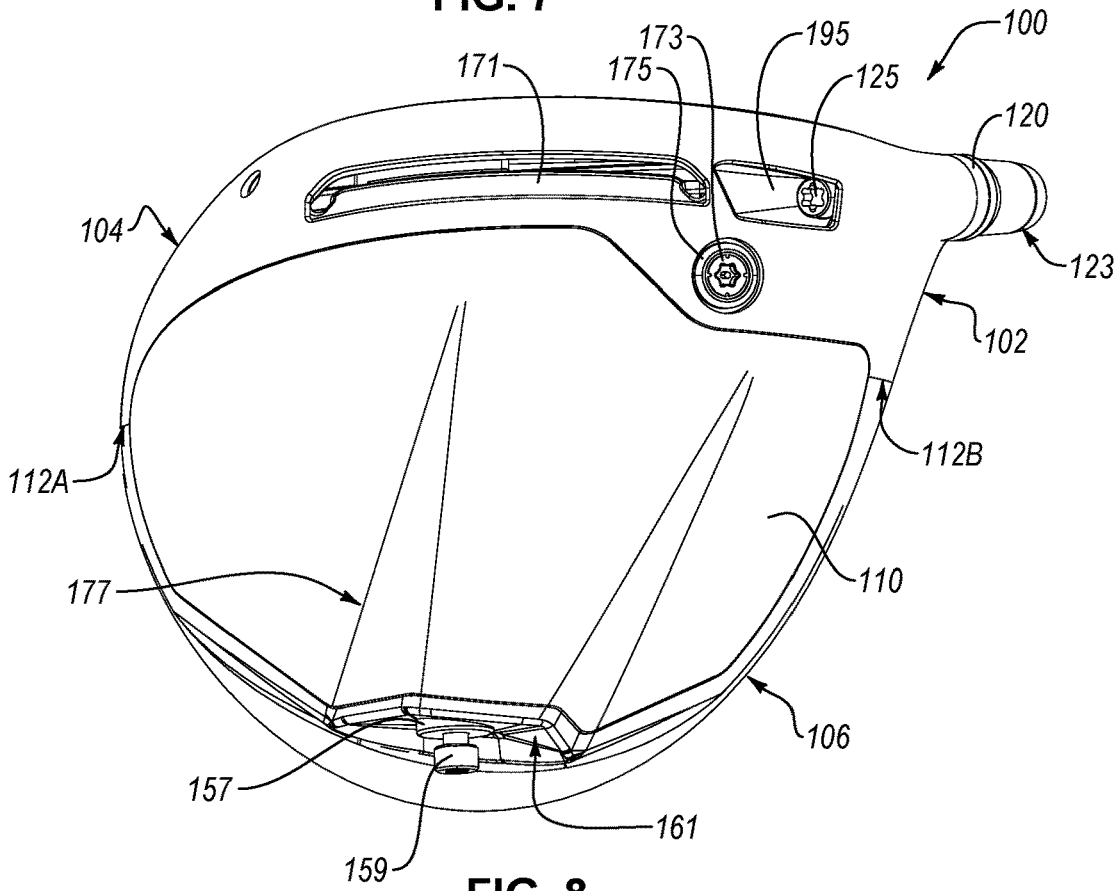

FIGS. 3, 4, 5, and 9A are examples that show a golf club head 100 in the address or reference position. The golf club head 100 is in the address or reference position when a hosel axis 191 of the golf club head 100 is at a lie angle θ of 60-degrees relative to a ground plane 181 (see, e.g., FIG. 5) and a strike face 145 of the golf club head 100 is square relative to an imaginary target line 101 (see, e.g., FIG. 7). As shown in FIGS. 3, 4, 5, and 9A, positioning the golf club head 100 in the address or reference position lends itself to using a club head origin coordinate system 185, centered at a geometric center (e.g., center face 183) of the strike face 145, for making various measurements. With the golf club head in the address or reference position, using the USGA methodology, various parameters described throughout this application including head height, club head center of gravity (CG) location, and moments of inertia (MOI), can be measured relative to the club head origin coordinate system 185 or relative to another reference or references.

For further details or clarity, the reader is advised to refer to the measurement methods described in the '946 application and the USGA procedure. Notably, however, the origin and axes associated with the club head origin coordinate system 185 used in this application may not necessarily be aligned or oriented in the same manner as those described in the '946 application or the USGA procedure. Further details are provided below on locating the club head origin coordinate system 185.

In some examples, the golf club heads described herein include driver-type golf club heads, which can be identified, at least partially, as golf club heads with strike faces that have a total surface area of at least 3,500 mm^2, preferably at least 3,800 mm^2, and even more preferably at least 3,900 mm^2 (e.g., between 3,500 $mm^2$ and 5,000 $mm^2$ in one example, less than 5,000 $mm^2$ in various examples, and between 3,700 $mm^2$ and 4,300 $mm^2$ in another example). In some examples, such as when the strike face is defined by a non-metal material, the total surface area of the strike face is no more than 4,300 $mm^2$ and no less than 3,300 $mm^2$. The total surface area of the strike face is the outermost area of the striking face, which can be the outermost area of a face insert in some examples. In certain examples, the total surface area of the strike face is the surface area of the surface of the striking face that is bounded on its periphery by all points where the face transitions from a substantially uniform bulge radius (i.e., face heel-to-toe radius of curvature) and a substantially uniform roll radius (i.e., face crown-to-sole radius of curvature) to the body of the golf club head. In certain examples, the strike face of the golf club head disclosed herein is defined in the same manner as in one or more of U.S. Patent Application Publication No. 2020/0139208, filed Oct. 22, 2019, U.S. Pat. No. 8,801,541, issued Aug. 12, 2014, and U.S. Pat. No. 8,012,039, issued Sep. 6, 2011, all of which are incorporated herein by reference in their entirety. In yet some examples, the strike face has a uniform bulge radius and a uniform roll radius, except for portions that have a higher lofted toe and a lower lofted heel, such as described in U.S. patent application Ser. No. 17/006,561, filed Aug. 28, 2020, U.S. Pat. No. 9,814,944, issued Nov. 14, 2017, U.S. Pat. No. 10,265,586, issued Apr. 23, 2019, and U.S. Patent Application Publication No. 2019/0076705, filed Oct. 15, 2018, which are incorporated herein by reference in their entirety.

Additionally, in certain examples, driver-type golf club heads include a center-of-gravity (CG) projection, parallel to a horizontal (y-axis), which is, in one example, at most 3 mm above or below a center face of the strike face, and preferably at most 1 mm above or below the center face, as measured along a vertical axis (z-axis), or in another example, at most 5 mm below a center face of the strike face, and preferably at most 4 mm below the center face, as measured along a vertical axis (z-axis). In some examples, the CG projection is toe-ward of the geometric center of the strike face. Moreover, in some examples, driver-type golf club heads have a relatively high moment of inertia about a vertical axis (e.g., a CG z-axis passing through the CG and parallel with the z-axis of the club head origin coordinate system 185) (e.g. Izz>400 kg-mm^2 and preferably Izz>450 kg-mm^2, and more preferably Izz>500 kg-mm^2, but less than 590 kg-mm^2 in certain implementations), a relatively high moment of inertia about a horizontal axis (e.g., a CG x-axis passing through the CG and parallel with the x-axis of the club head origin coordinate system 185) (e.g. Ixx>250 kg-mm^2 and preferably Ixx>300 kg-mm^2 or 320 kg-mm^2, and more preferably Ixx>350 kg-mm^2, more preferably Ixx>375 kg-mm^2, more preferably Ixx>385 kg-mm^2, more preferably Ixx>400 kg-mm^2, more preferably Ixx>415 kg-mm^2, more preferably Ixx>430 kg-mm^2, more preferably Ixx>450 kg-mm^2, but no more than 590 kg·mm$^2$ in some examples), and preferably a ratio of Ixx/Izz>0.70. More details about inertia Izz and Ixx can be found in U.S. Patent Application Publication No. 2020/0139208, Published May 7, 2020, which is incorporate herein by reference in its entirety.

According to certain examples, a summation of Ixx and Izz is greater than 780 kg-mm^2, 800 kg-mm^2, 820 kg-mm^2, 825 kg-mm^2, 850 kg-mm^2, 860 kg-mm^2, 875 kg-mm^2, 900 kg-mm^2, 925 kg-mm^2, 950 kg-mm^2, 975 kg-mm^2, or 1000 kg-mm^2, but less than 1,100 kg-mm^2. For example, the summation of Ixx and Izz can be between 740 kg-mm^2 and 1,100 kg-mm^2, such as around 869 kg-mm^2. Ixx is at least 65% of Izz in some examples, even more preferably Ixx is at least 68% of Izz in some examples. In some example, a golf club head mass may range from 190 grams to 210 grams, preferably between 195 grams and 205 grams, even more preferably no more than 203 grams. The golf club head mass includes the mass of any FCT system and fastener to tighten the FCT system, but not the shaft of the golf club head or the grip of the golf club head. A maximum distance from a leading edge to a trailing edge of the club head as measured parallel to the y-axis is preferably is between 112 mm and 127 mm, preferably between 115 mm and 127 mm, even more preferably between 119 mm and 127 mm.

The larger inertia values and lower CG projection e.g. no more than 3 mm above center face can be achieved by including a forward weight and a rearward weight as discussed in more detail below. The forward weight can be a single forward weight or two or more forward weights. The forward weight can be located proximate to an imaginary vertical plane passing through the y-axis, or the forward weight can be offset to either a toe or a heel side of the imaginary vertical plane passing through the y-axis or both a toe and a heel side of the imaginary vertical plane passing through the y-axis of the golf club head. The forward weight can be separately formed and threadedly attached, welded, or bonded to the golf club head, or the forward weight can be a thickened region of the golf club head or in some cases the forwarded weight could be molded or over-molded into a forward portion of a golf club head. See below and U.S. Pat. No. 10,220,270, issued Mar. 5, 2019, which is incorporated herein by reference in its entirety, for further discussion on the various locations of forward and rearward weights. A forward weight is forward of a center of gravity of the golf club head and a rearward weight is rearward of a center of gravity of the golf club head.

In some examples, the golf club heads described herein have a delta-1 value that is no more than 25 mm, preferably between 20 mm and 25 mm. The delta-1 of the driver-type golf club head is a distance, along the y-axis of the head center face origin coordinate system 185, between the CG of the golf club head and an XZ plane, passing through the x-axis and the z-axis of the head center face origin coordinate system 185 and passing through the hosel axis 191. In certain examples, the Ixx of the golf club head is at least 335 kg·mm$^2$ and the delta 1 is no more than 25 mm, the Ixx of the golf club head is at least 345 kg·mm$^2$ and the delta 1 is no more than 25 mm, the Ixx of the golf club head is at least 355 kg·mm$^2$ and the delta 1 is no more than 25 mm, the Ixx of the golf club head is at least 365 kg·mm$^2$ and the delta 1 is no more than 25 mm, or the Ixx of the golf club head is at least 375 kg·mm$^2$ and the delta 1 is no more than 25 mm.

In some examples, the golf club heads described herein have a delta-1 value that is between 20 mm and 35 mm. In certain examples, the Ixx of the golf club head is at least 335 kg·mm$^2$ and the delta 1 is between 22 mm and 32 mm, the Ixx of the golf club head is at least 345 kg·mm$^2$ and the delta 1 is between 22 mm and 32 mm, the Ixx of the golf club head is at least 355 kg·mm$^2$ and the delta 1 is between 22 mm and 32 mm, the Ixx of the golf club head is at least 365 kg·mm$^2$ and the delta 1 is between 22 mm and 32 mm, the Ixx of the golf club head is at least 375 kg·mm$^2$ and the delta 1 is between 23 mm and 32 mm, the Ixx of the golf club head is at least 385 kg·mm2 and the delta 1 is between 24 mm and 32 mm, the Ixx of the golf club head is at least 395 kg·mm2 and the delta 1 is between 25 mm and 32 mm, or the Ixx of the golf club head is at least 405 kg·mm2 and the delta 1 is between 27 mm and 32 mm.

Figure 1:
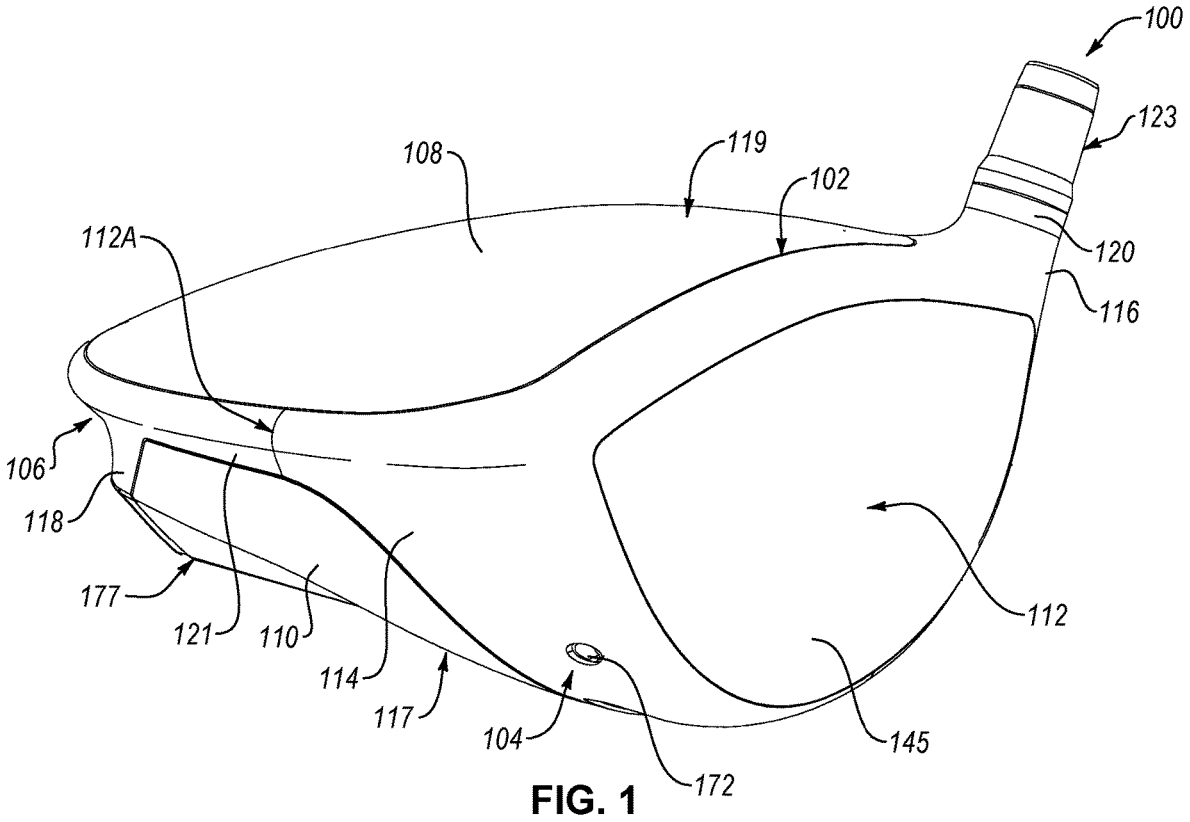
FIGS. 1-8 are schematic views of a golf club head, according to one or more examples of the present disclosure.
Figure 2:
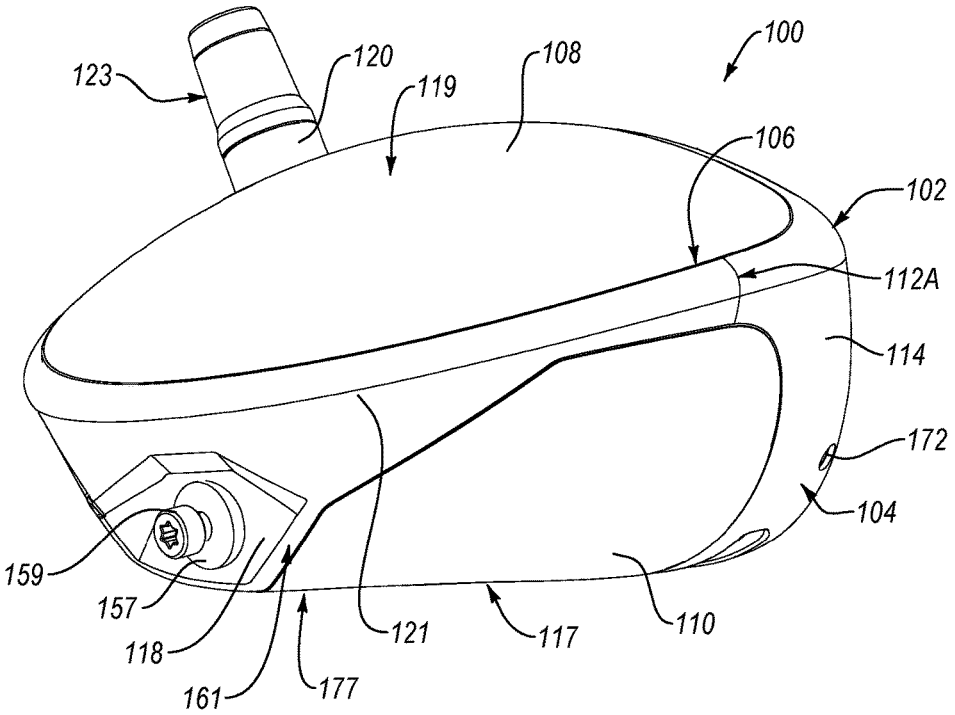
Figure 9A:
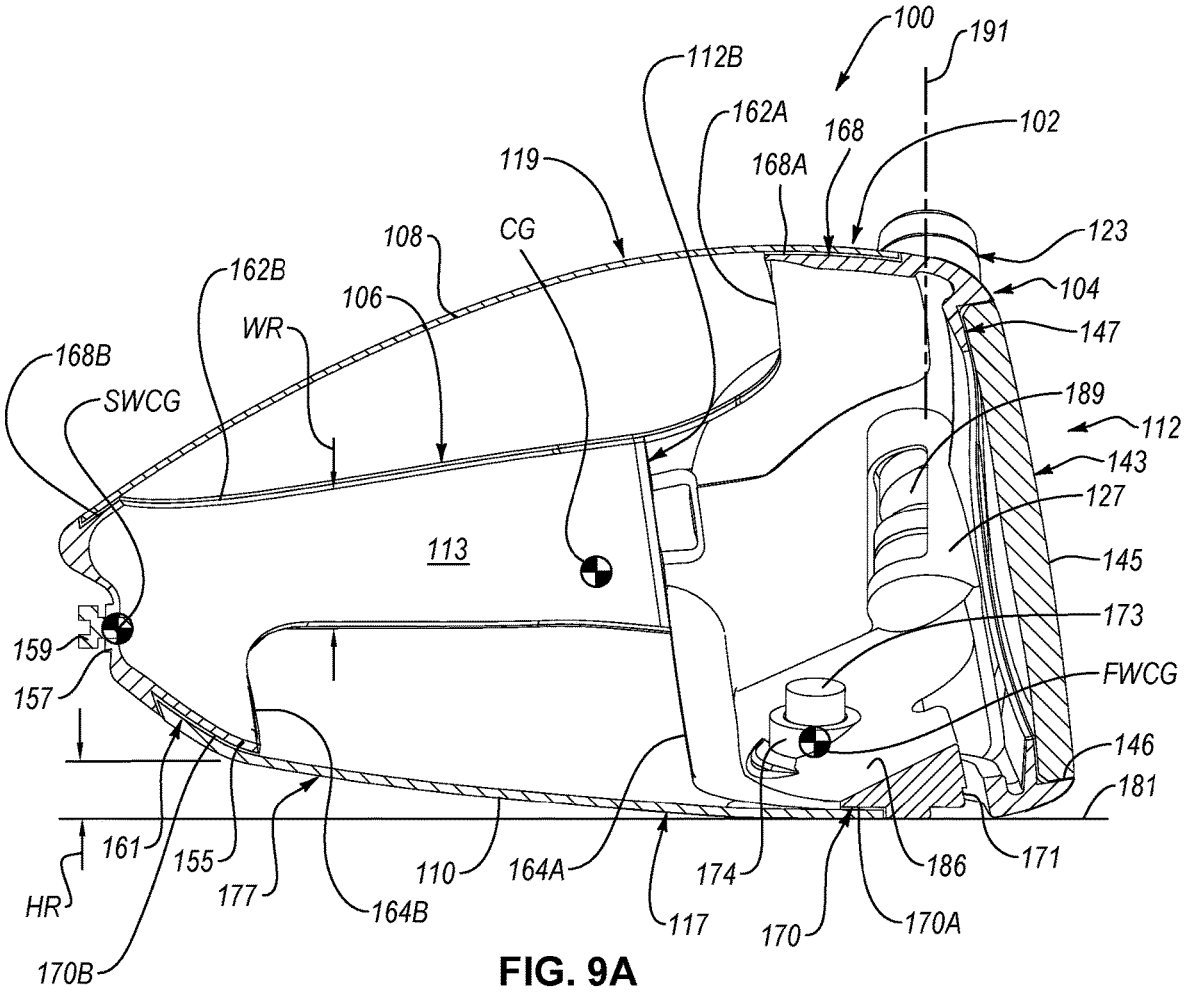
FIG. 9A is a schematic, cross-sectional, side elevation view of the golf club head of FIG. 1, taken along the line 9-9 of FIG. 5, according to one or more examples of the present disclosure.

Referring to FIGS. 1 and 2, according to some examples, the golf club head 100 of the present disclosure includes a toe portion 114 and a heel portion 116, opposite the toe portion 114. Additionally, the golf club head 100 includes a forward portion 112 (e.g., face portion) and a rearward portion 118, opposite the forward portion 112. The golf club head 100 additionally includes a sole portion 117, at a bottom region of the golf club head 100, and a crown portion 119, opposite the sole portion 117 and at a top region of the golf club head 100. Also, the golf club head 100 includes a skirt portion 121 that defines a transition region where the golf club head 100 transitions between the crown portion 119 and the sole portion 117. Accordingly, the skirt portion 121 is located between the crown portion 119 and the sole portion 117 and extends about a periphery of the golf club head 100. Referring to FIG. 9A, the golf club head 100 further includes an interior cavity 113 that is collectively defined and enclosed by the forward portion 112, the rearward portion 118, the crown portion 119, the sole portion 117, the heel portion 116, the toe portion 114, and the skirt portion 121.

The strike face 145 extends along the forward portion 112 from the sole portion 117 to the crown portion 119, and from the toe portion 114 to the heel portion 116. Moreover, the strike face 145, and at least a portion of an interior surface 166 of the forward portion 112, opposite the strike face 145, is planar in a top-to-bottom direction. As further defined, the strike face 145 faces in the generally forward direction. In some examples, the strike face 145 is co-formed with the body 102. In such examples, a minimum thickness of the forward portion 112 at the strike face 145 is between 1.5 mm and 2.5 mm and a maximum thickness of the forward portion 112 at the strike face 145 is less than 3.7 mm. An interior surface 166 of the forward portion 112, opposite the strike face 145, is not chemically etched and has an alpha case thickness of no more than 0.30 mm, in some examples.

Figure 9B:
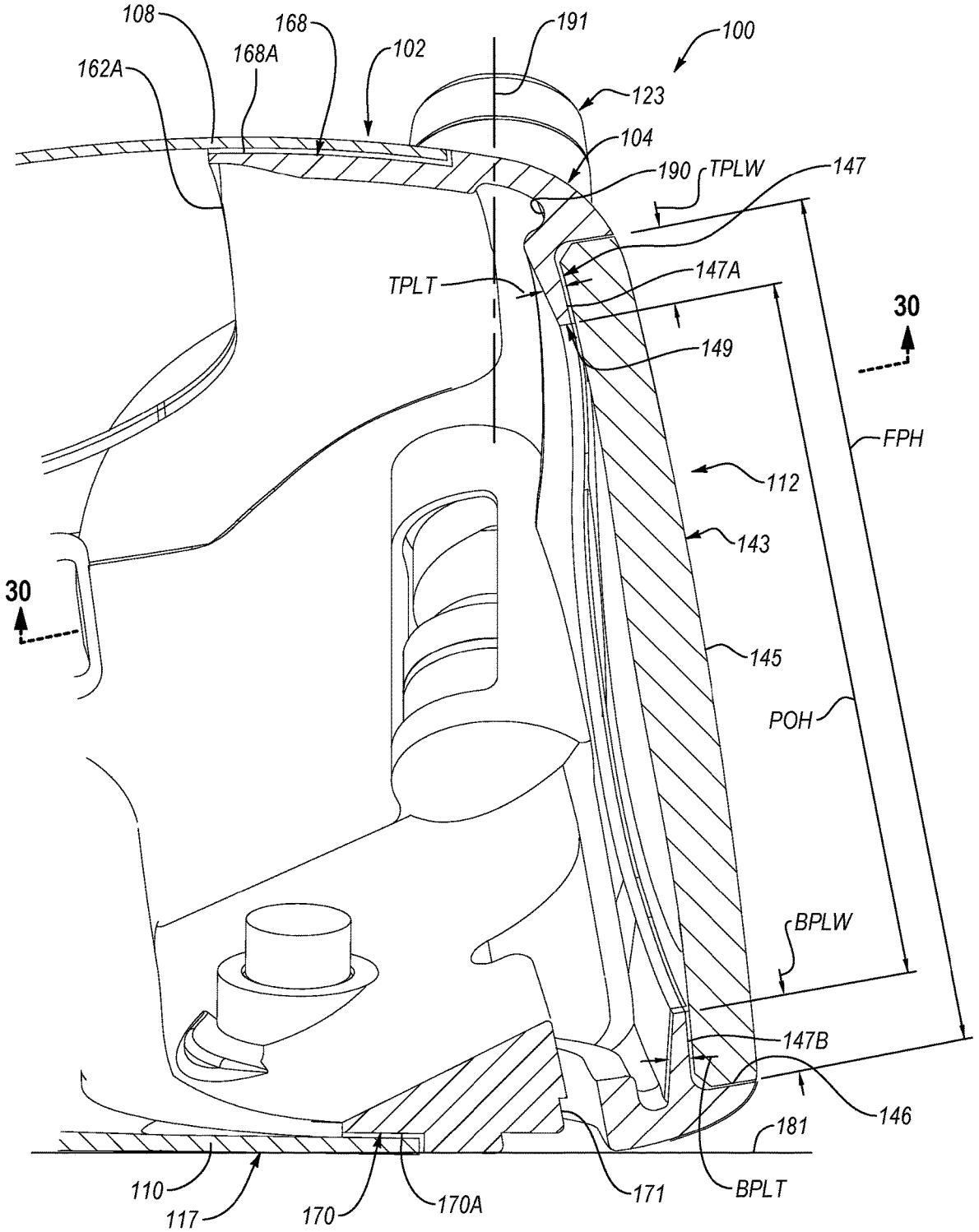
FIG. 9B is a schematic, cross-sectional, side elevation view of a detail of the golf club head of FIG. 9A, according to one or more examples of the present disclosure.
Figure 41:
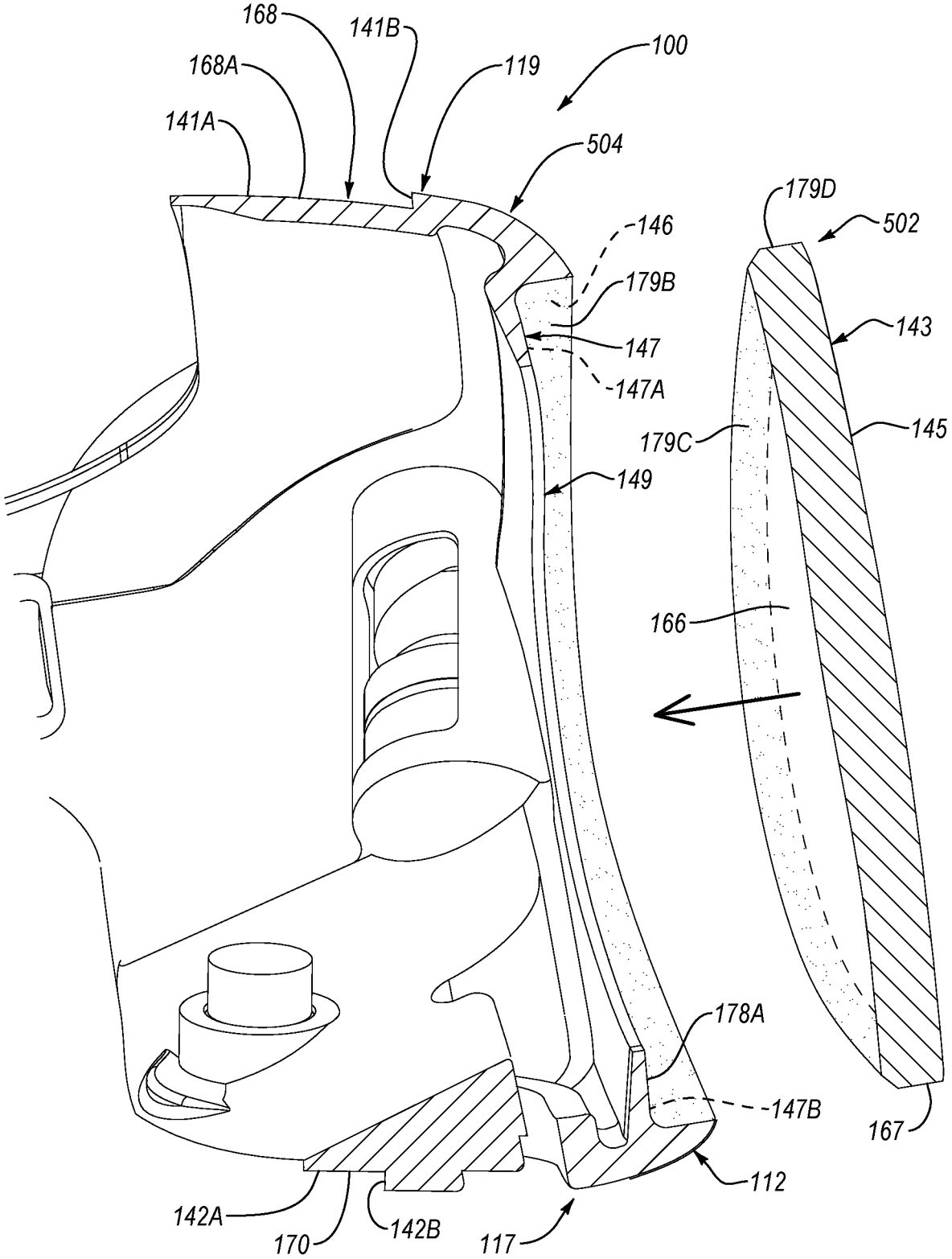

Referring to FIGS. 9B and 41, in some examples, the golf club head 100 includes a strike plate 143 that is not co-formed with the body 102. The strike plate 143 is formed separately from the body 102 and attached to the body 102, such as via bonding, welding, brazing, fastening, and the like. As shown, the strike plate 143 defines the strike face 145 of the golf club head 100. In these examples, the body 102 includes a plate opening 149 at the forward portion 112 of the golf club head 100 and a plate-opening recessed ledge 147 that extends continuously about the plate opening 149. The plate opening recessed ledge 147 is non-planar or curved in some examples. An inner periphery of the plate-opening recessed ledge 147 defines the plate opening 149. The plate-opening recessed ledge 147 is divided into at least a top plate-opening recessed ledge 147A, that extends adjacently along the crown portion 119 of the golf club head 100 in a heel-to-toe direction, and a bottom plate-opening recessed ledge 147B, that extends adjacently along the sole portion 117 of the golf club head 100 in a heel-to-toe direction. Although not shown, the plate-opening recessed ledge is further divided into toe and heel plate-opening recessed ledges. Some properties of a plate-opening recessed ledge can be found in U.S. Pat. No. 9,278,267, issued Mar. 8, 2016, which is incorporated herein by reference in its entirety.

As shown in FIG. 9B, the top plate-opening recessed ledge 147A has a width (TPLW) and a thickness (TPLT). The width TPLW is defined as the distance from the inner periphery of the ledge 147A defining the plate opening 149 to the furthest extent of the adhering surface of the ledge 147A away from the inner periphery. The thickness TPLT is defined as the thickness of the material defining the adhering surface of the ledge 147A. In some examples, a recess 190 (e.g., an internal recess) is formed in an internal surface of the body 102 and has depth that extends in a back-to-front direction such that in a sole-to-crown direction, the recess 190 is between the top plate-opening recessed ledge 147A and a top of the golf club head 100. In other words, the recess 190 overlaps the top plate-opening recessed ledge 147A in a crown-to-sole direction. Notably, rearward of the recess 190 the thickness of the crown may increase locally such that the thickness of the crown portion proximate to where the crown insert joins the club head is thicker than at the recess 190. This may be done to stiffen the overall structure of the crown joint and mitigate stress in the composite crown joint. Otherwise, the composite crown joint may be prone to cracking in that region resulting in a premature failure of the composite crown joint due to the casting cracking and/or the glue failing.

Figure 30:
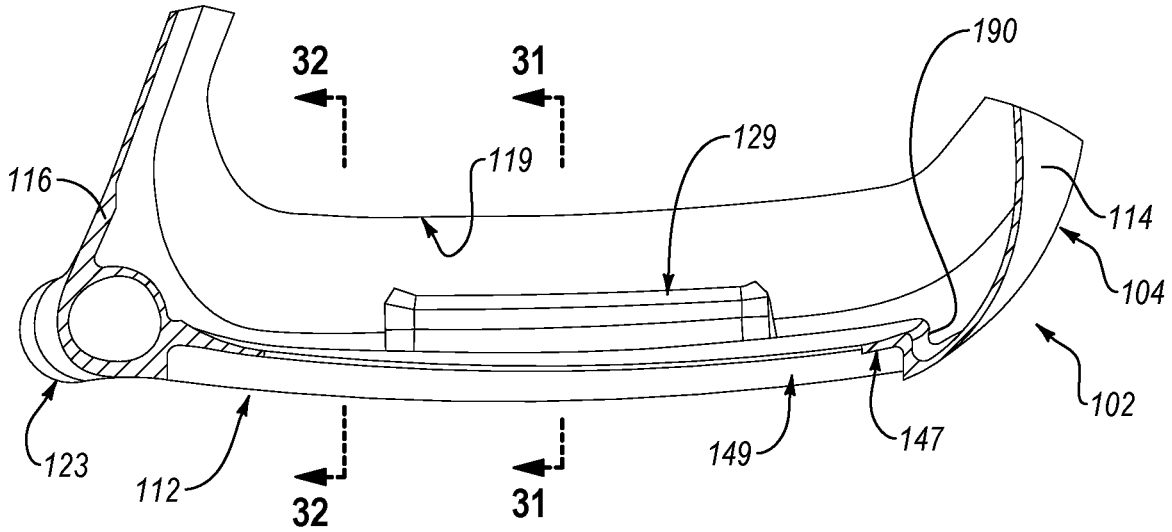
FIG. 30 is a schematic, sectional, bottom plan view of a golf club head, taken along a line similar to the line 30-30 of FIG. 9B, according to one or more examples of the present disclosure.
Figure 31:
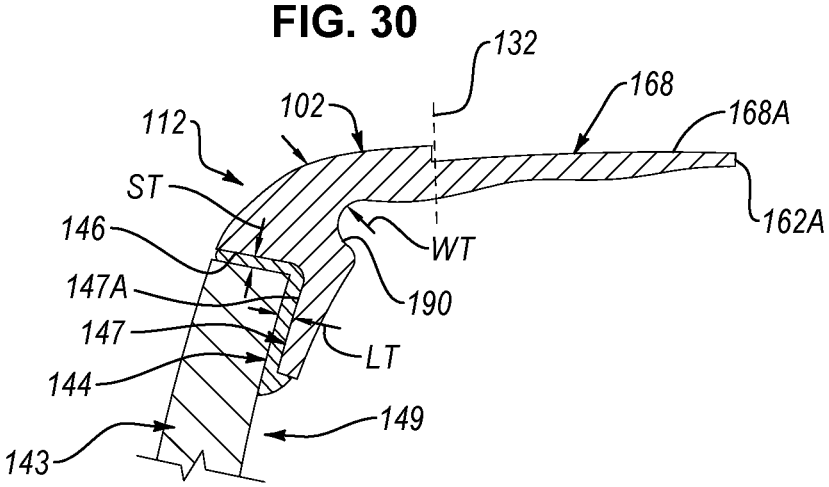
FIG. 31 is a schematic, sectional, side elevation view of a forward portion and a crown portion of the golf club head of FIG. 30, taken along the line 31-31 of FIG. 30, according to one or more examples of the present disclosure.
Figure 32:
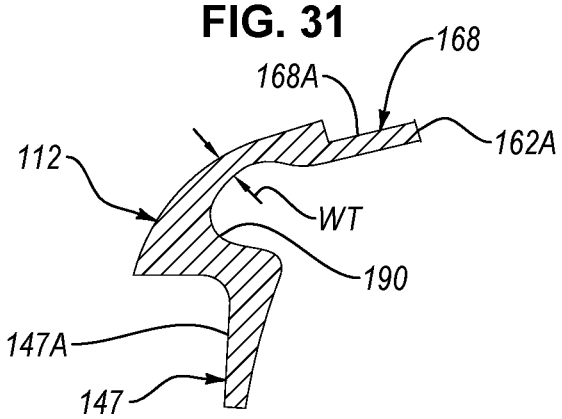
FIG. 32 is a schematic, sectional, side elevation view of a forward portion and a crown portion of the golf club head of FIG. 30, taken along the line 32-32 of FIG. 30, according to one or more examples of the present disclosure.

Referring to FIGS. 30-32, in some examples, the golf club head 100 further includes an interior mass pad 129 formed in the crown portion 119 at a location adjacent a top plate-opening recessed ledge 168. The interior mass pad 129 is also located between and offset (e.g., spaced apart) from the heel portion 116 and the toe portion 114 of the golf club head 100. A portion of the recess 190 is formed in the interior mass pad 129 in some examples. The interior mass pad 129 extends along only a portion of a length of the top plate-opening recessed ledge 168. The length of the top plate-opening recessed ledge 168 extends in a heel-to-toe direction. Moreover, in some examples, the top plate-opening recessed ledge 168 is non-planar or curved. According to some examples, a thickness (WT) of the crown portion at the recess 190 is thicker at the interior mass pad 129 (see, e.g., FIG. 31) than away from the interior mass pad 129 (see, e.g., FIG. 32).

In certain examples, the width TPLW of the top plate-opening recessed ledge 147A is greater than 4.5 mm (e.g., greater than 5.0 mm in some examples and greater than 5.5 mm in other examples, but less than 8.0 mm, preferably less than 7.0 mm in some examples). In some examples, a ratio of the width TPLW to a maximum height of the strike plate 143 is between 0.08 and 0.15. In the same or different examples, a ratio of the width TPLW to a maximum height of the plate opening 149 is between 0.07 and 0.15, such as 0.1, where in some examples the maximum height of the plate opening 149 is between 50-60 mm, such as 53 mm.

According to some examples, the thickness TPLT of the top plate-opening recessed ledge 147A is between a minimum value of 0.8 mm and a maximum value of 1.7 mm (e.g., between 0.9 mm and 1.6 mm in some examples and between 0.95 mm and 1.5 mm in other examples). As shown, the thickness TPLT is greater away from the inner periphery of the ledge 147A than at the inner periphery of the ledge 147A. Accordingly, the thickness TPLT varies along the width TPLW of the ledge 147A in some examples. For example, as shown, the thickness TPLT tapers or decreases in a crown-to-sole direction (e.g., toward a center of the plate opening 149). In some examples, the top ledge thickness TPLT of the top plate-opening recessed ledge 147A varies such that a maximum value of the top ledge thickness TPLT is between 30% and 60% greater than a minimum value of the top ledge thickness TPLT. In certain examples, a ratio of the thickness TPLT to a thickness of the strike plate is between 0.2 and 1.2. According to certain examples, a ratio of the width TPLW to the thickness TPLT is between 2.6 and 10.

The bottom plate-opening recessed ledge 147B has a width (BPLW) and a thickness (BPLT). The width BPLW is defined as the distance from the inner periphery of the ledge 147B defining the plate opening 149 to the furthest extent of the adhering surface of the ledge 147B away from the inner periphery. The thickness BPLT is defined as the thickness of the material defining the adhering surface of the ledge 147B.

In certain examples, the width BPLW of the bottom plate-opening recessed ledge 147B is greater than 4.5 mm (e.g., greater than 5.0 mm in some examples and greater than 5.5 mm in other examples, but less than 8.0 mm, preferably less than 7.0 mm in some examples). In some examples, a ratio of the width BPLW to a maximum height of the strike plate 143 is between 0.08 and 0.15. In the same or different examples, a ratio of the width BPLW to a maximum height of the plate opening 149 is between 0.07 and 0.15, such as 0.1, where in some examples the maximum height of the plate opening 149 is between 50-60 mm, such as 53 mm.

According to some examples, the thickness BPLT of the bottom plate-opening recessed ledge 147B is between 0.8 mm and 1.7 mm (e.g., between 0.9 mm and 1.6 mm in some examples and between 0.95 mm and 1.5 mm in other examples). As shown, the thickness BPLT is greater away from the inner periphery of the ledge 147B than at the inner periphery of the ledge 147B. Accordingly, the thickness BPLT varies along the width BPLW of the ledge 147B in some examples. For example, as shown, the thickness BPLT decreases in a sole-to-crown direction (e.g., toward a center of the plate opening 149). In some examples, the bottom ledge thickness BPLT of the bottom plate-opening recessed ledge 147B varies such that a maximum value of the bottom ledge thickness BPLT is between 30% and 60% greater than a minimum value of the bottom ledge thickness BPLT. In certain examples, a ratio of the thickness BPLT to a thickness of the strike plate is between 0.2 and 1.2. According to certain examples, a ratio of the width BPLW to the thickness BPLT is between 2.6 and 10.

As shown, the strike plate 143 is attached to the body 102 by fixing the strike plate 143 in seated engagement with at least the top plate-opening recessed ledge 147A and the bottom plate-opening recessed ledge 147B. When joined to the top plate-opening recessed ledge 147A and the bottom plate-opening recessed ledge 147B in this manner, the strike plate 143 covers or encloses the plate opening 149. Moreover, the top plate-opening recessed ledge 147A and the strike plate 143 are sized, shaped, and positioned relative to the crown portion 119 of the golf club head 100 such that the strike plate 143 abuts the crown portion 119 when seatably engaged with the top plate-opening recessed ledge 147A. The strike plate 143, abutting the crown portion 119, defines a topline of the golf club head 100. Moreover, in some examples, the visible appearance of the strike plate 143 contrasts enough with that of the crown portion 119 of the golf club head 100 that the topline of the golf club head 100 is visibly enhanced. Because the strike plate 143 is formed separately from the body 102, the strike plate 143 can be made of a material that is different than that of the body 102. In one example, the strike plate 143 is made of a fiber-reinforced polymeric material, such as described hereafter.

Notably, the TPLW, TPLT, BPLW, and BPLT dimensions help to control the local stiffness of the club head and to ensure sufficient bonding area to bond the strike plate to the body 102. The modulus of the strike plate if formed from a fiber-reinforced polymeric material will be much different than the modulus of the body if formed from a metal material such that the stiffness or compliance of the two are different, and during impact the strike plate and the body will move at different rates due to the different moduli unless precautions are taken in the design to account for the stiffness differences. Recess 190, TPLW, TPLT, BPLW, and BPLT dimensions all play a role in controlling the overall compliance and rate with which the face and body move during impact. Additionally, TPLW and BPLW contribute to ensuring sufficient bond area and face performance. Too little bond area and the glue joint will fail, too much bond area and the face will not perform i.e. the coefficient of restitution will not be optimized, and in some examples too much bond area will result in the face peeling away from the club head due to the differences in stiffness. Thus, TPLW, TPLT, BPLW, and BPLT dimensions contribute to the overall performance of the club head and to the avoidance of bond or glue joint failure. In some examples, the bond area will range from 850 $mm^2$ to 1800 $mm^2$, preferably between 1,300 $mm^2$ to 1,500 $mm^2$. In some examples, a ratio of the bond area to the inner surface area of the strike plate (rear surface area of the strike plate) will range from 21% to 45%. In some examples, a total bond area of the strike plate will be less than a total bond area of the crown insert. In some examples, a ledge width TPLW and/or BPLW will be less than a ledge width of the forward crown-opening recessed ledge 168A (front-back as measured along the y-axis).

Referring to FIG. 31, a layer of adhesive 144 adhesively bonds the strike plate 143 to the body 102. The forward portion 112 includes a sidewall 146 that defines a depth of the plate-opening recessed ledge 147 and defines a radially outer periphery of the plate-opening recessed ledge 147 away from a center of the plate opening 149. The sidewall 146 is angled (e.g., acute, obtuse, or perpendicular) relative to the plate-opening recessed ledge 147. In some examples, the angle defined between the sidewall 146 and the plate-opening recessed ledge 147 is between 70° and 120°. In certain examples, the angle defined between the sidewall 146 and the plate-opening recessed ledge 147 is greater than 90°. The body 102 further includes a transition portion between the plate-opening recessed ledge 147 and the sidewall 146. The transition portion defines a radiused surface, in some examples, which couples together the surfaces of the plate-opening recessed ledge 147 and the sidewall 146. The layer of adhesive 144 is interposed between the plate-opening recessed ledge 147 and the strike plate 143 and interposed between the sidewall 146 and the strike plate 143. A thickness (LT) of the layer of adhesive 144 between the plate-opening recessed ledge 147 and the strike plate 143 is greater than a thickness (ST) of the layer of adhesive 144 between the sidewall 146 and the strike plate 143, in some examples. According to one particular example, the thickness (LT) of the layer of adhesive 144 between the plate-opening recessed ledge 147 and the strike plate 143 is between 0.25 mm and 0.45 mm, and the thickness (ST) of the layer of adhesive 144 between the sidewall 146 and the strike plate 143 is between 0.15 mm and 0.25 mm.

In some examples, the strike plate may have a maximum face plate height of no more than 55 mm as measured along the z-axis through the club head origin, preferably no more than 55 mm and no less than 40 mm, even more preferably between 49 mm and 54 mm. In some instance, the strike plate formed of fiber-reinforced polymeric material may have a front surface area of no more than 4,180 $mm^2$, and preferably between 3,200 $mm^2$ and 4,180 $mm^2$, more preferably between 3,500 $mm^2$ and 4,180 $mm^2$. According to certain examples, the strike face 145 has a first bulge radius of at least 300 mm and a first roll radius of at least 250 mm. Generally, a bulge radius greater than 300 mm has a better CT creep rate and club heads with a bulge no less 300 mm bulge radius and a roll radius within 30-50 mm of the bulge radius performed well.

Figure 10:
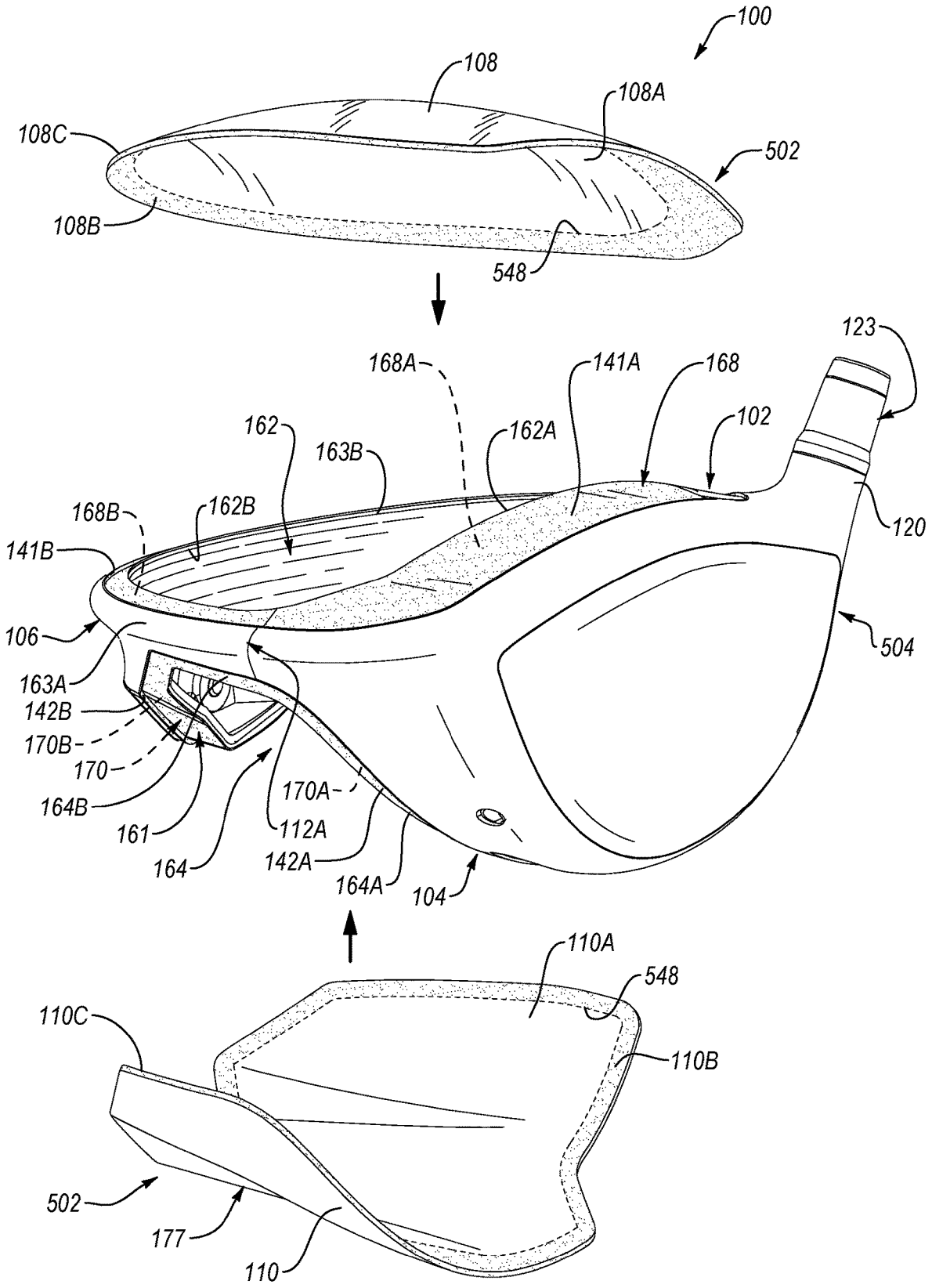
FIGS. 10 and 11 are schematic, exploded, perspective views of the golf club head of FIG. 1, according to one or more examples of the present disclosure.
Figure 11:
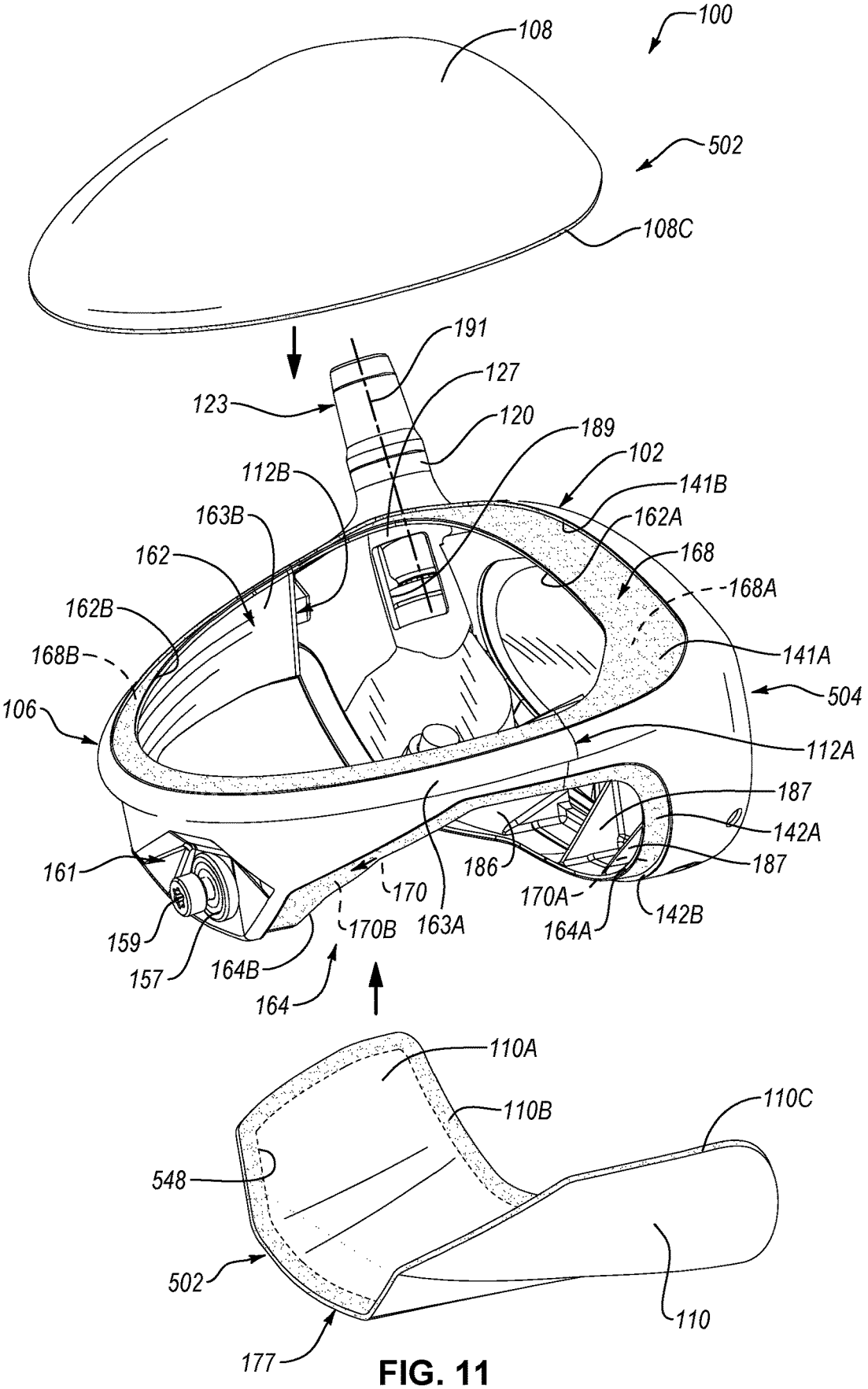
Figure 12:
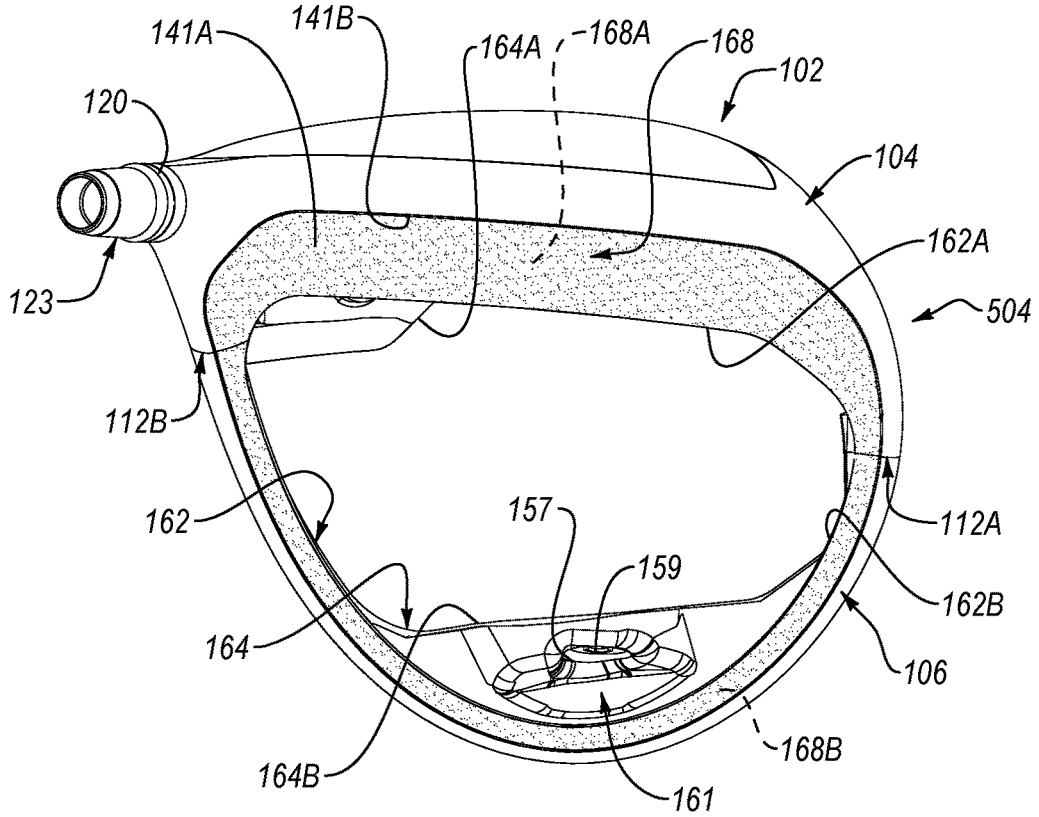
FIGS. 12-15 are schematic views of a body of the golf club head of FIG. 1, according to one or more examples of the present disclosure.
Figure 13:
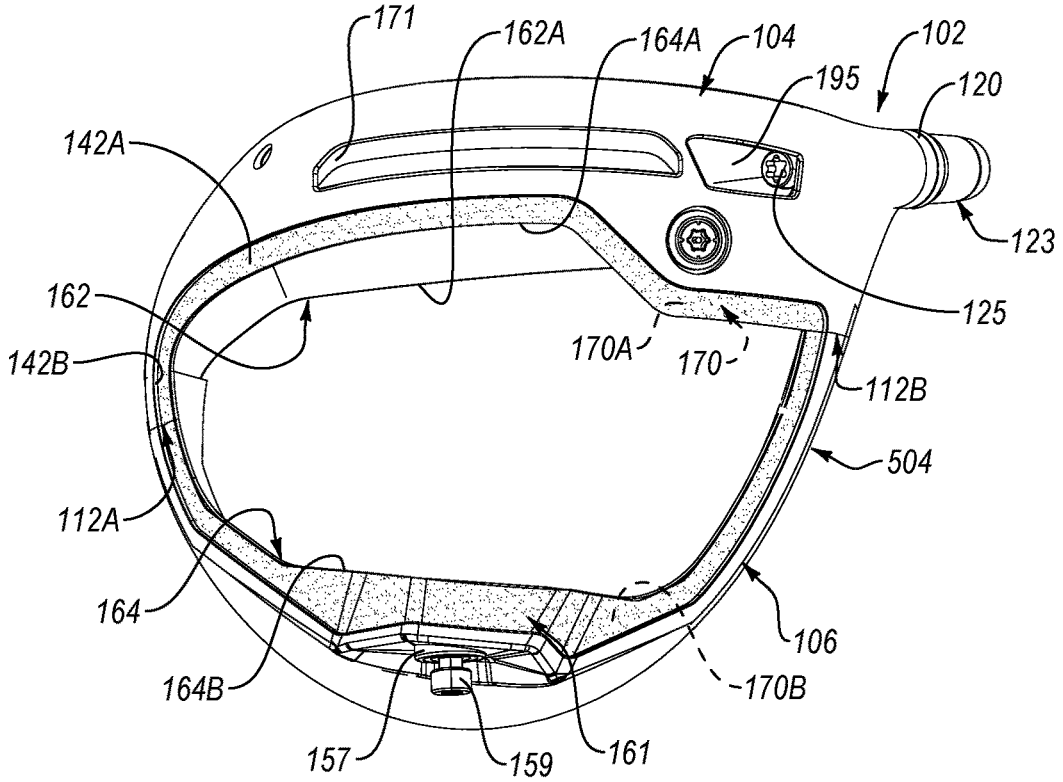

The golf club head **1*r*00 includes a body 102, a crown insert 108 (or crown panel) attached to the body 102 at a top of the golf club head 100, and a sole insert 110 (or sole panel) attached to the body 102 at a bottom of the golf club head 100 (see, e.g. FIGS. 10 and 11). Accordingly, the body 102 effectually provides a frame to which one or more inserts, panels, or plates are attached. The body 102 includes a cast cup 104 and a ring 106 (e.g., a rear ring). The ring 106 is joined to the cast cup 104 at a toe-side joint 112A and a heel-side joint 112B. The cast cup 104 defines at least part of the forward portion 112 of the golf club head 100. The ring 106 defines at least part of the rearward portion 118 of the golf club head 100. Additionally, the cast cup 104 defines part of the crown portion 119, the sole portion 117, the heel portion 116, the toe portion 114, and the skirt portion 121. Similarly, the ring 106 defines part of the heel portion 116, the toe portion 114, and the skirt portion 121**.

Figure 14:
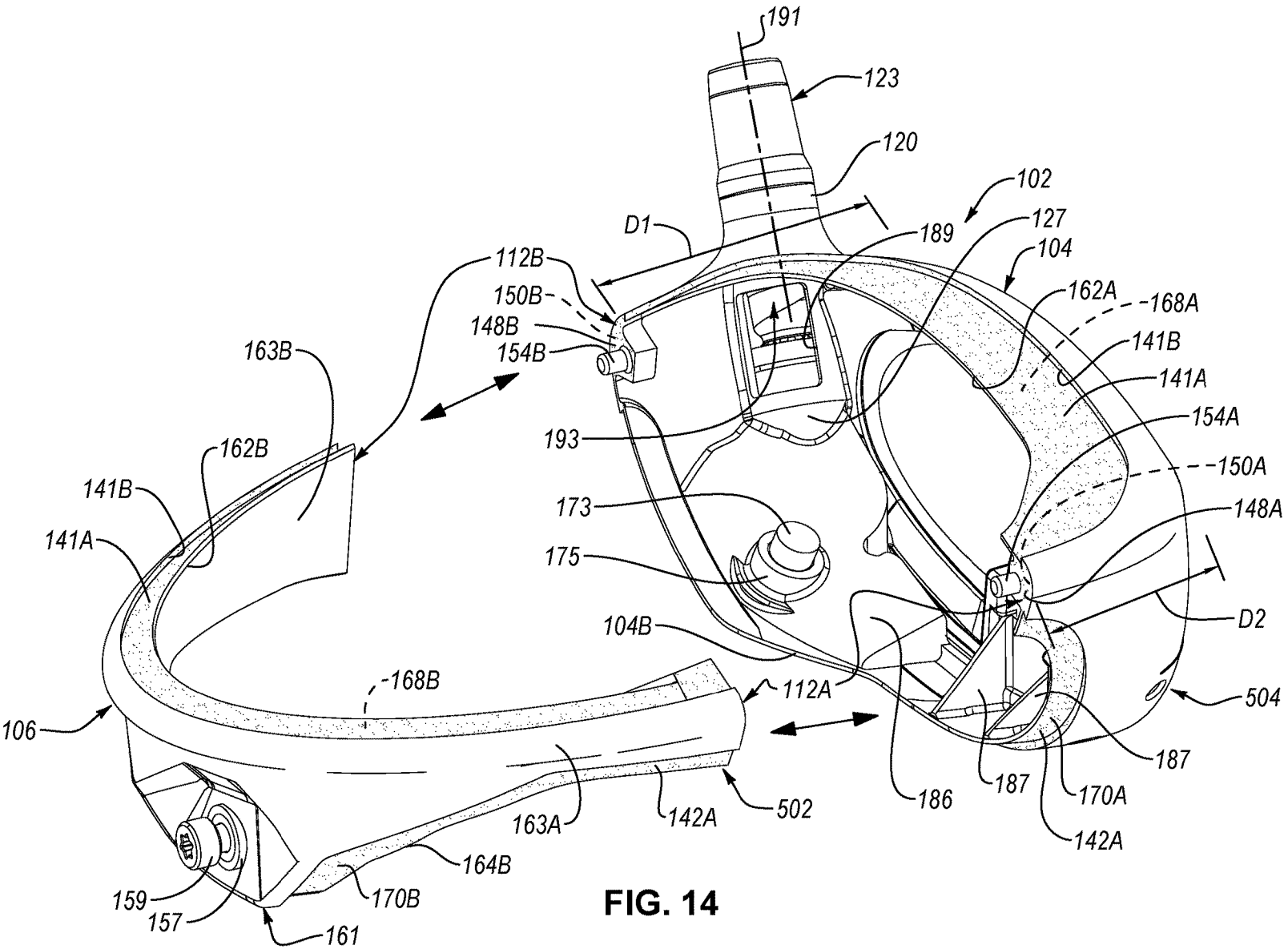

The cast cup 104 (or just cup) is cup-shaped. More specifically, as shown in FIG. 14, the cast cup 104, including the strike face 145, is enclosed on one end by the strike face 145, enclosed on four sides (e.g., by the crown portion 119, the sole portion 117, the toe portion 114, and the heel portion 116), which extend substantially transversely from the strike face 145, and open on an end opposite the strike face 145. Accordingly, the cast cup 104, when coupled with the strike face 145, resembles a cup or a cup-like unit.

The ring 106 is not circumferentially closed or does not form a continuous annular or circular shape. Instead, the ring 106 is circumferentially open and defines a substantially semi-circular shape. Thus, as defined herein, the ring 106 is termed a ring because it has a ring-like, semi-circular shape, and, when joined to the cast cup 104, forms a circumferentially closed or annular shape with the cast cup 104.

The cast cup 104 is formed separately from the ring 106 and the ring 106 is subsequently joined to the cast cup 104. Accordingly, the body 102 has at least a two-piece construction where the cast cup 104 defines one piece of the body 102 and the ring 106 define another piece of the body 102. Accordingly, a seam is defined at each of the toe-side joint 112A and the heel-side joint 112B where the cast cup 104 and the ring 106 are adjoined. The cast cup 104 and the ring 106 are separately formed using any of various manufacturing techniques. In one example, the cast cup 104 and the ring 106 are formed using a casting process. Because the cast cup 104 and the ring 106 are formed separately, the cast cup 104 and the ring 106 can be made of different materials. For example, the cast cup 104 can be made of a first material and the ring 106 can be made of a second material where the second material is different than the first material.

Figure 15:
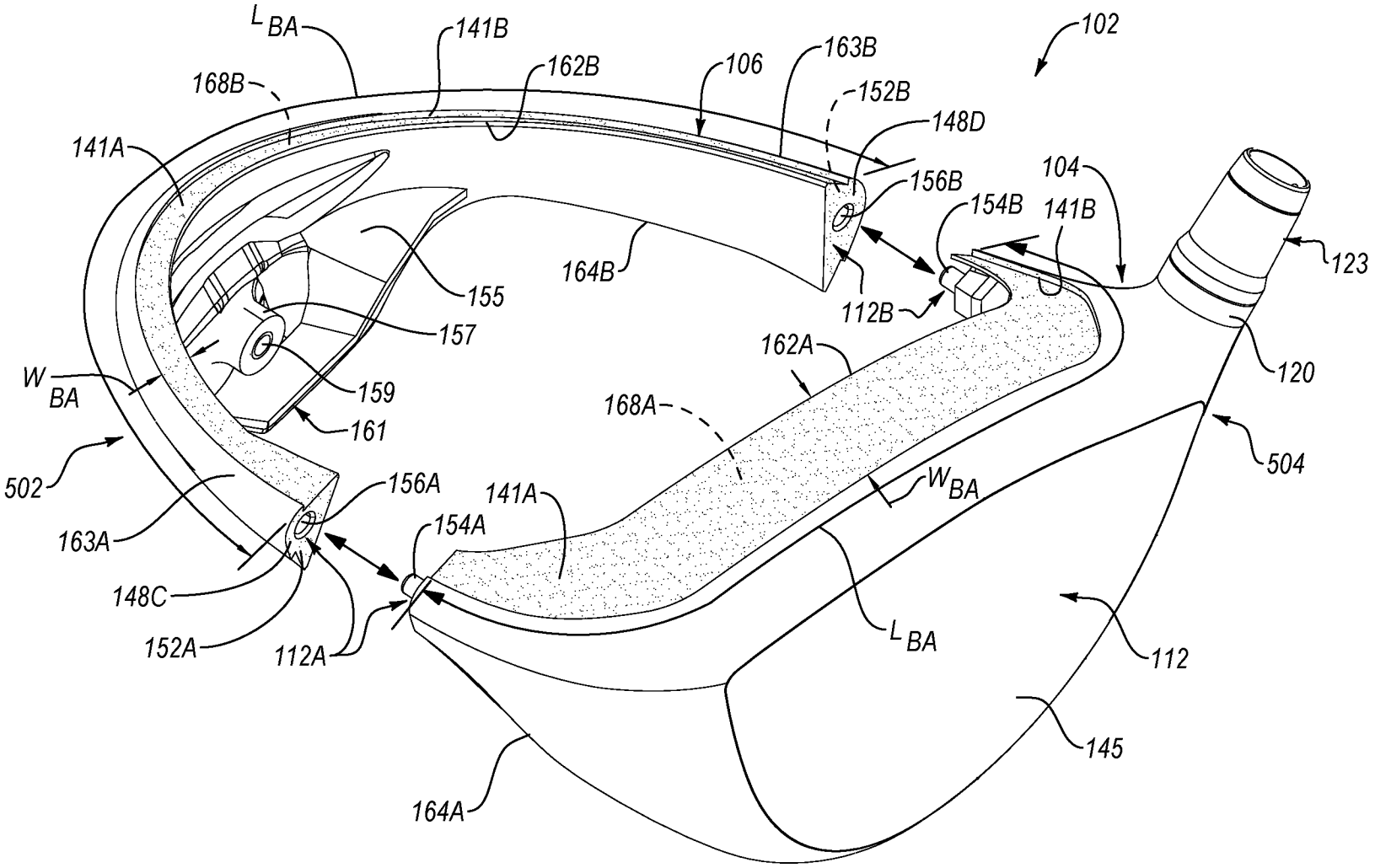

Referring to FIGS. 14 and 15, the cast cup 104 includes a toe ring-engagement surface 150A and a heel ring-engagement surface 150B. Similarly, the ring 106 includes a toe cup-engagement surface 152A and a heel cup-engagement surface 152B. The toe-side joint 112A is formed by abutting and securing together the toe ring-engagement surface 150A of the cast cup 104 and the toe cup-engagement surface 152A of the ring 106 and abutting and securing together the heel ring-engagement surface 150B of the cast cup 104 and the heel cup-engagement surface 152B of the ring 106. The engagement surfaces can be secured together via any suitable securing techniques, such as welding, brazing, adhesives, mechanical fasteners, and the like.

To help strengthen and stiffen the toe-side joint 112A and the heel-side joint 112B, complementary mating elements can be incorporated into or coupled to the engagement surfaces. In the illustrated example, the cast cup 104 includes a toe projection 154A protruding from the toe ring-engagement surface 150A and a heel projection 154B protruding from the heel ring-engagement surface 150B. In contrast, in the illustrated example, the ring 106 includes a toe receptacle 156A formed in the toe cup-engagement surface 152A and a heel receptacle 156B formed in the heel cup-engagement surface 152B. The toe projection 154A mates with (e.g., is received within) the toe receptacle 156A and the heel projection 154B mates with (e.g., is received within) the heel receptacle 156B as the engagement surfaces abut each other to form the joints. Although in the illustrated example, the toe projection 154A and the heel projection 154B form part of the cast cup 104 and the toe receptacle and the heel receptacle 156B form part of the ring 106, in other examples, the mating elements can be reversed such that the toe projection 154A and the heel projection 154B form part of the ring 106 and the toe receptacle and the heel receptacle 156B form part of the cast cup 104. Additionally, different types of complementary mating elements, such as tabs and notches, can be used in addition to or in place of the projections and receptacles.

In some examples, the toe-side joint 112A and the heel-side joint 112B are located a sufficient distance from the strike face 145 to avoid potential failures due to severe impacts undergone by the golf club head 100 when striking a golf ball. For example, each one of the toe-side joint 112A and the heel-side joint 112B can be spaced at least 20 mm, at least 30 mm, at least 40 mm, at least 50 mm, at least 60 mm, and/or from 20 mm to 70 mm rearward of the center face 183 of the strike face 145, as measured along a y-axis (front-to-back direction) of the club head origin coordinate system 185. Referring to FIG. 14, according to certain examples, a first distance D1, from the strike face 145 to the heel ring-engagement surface 150B, is less than a second distance D2, from the strike face 145 to the toe ring-engagement surface 150A. In other words, in some examples, the cast cup 104 extends rearwardly from the strike face 145 a shorter distance at the heel portion 116 than at the toe portion 114.

Referring to FIGS. 10-13, the body 102 comprises a crown opening 162 and a sole opening 164. The crown opening 162 is located at the crown portion 119 of the golf club head 100 and when open provides access into the interior cavity 113 of the golf club head 100 from a top of the golf club head 100. In contrast, the sole opening 164 is located at the sole portion 117 of the golf club head 100 and when open provides access into the interior cavity 113 of the golf club head 100 from a bottom of the golf club head 100. Corresponding sections of the crown opening 162 and the sole opening 164 are defined by the cast cup 104 and the ring 106. More specifically, referring to FIGS. 10-15, a forward section 162A of the crown opening 162 and a forward section 164A of the sole opening 164 are defined by the cast cup 104, and a rearward section 162B of the crown opening 162 and a rearward section 164B of the sole opening 164 are defined by the ring 106. Accordingly, when the cast cup 104 and the ring 106 are joined together, the forward section 162A and the rearward section 162B collectively define the crown opening 162, and the forward section 164A and the rearward section 164B collectively define the sole opening 164.

The cast cup 104 additionally includes a forward crown-opening recessed ledge 168A and a forward sole-opening recessed ledge 170A. The ring 106 includes a rearward crown-opening recessed ledge 168B and a rearward sole-opening recessed ledge 170B. The forward sole-opening recessed ledge 170A and the rearward sole-opening recessed ledge 170B form a sole-opening recessed ledge 170 of the golf club head 100. Moreover, in some examples, the sole-opening recessed ledge 170 is non-planar or curved. The ledges are offset inwardly, toward the interior cavity 113, from the exterior surfaces of the body 102 surrounding the ledges by distances corresponding with the thicknesses of the crown insert 108 and the sole insert 110. In some examples, the offset of the ledges from the exterior surfaces of the body 102 is approximately equal to the corresponding thicknesses of the crown insert 108 and the sole insert 110, such that the inserts are flush with the corresponding surrounding exterior surfaces of the body 102 when attached to the ledges. However, in some examples, the crown insert 108 and the sole insert 110 need not be flush with (e.g., can be raised or recessed relative to) the surrounding exterior surface of the body 102 when seatably engaged with the corresponding ledges. In some examples, a thickness of the sole insert 110 is greater than a thickness of the crown insert 108. Moreover, the sole insert 110 is made up of a first quantity of stacked plies, each made of a fiber-reinforced polymeric material, and the crown insert 108 is made up of a second quantity of stacked plies, each made of a fiber-reinforced polymeric material. In some examples, the first quantity of stacked plies is greater than the second quantity of stacked plies.

When the cast cup 104 and the ring 106 are joined, the forward crown-opening recessed ledge 168A and the rearward crown-opening recessed ledge 168B collectively define a crown-opening recessed ledge 168 of the body 102, and the forward sole-opening recessed ledge 170A and the rearward sole-opening recessed ledge 170B collectively define a sole-opening recessed ledge 170 of the body 102. The inner periphery of the forward crown-opening recessed ledge 168A defines the forward section 162A of the crown opening 162 and the inner periphery of the rearward crown-opening recessed ledge 168B defines the rearward section 162B of the crown opening 162. Likewise, the inner periphery of the forward sole-opening recessed ledge 170A defines the periphery of the forward section 164A of the sole opening 164 and the inner periphery of the rearward sole-opening recessed ledge 170B defines the periphery of the rearward section 164B of the sole opening 164. Accordingly, the inner periphery of the crown-opening recessed ledge 168 defines the periphery of the crown opening 162 and the inner periphery of the sole-opening recessed ledge 170 defines the periphery of the sole opening 164.

Referring to FIG. 31, a thickness of the body 102 at the crown portion 119 decreases in a rearward-to-forward direction from a forward extent 132 of the crown opening recessed ledge 168, and decreases in a forward-to-rearward direction from the forward extent 132 of the crown opening recessed ledge 168. This results in a localized increase in thickness at the forward extent 132, which helps to strengthen and stiffen the joint between the body 102 and the crown insert 108.

The crown insert 108 and the sole insert 110 are formed separately from each other and separately from the body 102. Accordingly, the crown insert 108 and the sole insert 110 are attached to the body 102 as shown in FIGS. 10 and 11. In some examples, the crown insert 108 is seated on and adhered, such as with an adhesive, to the crown-opening recessed ledge 168 and the sole insert 110 is seated on and adhered, such as with an adhesive, to the sole-opening recessed ledge 170. In this manner, the crown insert 108 encloses or covers the crown opening 162 and defines, at least in part, the crown portion 119 of the golf club head 100, and the sole insert 110 encloses or covers the sole opening 164 and defines, at least in part, the sole portion 117 of the golf club head 100.

Figure 4:
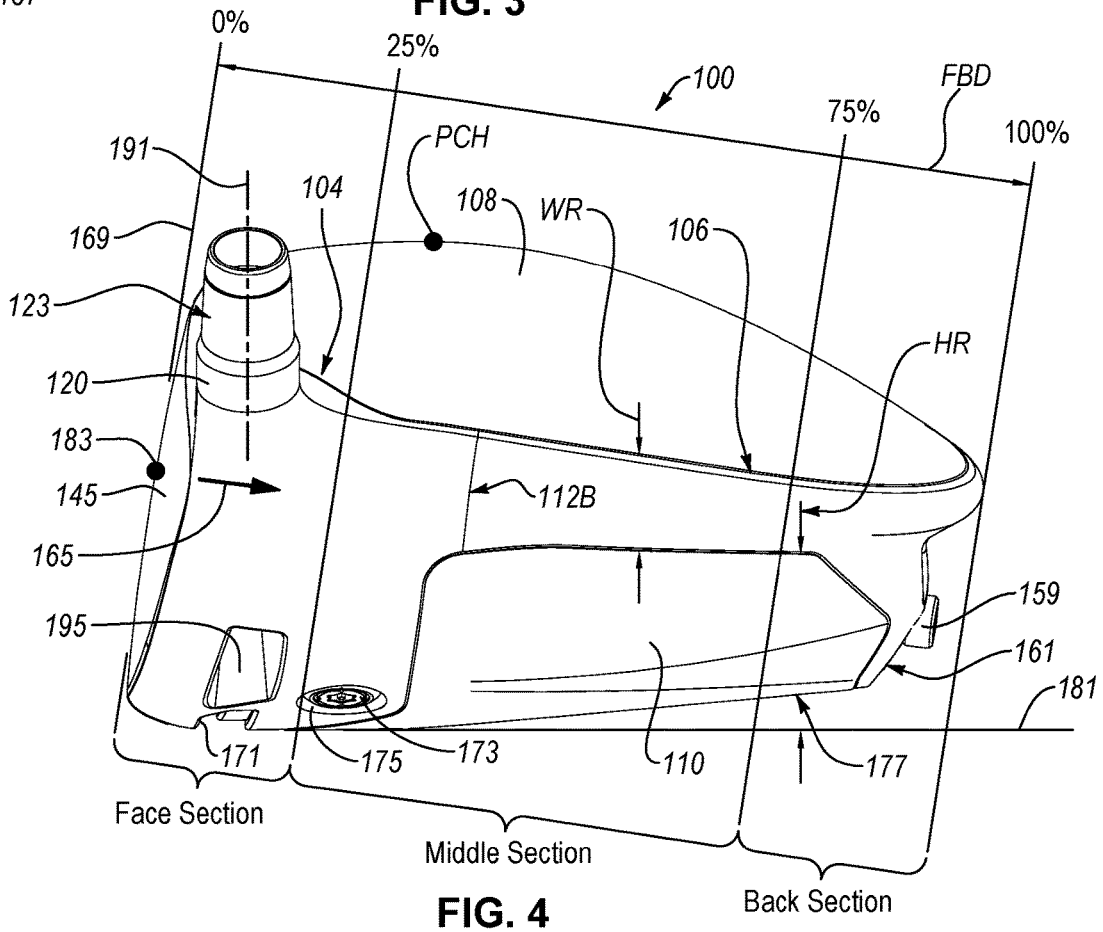

The crown insert 108 and the sole insert 110 can have any of various shapes. Referring to FIG. 4, in one example, the crown insert 108 is shaped such that a location (PCH), corresponding with the peak crown height of the golf club head 100, is rearward of a hosel 120 of the golf club head 100 and rearward of the hosel axis 191 of the hosel 120 of the golf club head 100. The peak crown height is the maximum crown height of a golf club head where the crown height at a given location along the golf club head is the distance from the ground plane 181, when the golf club head is in the address position on the ground plane, to an uppermost point on the crown portion at the given location. In some examples, the crown height of the golf club head 100 increases and then decreases in a front-to-rear direction away from the strike face 145. In certain examples, the portion or exterior surface of the crown portion that defines the peak crown height is made of the at least one first material. According to some examples, a first crown height is defined at a face-to-crown transition region in the forward crown area where the club face connects to the crown portion of the club head, a second crown height is defined at a crown-to-skirt transition region where the crown portion connects to a skirt of the golf club head near a rear end of the golf club head, and a maximum crown height is defined rearward of the first crown height and forward of the second crown height, where the maximum crown height is greater than both the first and second crown heights. In some examples, the maximum crown height occurs toeward of a geometric center of the strike face. According to certain examples, the maximum crown height is formed by a non-metal composite crown insert.

Figure 3:
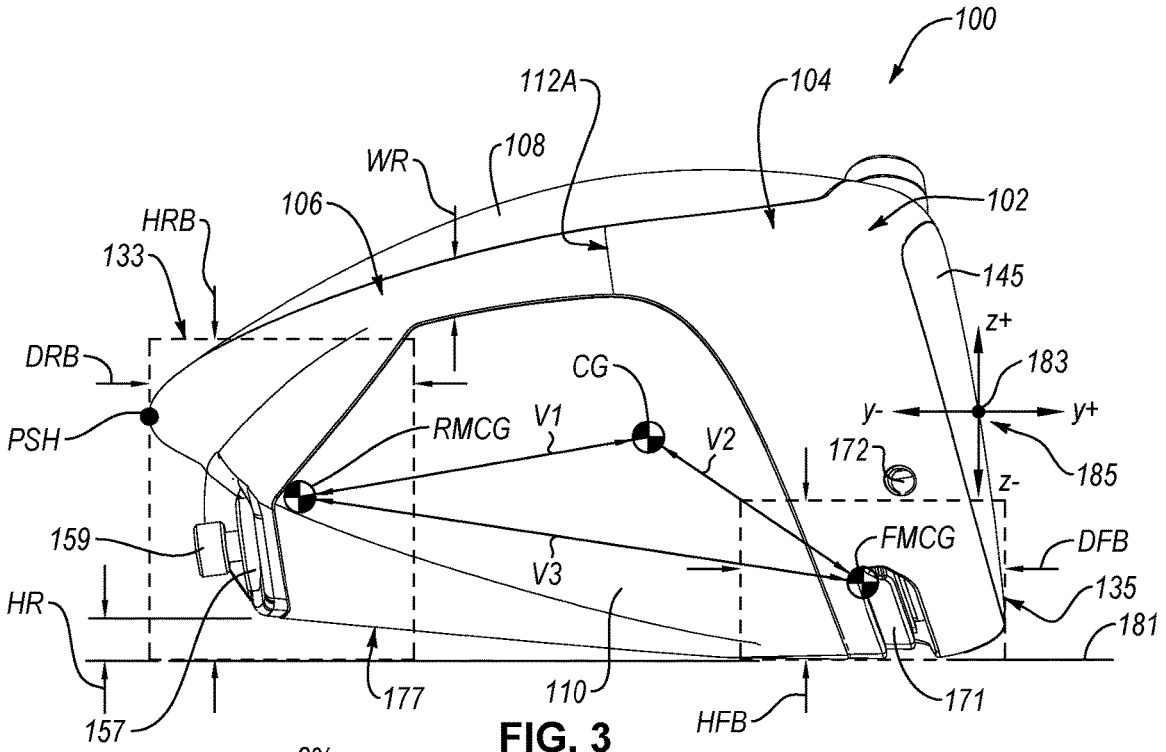

Referring to FIG. 3, a peak skirt height (shown associated with a location (PSH)) is the maximum skirt height of a golf club head, where the skirt height at a given location along the golf club head is the distance from the ground plane, when the golf club head is in the address position on the ground plane, to an uppermost point on the skirt portion at the rearwardmost point of the skirt portion on the golf club head.

According to some examples, a ratio of a peak crown height of the crown portion 119 to a peak skirt height of the skirt portion 121 ranges between about 0.45 to 0.59, preferably 0.49-0.55, and in one example the skirt height is about 34 mm and the peak crown height is about 65 mm, which results in a ratio of peak skirt height to peak crown height of about 0.52. A peak skirt height typically ranges between 28 mm and 38 mm, preferably between 31 mm and 36 mm. A peak crown height typically ranges between 60 mm and 70 mm, preferably between 62 mm and 67 mm. It is desirable to limit a difference between the peak crown height and the peak skirt height to no more than 40 mm, preferably between 27 mm and 35 mm. It is desirable for the peak skirt height to be the same as or greater than a Z-up value for the golf club head i.e. the vertical distance along a z-axis from the ground plane 181 to the center of gravity. It is desirable for the peak crown height to be two times (2×) larger than a Z-up value for the golf club head. A greater peak skirt height may help with better aerodynamics and better air flow attachment especially for faster swing speeds. Likewise, if the difference between the peak crown height and peak skirt height is too great there will be a greater likelihood of the flow separating early from the golf club head i.e. increased likelihood of turbulent flow.

The construction and material diversity of the golf club head 100 enables the golf club head 100 to have a desirable center-of-gravity (CG) location and peak crown height location. In one example, a y-axis coordinate, on the y-axis of the club head origin coordinate system 185, of the location (PCH) of the peak crown height is between about 26 mm and about 42 mm. In the same or a different example, a distance parallel to the z-axis of the club head origin coordinate system 185, from the ground plane 181, when the golf club head 100 is in the address position, of the location (PCH) of the peak crown height ranges between 60 mm and 70 mm, preferably between 62 mm and 67 mm as described above. According to some examples, a y-axis coordinate, on the y-axis of the head origin coordinate system 185, of the center-of-gravity (CG) of the golf club head 100 ranges between 25 mm and 50 mm, preferably between 32 mm and 38 mm, more preferably between 36.5 mm and 42 mm, an x-axis coordinate, on the x-axis of the head origin coordinate system 185, of the center-of-gravity (CG) of the golf club head 100 ranges between −10 mm and 10 mm, preferably between −6 mm and 6 mm, and more preferably between −7 mm and 7 mm, and a z-axis coordinate, on the z-axis of the head origin coordinate system 185, of the center-of-gravity (CG) of the golf club head 100 is less than 2 mm, such as ranges between −10 mm and 2 mm, preferably between −7 mm and −2 mm.

Figure 5:
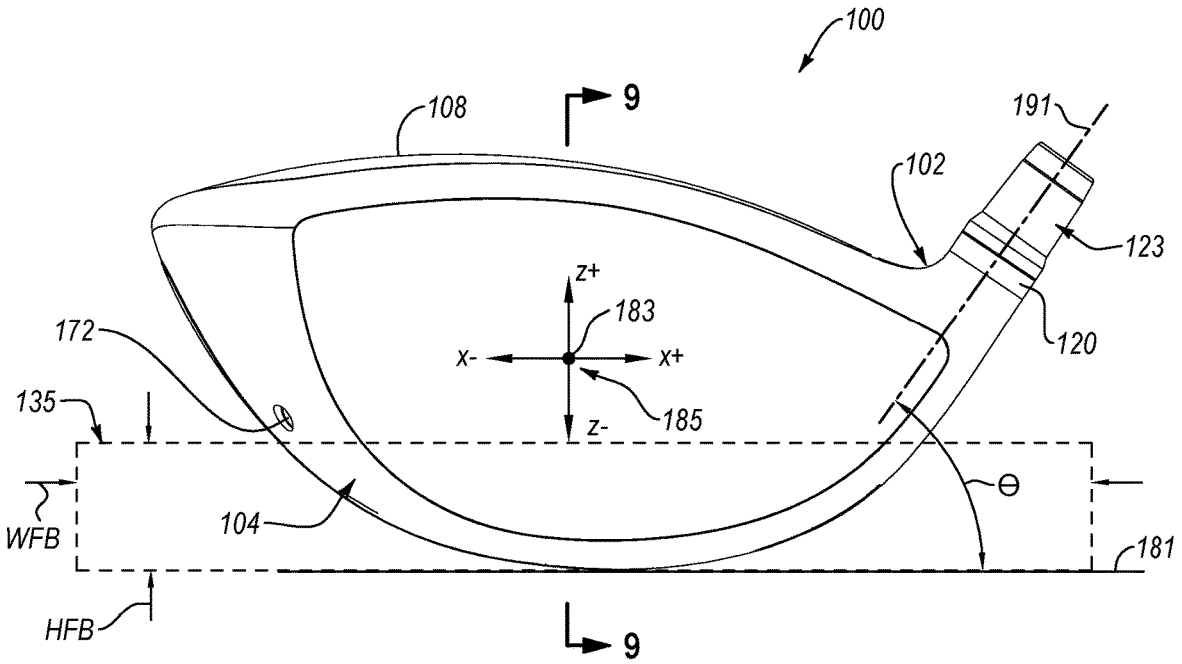
Figure 6:
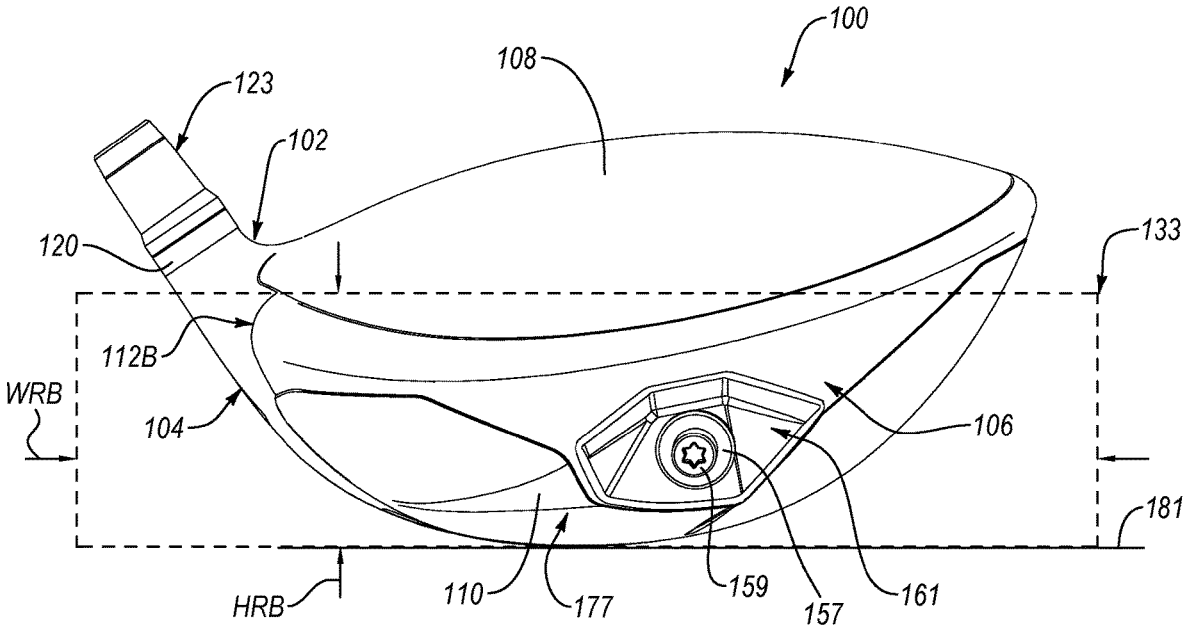

Additionally, the construction and material diversity of the golf club head 100 enables the golf club head 100 to have desirable mass distribution properties. Referring to FIGS. 3, 5, and 6, the golf club head 100 includes a rearward mass and a forward mass. The rearward mass of the golf club head 100 is defined as the mass of the golf club head 100 within an imaginary rearward box 133 having a height (HRB), parallel to a crown-to-sole direction (parallel to z-axis of golf club head origin coordinate system 185), of 35 mm, a depth (DRB), in a front-to-rear direction (parallel to y-axis of golf club head origin coordinate system 185), of 35 mm, and a width (WRB), in a toe-to-heel direction (parallel to x-axis of golf club head origin coordinate system 185), greater than a maximum width of the golf club head 100. As shown, a rear side of the imaginary rearward box 133 is coextensive with a rearmost end of the golf club head 100 and a bottom side of the imaginary rearward box 133 is coextensive with the ground plane 181 when the golf club head 100 is in the address position on the ground plane 181. The forward mass of the golf club head 100 is defined as the mass of the golf club head 100 within an imaginary forward box 135 having a height (HFB), parallel to the crown-to-sole direction, of 20 mm, a depth (DFB), in the front-to-rear direction, of 35 mm, and a width (WFB), in the toe-to-heel direction, greater than a maximum width of the golf club head 100. As shown, a forward side of the imaginary forward box 135 is coextensive with a forwardmost end of the golf club head 100 and a bottom side of the imaginary forward box 135 is coextensive with the ground plane 181 when the golf club head 100 is in the address position on the ground plane 181.

According to some examples, a first vector distance (V1) from a center-of-gravity of the rearward mass (RMCG) to a CG of the driver-type golf club head is between 49 mm and 64 mm (e.g., 55.7 mm), a second vector distance (V2) from a center-of-gravity of the forward mass (FMCG) to the CG of the driver-type golf club head is between 22 mm and 34 mm (e.g., 29.0 mm), and a third vector distance (V3) from the CG of the rearward mass (RMCG) to the CG of the forward mass (FMCG) is between 75 mm and 82 mm (e.g., 79.75 mm). In certain examples, V1 is no more than 56.3 mm. In some examples, V2 is no less than 23.7 mm, preferably no less than 25 mm, or even more preferably no less than 27 mm. Some additional values of V1 and V2 relative to Zup and CGy values for various examples of the golf club head 100 are provided in Table 1 below. As defined herein, Zup measures the center-of-gravity of the golf club head 100 relative to the ground plane 181 along a vertical axis (e.g., parallel to the z-axis of the club head origin coordinate system 185) when the golf club head 100 is in the proper address position on the ground plane 181. CGy is the coordinate of the center-of-gravity of the golf club head 100 on the y-axis of the club head origin coordinate system 185.

TABLE 1

| Example | Zup | CGy | V1 | V2 |
|---|---|---|---|---|
| 1 | 26 mm | 37 mm | 55.7 mm | 29.0 mm |
| 2 | 30 mm | 37 mm | 56.3 mm | 31.8 mm |
| 3 | 22 mm | 37 mm | 55.2 mm | 27.3 mm |
| 4 | 25 mm | 32 mm | 61.0 mm | 23.7 mm |
| 5 | 25 mm | 40 mm | 52.7 mm | 30.76 mm |

The crown insert 108 has a crown-insert outer surface that defines an outward-facing surface or exterior surface of the crown portion 119. Similarly, the sole insert 110 has a sole-insert outer surface that defines an outward-facing surface or exterior surface of the sole portion 117. As defined herein, the crown-insert outer surface and the sole-inert outer surface includes the combined outer surfaces of multiple crown inserts and multiple sole inserts, respectively, if multiple crown inserts or multiple sole inserts are used. In one example, a total surface area of the sole-insert outer surface is smaller than a total surface area of the crown-insert outer surface. According to one example, the total surface area of the crown-insert outer surface is at least 9,482 $mm^2$. In one example, the total surface area of the sole-insert outer surface is at least 8,750 $mm^2$ and the sole insert has a maximum width, parallel to a heel-to-toe direction, of at least between 80 mm and 120 mm. The total surface area of the crown-insert outer surface can range between 5,300 mm^2 to 11,000 mm^2, preferably between 9,200 mm^2 and 10,300 mm^2, preferably between 5,300 mm^2 and 7,000 mm^2. The total surface area of the sole-insert outer surface can range between 4,300 mm^2 to 10,200 mm^2, preferably between 7,700 mm^2 and 9,900 mm^2, preferably between 4,300 mm^2 and 6,600 mm^2.

Preferably the total surface area of the sole-insert outer surface is greater than the total surface area of the sole-insert outer surface in the instance when at least a portion of the sole is formed of a composite material. A ratio of total surface area of the crown-insert outer surface formed of composite material to the total surface area of the sole-insert outer surface formed of composite material may be at least 2:1 in some examples, in other instance the ratio may be between 0.95 and 1.5, more preferably between 1.03 and 1.4, even more preferably between 1.05 and 1.3. In this instance a composite material will generally have a density between about 1 g/cc and about 2 g/cc, and preferably between about 1.3 g/cc and about 1.7 g/cc.

In some embodiments, the total exposed composite surface area in square centimeters multiplied by the CGy in centimeters and the resultant divided by the volume in cubic centimeters may range from 1.22 to 2.1, preferably between 1.24 and 1.65, even more preferably between 1.49 and 2.1, and even more preferably 1.7 and 2.1.

Moreover, the total mass of the crown insert 108 is less than a total mass of the sole insert 110 in some examples. According to some examples, where the crown insert 108 and the sole insert 110 are made of a fiber-reinforced polymeric material and the body 102 is made of a metallic material, a ratio of a total exposed surface area of the body 102 to a total exposed surface area (e.g., the surface area of the outward-facing surfaces) of the crown insert 108 and the sole insert 110 is between 0.95 and 1.25 (e.g., 1.08). The crown insert 108, whether a single piece or split into multiple pieces, has a mass of 9 grams and the sole insert 110, whether a single piece or split into multiple pieces, has a mass of 13 grams, in some examples. Moreover, in certain examples, the crown insert 108 is about 0.65 mm thick and the sole insert 110 is about 1.0 mm thick. However, in certain examples, the minimum thickness of the crown portion 119 is less than 0.6 mm. According to some examples, an areal weight of the crown portion 119 of the golf club head 100 is less than 0.35 $g/cm^2$ over more than 50% of an entire surface area of the crown portion 119 and/or at least part of the crown portion 119 is formed of a non-metal material with a density between about 1 $g/cm^3$ to about 2 $g/cm^3$. These and other properties of the crown insert 108 and the sole insert 110 can be found in U.S. Patent Application Publication No. 2020/0121994, published Apr. 23, 2020, which is incorporated herein by reference in its entirety. In certain examples, an areal weight of the sole portion 117 is less than about 0.35 $g/cm^2$ over more than about 50% of an entire surface area of the sole portion 117. In certain examples, an areal weight of the crown insert 108 is less than an areal weight of the sole insert 110. At least 50% of the crown portion 119 has a variable thickness that changes at least 25% along at least 50% of the crown portion 119, in certain examples.

The cast cup 104 of the body 102 also includes the hosel 120, which defines the hosel axis 191 extending coaxially through a bore 193 of the hosel 120 (see, e.g., FIG. 14). The hosel 120 is configured to be attached to a shaft of a golf club. In some examples, the hosel 120 facilitates the inclusion of a flight control technology (FCT) system 123 between the hosel 120 and the shaft to control the positioning of the golf club head 100 relative to the shaft.

The FCT system 123 may include a fastener 125 that is accessible through a lower opening 195 formed in a sole region of the cast cup 104. An additional example of the FCT system 123 is shown in association with the golf club head 400 of FIGS. 19 and 20, which has a hosel 420 and a lower opening 495 to facilitate attachment of the FCT system 123 to the body 102. The FCT system 123 includes multiple movable parts that fit within the and extend from the hosel 120. The fastener 125 facilitates adjustability of the FCT system 123 system by loosening the fastener 125 and maintaining an adjustable position of the golf club head relative to the shaft by tightening the fastener 125. The lower opening 195 is open to the bore 193 of the hosel 120. To promote an increase in discretionary mass, an internal portion 127 of the hosel 120 (i.e., a portion of the hosel 120 that is within the interior cavity 113) includes a lateral opening 189 that is open to the interior cavity 113. Because of the lateral opening 189, the internal portion 127 of the hosel 120 only partially surrounds FCT components extending through the bore 193 of the hosel 120. In some examples a height of the lateral opening 189, in a direction parallel to the hosel axis 191, is between 10 mm and 15 mm, a width of the lateral opening 189, in a direction perpendicular to the hosel axis 191, is at least 1 radian, and/or a projected area of the lateral opening 189 is at least 75 $mm^2$.

Referring to FIG. 15, in some examples, the cast cup 104 includes the strike face 145. In other words, in some examples, the strike face 145 is co-formed (e.g., co-cast) with all other portions of the cast cup 104. Accordingly, in these examples, the strike face 145 is made of the same material as the rest of the cast cup 104. However, in other examples, similar to those associated with the golf club heads of FIGS. 17 and 18, the strike face 145 is defined by a strike plate that is formed separate from the cast cup 104 and separately attached to the cast cup 104. According to certain examples, the portion of the golf club head 100 defining the strike face 145 or the strike plate defining the strike face 145 includes variable thickness features similar to those described in more detail in U.S. patent application Ser. No. 12/006,060; and U.S. Pat. Nos. 6,997,820; 6,800,038; and 6,824,475, which are incorporated herein by reference in their entirety.

Figure 21:
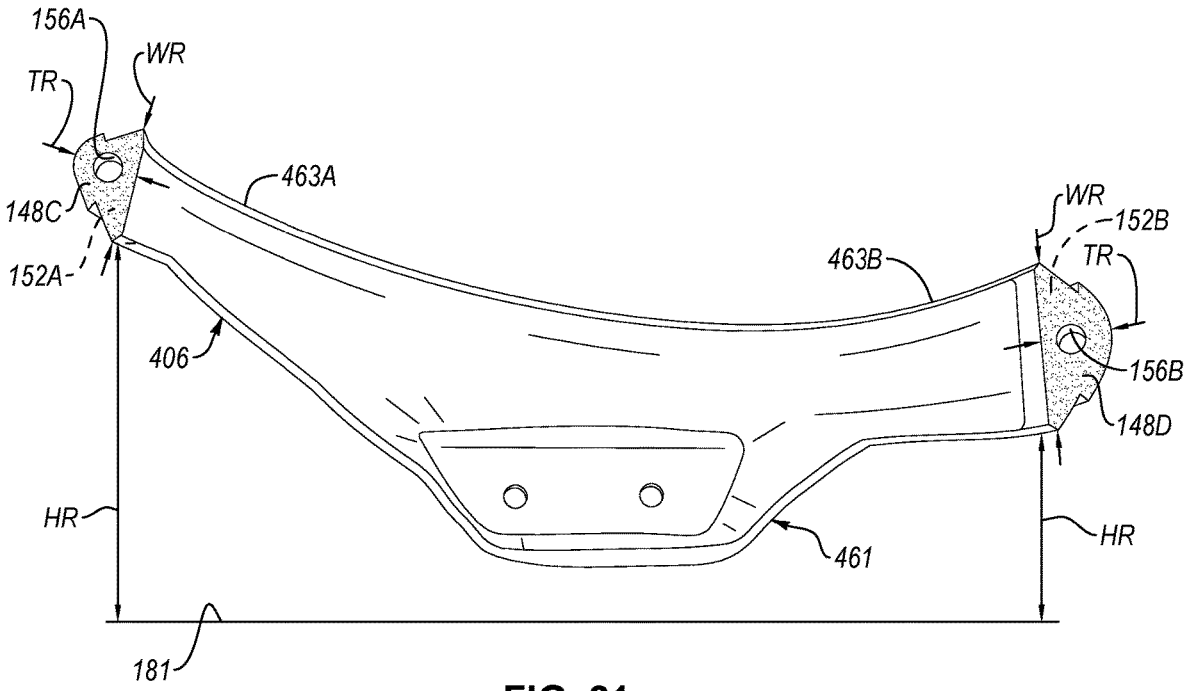
FIG. 21 is a schematic, front elevation view of a ring of the golf club head of FIG. 19, according to one or more examples of the present disclosure.
Figure 22:
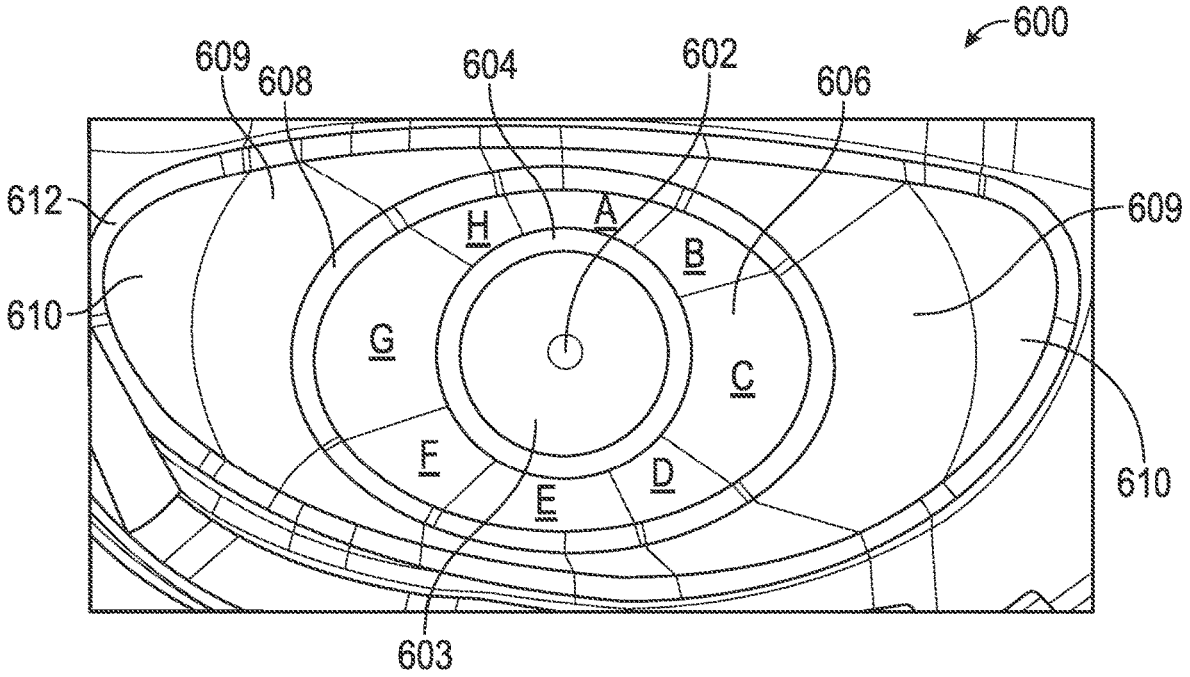
FIG. 22 is a schematic, rear view of a face portion of a golf club head, according to one or more examples of the present disclosure.
Figure 23:
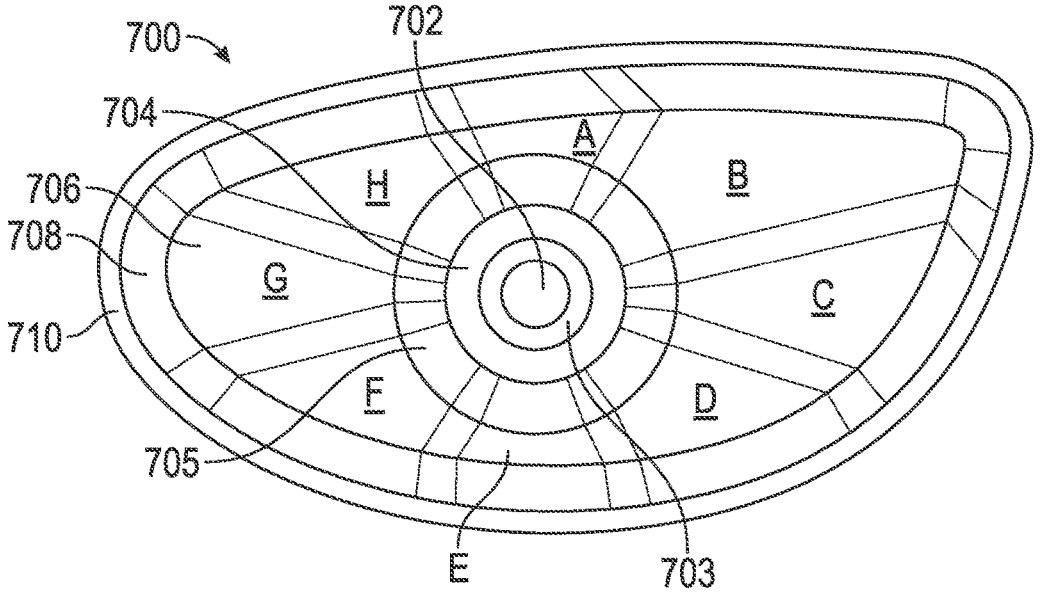
FIG. 23 is a schematic, rear view of a face portion of a golf club head, according to one or more examples of the present disclosure.
Figure 24:
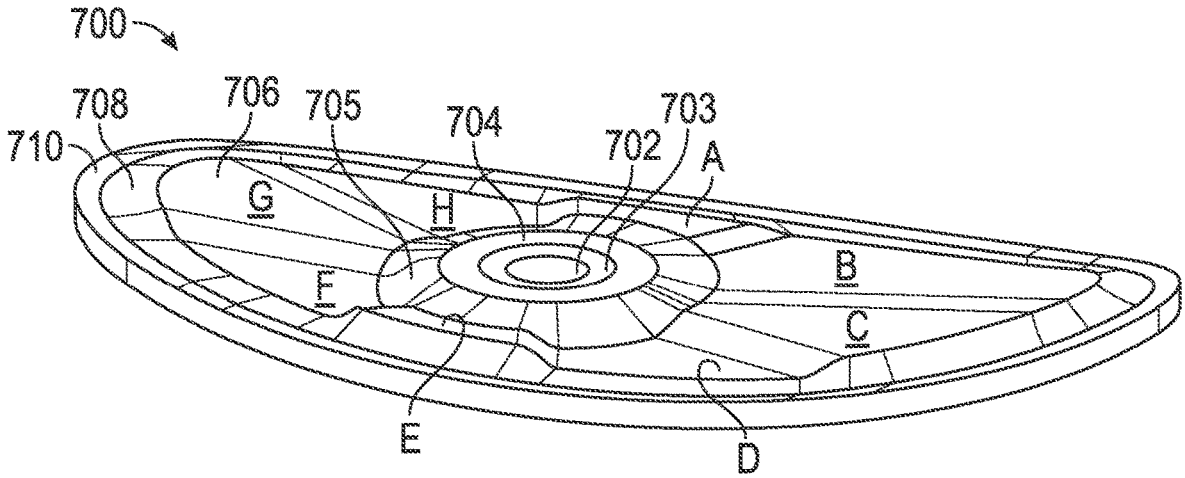
FIG. 24 is a schematic, perspective view of the face portion of FIG. 56, according to one or more examples of the present disclosure.

FIG. 21 illustrates an exemplary rear surface of a face portion 600 of one or more of the golf club heads disclosed herein. In FIG. 21, the rear surface is viewed from the rear with the hosel/heel to the left and the toe to the right. FIGS. 22 and 23 illustrate another exemplary face portion 700 having a variable thickness profile, and FIG. 24 illustrates yet another exemplary face portion 800 having a variable thickness profile. The variable thickness profile of the face portion 700 is formed by a cone-shaped projection, which can have a geometric center that is toeward of a geometric center of the strike face in some examples. The face portions disclosed herein can be formed as a result of a casting process and optional post-casting modifications to the face portions. Accordingly, the face portion can have a great variety of novel thickness profiles. For example, in one examples, a thickness of the forward portion, at the strike face, changes at least 25% along the strike face. By casting the face into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a traditional process, the face plate is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost.

Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 22-25 are made possible using casting methods, such as those disclosed in U.S. Pat. No. 10,874,915 issued Dec. 29, 2020, which is incorporated by reference in its entirety, and were previously not possible to achieve using conventional processes, such as starting from a sheet of metal having a uniform thickness, mounting the sheet in a lathe or similar machine and turning the sheet to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using casting methods, large numbers of the disclosed club heads can be manufacture faster and more efficiently. For example, 50 or more heads can be cast at the same time on a single casting tree, whereas it would take much longer and require more resources to create the novel face thickness profiles on face plates using a conventional milling methods using a lathe, one at a time.

In FIG. 22, the rear face surface or interior surface of the face portion 600 includes a non-symmetrical variable thickness profile, illustrating just one example of the wide variety of variable thickness profiles made possible using the disclosed casting methods. The center 602 of the face can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across an variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion)

and/or to a radial perimeter zone 612 defining the extent of the face portion 600 where the face transitions to the rest of the golf club head 100.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 22, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the face portion 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610.

According to one example, the ring 604 can be about 8 mm away from the center 602 and the ring 608 can be about 19 mm away from the center 602. The thickness of the face portion 600 at the center 602 can be between 2.8 mm and 3.0 mm. The thickness of the face portion 600 along the ring 604 can be between 2.9 mm and 3.1 mm. The thickness of the face portion 600 along the ring 608 proximate zone A can be between 2.35 mm and 2.55 mm, proximate zone C can be between 2.3 mm and 2.5 mm, proximate zone E can be between 2.1 mm and 2.3 mm, and proximate zone G can be between 2.6 mm and 2.8 mm. The thickness of the face portion 600 at approximately 35 mm away from the center 602 can be between 1.7 mm and 1.9 mm.

According to yet another example, the thickness of the face portion 600 at the center 602 is between 2.95 mm and 3.35 mm, at about 9 mm away from the center 602 is between 3.3 mm and 3.65 mm, at about 16 mm away from the center 602 is between 2.95 mm and 3.36 mm, and at about 28 mm away from the center 602 is between 2.03 mm and 2.27 mm. The thickness of the face portion 600 greater than 28 mm away from the center 602 can be between 1.8 mm and 1.95 mm on a toe side of the face portion 600 and between 1.83 mm and 1.98 mm on a heel side of the face portion 600.

FIGS. 23 and 24 show the rear face surface of another exemplary face portion 700 that includes a non-symmetrical variable thickness profile. The center 702 of the face can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across a variable blend zone 705 to an outer zone 706 comprised of a plurality of wedge shaped sectors A-H having varying thicknesses. As best shown in FIG. 24, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the face portion 700 can have the following thicknesses: 3.9 mm at center 702, 4.05 mm at ring 704, 3.6 mm in zone A, 3.2 mm in zone B, 3.25 mm in zone C, 2.05 mm in zone D, 3.35 mm in zone E, 2.05 mm in zone F, 3.00 mm in zone G, 2.65 mm in zone H, and 1.9 mm at perimeter ring 710.

Figure 25:
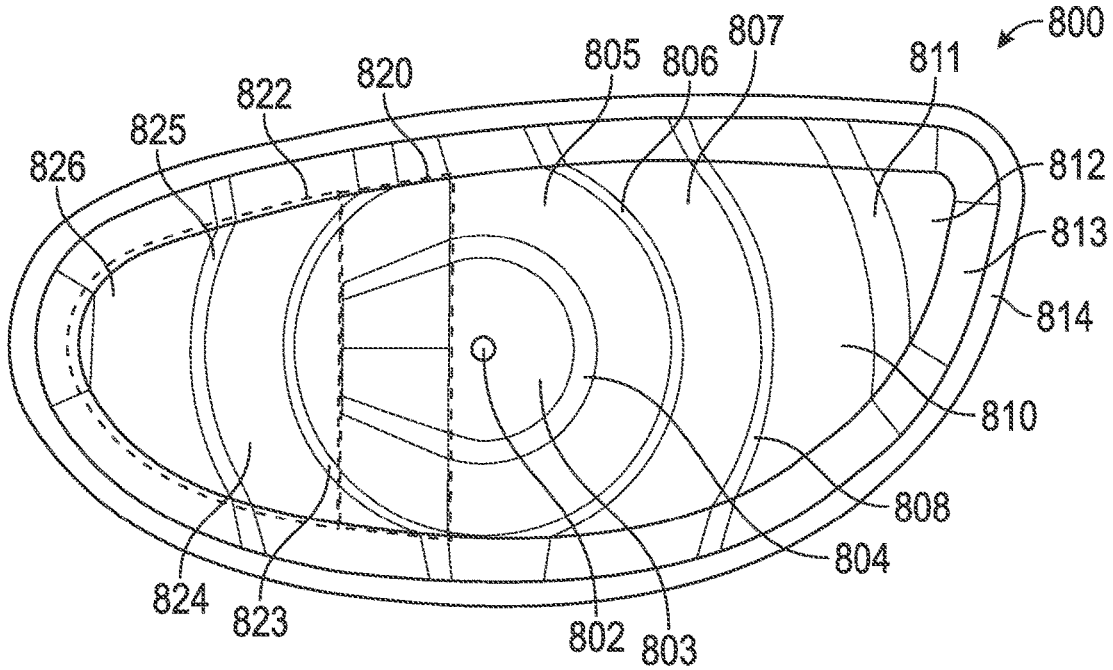
FIG. 25 is a schematic, rear view of a face portion of a golf club head, according to one or more examples of the present disclosure.

FIG. 25 shows the rear face of another exemplary face portion 800 that includes a non-symmetrical variable thickness profile having a targeted thickness offset toward the heel side (left side). The center 802 of the face has a center thickness, and to the toe/top/bottom the thickness gradually increases across an inner blend zone 803 to inner ring 804 having a greater thickness than at the center 802. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the face portion 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the perimeter ring 814.

The targeted offset thickness profile shown in FIG. 25 can help provide a desirable CT profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other embodiments, an offset thickness profile can be applied to the upper side of the face and/or toward the bottom side of the face.

As shown in FIGS. 2, 4, 8, 9A, and 13, in some examples, the cast cup 104 further includes a slot 171 located in the sole portion 117 of the golf club head 100. The slot 171 is open to an exterior of the golf club head 100 and extends lengthwise from the heel portion 116 to the toe portion 114. More specifically, the slot 171 is elongate in a lengthwise direction substantially parallel to, but offset from, the strike face 145. Generally, the slot 171 is a groove or channel formed in the cast cup 104 at the sole portion 117 of the golf club head 100. In some implementations, the slot 171 is a through-slot, or a slot that is open to the interior cavity 113 from outside of the golf club head 100. However, in other implementations, the slot 171 is not a through-slot, but rather is closed on an interior cavity side or interior side of the slot 171. For example, the slot 171 can be defined by a portion of the side wall of the sole portion 117 of the body 102 that protrudes into the interior cavity 113 and has a concave exterior surface having any of various cross-sectional shapes, such as a substantially U-shape, V-shape, and the like.

In some examples, the slot 171 is offset from the strike face 145 by an offset distance, which is the minimum distance between a first vertical plane passing through a center of the strike face 145 and the slot at the same x-axis coordinate as the center of the strike face 145, between about 5 mm and about 50 mm, such as between about 5 mm and about 35 mm, such as between about 5 mm and about 30 mm, such as between about 5 mm and about 20 mm, or such as between about 5 mm and about 15 mm.

Although not shown, the cast cup 104 and/or the ring 106 may include a rearward slot, with a configuration similar to the slot 171, but oriented in a forward-to-rearward direction, as opposed to a heel-to-toe direction. The cast cup 104 includes a rearward slot, but no slot 171 in some examples, and both a rearward slot and the slot 171 in other examples. In one example, the rearward slot is positioned rearwardly of the slot 171. The rearward slot can act as a weight track in some implementations. Moreover, the rearward track can be offset from the strike face 145 by an offset distance, which is the minimum distance between a first vertical plane passing through the center of the strike face 145 and the rearward track at the same x-axis coordinate as the center of the strike face 145, between about 5 mm and about 50 mm, such as between about 5 mm and about 40 mm, such as between about 5 mm and about 30 mm, or such as between about 10 mm and about 30 mm.

In certain embodiments, the slot 171, as well as the rearward slot if present, has a certain slot width, which is measured as a horizontal distance between a first slot wall and a second slot wall. For the slot 171, as well as the rearward slot, the slot width may be between about 5 mm and about 20 mm, such as between about 10 mm and about 18 mm, or such as between about 12 mm and about 16 mm. According to some embodiments, a depth of the slot 171 (i.e., the vertical distance between a bottom slot wall and an imaginary plane containing the regions of the sole portion 117 adjacent opposing slot walls of the slot 171) may be between about 6 mm and about 20 mm, such as between about 8 mm and about 18 mm, or such as between about 10 mm and about 16 mm.

Additionally, the slot 171, as well as the rearward slot if present, has a certain slot length, which can be measured as the horizontal distance between a slot end wall and another slot end wall. For both the slot 171 and rearward slot, their lengths may be between about 30 mm and about 120 mm, such as between about 50 mm and about 100 mm, or such as between about 60 mm and about 90 mm. Additionally, or alternatively, the length of the slot 171 may be represented as a percentage of a total length of the strike face 145. For example, the slot 171 may be between about 30% and about 100% of the length of the strike face 145, such as between about 50% and about 90%, or such as between about 60% and about 80% mm of the length of the strike face 145.

In some examples, the slot 171 is a feature to improve and/or increase the coefficient of restitution (COR) across the strike face 145. With regards to a COR feature, the slot 171 may take on various forms such as a channel or through slot. The COR of the golf club head 100 is a measurement of the energy loss or retention between the golf club head 100 and a golf ball when the golf ball is struck by the golf club head 100. Desirably, the COR of the golf club head 100 is high to promote the efficient transfer of energy from the golf club head 100 to the ball during impact with the ball. Accordingly, the COR feature of the golf club head 100 promotes an increase in the COR of the golf club head 100. Generally, the slot 171 increases the COR of the golf club head 100 by increasing or enhancing the pelipeter flexibility of the strike face 145. In some examples of the golf club heads disclosed herein, the COR is at least 0.8 for at least 25% of the strike face within the central region, as defined below.

Further details concerning the slot 171 as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

The slot 171 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100. The slot 171 may be made up of curved sections, or several segments that may be a combination of curved and straight segments. Furthermore, the slot 171 may be machined or cast into the golf club head 100. Although shown in the sole portion 117 of the golf club head 100, the slot 171 may, alternatively or additionally, be incorporated into the crown portion 119 of the golf club head 100.

In some examples, the slot 171 is filled with a filler material. However, in other examples, the slot 171 is not filled with a filler material, but rather maintains an open, vacant, space within the slot 171. The filler material can be made from a non-metal, such as a thermoplastic material, thermoset material, and the like, in some implementations. The slot 171 may be filled with a material to prevent dirt and other debris from entering the slot and possibly the interior cavity 113 of the golf club head 100 when the slot 171 is a through-slot. The filler material may be any relatively low modulus materials including polyurethane, elastomeric rubber, polymer, various rubbers, foams, and fillers. The filler material should not substantially prevent deformation of the golf club head 100 when in use as this would counteract the flexibility of the golf club head 100.

According to one embodiment, the filler material is initially a viscous material that is injected or otherwise inserted into the slot 171. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Referring to FIGS. 4, 8, 9A, and 14, in some examples, the golf club head 100 further includes a weight 173 attached to the cast cup 104. The cast cup 104 includes a threaded port 175 that receives and retains the weight 173. The threaded port 175 is open to an exterior and the interior cavity 113 of the golf club head 100 and includes internal threads in certain examples. In other examples, the threaded port 175 is closed to the interior cavity 113. The weight 173 includes external threads that threadably engage with the internal threads of the threaded port 175 to retain the weight 173 within the threaded port 175. When the threaded port 175 is open to the interior cavity 113, the weight 173 effectually closes the threaded port 175 to prevent access to the interior cavity 113 when threadably attached to the cast cup 104 within the threaded port 175. As shown, when the threaded port 175 is open to the interior cavity 113, a portion of the weight 173 is located external to the interior cavity 113 and another portion is located within the interior cavity 113. In contrast, in other examples, such as when the threaded port 175 is closed to the interior cavity 113, an entirety of the weight 173 is located external to the interior cavity 113. Although not shown, in one example, the threaded port 175 can be open to the interior cavity 113 and closed to an exterior of the golf club head 100 (e.g., the threaded port 175 faces inwardly as opposed to outwardly). In such an example, the entirety of the weight 173 would be located internally within the interior cavity 113. As defined herein, when any portion of the weight 173 is internal relative to or within the interior cavity 113, the weight 173 is considered internal to the interior cavity 113 and when any portion of the weight 173 is external relative to the interior cavity 113, the weight 173 is alternatively, or also, considered external to the interior cavity 113.

In some examples, as shown, the threaded port 175, and thus the weight 173, is located in the sole portion 117 of the golf club head 100. Moreover, according to certain examples, the threaded port 175 and the weight 173 are located closer to the heel portion 116 than the toe portion 114. In one example, the threaded port 175 and the weight are located closer to the heel portion 116 than the slot 171. The weight 173 has a mass between about 3 g and about 23 g (e.g., 6 g) in some examples.

Referring to FIGS. 9A, 11, and 14, the cast cup 104 further comprises a mass pad 186 attached to or co-formed with the rest of the cast cup 104. The mass pad 186 has a thickness greater than any other portion of the cast cup 104. In the illustrated example, the mass pad 186 is located proximate the sole portion 117 of the golf club head 100, and thus a sole region of the cast cup 104. Additionally, in certain examples, a portion of the mass pad 186 is located proximate the heel portion 116 of the golf club head 100, and thus a heel region of the cast cup 104. As defined herein, when located at the sole portion 117 of the golf club head 100, the mass pad 186 is considered a sole mass pad, and when located at the heel portion 116 of the golf club head 100, the mass pad 186 is considered a heel mass pad. It is recognized that when the mass pad 186 is located at both the sole portion 117 and the heel portion 116, the mass pad 186 is considered to be a sole mass pad and a heel mass pad.

Referring to FIGS. 11 and 14, in some examples, the cast cup 104 further includes internal ribs 187 co-formed with other portions of the cast cup 104. The internal ribs 187 can be in any of various locations within the cast cup 104. In the illustrated example, the internal ribs 187 are located (e.g., formed in) a sole region of the cast cup 104 closer to a toe region of the cast cup 104 than a heel region of the cast cup 104. The internal ribs 187 help to stiffen and promote desirable acoustic properties of the golf club head 100.

Referring to FIGS. 11, 14, and 15, the ring 106 includes a cantilevered portion 161, and a toe arm portion 163A and a heel arm portion 163B extending from the cantilevered portion 161. The toe arm portion 163A and the heel arm portion 163B are on opposite sides of the golf club head 100, initiate at the cantilevered portion 161, and terminate at a corresponding one of the toe cup-engagement surface 152A and the heel cup-engagement surface 152B. The cantilevered portion 161 defines at least part of the rearward portion 118 of the golf club head 100 and further defines a rearmost end of the golf club head 100. Moreover, in the illustrated examples, the cantilevered portion 161 extends from the crown portion 119 to the sole portion 117. Accordingly, the cantilevered portion 161 defines part of the sole portion 117 of the golf club head 100 in some examples, such as defining an outwardly-facing surface of the sole portion 117 of the golf club head 100.

In some examples, the cantilevered portion 161 is close to the ground plane 181 when the golf club head 100 is in the address position. According to certain examples, a ratio of the peak crown height to a vertical distance from the peak crown height to a lowest surface of the cantilevered portion 161 of the ring 106 is at least 6.0, at least 5.0, at least 4.0, or more preferably at least 3.0. Alternatively, or additionally, in some examples, a vertical distance from the peak skirt height of the skirt portion to a lowermost surface of the cantilevered portion 161 of the ring 106, when the golf club head 100 is in the address position, is no less than between 20 mm and 30 mm.

The toe arm portion 163A and the heel arm portion 163B define a toe side of the skirt portion 121 and a heel side of the skirt portion 121, respectively, as well as part of the toe portion 114 and heel portion 116, respectively, of the golf club head 100. The cantilevered portion 161 extends downwardly away from the toe arm portion 163A and the heel arm portion 163B, while the toe arm portion 163A and the heel arm portion 163B extend forwardly away from the cantilevered portion 161. Accordingly, the cantilevered portion 161 is closer to the ground plane 181 than the toe arm portion 163A and the heel arm portion 163B when the golf club head 100 is in the address position. In other words, referring to FIGS. 3, 4, and 9A, a height (HR) of the lowest surface of the ring 106 above the ground plane 181, in a vertical direction when the golf club head 100 is in the address position, at any location along the cantilevered portion 161 is less than at any location along the toe arm portion 163A and the heel arm portion 163B.

In some examples, the height HR of the lowest surface of the toe arm portion 163A at the toe portion 114 of the golf club head 100 is different than the height HR of the lowest surface of the heel arm portion 163B at the heel portion 116 of the golf club head 100. More specifically, in one example, the height HR of the lowest surface of the toe arm portion 163A at the toe portion 114 of the golf club head 100 is greater than the height HR of the lowest surface of the heel arm portion 163B at the heel portion 116 of the golf club head 100.

According to certain examples, as shown in FIGS. 3, 4, and 9A, a width (WR) of the of the ring 106, as measured in a vertical direction when the golf club head 100 is in the address position, varies in a forward-to-rearward direction (e.g., along a length of the ring 106). In one example, the width WR increases from a minimum width to a maximum width in the forward-to-rearward direction. In other words, the width WR of the ring 106 varies in the forward-to-rearward direction in certain examples. In some examples, the maximum width WR of the ring 106 is at the rearmost end of the golf club head 100. In one example, the maximum width WR of the ring 106 is as least 20 mm. According to certain examples, as shown in FIG. 14, the width WR of the ring 106 at the toe portion 114 is less than the width WR of the ring 106 at the heel portion 116. According to some additional examples, a thickness of the ring 106 can vary along the ring 106 in a forward-to-rearward direction.

Referring to FIGS. 2-4, 6, 8, 9A, and 11-15, in some examples, the golf club head 100 further includes a mass element 159 attached to the cantilevered portion 161 of the ring 106, such as at a rearmost end of the golf club head 100. The mass element 159 can be selectively removable from (e.g., interchangeable with differently weighted mass elements) or permanently attached to the cantilevered portion 161. According to one example, the mass element 159 and the weight 173 are interchangeably coupleable to the cast cup 104 and the cantilevered portion 161 of the ring 106. Accordingly, in some examples, the flight control technology component of the golf club head 100, the mass element 159, and the weight 173 are adjustable relative to the golf club head 100. In certain examples, the flight control technology component of the golf club head 100, the mass element 159, and the weight 173 are configured to be adjustable via a single or the same tool.

In one example, the mass element 159 includes external threads. The golf club head 100 can additionally include a mass receptacle 157 attached to the cantilevered portion 161 of the ring 106. The mass receptacle 157 can include a threaded aperture, with internal threads, that threadably engages the mass element 159 to secure the mass element 159 to the cantilevered portion 161. The mass receptacle 157 is welded to the cantilevered portion 161 in some examples and adhered to the cantilevered portion 161 in other examples. In certain examples, the mass receptacle 157 is co-formed with the cantilevered portion 161. The cantilevered portion 161 also includes a mass pad 155 (see, e.g., FIGS. 9A, 12, and 15) or a portion of the cantilevered portion 161 with a localized increase in thickness and thus mass. The mass receptacle 157 can be formed in the mass pad 155 of the cantilevered portion 161. The mass element 159 has a mass between about 15 g and about 35 g (e.g., 24 g) in some examples.

Figure 16:
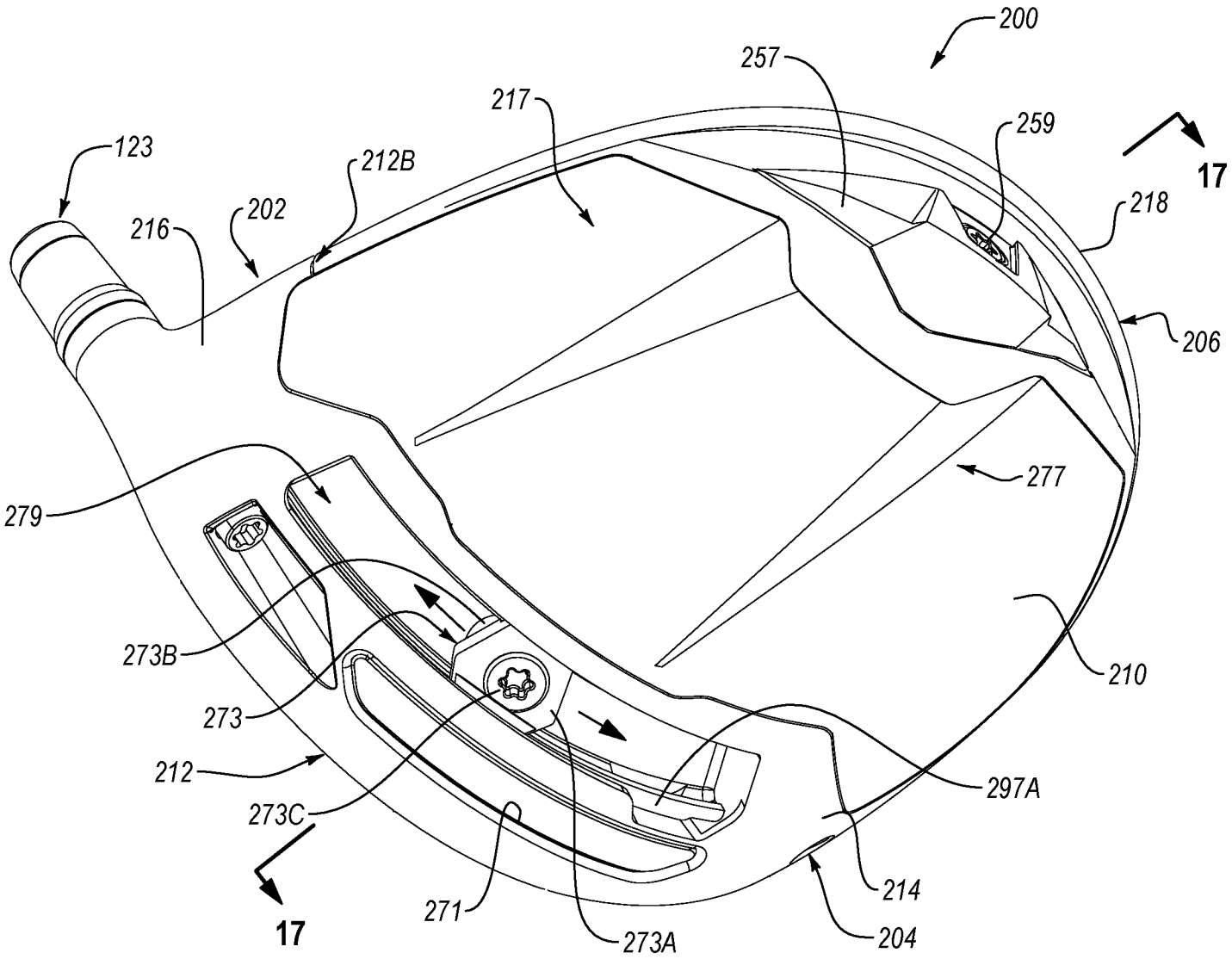
FIG. 16 is a schematic, perspective view of another golf club head, according to one or more examples of the present disclosure.

The outer peripheral shape of one or both of the mass element 159 and the weight 173 in the illustrated examples is circular. Accordingly, an orientation of one or both of the mass element 159 and the weight 173 is rotatable about a central axis of the mass element 159 and the weight 173, respectively, in any of various orientations between 0-degrees and 360-degrees. However, in other examples, the outer peripheral shape of at least one or both of the mass element 159 and the weight 173 is non-circular, such as ovular, triangular, trapezoidal, square, and the like. For example, as shown in FIG. 16, the weight 273 has an outer peripheral shape that is trapezoidal or rectangular. In certain examples, the mass element 159 and/or the weight 173, having a non-circular outer peripheral shape, is rotatable about the central axis of the mass element 159 and the weight 173, respectively, in any of various orientations between 0-degrees and at least 90-degrees in certain implementations and 0-degrees and at least 180-degrees in other implementations.

The construction and material diversity of the golf club head 100 enables flexibility of the position of the weight 173 (e.g., first weight or forward weight) relative to the position of the mass element 159 (e.g., second weight or rearward weight). In some examples, the relative positions of the weight 173 and the mass element 159 can be similar to those disclosed in U.S. patent application Ser. No. 16/752,397, filed Jan. 24, 2020. Referring to FIG. 9A, according to one example, a z-axis coordinate of the CG of the first weight (FWCG), on the z-axis of the head origin coordinate system 185, is between −30 mm and −10 mm (e.g., −21 mm), a y-axis coordinate of the CG of the first weight (FWCG), on the y-axis of the head origin coordinate system 185 is between 10 mm and 30 mm (e.g., 23 mm), and an x-axis coordinate of the CG of the first weight (FWCG), on the x-axis of the head origin coordinate system 185 is between 15 mm and 35 mm (e.g., 22 mm). According to the same, or a different, example, a z-axis coordinate of the CG of the second weight (SWCG), on the z-axis of the head origin coordinate system 185, is between −30 mm and 10 mm (e.g., −11 mm), a y-axis coordinate of the CG of the second weight (SWCG), on the y-axis of the head origin coordinate system 185 is between 90 mm and 120 mm (e.g., 110 mm), and an x-axis coordinate of the CG of the second weight (SWCG), on the x-axis of the head origin coordinate system 185 is between −20 mm and 10 mm (e.g., −7 mm).

In certain examples, the sole portion 117 of the golf club head 100 includes an inertia generating feature 177 that is elongated in a lengthwise direction. The lengthwise direction is perpendicular or oblique to the strike face 145. According to some examples, the inertia generating feature 177 includes the same features and provides the same advantages as the inertia generator disclosed in U.S. patent application Ser. No. 16/660,561, filed Oct. 22, 2019, which is incorporated herein by reference in its entirety. In the illustrated examples, the sole insert 110 forms at least a portion of the inertia generating feature 177. More specifically, in some examples, the sole insert 110 forms all or a majority of the inertia generating feature 177. The cantilevered portion 161 of the ring 106 also forms part, such as a rearmost part, of the inertia generating feature 177 in certain examples. The inertia generating feature 177 helps to increase the inertia of the golf club head 100 and lower the center-of-gravity (CG) of the golf club head 100.

The inertia generating feature 177 includes a raised or elevate platform that extends from a location rearwardly of the hosel 120 to a location proximate the rearward portion 118 of the golf club head 100. The inertia generating feature 177 includes a substantially flat or planar surface that is raised above (or protrudes from, depending on the orientation of the golf club head 100) the surrounding external surface of the sole portion 117. In certain examples, at least a portion of the inertia generating feature 177 is raised above the surrounding external surface of the sole portion 117 by at least 1.5 mm, at least 1.8 mm, at least 2.1 mm, or at least 3.0 mm. The inertia generating feature 177 also has a width that is less than an entire width (e.g., less than half the entire width) of the sole portion 117. In view of the foregoing, the inertia generating feature 177 has a complex curved geometry with multiple inflection points. Accordingly, the sole insert 110, which defines the inertia generating feature 177, has a complex curved surface that has multiple inflection points.

Referring to FIGS. 1-3 and 5, in some examples, the golf club head 100 includes a through-aperture 172 in the body 102 at the toe portion 114. The through-aperture 172 extends entirely through the wall of the body 102 such that the interior cavity 113 is accessible through the aperture 172. The aperture 172 can be used to insert a stiffener into the interior cavity 113 against an interior surface of the forward portion 112 to help set the CT of the strike face 145. Further details of the stiffener, the insertion process, and the effect of the stiffener on the CT of the strike face 145 can be found in U.S. Patent Application Publication No. 2019/0201754, published Jul. 4, 2019, which is incorporated herein by reference in its entirety. As shown, the through-aperture 172 is not located in the forward portion 112 (e.g., the strike face 145). Accordingly, in some examples, the strike face 145 is void of through-apertures open to the interior cavity 113 or the hollow interior region of the golf club head 100. Moreover, in some examples, no material having a shore D value greater than 10, greater than 5, or greater than 1 contacts an interior surface 166 of the forward portion 112, opposite the strike face 145 and open to the hollow interior region, at a location toeward and/or heelward of the geometric center of the strike face 145. In yet other examples, no material, regardless of hardness, contacts an interior surface 166 of the forward portion 112, opposite the strike face 145 and open to the hollow interior region.

The CT properties of the golf club heads disclosed herein can be defined as CT values within a central region of the strike face 145. The central region, is forty millimeter by twenty millimeter rectangular area centered on a center of the strike face and elongated in a heel-to-toe direction. The center of the strike face 145 can be a geometric center of the strike face 145 in some examples. Within the central region, the strike face 145 has a characteristic time (CT) of no more than 257 microseconds. In some examples, the CT of at least 60% of the strike face, within the central region, is at least 235 microseconds. According to some examples, the CT of at least 35% of the strike face, within the central region, is at least 240 microseconds.

The CT of the strike face 145, at the geometric center of the strike face, has an initial CT value. The initial CT value is the CT value of the strike face 145 before any impacts with a standard golf ball. As defined herein, an impact with the standard golf ball is an impact of the standard golf ball when the golf ball is traveling at a velocity of 52 meters per second. According to some examples, the initial CT value is at least 244 microseconds. In certain examples, the driver-type golf club heads disclosed herein, including the golf club head 100, are configured such that after 500 impacts of a standard golf ball at the geometric center of the strike face 145, the CT of the strike face at any point within the central region is less than 256 microseconds and the CT at the geometric center of the strike face is no more than five microseconds different than (e.g., greater than) the initial CT value.

In certain examples, the driver-type golf club heads disclosed herein, including the golf club head 100, are configured such that after 1,000, 1,500, 2,000, 2,500, or 3,000 impacts of the standard golf ball at the geometric center of the strike face, the CT of the strike face at any point within the central region is less than 256 microseconds. According to some examples, after 2,000 impacts of the standard golf ball at the geometric center of the strike face, the CT of the strike face 145 at any point within the central region is no more than seven microseconds or nine microseconds different that the initial CT value. Moreover, in certain examples, after 2,000 impacts of the standard golf ball at the geometric center of the strike face, the CT of the strike face 145 at the geometric center of the strike face is no less than 249 microseconds and no more than ten microseconds different than the initial CT value. According to some examples, after 3,000 impacts of the standard golf ball at the geometric center of the strike face, the CT of the strike face 145 at any point within the central region is no more than nine microseconds or thirteen microseconds different that the initial CT value. In certain examples, such as those where the strike face 145 is made of a metallic material, an inward face progression of the strike face 145 is less than 0.01 inches after 500 impacts of the standard golf ball at the geometric center of the strike face.

Figure 17:
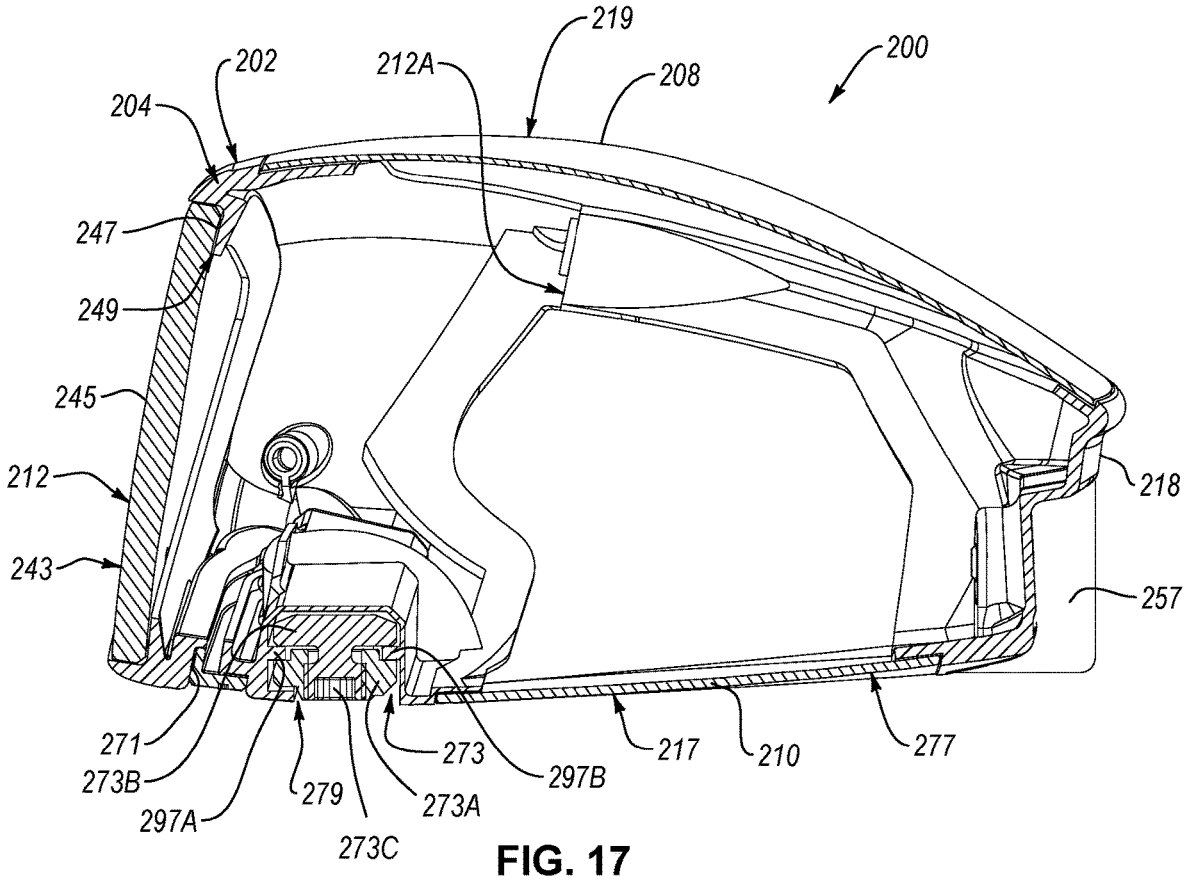
FIG. 17 is a schematic, cross-sectional, side elevation view of the golf club head of FIG. 16, taken along the line 16-16 of FIG. 16, according to one or more examples of the present disclosure.

Referring to FIGS. 16 and 17, and according to another example of a golf club head disclosed herein, a golf club head 200 is shown. The golf club head 200 includes features similar to the features of the golf club head 100, with like numbers (e.g., same numbers but in 200-series) referring to like features. For example, like the golf club head 100, the golf club head 200 includes a toe portion 214 and a heel portion 216, opposite the toe portion 214. Additionally, the golf club head 200 includes a forward portion 212 and a rearward portion 218, opposite the forward portion 212. The golf club head 200 additionally includes a sole portion 217, at a bottom region of the golf club head 200, and a crown portion 219, opposite the sole portion 217 and at a top region of the golf club head 200. Also, the golf club head 200 includes a skirt portion 221 that defines a transition region where the golf club head 200 transitions between the crown portion 219 and the sole portion 217. The golf club head 200 further includes an interior cavity 213 that is collectively defined and enclosed by the forward portion 212, the rearward portion 218, the crown portion 219, the sole portion 217, the heel portion 216, the toe portion 214, and the skirt portion 221. Additionally, the forward portion 212 includes a strike face 245 that extends along the forward portion 212 from the sole portion 217 to the crown portion 219, and from the toe portion 214 to the heel portion 216. Additionally, the golf club head 200 further includes a body 202, a crown insert 208 attached to the body 202 at a top of the golf club head 200, and a sole insert 210 attached to the body 202 at a bottom of the golf club head 200. The body 202 includes a cast cup 204 and a ring 206. The ring 206 is joined to the cast cup 204 at a toe-side joint 212A and a heel-side joint 212B. The cast cup 204 of the body 202 also includes a slot 271 in the sole portion 217 of the golf club head 200. Further, the golf club head 200 additionally includes a mass element 259 and a mass receptacle 257 attached to the ring 206 of the body 202, as well as a weight 273 attached to the cast cup 204. Accordingly, in view of the foregoing, the golf club head 200 shares some similarities with the golf club head 100.

Unlike the golf club head 100, however, the strike face 245 of the golf club head 200 is not co-formed with the cast cup 204. Rather, the strike face 245 forms part of a strike plate 243 that is formed separately from the cast cup 204 and attached to the cast cup 204, such as via bonding, welding, brazing, fastening, and the like. Accordingly, the strike plate 243 defines the strike face 245. The cast cup 204 includes a plate opening 249 at the forward portion 212 of the golf club head 200 and a plate-opening recessed ledge 247 that extends continuously about the plate opening 249. An inner periphery of the plate-opening recessed ledge 247 defines the plate opening 249. The strike plate 243 is attached to the cast cup 204 by fixing the strike plate 243 in seated engagement with the plate-opening recessed ledge 247. When joined to the plate-opening recessed ledge 247 in this manner, the strike plate 243 covers or encloses the plate opening 249. Moreover, the plate-opening recessed ledge 247 and the strike plate 243 are sized, shaped, and positioned relative to the crown portion 219 of the golf club head 200 such that the strike plate 243 abuts the crown portion 219 when seatably engaged with the plate-opening recessed ledge 247. The strike plate 243, abutting the crown portion 219, defines a topline of the golf club head 200. Moreover, in some examples, the visible appearance of the strike plate 243 contrasts enough with that of the crown portion 219 of the golf club head 200, which is partially defined by the cast cup 204, that the topline of the golf club head 200 is visibly enhanced. Because the strike plate 243 is formed separately from the cast cup 204, the strike plate 243 can be made of a material that is different than that of the cast cup 204. In one example, the strike plate 243 is made of a fiber-reinforced polymeric material. In yet another example, the strike plate 243 is made of a metallic material, such as a titanium alloy (e.g., Ti 6-4, Ti 9-1-1, and ZA 1300).

Additionally, unlike the golf club head 100, the cast cup 204 includes a weight track 279 in the sole portion 217 of the golf club head 200. The weight track 279 extends lengthwise in a heel-to-toe direction along the sole portion 217. In examples where the cast cup 204 also includes the slot 271, such as shown, the weight track 279 is substantially parallel to the slot 271 and offset from the slot 271 in a front-to-rear direction. The weight track 279 includes at least one ledge that extends lengthwise along the length of the weight track 279. In the illustrated example, the weight track 279 includes a forward ledge 297A and a rearward ledge 297B, which are spaced apart from each other in the front-to-rear direction. The weight 273, which positioned within the weight track 279, is selectively clampable to the ledge or ledges of the weight track 279 to releasably fix the weight 273 to the weight track 279. In the illustrated example, the weight 273 is selectively clampable to both the forward ledge 297A and the rearward ledge 297B. When unclamped to the one or more ledges of the weight track 279, the weight 273 is slidable along the one or more ledges, as shown by directional arrows in FIG. 16, to change a position of the weight 273 relative to the weight track 279 and, when re-clamped to the one or more ledges, adjust the mass distribution, center-of-gravity (CG), and other performance characteristics of the golf club head 200.

According to one example, the weight 273 includes a washer 273A, a nut 273B, and a fastening bolt 273C that interconnects with the washer 273A and the nut 273B to clamp down on the ledges 297A, 297B of the weight track 279. The washer 273A has a non-threaded aperture and the nut 273B has a threaded aperture. The fastening bolt 273C is threaded and passes through the non-threaded aperture of the washer 273A to threadably engage the threaded aperture of the nut 273B. Threadable engagement between the fastening bolt 273C and the nut 273B allows a gap between the washer 273A and the nut 273B to be narrowed, which facilitates the clamping of the ledge or ledges between the washer 273A and the nut 273B, or widened, which facilitates the un-clamping of the ledge or ledges from between the washer 273A and the nut 273B. The fastening bolt 273C can be rotatable relative to both the washer 273A and the nut 273B or form a one-piece monolithic construction and be co-rotatable with one of the washer 273A and the nut 273B.

To reduce the weight of the golf club head 200 and the depth of the weight track 279, the fastening bolt 273C is short. For example, the length of the fastening bolt 273C, when the weight 273 is clamped on the ledges 297A, 297B, extends no more than 3 mm past the nut 273B (or the washer 273A if the position of the nut 273B and the washer 273A are reversed). In some examples, the entire length of the fastening bolt 273C is no more than 15% greater than the combined thicknesses of the washer 273A, the nut 273B, and one of the ledges 297A, 297B.

As shown, an outer peripheral shape of the washer 273A is non-circular, such as trapezoidal or rectangular. Similarly, the outer peripheral shape of the nut 273B can be non-circular, such as trapezoidal or rectangular. Alternatively, as shown, the outer peripheral shape of the nut 273B is circular and the outer peripheral shape of the washer 273A is non-circular.

Figure 18:
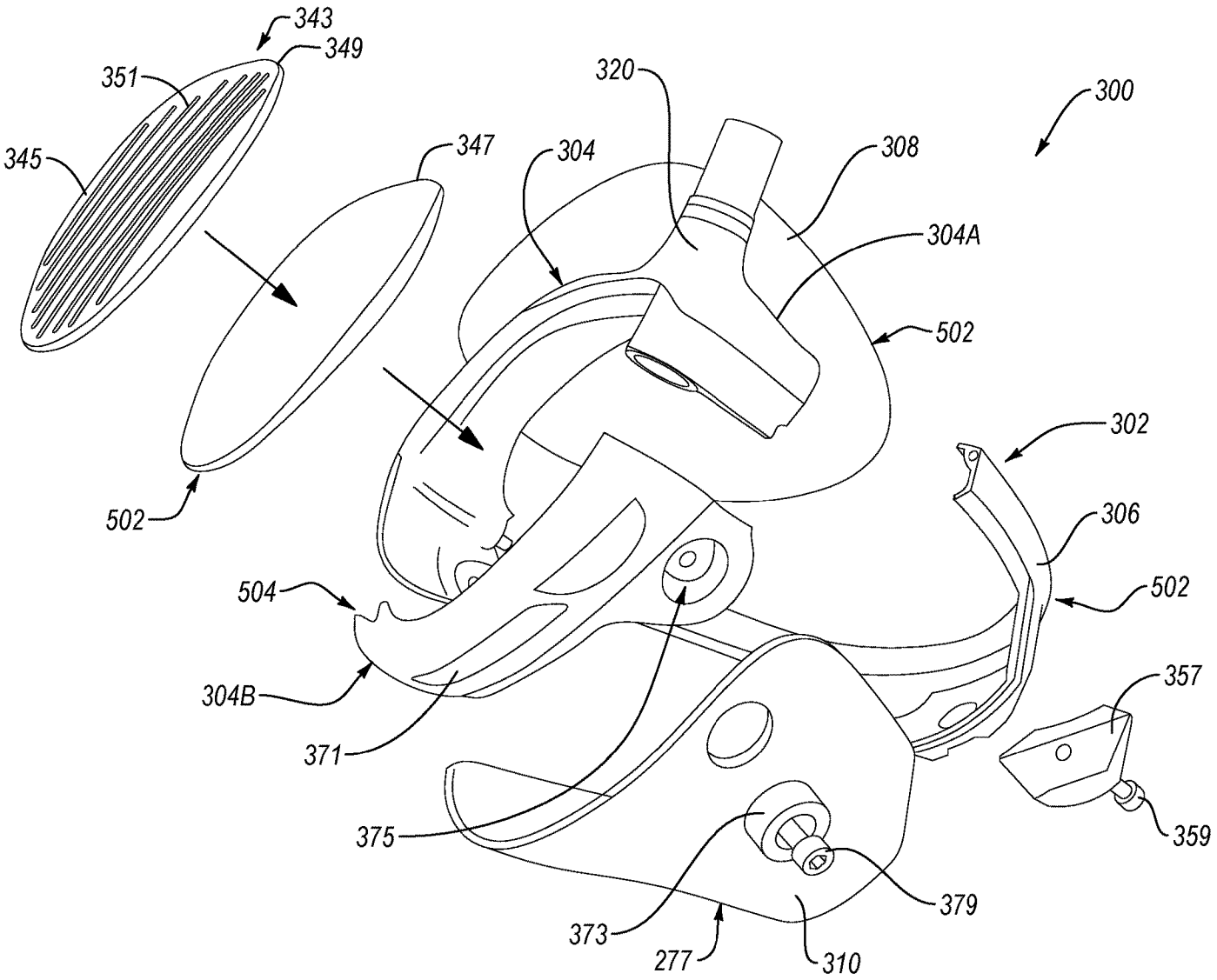
FIG. 18 is a schematic, exploded, perspective view of another golf club head, according to one or more examples of the present disclosure.

Referring to FIG. 18, and according to another example of a golf club head disclosed herein, a golf club head 300 is shown. The golf club head 300 includes features similar to the features of the golf club head 100 and the golf club head 200, with like numbers (e.g., same numbers but in 300-series) referring to like features. For example, like the golf club head 100 and the golf club head 200 includes a body 302, a crown insert 308 attached to the body 302 at a top of the golf club head 300, and a sole insert 310 attached to the body 302 at a bottom of the golf club head 300. The body 302 includes a cast cup 304 and a ring 306. The ring 306 is joined to the cast cup 304 at a toe-side joint and a heel-side joint. The cast cup 304 of the body 302 also includes a slot 371 in the sole portion of the golf club head 300. Further, the golf club head 300 additionally includes a mass element 359 and a mass receptacle 357 attached to the ring 306 of the body 302, as well as a weight 373 attached to the cast cup 304 via a fastener 379. Additionally, like the golf club head 200, the golf club head 300 includes a strike plate 343, defining a strike face 145, that is formed separate from and attached to the cast cup 304. The strike plate 343 is made of a fiber-reinforced polymer in some examples and includes a base portion 347 and a cover 349 applied onto the base portion 347. The base portion 347 is thicker compared to the cover 349, the base portion 347 is made of a fiber-reinforced polymer, and the cover 349 is made of a fiber-less polymer in some examples. The cover 349 is made of polyurethane in certain examples. Also, the cover 349 includes grooves 351 or scorelines formed in the fiber-less polymer. The surface roughness of the portion of the cover 349 that defines the strike face 345 is greater than the surface roughness of the body 302. Accordingly, in view of the foregoing, the golf club head 300 shares some similarities with the golf club head 100 and the golf club head 200.

Unlike the illustrated examples of the cast cup 104 of the golf club head 100 and the cast cup 204 of the golf club head 200, however, the cast cup 304 has a multi-piece construction. More specifically, the cast cup 304 includes an upper cup piece 304A and a lower cup piece 304B. The upper cup piece 304A is formed separately from the lower cup piece 304B. Accordingly, the upper cup piece 304A and the lower cup piece 304B are joined or attached together to form the cast cup 304. Because the upper cup piece 304A and the lower cup piece 304B are formed separately, the upper cup piece 304A can be made of a material that is different than that of the lower cup piece 304B. The cast cup 304 includes a hosel 320 where a portion of the hosel 320 is formed into the upper cup piece 304A and another portion of the hosel 320 is formed into the lower cup piece 304B.

According to some examples, the upper cup piece 304A is made of a material that is different than that of the lower cup piece 304B. For example, the upper cup piece 304A can be made of a material with a density that is lower than the material of the lower cup piece 304B. In one example, the upper cup piece 304A is made of a titanium alloy and the lower cup piece 304B is made of a steel alloy. According to another example, the upper cup piece 304A is made of an aluminum alloy and the lower cup piece 304B is made of a steel alloy or a tungsten alloy, such as 10-17 density tungsten. Such configurations help to increase the mass of the cast cup 304 and lower the center-of-gravity (CG) of the cast cup 304 and the golf club head 300 compared to the single-piece cast cup 104 of the golf club head 100. In alternative configurations, according to some examples, the upper cup piece 304A is made of an aluminum alloy and the lower cup piece 304B is made of a titanium alloy. These later configurations help to lower the overall mass of the cast cup 304. According to some examples, the upper cup piece 304A and the lower cup piece 304B are made using different manufacturing techniques. For example, the upper cup piece 304A can be made by stamping, forging, and/or metal-injection-molding (MIM) and the lower cup piece 304B can be made by another one or a different combination of stamping, forging, and/or metal-injection-molding (MIM). Various examples of combinations of materials and mass properties for the upper cup piece 304A and the lower cup piece 304B are shown in Table 2 below.

three-piece construction or constructed with more than three pieces. According to one instance, the cast cup 304 has a crown-toe piece, a crown-heel piece, and a sole piece. The crown-toe piece and the crown-heel piece are made of titanium alloys and the sole piece is made of a steel alloy in certain implementations. The titanium alloy of the crown-toe piece can be the same as or different than the titanium alloy of the crown-heel piece.

Figure 19:
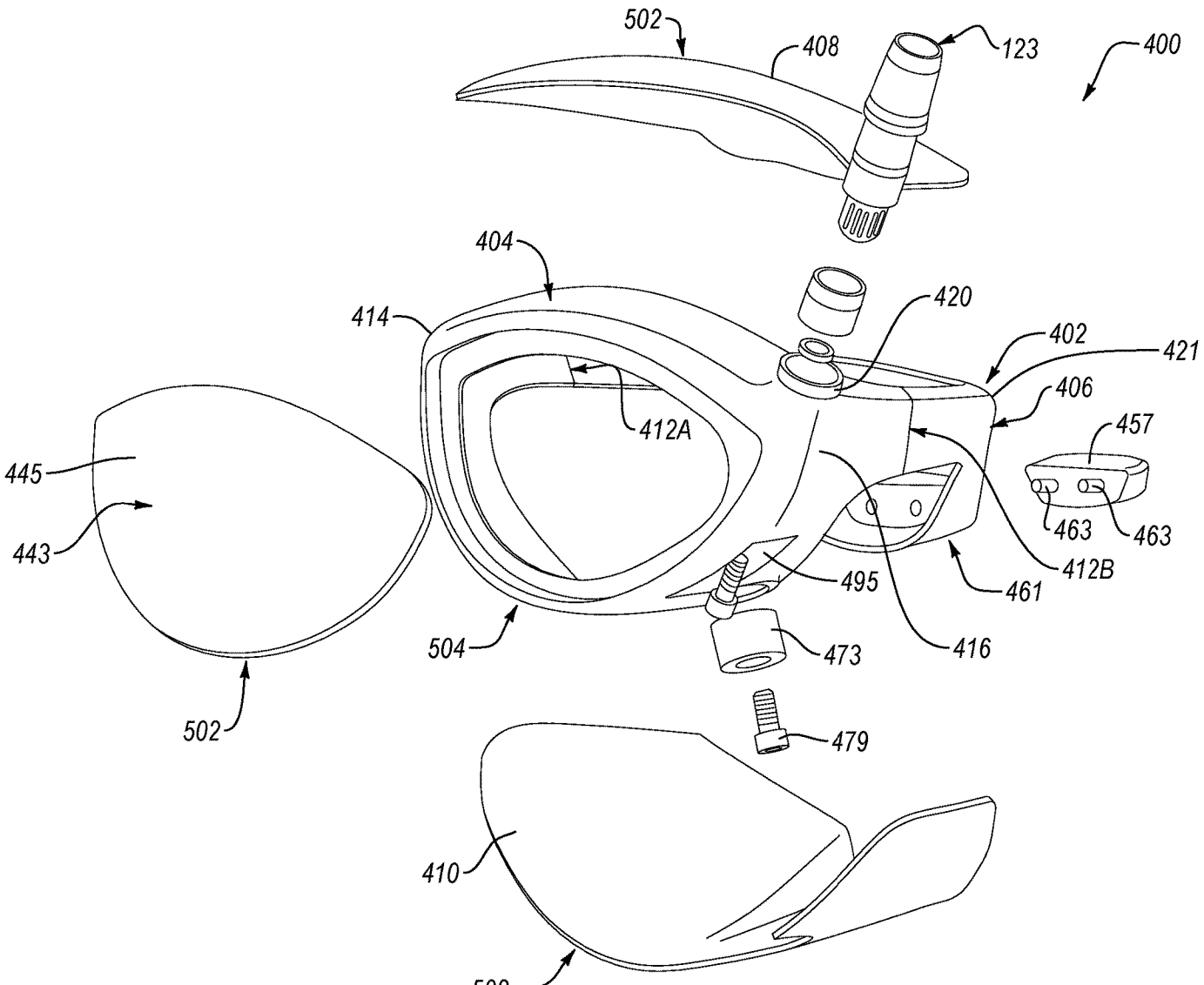
FIGS. 19 and 20 are schematic, exploded, perspective views of yet another golf club head, according to one or more examples of the present disclosure.
Figure 20:
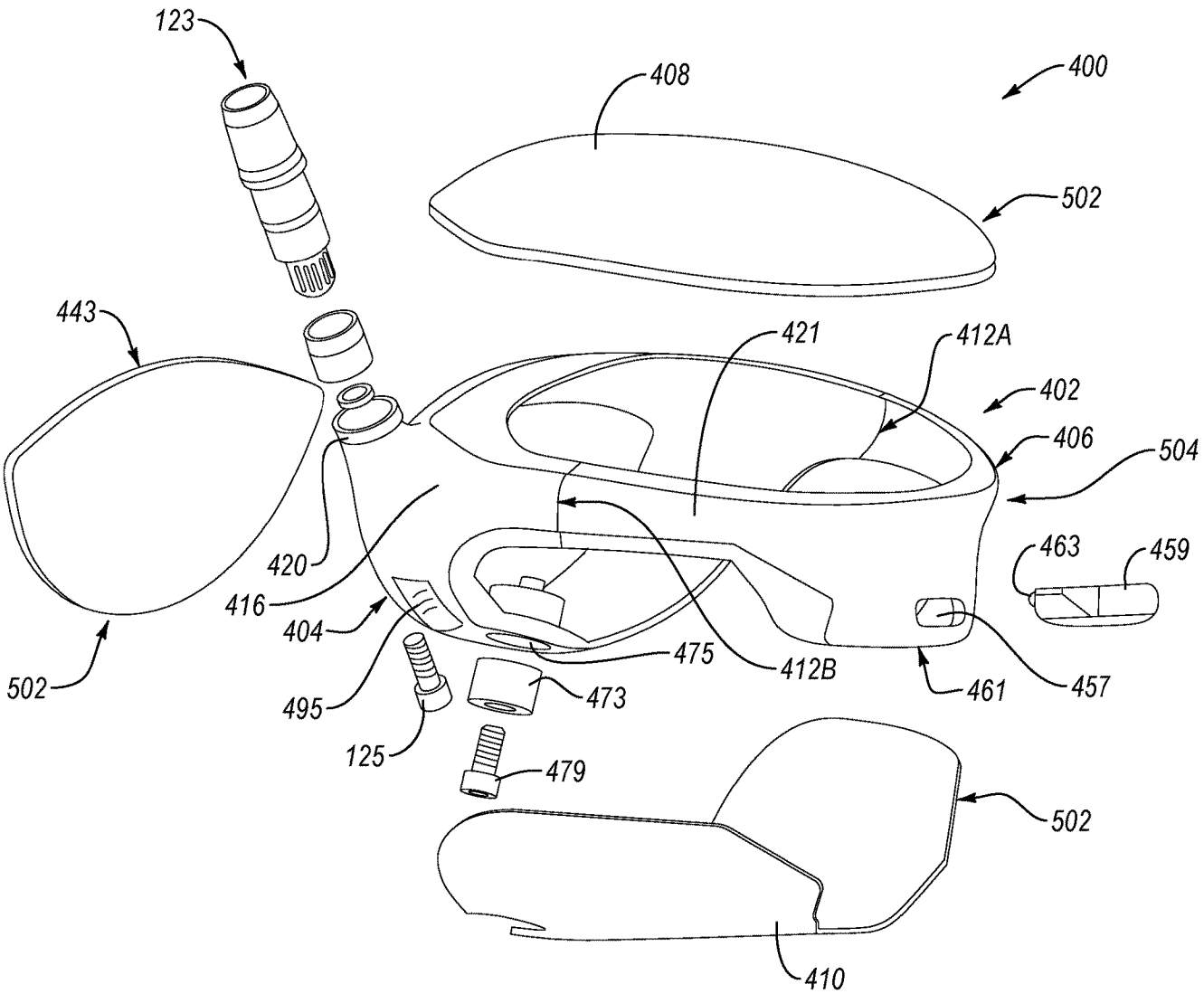

Referring to FIGS. 19 and 20, and according to another example of a golf club head disclosed herein, a golf club head 400 is shown. The golf club head 400 includes features similar to the features of the golf club head 100, the golf club head 200, and the golf club head 300, with like numbers (e.g., same numbers but in 400-series) referring to like features. For example, like the golf club head 100, the golf club head 200, and the golf club head 300, the golf club head 400 includes a body 402, a crown insert 408 attached to the body 402 at a top of the golf club head 400, and a sole insert 410 attached to the body 402 at a bottom of the golf club head 400. The body 402 includes a cast cup 404 and a ring 406. The ring 406 is joined to the cast cup 404 at a toe-side joint 412A and a heel-side joint 412B. Additionally, like the golf club head 200 and the golf club head 300, the golf club head 400 includes a strike plate 443, defining a strike face 445, that is formed separate from and attached to the cast cup 404. Accordingly, in view of the foregoing, the golf club head 400 shares some similarities with the golf club head 100, the golf club head 200, and the golf club head 300.

Furthermore, the golf club head 400 additionally includes a weight 473 attached to the cast cup 404 via a fastener 479. As shown, the cast cup 404 includes a port 475 that receives and retains the weight 473. The port 475 is configured to retain the weight 473 in a fixed location on the sole portion of the golf club head 400. However, in other examples, the port 475 can be replaced with a weight track, similar to the weight track 279 of the golf club head 200, such that the weight 473 can be selectively adjustable and moved into any of various positions along the weight track. In this manner, a weight track, and a corresponding ledge or ledges of the weight track, can form part of the cast cup 404.

TABLE 2

| | Material | | Density (g/cc) | | Mass (g) | | CG (2-axis) (mm) | | Mass (g) | Delta-CG | Delta-CG |
|---|---|---|---|---|---|---|---|---|---|---|---|
| Example | Upper | Lower | Upper | Lower | Upper | Lower | Upper | Lower | Combined | Combined | Total Head |
| 1 | Ti-64 | Ti-64 | 4.4 | 4.4 | 37.5 | 37.5 | 15 | −15 | 75 | 0 | 0 |
| 2 | Ti-64 | Steel | 4.4 | 7.8 | 37.5 | 66.5 | 15 | −15 | 104.0 | −4.2 | −2.2 |
| 3 | Al-7075 | Steel | 2.8 | 7.8 | 23.9 | 66.5 | 15 | −15 | 90.3 | −7.1 | −3.2 |
| 4 | Al-7075 | W-10 | 2.8 | 10 | 23.9 | 85.2 | 15 | −15 | 109.1 | −8.4 | −4.5 |
| 5 | Al-7075 | Ti-64 | 2.8 | 4.4 | 23.9 | 37.5 | 15 | −15 | 61.4 | −3.3 | −1.0 |
| 6 | Al-7075 | Al-7075 | 2.8 | 2.8 | 23.9 | 23.9 | 15 | −15 | 47.7 | 0.0 | 0.0 |

As shown, the cast cup 304 includes a port 375 that receives and retains the weight 373. The port 375 is configured to retain the weight 373 in a fixed location on the sole portion of the golf club head 300. However, in other examples, the port 375 can be replaced with a weight track, similar to the weight track 279 of the golf club head 200, such that the weight 373 can be selectively adjustable and moved into any of various positions along the weight track. In this manner, a weight track, and a corresponding ledge or ledges of the weight track, can form part of one piece of a multi-piece cast cup.

Although the cast cup 304 is shown to have a two-piece construction, in other examples, the cast cup 304 has a Also, like the golf club head 100, the golf club head 200, and the golf club head 300, the golf club head 400 additionally includes a mass element 459 and a mass receptacle 457. However, unlike some examples, of the receptacles of the previously discussed golf club heads, the mass receptacle 457 of the golf club head 400 forms a one-piece monolithic construction with a cantilevered portion 461 of the ring 406. Accordingly, in certain examples, the mass receptacle 457 is co-cast with the ring 406. The mass receptacle 457 includes an opening or recess that is configured to nestably receive the mass element 459. The mass element 459 can be made of a material, such as tungsten, that is different (e.g., denser) than the material of the ring 406.

The mass element 459 is bonded, such as via an adhesive, to the ring 406 to secure the mass element 459 within the mass receptacle 457. In some examples, the mass element 459 includes prongs 463 that engage corresponding apertures in the mass receptacle 457 when bonded to the ring 406. Engagement between the prongs 463 and the corresponding apertures of the mass receptacle 457 help to strengthen and stiffen the coupling between the mass element 459 and the ring 406.

Referring to FIG. 21, the ring 406 includes a toe arm portion 463A that defines a toe side of a skirt portion 421 of the golf club head 400 and a heel arm portion 463B that defines a heel side of the skirt portion 421. Moreover, the toe arm portion 463A and the heel arm portion 463B define part of a toe portion 414 and a heel portion 416, respectively, of the golf club head 400 (see, e.g., FIGS. 19 and 20). The cantilevered portion 461 extends downwardly away from the toe arm portion 463A and the heel arm portion 463B, while the toe arm portion 463A and the heel arm portion 463B extend forwardly away from the cantilevered portion 461. Accordingly, the cantilevered portion 461 is closer to the ground plane 181 than the toe arm portion 463A and the heel arm portion 463B when the golf club head 400 is in the address position. In FIG. 21, the ring 406 is shown in a position corresponding with the position of the ring 406 when the golf club head 400 is in the address position relative to the ground plane 181.

In some examples, the height HR of the lowest surface (and in some examples, an entirety) of the toe arm portion 463A at the toe portion 414 of the golf club head 400 is different than the height HR of the lowest surface (and in some examples, an entirety) of the heel arm portion 463B at the heel portion 416 of the golf club head 400. More specifically, in one example, the height HR of the lowest surface of the toe arm portion 463A at the toe portion 414 of the golf club head 400 is greater than the height HR of the lowest surface of the heel arm portion 463B at the heel portion 416 of the golf club head 100.

According to certain examples, the width WR of the toe arm portion 463A of the ring 406 at the toe portion 414 is less than the width WR of the heel arm portion 463B of the ring 406 at the heel portion 416. According to some additional examples, a thickness (TR) of the ring 406 can vary along the ring 406 in a forward-to-rearward direction. For example, in some examples, the thickness TR of the ring 406 varies from a minimum thickness to a maximum thickness in a forward-to-rearward direction. In certain examples, as shown, the thickness TR of the toe arm portion 463A of the ring 406 at the toe portion 414 is less than the thickness TR of the heel arm portion 463B of the ring 406 at the heel portion 416.

The golf club heads disclosed herein, including the golf club head 100, the golf club head 200, and the golf club head 300, each has a volume, equal to the volumetric displacement of the golf club head, that is between 390 cubic centimeters ($cm^3$ or cc) and about 600 $cm^3$. In more particular examples, the volume of each one of the golf club heads disclosed herein is between about 350 $cm^3$ and about 500 $cm^3$ or between about 420 $cm^3$ and about 500 $cm^3$. The total mass of each one of the golf club heads disclosed herein is between about 145 g and about 245 g, in some examples, and between 185 g and 210 g in other examples.

The golf club heads disclosed herein have a multi-piece construction. For example, with regards to the golf club head 100, the cast cup 104, the ring 106, the crown insert 108, and the sole insert 110 each comprises one piece of the multi-piece construction. Because each piece of the multi-piece construction is separately formed and attached together, each piece can be made of a material different than at least one other of the pieces. Such a multi-material construction allows for flexibility of the material composition, and thus the mass composition and distribution, of the golf club heads.

The following properties of the golf club heads disclosed herein proceeds with reference to the golf club head 100. However, unless otherwise noted, the properties described with reference to the golf club head 100 also apply to the golf club head 200, the golf club head 300, and the golf club head 400. The golf club head 100 is made from at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the cast cup 104 is made of the third material, the ring 106 is made of the second material, and the crown insert 108 and the sole insert 110 are made of the first material. In this first example, according to one instance, the cast cup 104 is made of a steel alloy, the ring 106 is made of a titanium alloy, and the crown insert 108 and the sole insert 110 are made of a fiber-reinforced polymeric material. In a second example, the cast cup 104 is made of the second and third material, the ring 106 is made of the first or the second material, and the crown insert 108 and the sole insert 110 are made of the first material. In this second example, according to one instance, the cast cup 104 is made of a steel alloy and a titanium alloy, the ring 106 is made of a titanium alloy, aluminum alloy, or plastic, and the crown insert 108 and the sole insert 110 are made of a fiber-reinforced polymeric material.

According to some examples, the at least one first material has a first mass no more than 55% of the total mass of the golf club head 100 and no less than 25% of the total mass of the golf club head 100 (e.g., between 50 g and 110 g). In certain examples, the first mass of the at least one first material is no more than 45% of the total mass of the golf club head 100 and no less than 30% of the total mass of the golf club head 100. The first mass of the at least one first material can be greater than the second mass of the at least one second material. Alternatively, or additionally, the first mass of the at least one first material can be within 10 g of the second mass of the at least one second material.

In some examples, the at least one second material has a second mass no more than 65% of the total mass of the golf club head 100 and no less than 20% of the total mass of the golf club head 100 (e.g., between 40 g and 130 g). According to certain examples, the second mass of the at least one second material is no more than 50% of the total mass of the golf club head 100. The second mass of the at least one second material is less than two times the first mass of the at least one first material in certain examples. The second mass of the at least one second material is between 0.9 times and 1.8 times the first mass of the at least one first material in some examples. In one example, the second mass of the at least one second material is less than 0.9 times, or less than 1.8 times, the first mass of the at least one first material.

The at least one third material has a third mass equal to the total mass of the golf club head 100 less the first mass of the at least one first material and the second mass of the at least one second material. In one example, the third mass of the at least one third material is no less than 5% of the total mass of the golf club head 100 and no more than 50% of the total mass of the golf club head 100 (e.g., between 10 g and 100 g). According to another example, the third mass of the at least one third material is no less than 10% of the total mass of the golf club head 100 and no more than 20% of the total mass of the golf club head 100.

According to one example, the cast cup 104 of the body 102 of the golf club head 100 is made from the at least one first material and the at least one first material is a first metal material that has a density between 4.0 g/cc and 8.0 g/cc. In this example, the ring 106 of the body 102 of the golf club head 100 is made of a material that has a density between 0.5 g/cc and 4.0 g/cc. According to certain implementations, the first metal material of the cast cup 104 is a titanium alloy and/or a steel alloy and the material of the ring 106 is an aluminum alloy and/or a magnesium alloy. In some implementations, the first metal material of the cast cup 104 is a titanium alloy and/or a steel alloy and the material of the ring 106 is a non-metal material, such as a plastic or polymeric material. Accordingly, in some examples, the ring 106 is made of any of various materials, such as titanium alloys, aluminum alloys, and fiber-reinforced polymeric materials.

The ring 106, in some examples, is made of one of 6000-series, 7000-series, or 8000-series aluminum, which can be anodized to have a particular color the same as or different than the cast cup 104. According to some examples, the ring 106 can be anodized to have any one of an array of colors, including blue, red, orange, green, purple, etc. Contrasting colors between the ring 105 and the cast cup 104 may help with alignment or suit a user's preferences. In one example, the ring 106 is made of 7075 aluminum. According to some examples, the ring 106 is made of a fiber-reinforced polycarbonate material. The ring 106 can be made from a plastic with a non-conductive vacuum metallizing coating, which may also have any of various colors. Accordingly, in certain examples, the ring 106 is made of a titanium alloy, a steel alloy, a boron-infused steel alloy, a copper alloy, a beryllium alloy, composite material, hard plastic, resilient elastomeric material, carbon-fiber reinforced thermoplastic with short or long fibers. The ring 106 can be made via an injection molded, cast molded, physical vapor deposition, or CNC milled technique.

As described herein, the ring (e.g., the ring 106) of any of the club heads disclosed herein can comprise various different materials and features, and be made of different materials and have different properties than the cast cup (e.g., the cast cup 104), which is formed separately and later coupled to the ring. In addition to or alternative to other materials described herein, the ring can comprise metallic materials, polymeric materials, and/or composite materials, and can include various external coatings.

In some embodiments, the ring comprises anodized aluminum, such as 6000, 7000, and 8000 series aluminum. In one specific example, the ring comprises 7075 grade aluminum. The anodized aluminum can be colored, such as red, green, blue, gray, white, orange, purple, pink, fuchsia, black, clear, yellow, gold, silver, or metallic colors. In some embodiments, the ring can have a color that contrasts from a majority color located on other parts of the club head (e.g., the crown insert, the sole insert, the cup, the rear weight, etc.).

In some embodiments, the ring can comprise any combination of metals, metal alloys (e.g., Ti alloys, steel, boron infused steel, aluminum, copper, beryllium), composite materials (e.g., carbon fiber reinforced polymer, with short or long fibers), hard plastics, resilient elastomers, other polymeric materials, and/or other suitable materials. Any material selection for the ring can also be combined with any of various formation methods, such as any combination of the following: casting, injection molding, sintering, machining, milling, forging, extruding, stamping, and rolling.

A plastic ring (fiber reinforced polycarbonate ring) may offer both mass savings e.g. about 5 grams compared to an aluminum ring, cost savings as well, give greater design flexibility due to processes used to form the ring e.g. injection molded thermoplastic, and perform similarly to an aluminum ring in abuse testing e.g. slamming the club head into a concrete cart path (extreme abuse) or shaking it in a bag where other metal clubs can repeatedly impact it (normal abuse).

In some embodiments, the ring can comprise a polymeric material (e.g., plastic) with a non-conductive vacuum metallizing (NCVM) coating. For example, in some embodiments, the ring may include a primer layer having an average thickness of about 5-11 micrometers (μm) or about 8.5 and under coating layer on top of the primer layer having an average thickness of about 5-11 μm or about 8.5 μm, a NCVM layer on top of under coating layer having an average thickness of about 1.1-3.5 μm or about 2.5 μm, a color coating layer on top of the NCVM layer having an average thickness of about 25-35 μm or about 29 μm, and a top coating (UV protection coat) outer layer on top of the color coating layer having an average thickness of about 20-35 μm or about 26 μm. In general, for a NCVM coated part or ring the NCVM layer will be the thinnest and the color coating layer and the top coating layers will be the thickest and generally about 8-15 times thicker than NCVM layer. Generally, all the layers will combine to have a total average thickness of about 60-90 μm or about 75 μm. The described layers and NCVM coating could be applied to other parts other than the ring, such as the crown, sole, forward cup, and removable weights, and it can be applied prior to assembly.

In some embodiments, the ring can comprise a physical vapor deposition (PVD) coating or film layer. In some embodiments, the ring can include a paint layer, or other outer coloring layer. Conventionally, painting a golf club heads is all done by hand and requires masking various components to prevent unwanted spray on unwanted surfaces. Hand painting, however, can lead to great inconsistency from club to club. Separately forming the ring not only allows for greater access to the rearward portion of the face for milling operations to remove unwanted alpha case and allows for machining in various face patterns, but it also eliminates the need for masking off various components. The ring can be painted in isolation prior to assembly. Or in the case of anodized aluminum, no painting may be necessary, eliminating a step in the process such that the ring can simply be bonded or attached to a cup that may also be fully finished. Similarly if the ring is coated using PVD or NCVM, this coating can be applied to the ring prior to assembly, again eliminating several steps. This also allows for attachment of various color rings that may be selectable by an end user to provide an alignment or aesthetic benefit to the user. Whether the ring is a NCVM coated ring or a PVD coated ring, as mentioned above, it can be colored an array of colors, such as red, green, blue, gray, white, orange, purple, pink, fuchsia, black, clear, yellow, gold, silver, or metallic colors.

The following properties of the golf club heads disclosed herein proceeds with reference to the golf club head 100. However, unless otherwise noted, the properties described with reference to the golf club head 100 also apply to the golf club head 200, the golf club head 300, and the golf club head 400. The golf club head 100 is made from two of at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the cast cup 104 is made of the second material and the ring 106, the crown insert 108, and the sole insert 110 are made of the first material. In this first example, according to one instance, the cast cup 104 is made of a titanium alloy, the ring 106 is made of an aluminum alloy, and the crown insert 108 and the sole insert 110 are made of a fiber-reinforced polymeric material. In this first example, according to another instance, the cast cup 104 is made of a titanium alloy, the ring 106 is made of plastic, and the crown insert 108 and the sole insert 110 are made of a fiber-reinforced polymeric material. According to a second example, the cast cup 104 is made of the second material, the ring 106 is made of the second material, and the crown insert 108 and the sole insert 110 are made of the first material. In this second example, according to one instance, the cast cup 104 and the ring 106 are made of a titanium alloy and the crown insert 108 and the sole insert 110 are made of a fiber-reinforced polymeric material.

In some examples, the at least one first material is a fiber-reinforced polymeric material that includes continuous fibers embedded in a polymeric matrix (e.g., epoxy or resin), which is a thermoset polymer is certain examples. The continuous fibers are considered continuous because each one of the fibers is continuous across a length, width, or diagonal of the part formed by the fiber-reinforced polymeric material. The continuous fibers can be long fibers having a length of at least 3 millimeters, 10 millimeters, or even 50 millimeters. In other embodiments, shorter fibers can be used having a length of between 0.5 and 2.0 millimeters. Incorporation of the fiber reinforcement increases the tensile strength, however it may also reduce elongation to break therefore a careful balance can be struck to maintain sufficient elongation. Therefore, one embodiment includes 35-55% long fiber reinforcement, while in an even further embodiment has 40-50% long fiber reinforcement. The continuous fibers, as well as the fiber-reinforced polymeric material in general, can be the same or similar to that described in Paragraph 295 of U.S. Patent Application Publication No. 2016/0184662, published Jun. 30, 2016, now U.S. Pat. No. 9,468,816, issued Oct. 18, 2016, which is incorporated herein by reference in its entirety. In several examples, the crown insert 108 and the sole insert 110 are made of the fiber-reinforced polymeric material. Accordingly, in some examples, each one of the continuous fibers of the fiber-reinforced polymeric material does not extend from the crown portion 119 to the sole portion 117 of the golf club head 100. Alternatively, or additionally, in certain examples, each one of the continuous fibers of the fiber-reinforced polymeric material does not extend from the crown portion 119 to the forward portion 112 of the golf club head 100. The crown insert 108 is made of a material that has a density between 0.5 g/cc and 4.0 g/cc in one example. The sole insert 110 is made of a material that has a density between 0.5 g/cc and 4.0 g/cc in one example.

In certain examples, the first material is a fiber-reinforced polymeric material as described in U.S. patent application Ser. No. 17/006,561, filed Aug. 28, 2020. Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy.

Figure 26:
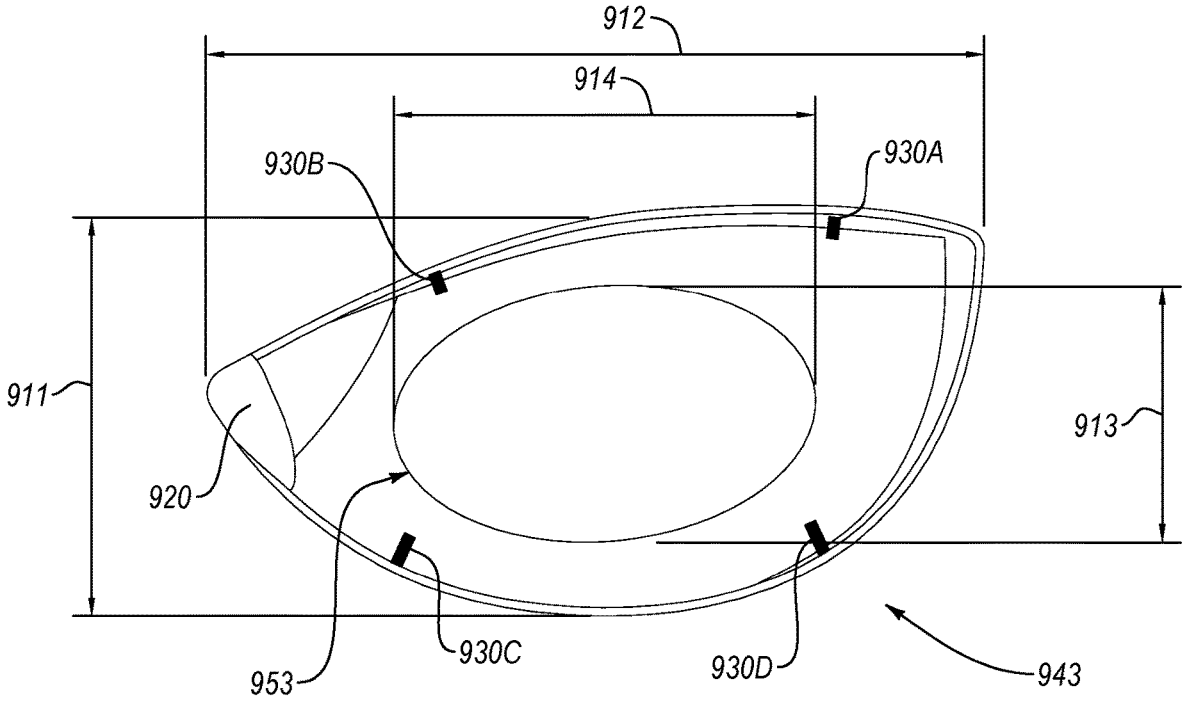
FIG. 26 is a schematic, front elevation view of a strike plate of a golf club head, according to one or more examples of the present disclosure.

FIG. 26 is a front elevation view of a strike plate 943, which can replace any one of the strike plates disclosed herein. The strike plate 943 is made of composite materials, and can be termed a composite strike plate in some examples. The non-metal or composite material of the strike plate 943 comprises a fiber-reinforced polymer comprising fibers embedded in a resin. A percent composition of the resin in the fiber-reinforced polymer is between 38% and 44%. Further details concerning the construction and manufacturing processes for the composite strike plate 943 are described in U.S. Pat. No. 7,871,340 and U.S. Published Patent Application Nos. 2011/0275451, 2012/0083361, and 2012/0199282, which are incorporated herein by reference. The composite strike plate 943 is attached to an insert support structure located at the opening at the front portion of a golf club head, such as one disclosed herein.

In some examples, the strike plate 943 can be machined from a composite plaque. In an example, the composite plaque can be substantially rectangular with a length between about 90 mm and about 130 mm or between about 100 mm and about 120 mm, preferably about 110 mm±1.0 mm, and a width between about 50 mm and about 90 mm or between about 6 mm and about 80 mm, preferably about 70 mm±1.0 mm plaque size and dimensions. The strike plate 943 is then machined from the plaque to create a desired face profile. For example, the face profile length 912 can be between about 80 mm and about 120 mm or between about 90 mm and about 110 mm, preferably about 102 mm. The face profile width 911 can be between about 40 mm and about 65 mm or between about 45 mm and about 60 mm, preferably about 53 mm. The height 913 of a preferred impact zone 953 on the strike face, defined by the strike plate 943 and centered on a geometric center of the strike face, can be between about 25 mm and about 50 mm, between about 30 mm and about 40 mm, or between about 17 mm and about 45 mm, such as preferably about 34 mm. The length 914 of the preferred impact zone 953 can be between about 40 mm and about 70 mm, between about 28 mm and about 65 mm, or between about 45 mm and about 65 mm, preferably about 55.5 mm or 56 mm. In certain examples, the preferred impact zone 953 of the strike face defined by the strike plate 943 has an area between 500 $mm^2$ and 1,800 $mm^2$. Alternatively, the strike plate 943 can be molded to provide the desired face dimensions and profile.

Figure 27:
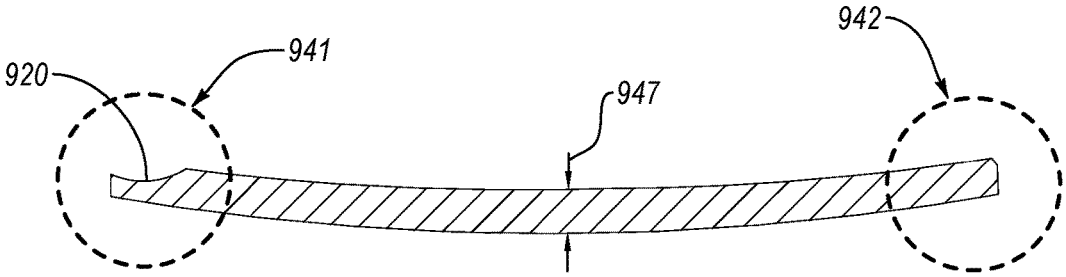
FIG. 27 is a schematic, bottom view of a strike plate of a golf club head, according to one or more examples of the present disclosure.

Additional features can be machined or molded into face the strike plate 943 to create the desired face profile. For example, as shown in FIG. 27, a notch 920 can be machined or molded into the backside of a heel portion of the strike plate 943. The notch 920 in the back of the strike plate 943 allows for the golf club head to utilize flight control technology (FCT) in the hosel, in some examples. The notch 920 can be configured to accept at least a portion of the hosel within the strike plate 943. Alternatively or additionally, the notch 920 can be configured to accept at least a portion of the club head body within the strike plate 943. The notch may allow for the reduction of center-face y-axis location (CFY) by accommodating at least a portion of the hosel and/or at least a portion of the club body within the strike plate 943, allowing the preferred impact zone 953 of the strike plate 943 to be closer to a plane passing through a center point location of the hosel. The strike plate 943 can be configured to provide a CFY no more than about 18 mm and no less than about 9 mm, preferably between about 11.0 mm and about 16.0 mm, and more preferably no more than about 15.5 mm and no less than about 11.5 mm. The strike plate 943 can be configured to provide face progression no more than about 21 mm and no less than about 12 mm, preferably no more than about 19.5 mm and no less than about 13 mm and more preferably no more than about 18 mm and no less than about 14.5 mm. In some embodiments, a difference between CFY and face progression is at least 3 mm and no more than 12 mm.

In another example, backside bumps 4230A, 4230B, 4230C, 4230D may be machined or molded into the backside of the strike plate 943. The backside bumps 4230A, 4230B, 4230C, 4230D can be configured to provide for a bond gap. A bond gap is an empty space between the club head body and the strike plate 943 that is filled with adhesive during manufacturing. The backside bumps 4230A, 4230B, 4230C, 4230D protrude to separate the face from the club head body when bonding the strike plate 943 to the club head body during manufacturing. In some examples, too large or too small of a bond gap may lead to durability issues of the club head, the strike plate 943, or both. Further, too large of a bond gap can allow too much adhesive to be used during manufacturing, adding unwanted additional mass to the club head. The backside bumps 4230A, 4230B, 4230C, 4230D can protrude between about 0.1 mm and 0.5 mm, preferably about 0.25 mm. In some embodiments, the backside bumps are configured to provide for a minimum bond gap, such as a minimum bond gap of about 0.25 mm and a maximum bond gap of about 0.45 mm.

Further, one or more of the edges of the strike plate 943 can be machined or molded with a chamfer. In an example, the strike plate 943 includes a chamfer substantially around the inside perimeter edge of the strike plate 943, such as a chamfer between about 0.5 mm and about 1.1 mm, preferably 0.8 mm.

FIG. 27 is a is a bottom perspective view of the strike plate 943. The strike plate 943 has a heel portion 941 and a toe portion 942. The notch 920 is machined or molded into the heel portion 941. In this example, the strike plate 943 has a variable thickness, such as with a peak thickness 947 within the preferred impact zone 953. The peak thickness 947 can be between about 2 mm and about 7.5 mm, between about 4.3 mm and 5.15 mm, between about 4.0 mm and about 5.15 or 5.5 mm, or between about 3.8 mm and about 4.8 mm, preferably 4.1 mm±0.1 mm, 4.25 mm±0.1 mm, or 4.5 mm±0.1 mm. The peak thickness 947 can be located at the geometric center of the strike face defines by the strike plate 943. A minimum thickness of the strike plate 943 is between 3.0 mm and 4.0 mm in some examples.

Additionally, in certain examples, the preferred impact zone 953 is off-center or offset relative to the geometric center of the strike face, and can be thicker toeward of the geometric center of the strike face. In some examples, the thickness of the strike plate 943 within the preferred impact zone 953 is variable (e.g., between about 3.5 mm and about 5.0 mm) and the thickness of the strike plate 943 outside of the preferred impact zone 953 is constant (e.g., between 3.5 mm and 4.2 mm) and less than within preferred impact zone 953. In some examples, the strike plate 943 have a thickness between 3.5 mm and 6.0 mm.

The strike plate 943 has a toe edge region and a heel edge region outside of the preferred impact zone 953 such that the preferred impact zone is between the toe edge region and the heel edge region. The toe edge region is closer to the toe portion than the heel edge region. The heel edge region is closer to the heel portion than the toe edge region. The toe edge region thickness is less than the maximum thickness. A thickness of the strike plate 943 transitions from the maximum thickness, within the preferred impact zone 953, to a toe edge region thickness, within the toe edge region, between 3.85 mm and 4.5 mm.

In some embodiments, the strike plate 943 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the strike plate 943 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike plate 943 in a localized area, such as in the center face at the preferred impact zone. Some Q's and C's can have additional or fewer plies (e.g., three-ply rather than four-ply), such as to fine tune the thickness, mass, localized thickness, and provide for other properties of the strike plate 943, such as to increase or decrease COR of the strike plate 943.

In some embodiments, the strike face, such as the strike plate 243, of some examples of the golf club head disclosed herein is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the strike face with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike face, or other composite features, in a localized area, such as in the center face at the preferred impact zone. Some Q's and C's can have additional or fewer plies (e.g., three-ply rather than four-ply), such as to fine tune the thickness, mass, localized thickness, and provide for other properties of the strike face, such as to increase or decrease COR of the strike face.

Additional composite materials and methods for making the same are described in U.S. Pat. Nos. 8,163,119 and 10,046,212, which is incorporated by reference. For example, the usual number of layers for a strike plate is substantial, e.g., fifty or more. However, improvements have been made in the art such that the layers may be decreased to between 30 and 50 layers.

Table 3 below provide examples of possible layups of one or more of the composite parts of the golf club head disclosed herein. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

TABLE 3

| ply 1 | ply 2 | ply 3 | ply 4 | ply 5 | ply 6 | ply 7 | ply 8 | Aw g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 99 | +45 | −45 | 90 | 0 | | | 590-720 |
| 90 | 0 | +45 | −45 | 0 | 90 | | | 590-720 |
| 0 | 90 | 45 | −45 | −45 | 45 | 0.90 woven | | 680-840 |
| 90 | 0 | 45 | −45 | −45 | 48 | 90/0 woven | | 680-840 |
| −45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0.90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$.

In general, a composite face plate or composite face insert may have a peak thickness that varies between about 3.8 mm and 5.15 mm. In general, the composite face plate is formed from multiple composite plies or layers. The usual number of layers for a composite striking face is substantial, e.g., forty or more, preferably between 30 to 75 plies, more preferably, 50 to 70 plies, even more preferably 55 to 65 plies.

In an example, a first composite face insert can have a peak thickness of 4.1 mm and an edge thickness of 3.65 mm, including 12 Q's and 2 C's, resulting in a mass of 24.7 g. In another example, a second composite face insert can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, a third composite face insert can have a peak thickness of 4.5 mm and an edge thickness of 3.9 mm, including 12 Q's and 3 C's, resulting in a mass of 26.2 g. Additional and different combinations of Q's and C's can be provided for a composite face insert 110 with a mass between about 20 g and about 30 g, or between about 15 g and about 35 g. In some examples, wherein the strike plate, such as the strike plate 943, has a total mass between 22 grams and 28 grams.

Figure 28A:
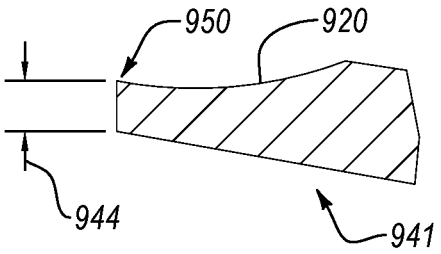
FIG. 28A is a schematic, bottom sectional view of a heel portion of a strike plate of a golf club head, according to one or more examples of the present disclosure.

FIG. 28A is a section view of a heel portion 41 of the strike plate 943. The heel portion 941 can include a notch 920. In embodiments with a chamfer on an inside edge of the strike plate 943, no chamfer 950 is provided on the notch 920. The notch 920 can have a notch edge thickness 944 less than the edge thickness 945 of the face insert 110 (see, e.g., FIG. 28B). For example, the notch edge thickness 944 can be between 1.5 mm and 2.1 mm, preferably 1.8 mm.

Figure 28B:
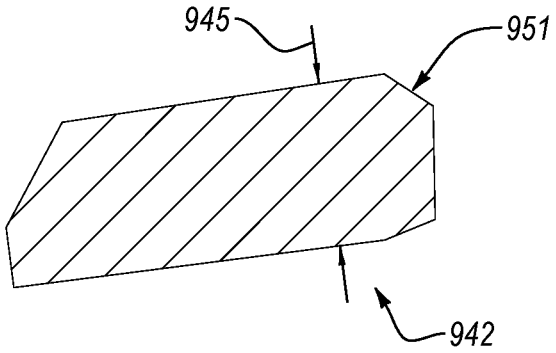
FIG. 28B a schematic, bottom sectional view of a toe portion of a strike plate of a golf club head, according to one or more examples of the present disclosure.

FIG. 28B is a section view of a toe portion 942 of the strike plate 943. The toe portion 942 includes a chamfer 951 on the inside edge of the strike plate 943. In some embodiments, the edge thickness 945 can be between about 3.35 mm and about 4.2 mm, preferably 3.65 mm±0.1 mm, 3.8 mm±0.1 mm, or 3.9 mm±0.1 mm.

Figure 29:
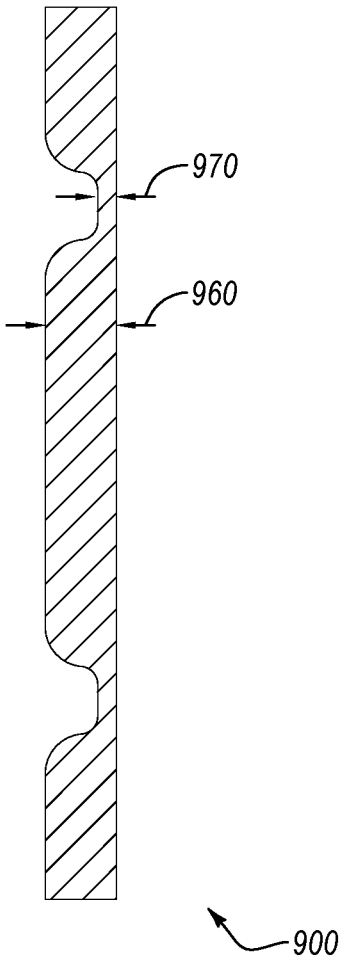
FIG. 29 is a schematic, sectional view of a polymer layer of a strike plate of a golf club head, according to one or more examples of the present disclosure.

FIG. 29 is a section view of a polymer layer 900 of the strike plate 943. The polymer layer 900 can be provided on the outer surface of the strike plate 943 to provide for better performance of the strike plate 943, such as in wet conditions. Exemplary polymer layers are described in U.S. patent application Ser. No. 13/330,486 (patented as U.S. Pat. No. 8,979,669), which is incorporated by reference. The polymer layer 900 may include polyurethane and/or other polymer materials. The polymer layer may have a polymer maximum thickness 960 between about 0.2 mm and 0.7 mm or about 0.3 mm and about 0.5 mm, preferably 0.40 mm±0.05 mm. The polymer layer may have a polymer minimum thickness 970 between about 0.05 mm and 0.15 mm, preferably 0.09 mm±0.02 mm. The polymer layer can be configured with alternating maximum thicknesses 960 and minimum thicknesses 970 to create score lines on the strike plate 943. Further, in some embodiments, teeth and/or another texture may be provided on the thicker areas of the polymer layer 900 between the score lines.

In some examples, the crown insert, such as the crown insert 108, and the sole insert, such as the sole insert 110, are made of a carbon-fiber reinforced polymeric material. In one example, the crown insert is made of layers of unidirectional tape, woven cloth, and composite plies.

Referring to FIG. 4, the golf club head 100 has a face-back dimension (FBD) defined as the distance between a hypothetical plane 169, passing through the center face 183 of the strike face 145 and parallel to the strike face 145, and a rearmost point on the golf club head 100 in a face-back direction 165 perpendicular to the hypothetical plane 169. As defined herein, the center face 183 is located at 0% of the face-back dimension (FBD) and the rearmost point is located at 100% of the face-back dimension (FBD). Under this definition, the golf club head 100 can be divided into a face section that extends, in the face-back direction 165, from 0% of the face-back dimension (FBD) to 25% of the face-back dimension (FBD), a middle section that extends, in the face-back direction 165, from 25% to 75% of the face-back dimension (FBD), and a back section that extends, in the face-back direction 165, from 75% to 100% of the face-back dimension (FBD). According to some examples, at least 95% by weight of the middle section is made of a material having a density between 0.9 g/cc and 4.0 g/cc. In certain examples, at least 95% by weight of the middle section is made of material having a density between 0.9 g/cc and 2.0 g/cc. In some examples, at least 95% by weight of the middle section and at least 95% by weight of the back section are made of a material having a density between 0.9 g/cc and 2.0 g/cc, excluding any attached weights and any housings for the attached weights. No more than 20% by weight of the middle section and no more than 20% by weight of the back section are made of a material having a density between 4.0 g/cc and 20.0 g/cc, according to various examples.

In some examples, the golf club head 100 includes one or more of the following materials: carbon steel, stainless steel (e.g. 17-4 PH stainless steel), alloy steel, Fe—Mn—Al alloy, nickel-based ferroalloy, cast iron, super alloy steel, aluminum alloy (including but not limited to 3000 series alloys, 5000 series alloys, 6000 series alloys, such as 6061-T6, and 7000 series alloys, such as 7075), magnesium alloy, copper alloy, titanium alloy (including but not limited to 6-4 titanium, 3-2.5, 6-4, SP700, 15-3-3-3, 10-2-3, Ti 9-1-1, ZA 1300, or other alpha/near alpha, alpha-beta, and beta/near beta titanium alloys) or mixtures thereof.

In one example, when forming part of the golf club heads disclosed herein, such as when forming part of the strike plate, the titanium alloy is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation. In certain examples, the titanium alloy is 8-1-1 Ti.

In another example, when forming part of the golf club heads disclosed herein, such as when forming part of the strike plate, the titanium alloy is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). The alpha-beta titanium alloy or ZA1300 titanium alloy has a first ultimate tensile strength of at least 1,000 MPa in some examples and at least 1,100 MPa in other examples. An ultimate tensile strength of the material forming the body 102, other than the strike face 145, can be less than the first ultimate tensile strength by at least 10%. In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain examples may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some examples, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

In yet certain examples, the golf club head 100 is made of a non-metal material with a density less than about 2 g/cm$^3$, such as between about 1 g/cm$^3$ to about 2 g/cm$^3$. The non-metal material may include a polymer, such as fiber-reinforced polymeric material. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyethelipide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Organic fibers, such as fiberglass, carbon fiber, or metallic fiber, can be added into the engineering plastic, so as to enhance structural strength. The reinforcing fibers can be continuous long fibers or short fibers. One of the advantages of PSU is that it is relatively stiff with relatively low damping which produces a better sounding or more metallic sounding golf club compared to other polymers which may be overdamped. Additionally, PSU requires less post processing in that it does not require a finish or paint to achieve a final finished golf club head.

One exemplary material from which any one or more of the sole insert 110, the crown insert 108, the cast cup 103, the ring 106, and/or the strike face, such as the strike plate 243, can be made from is a thermoplastic continuous carbon fiber composite laminate material having long, aligned carbon fibers in a PPS (polyphenylene sulfide) matrix or base. A commercial example of a fiber-reinforced polymer, from which the sole insert 110, the crown insert 108, and/or the strike face can be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$. Another commercial example of a fiber-reinforced polymer, from which the sole insert 110, crown insert 108, and/or the strike face is made, is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the sole insert 110, the crown insert 108, and/or the strike face. After the sole insert 110, the crown insert 108, and/or the strike face are formed (separately, in some implementations) by the thermoforming process, each is cooled and removed from the matched die. In some implementations, the sole insert 110, the crown insert 108, and/or the strike face has a uniform thickness, which facilitates use of the thermoforming process and ease of manufacture. However, in other implementations, the sole insert 110, the crown insert 108, and/or the strike face may have a variable thickness to strengthen select local areas of the insert by, for example, adding additional plies in select areas to enhance durability, acoustic properties, or other properties of the respective inserts.

In some examples, any one or more of the sole insert 110, the crown insert 108, the cast cup 103, the ring 106, and/or the strike face, such as the strike plate 243, can be made by a process other than thermoforming, such as injection molding or thermosetting. In a thermoset process, any one or more of the sole insert 110, the crown insert 108, the cast cup 103, the ring 106, and/or the strike face, such as the strike plate 243, may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the crown insert 126 and/or a sole insert. Each insert is cooled and removed from its respective mold.

The carbon fiber reinforcement material for any one or more of the sole insert 110, the crown insert 108, the cast cup 103, the ring 106, and/or the strike face, such as the strike plate 243, made by the thermoset manufacturing process, may be a carbon fiber known as "34-700" fiber, available from Grafil, Inc., of Sacramento, California, which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, California. In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the plipary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

In some examples, polymers used in the manufacturing of the golf club head 100 may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyethelipides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including

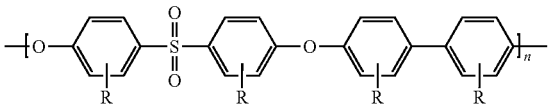

or

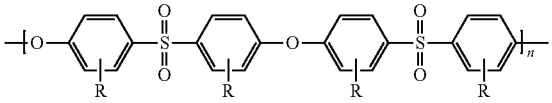

or wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyland hexenyl groups. As specific examples of the C3-C20 cycloalkyl group, there can be mentioned-cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

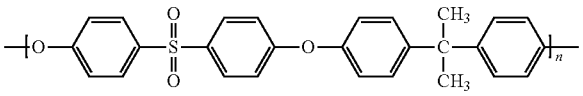

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

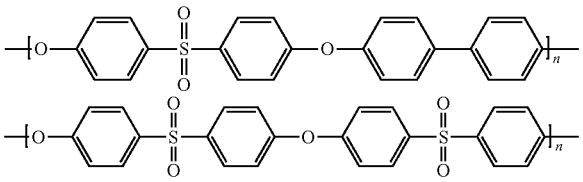

and the abbreviation PPSF and sold under the tradenames RADEL® resin; and (c) a condensation polymer made from 4,4'-dichlorodiphenyl sulfone in the presence of base and having the principle repeating structure and the abbreviation PPSF and sometimes called a "polyether sulfone" and sold under the tradenames Ultrason® E, LNP™, Veradel® PESU, Sumikaexce, and VICTREX® resin," and any and all combinations thereof.

In some examples, one exemplary material from which any one or more of the sole insert 110, the crown insert 108, the cast cup 103, the ring 106, and/or the strike face, such as the strike plate 243, can be made from is a composite material, such as a carbon fiber reinforced polymeric material, made of a composite including multiple plies or layers of a fibrous material (e.g., graphite, or carbon fiber including turbostratic or graphitic carbon fiber or a hybrid structure with both graphitic and turbostratic parts present). Examples of some of these composite materials for use in the and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

Any one or more of the sole insert 110, the crown insert 108, the cast cup 103, the ring 106, and/or the strike face, such as the strike plate 243, can have a complex three-dimensional shape and curvature corresponding generally to a desired shape and curvature of the golf club head 100. It will be appreciated that other types of club heads, such as fairway wood-type club heads, hybrid club heads, and iron-type club heads, may be manufactured using one or more of the principles, methods, and materials described herein.

Figure 33:
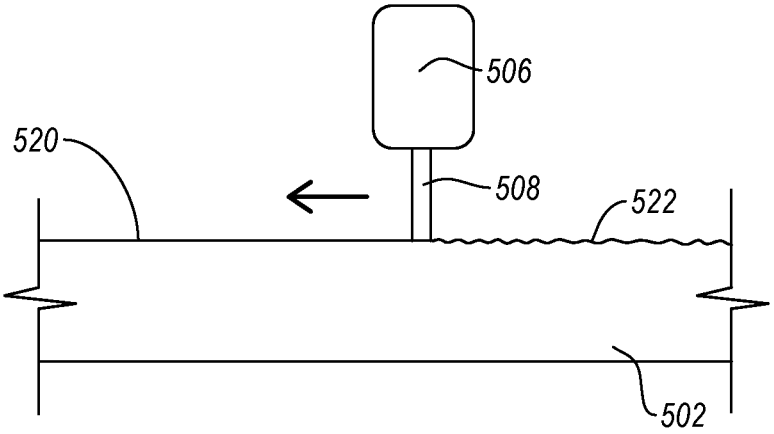
FIG. 33 is a schematic, side elevation view of a first part of a golf club head being laser ablated by a first laser, according to one or more examples of the present disclosure.
Figure 34:
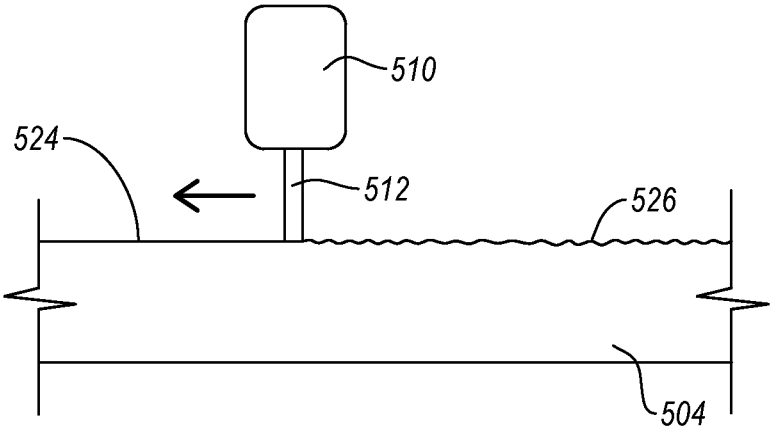
FIG. 34 is a schematic, side elevation view of a second part of a golf club head being laser ablated by a second laser, according to one or more examples of the present disclosure.
Figure 42:
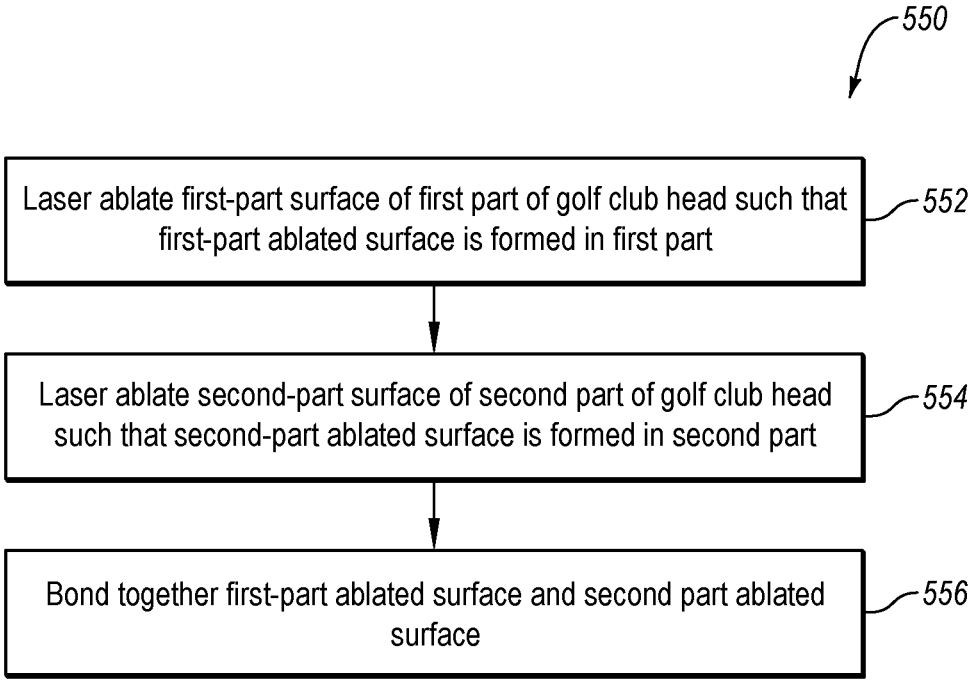
FIG. 42 is a schematic flow diagram of a method of making a golf club head, according to one or more examples of the present disclosure.

Referring to FIGS. 33, 34, and 42, according to some examples, a method 550 of making the golf club heads of the present disclosure, such as the golf club head 100, includes (block 552) laser ablating a first-part surface 520 of a first part 502 of a golf club head such that a first-part ablated surface 522 is formed in the first part 502. The method 550 also includes (block 554) laser ablating a second-part surface 524 of a second part 504 of the golf club head 100 such that a second-part ablated surface 526 is formed in the second part 504. The method 550 additionally includes (block 556) bonding together the first-part ablated surface 522 and the second-part ablated surface 526. Generally, the method 550 helps to produce bonding surfaces (i.e., faying surfaces) of a golf club head with features that promote strong and reliable bonds between the bonding surfaces. More specifically, the features formed by ablating the bonding surfaces of the golf club head with a laser promote an increase in the pattern uniformity and surface energy of the bonding surfaces, which helps to strengthen the bond between the bonding surfaces and increase the overall reliability and performance of the golf club head. Also, ablating the bonding surfaces with a laser enables the repeatability of surface characteristics across multiple parts and batches of parts. As defined herein, each one of the first-part ablated surface 522 and/or the second-part ablated surface 526 can be a single continuous surface or multiple spaced apart (e.g., intermittent) surfaces.

Conventional processes for bonding together surfaces of a golf club head, including surface preparation via non-laser ablation methods, may not provide a sufficient pattern uniformity and surface energy for producing strong and reliable bonds. For example, chemical ablation and media-blast ablation processes are unable to achieve pattern uniformities and surface energies of bonding surfaces that are achievable by the laser ablation of the present disclosure. The patterns of peaks and valleys on bonding surfaces ablated via a chemical ablation process or a media-blast ablation process are irregular and inconsistent, which leads to lower and non-uniform bonding strength across a bond between the bonding surfaces.

As shown in FIG. 33, a first-part laser 506 is configured to generate a first-part laser beam 508 and direct the first-part laser beam 508 at the first-part surface 520 of the first part 502. The first-part laser beam 508 impacts the first-part surface 520, which sublimates a portion of the first-part surface 520 up to a desired depth. More specifically, the energy of the first-part laser beam 508 is sufficient to transition the portion of the first-part surface 520 from a solid state directly to a gas state. In some examples, the desired depth is between 5 micrometers and 100 micrometers, between 20 micrometers and 50 micrometers, or approximately 30 micrometers. The gas sublimated from the first-part surface 520 can be suctioned away, such as by a vacuum pump (not shown).

The depth of the portion of the first-part surface 520 that is sublimated (e.g., removed) is dependent on the material of the first-part surface 520 and the characteristics of the first-part laser beam 508. The characteristics of the first-part laser beam 508 include the intensity (e.g., optical power per unit area) of, the pulse frequency of, and the duration of the impact on the first-part surface 520 by the first-part laser beam 508. After the portion of the first-part surface 520 is removed, the first-part ablated surface 522 is exposed. Accordingly, generally speaking, the first-part laser beam 508 removes a top surface of the first part 502 so that a fresh surface of the first part 502 is exposed. The first-part ablated surface 522 (e.g., fresh surface or exposed surface) is relatively free of contaminants (e.g., oxides, moisture, etc.) present on the first-part surface 520.

Similarly, as shown in FIG. 34, a second-part laser 510 is configured to generate a second-part laser beam 510 and direct the second-part laser beam 512 at the second-part surface 524 of the second part 504. The second-part laser beam 512 impacts the second-part surface 524, which sublimates a portion of the second-part surface 524 up to a desired depth. More specifically, the energy of the second-part laser beam 512 is sufficient to transition the portion of the second-part surface 524 from a solid state directly to a gas state. The gas sublimated from the second-part surface 524 can be suctioned away, such as by a vacuum pump (not shown). The depth of the portion of the second-part surface 524 that is sublimated is dependent on the material of the second-part surface 524 and the characteristics of the second-part laser beam 512. Like the first-part laser beam 508, the characteristics of the second-part laser beam 512 include the intensity (e.g., optical power per unit area) of, the pulse frequency of, and the duration of the impact on the second-part surface 524 by the second-part laser beam 512. Generally, the first-part laser beam 508 and the second part-laser beam 512 are highly focused beams of laser radiation. After the portion of the second-part surface 524 is removed, the second-part ablated surface 526 is exposed. Accordingly, generally speaking, the second-part laser beam 512 removes a top surface of the second part 504 so that a fresh surface of the second part 504 is exposed. The second-part ablated surface 526 is relatively free of contaminants present on the second-part surface 524.

In certain examples of the method 550, the first-part laser beam 508 is moved along the first-part surface 520 at a first-part rate to form the first-part ablated surface 522 in the first part 502. Similarly, in some examples, the second-part laser beam 510 is moved along the second-part surface 524 at a second-part rate to form the second-part ablated surface 526 in the second part 504. In this manner, a laser beam with a relatively small footprint can be used to form an ablated surface with a relatively larger surface area. Moreover, in various examples, a laser beam can be split into separate sub-beams, using optics, to move along and form separate portions of an ablated surface. Also, according to some examples, multiple laser beams generated from multiple lasers can be used to form an ablated surface in a single part. The rate at which a laser beam moves along a corresponding part is dependent on the type of material of the part. For example, a given laser beam may need to be moved along a given part at a faster rate, compared to another part, when the material of the given part sublimates faster than the material of the other part. In contrast, a given laser beam may need to be moved along a given part at a slower rate, compared to another part, when the material of the given part sublimates slower than the material of the other part.

The rate of sublimation, and thus the rate of movement of a laser beam along a part, is dependent on the type of laser generating the laser beam and the characteristics of the generated laser beam. Different types of lasers generate different types of laser beams. For example, a carbon-dioxide laser generates a laser beam that is different than the one generated by a fiber laser. Likewise, an Nd—YAG (neodymium-doped yttrium aluminum garnet) laser generates a laser beam that is different than the ones generated by a carbon-dioxide laser and fiber laser, respectively. Additionally, in some examples, a laser can be selectively controlled to adjust characteristics of the generated laser. For example, a laser can be selectively controlled to adjust one or both of an intensity or pulse frequency of the generated laser. Generally, the higher the intensity of the laser beam or the higher the pulse frequency of the laser beam, the higher the rate of sublimation.

Figure 35:
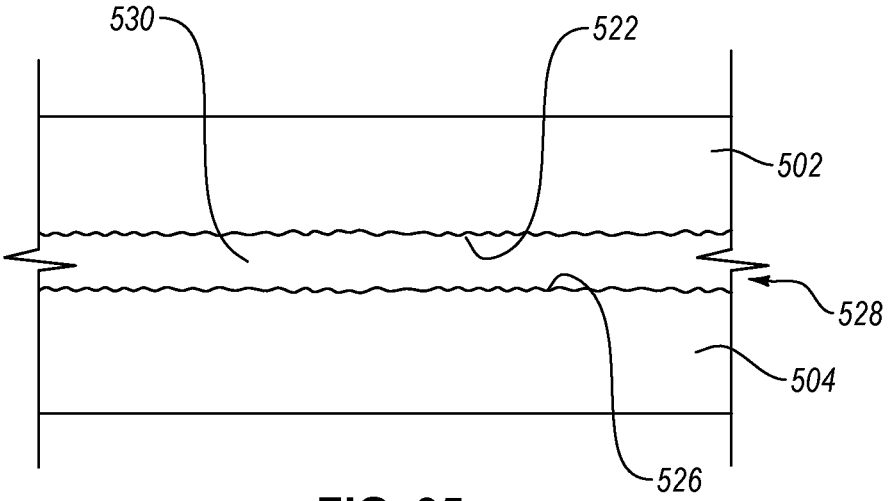
FIG. 35 is a schematic, side elevation view of a first part, of a golf club head, bonded to a second part, of the golf club head, according to one or more examples of the present disclosure.

After the first part 502 is laser ablated, to form the first-part ablated surface 522, and the second part 504 is laser ablated, to form the second-part ablated surface 526, the first-part ablated surface 522 and the second-part ablated surface 526 are bonded together. Referring to FIG. 35, the first-part ablated surface 522 and the second-part ablated surface 526, when facing each other, are bonded together along a bondline 528 to form a bonded joint. The bondline 528 is defined as the structure, including, but not limited to, the material, between the first-part ablated surface 522 and the second-part ablated surface 526. Accordingly, in certain examples, the first-part ablated surface 522 and the second-part ablated surface 526 are directly bonded together along the bondline 528. In other words, in such examples, other than the material of the bondline 528, no other intervening layer is interposed between the first-part ablated surface 522 and the second-part ablated surface 526. In some examples, the bondline 528 includes an adhesive 530 when the first-part ablated surface 522 and the second-part ablated surface 526 are adhesively bonded. The adhesive 530 can be any of various adhesives known in the art, such as glues, epoxies, resins, and the like. Additionally, the adhesive 530 has a maximum thickness and a minimum thickness, or alternatively an average thickness, along the bondline 528.

In some examples, the type of the first-part laser 506, the rate of movement of the first laser beam 508 (i.e., first-part rate), and/or the characteristics of the first-part laser beam 508 is dependent on the type of material of the first part 502. Similarly, in some examples, the type of the second-part laser 510, the rate of movement of the second-part laser beam 512 (i.e., second-part rate), and/or the characteristics of the second-part laser beam 512 is dependent on the type of material of the second part 504.

According to certain examples, the first part 502 is made of a first material and the second part is made of a second material, where the first material is different than the second material. In one example, the first part 502 is made of a first type of metallic material and the second part 504 is made of a second type of metallic material. In another example, the first part 502 is made of a first type of non-metallic material and the second part 504 is made of a second type of non-metallic material. In yet a further example, the first part 502 is made of a non-metallic material and the second part 504 is made of a metallic material. In the above examples, at least one of the type of the first-part laser 506, the rate of movement of the first-part laser beam 508, or the characteristics of the first-part laser beam 508 is different than the type of the second-part laser 510, the rate of movement of the second-part laser beam 512, or the characteristics of the second-part laser beam 512, respectively. According to some examples, the type of the first-part laser 506 is different than that of the second-part laser 510 (e.g., such that the first-part laser 506 is different than and separate from the second-part laser 510). In some examples, the first-part rate is different than the second-part rate. In one example, the intensity of the first-part laser beam 508 is different than the second-part laser beam 512. Additionally, or alternatively, according to certain examples, the pulse frequency of the first-part laser beam 508 is different than the pulse frequency of the second-part laser beam 512.

According to some examples, the first material is a fiber-reinforced polymeric material and the second material is a metallic material. In one example, the fiber-reinforced polymeric material is at least one of a glass-fiber-reinforced polymeric material or a carbon-fiber-reinforced polymeric material, such as one of those described above, and the metallic material is a titanium alloy, such as a cast titanium material. In these examples, at least one of: the first-part laser 506 is a carbon dioxide laser and the second-part laser 510 is a fiber laser; the first-part rate is slower than the second-part rate; the intensity of the first-part laser beam 508 is less than the intensity of the second-part laser beam 512; or the pulse frequency of the first-part laser beam 508 is less than the pulse frequency of the second-part laser beam 512. When the first-part rate is slower than the second-part rate, in some examples, the first-part rate is between 600 mm/s and 800 mm/s (e.g., 700 mm/s), and the second-part rate is between 600 mm/s and 800 mm/s (e.g., 700 mm/s). When the intensity of the first-part laser beam 508 is less than the intensity of the second-part laser beam 512, in certain examples, the intensity of the first-part laser beam 508 is between 40 watts and 60 watts, and the intensity of the second-part laser beam 512 is between 40 watts and 60 watts. When the pulse frequency of the first-part laser beam 508 is less than the pulse frequency of the second-part laser beam 512, in some examples, the pulse frequency of the first-part laser beam 508 is between 40 kHz and 60 kHz, and the pulse frequency of the second-part laser beam 512 is between 40 kHz and 60 kHz.

When either the first material of the first part 502 or the second material of the second part 504 is a fiber-reinforced polymeric material, which includes a plurality of reinforcement fibers embedded in a resin or epoxy matrix, the corresponding first-part surface 520 or the second-part surface 524 is defined entirely by the resin or epoxy matrix of the fiber-reinforced polymeric material. Accordingly, the first-part laser beam 508 or the second-part laser beam 512 impacts and ablates only the resin or epoxy matrix, without ablating the reinforcement fibers embedded therein. Moreover, in some examples, the first part 502 or the second part 504 is made of plies of a carbon-fiber-reinforced polymeric material sandwiched between opposing outer plies of a glass-fiber-reinforced polymeric material. In such examples, the corresponding laser beam impacts and ablates only the resin or epoxy matrix of the glass-fiber-reinforced polymeric material.

As presented previously, due the ability to precisely control the energy, pulse frequency, and directionality of a laser, laser ablation of a surface can result in a fresh (e.g., relatively uncontaminated) surface having a high uniformity of peaks and valleys, and a high surface energy. Generally, each pulse of the laser beam sublimates and removes a localized portion of the surface being ablated. The removed portion of the surface defines a valley (e.g., dimple or depression) that has a shape that corresponds with a cross-sectional shape of the laser beam and a depth that corresponds with the intensity and frequency of the laser beam. Because the laser beam is moved relative to the surface being ablated, each pulse of the laser beam contacts a different portion of the surface, which results in disparate and spaced apart valleys corresponding with the removed portions. Because the portions of the surface between the removed portions are not removed, the unremoved portions of the surface define peaks between diagonal ones of the valleys. In this manner, as the laser beam is moved relative to the surface, a pattern of peaks and valleys in the surface is formed.

Referring to FIG. 33, sublimation of the first-part surface 520 results in a first-part ablated surface 522 having a first-part ablation pattern of peaks and valleys. Similarly, referring to FIG. 34, sublimation of the second-part surface 524 results in a second-part ablated surface 526 having a second-part ablation pattern of peaks and valleys. Example of an ablation pattern of peaks of valleys, which can be representative of the first-part ablation pattern and the second-part ablation pattern, are shown in FIGS. 36, 37, 45, and 46.

Figure 36:
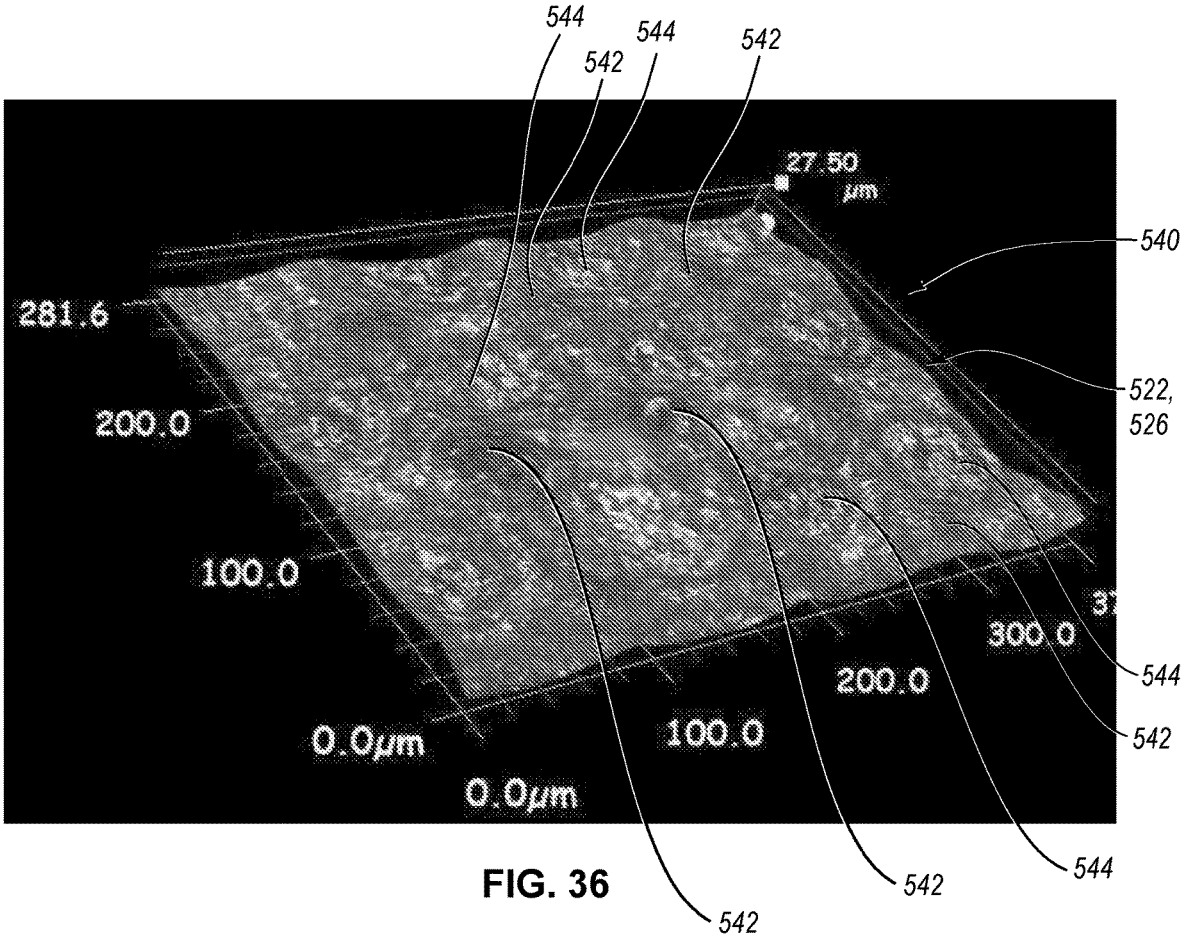
FIG. 36 is a schematic, perspective view of an ablation pattern, of peaks and valleys, of an ablated surface of a part of a golf club head, according to one or more examples of the present disclosure.
Figure 37:
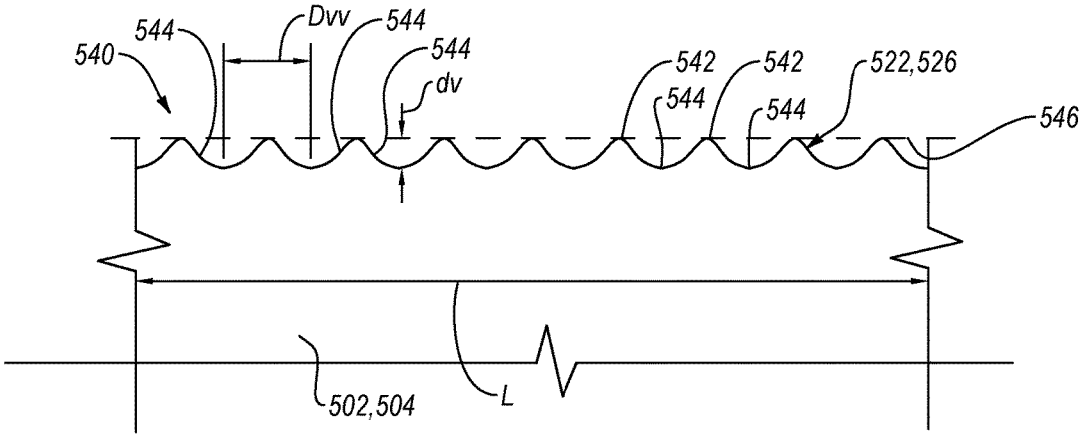
FIG. 37 is a schematic, side elevation view of an ablation pattern, of peaks and valleys, of an ablated surface of a part of a golf club head, according to one or more examples of the present disclosure.
Figure 45:
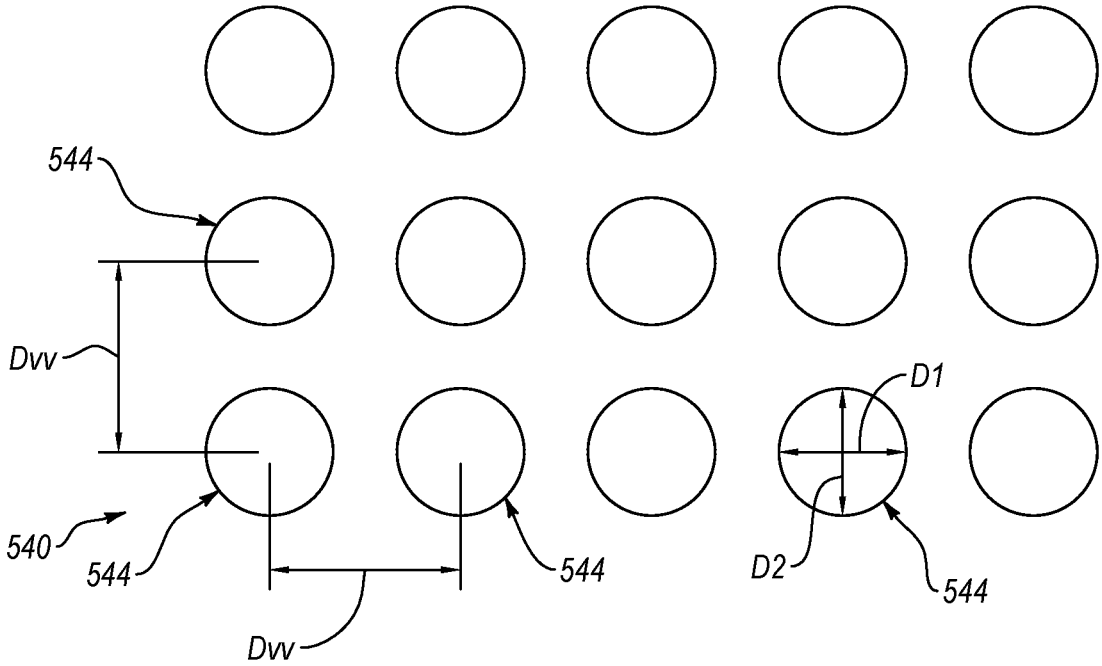
FIG. 45 is a schematic, top plan view of an ablation pattern on a part of a golf club head, according to one or more examples of the present disclosure.
Figure 46:
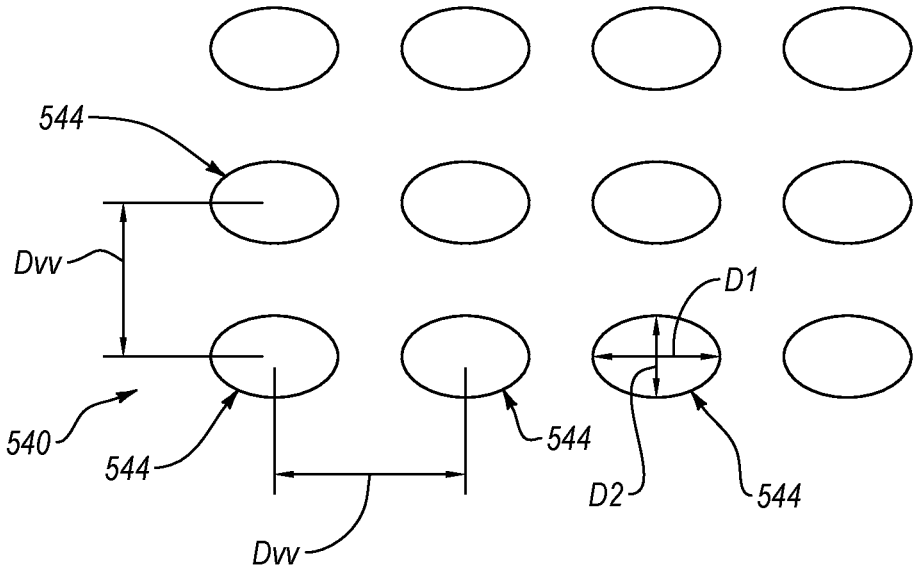
FIG. 46 is a schematic, top plan view of an ablation pattern on a part of a golf club head, according to one or more examples of the present disclosure.
Figure 47:
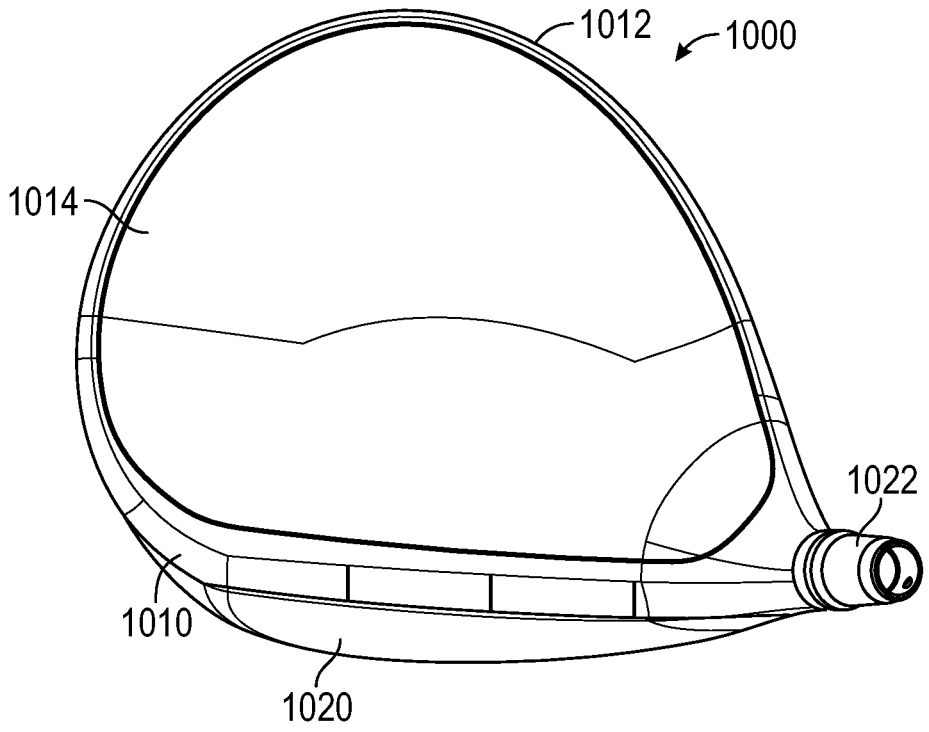
FIG. 47 is a top view of another embodiment of a golf club head.
Figure 48:
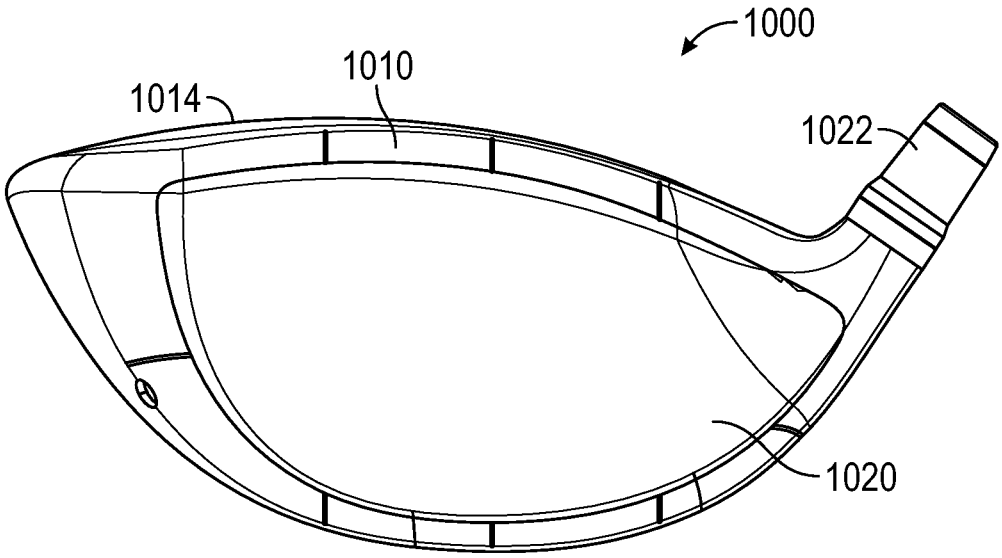
FIG. 48 is a front end view of the golf club head of FIG. 47.
Figure 49:
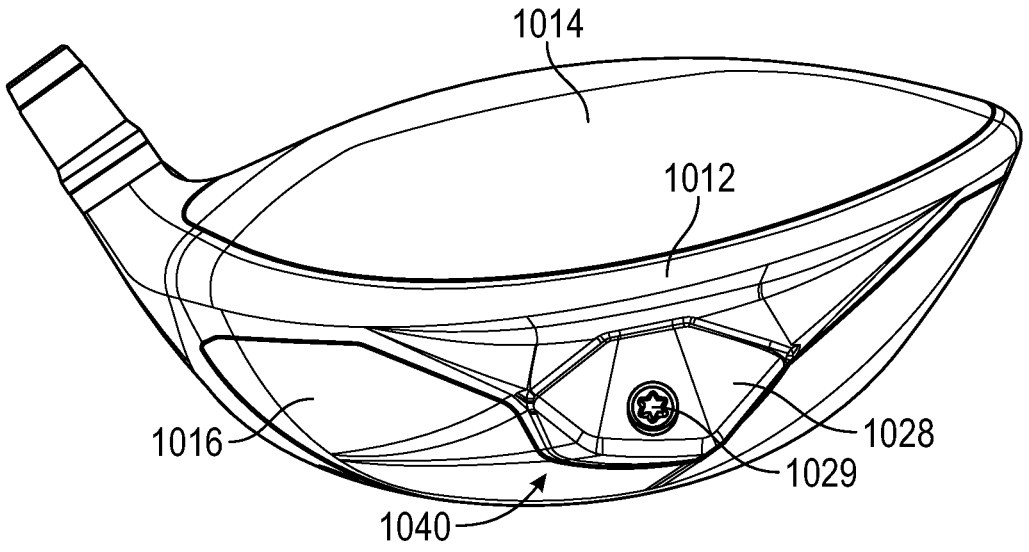
FIG. 49 is a rear end view of the golf club head of FIG. 47.

An ablation pattern 540 includes a plurality of peaks 542 spaced apart by a plurality of valleys 544. Generally, the laser beam is moved and pulsed such that the valleys are located relative to each other to form a desired pattern. The pattern of valleys can be symmetrical or non-symmetrical. Moreover, the spacing between valleys can be uniform or non-uniform. In one example, such as shown in FIGS. 36, 45, and 46, the ablation pattern 540 is symmetrical and the spacing between the valleys of the ablation pattern 540 is uniform. As shown in FIG. 36, in one example of a symmetrical pattern, the valleys of the ablation pattern 540 are uniformly spaced and closely spaced together, which means each valley is contiguous with at least one adjacent valley and at least one adjacent peak of the pattern of peaks and valleys. In the illustrated example of FIG. 36, some valleys, of the ablation pattern 540 of peaks and valleys, are contiguous with four adjacent valleys and four adjacent peaks. Likewise, in the illustrated example of FIG. 36, some peaks, of the ablation pattern 540 of peaks and valleys, are contiguous with four adjacent peaks and four adjacent valleys.

In some examples, each one of the valleys 544 is separated from an adjacent one of the valleys 544, across one of the peaks 542 and along a length L (or width) of the part, by a valley-to-valley distance Dvv. The valley-to-valley distance Dvv is defined as the distance from a center point of one of the valleys 544 and the center point of an adjacent one of the valleys 544. Moreover, each one of the valleys 544 has a valley depth dv measured from a hypothetical boundary 546 that is generally co-planar with the surface prior to being laser ablated. Referring to FIGS. 45 and 46, each one of the valleys 544 has a major dimension D1 (e.g., maximum dimension) and a minor dimension D2 (e.g., minimum dimension). The major dimension D1 is equal to or less than the minor dimension D2. For example, with reference to FIG. 45, when each one of the valleys 544 is substantially circular, the major dimension D1 is equal to the minor dimension D2. However, in other examples, as shown in FIG. 46, each one of the valleys 544 has a non-circular shape (e.g., an oval shape) such that the major dimension D1 is greater than the minor dimension D2. In some examples, such as when the surface, ablated by the laser beam, is flat, the resulting ablation pattern includes valleys 544 that are circular. However, according to certain examples, such as when the surface, ablated by the laser beam, is curved or contoured, the curvature of the surfaces causes the valleys 544 of the resulting ablation pattern to have an oval shape.

In some examples, the major dimension D1 of at least one of the valleys 544 is between 40 micrometers and 80 micrometers, and the minor dimension D2 is equal to the major dimension D1 or may vary by as much as 10% or 20% or by 10-20 micrometers. Additionally, or alternatively, the valley-to-valley distance Dvv between two valleys 544 can range from 80%-200% (preferably at least 120%) of the major dimension D1 of any one of the two valleys 544. As defined herein, in relation to the valleys 544, a first valley is adjacent a second valley when the second valley is the nearest neighbor to the first valley. Moreover, in some examples, such as those with uniform spacing between valleys, a given valley can be considered to be adjacent to multiple valleys. The center point of a valley 544 is defined as the location of greatest depth of the valley 544, which will typically be half of the major dimension inwards from an outer perimeter of the valley 544. The outer perimeter (e.g., perimeter) of a valley 544 is defined as the transition region where a change in the valley depth dv of the valley 544, versus an unablated surface, is no more than 5 micrometers, preferably between 0 to 2 micrometers versus an unablated surface.

According to one example, the uniformity of an ablation pattern of peaks and valleys, as used herein, can be defined in terms of the variation of the size of the valleys of the ablation pattern. As previously mentioned, the substantially non-controllable ablation pattern left behind by some ablation process, such as media-blast ablation processes, include valleys of widely disparate sizes, shapes, and spacing. The ability to precisely control the energy, pulse frequency, and directionality of the laser results in an ablation pattern where all the valleys of the pattern have a uniform size. The uniformity of the sizes of the valleys of the ablation pattern formed by the laser beam can be expressed by the percent difference in the size of one valley of the ablation pattern relative to any other one (e.g., all other ones) of the valleys of the ablation pattern. The percent difference, as pertaining to the size of the valleys, is equal to the ratio (expressed as a percentage) of the size of one valley in the pattern and the size of any other one of the valleys in the pattern. The lower the percent difference in the size of the valleys of the ablation pattern, the higher the uniformity of the ablation pattern. In some examples, the percent difference of the size of one valley of a given pattern and the size of any other one of the valleys of the given pattern is no more than 20%. In other words, the size of one valley is within 20% of the size of any other one, or all other ones, of the valleys. In other examples, the percent difference of the size of one valley of a given pattern and the size of any other one of the valleys of the given pattern is no more than 10%.

The size of a valley can be expressed as a cross-sectional area, the major dimension D1, the minor dimension D2, the depth dv, or other characteristic of the size of the valley. In certain examples, the major dimension D1 or the minor dimension D2 of one valley is within 20% of the corresponding major dimension D1 or the minor dimension D2 of any other one, or all other ones, of the valleys. According to one example, the major dimension D1 of one valley is within 20% of the major dimension D1 of any other one, or all other ones, of the valleys, and the minor dimension D2 of the one valley is within 20% of the minor dimension D2 of any other one, or all other ones, of the valleys. In certain examples, the major dimension D1 or the minor dimension D2 of one valley is within 10% of the corresponding major dimension D1 or the minor dimension D2 of any other one, or all other ones, of the valleys. According to one example, the major dimension D1 of one valley is within 10% of the major dimension D1 of any other one, or all other ones, of the valleys, and the minor dimension D2 of the one valley is within 10% of the minor dimension D2 of any other one, or all other ones, of the valleys. Although the above examples reference the major dimension D1 and the minor dimension D2 of the valleys, other characteristics of the size of the valleys, such as cross-sectional area and depth, can be interchanged with the major dimension D1 and the minor dimension D2.

Additionally, or alternatively, in some examples, the uniformity of an ablation pattern of peaks and valleys, as used herein, can be defined in terms of the variation of the distance between adjacent valleys of the ablation pattern. The ability to precisely control the energy, pulse frequency, and directionality of the laser results in an ablation pattern where all the valleys of the pattern are uniformly spaced apart from each other. The uniformity of the distance between the valleys of the ablation pattern formed by the laser beam can be expressed by the percent difference in the distance between two adjacent valleys of the ablation pattern relative to the distance between any other two adjacent valleys (e.g., all adjacent valleys) of the ablation pattern. The percent difference, as pertaining to the distances between valleys, is equal to the ratio (expressed as a percentage) of the distance between two adjacent valleys in the pattern and the distance between any other two adjacent valleys in the pattern. The lower the percent difference in the distances between the valleys of the ablation pattern, the higher the uniformity of the ablation pattern. In some examples, the percent difference of the distances between two adjacent valleys of a given pattern and the difference between any other two adjacent valleys of the given pattern is no more than 20%. In other words, the distance between two adjacent valleys is within 20% of the distance between any other two adjacent valleys. In other examples, the percent difference of the distances between two adjacent valleys of a given pattern and the difference between any other two adjacent valleys of the given pattern is no more than 10%.

Corresponding with the uniformity of the peaks and valleys of the ablation pattern on the ablated surfaces of the parts disclosed herein, laser ablating a surface of a part of the golf club head also promotes a higher surface energy compared to surfaces treated using other types of ablation processes. As presented above, a higher surface energy of surfaces to be bonded enables a stronger and more reliable bond between the surfaces. The surface energy of a surface is inversely proportional to the water contact angle of the surface. In other words, the lower the water contact angle of the surface, the higher the surface energy of that surface. The water contact angle is defined as the angle (through the water) a drop of water, on a surface, makes with the surface. The lower the water contact angle, the higher the wettability of the surface, which promotes the adhesiveness of the adhesive and the ability of the adhesive to bond to the surface. Accordingly, the lower the water contact angle, the better the bond, and the higher the strength of the bond. In some examples, the water contact angle can be measured by using a goniometer or other measuring device. According to Table 4 below, the water contact angle for various laser ablated surfaces of several examples of a golf club head, prior to forming a bonded joint, are shown.

TABLE 4

| | Crown-Hosel | Crown-Toe | Sole-Hosel | Sole-Toe |
|---|---|---|---|---|
| Example 1 | 14° | 6° | 10° | 5° |
| Example 2 | 16° | 12° | 10° | 6° |
| Example 3 | 14° | 13° | 10° | 10° |
| Example 4 | 11° | 13° | 10° | 2° |
| Example 5 | 16° | 13° | 10° | 12° |

TABLE 4-continued

| | Crown-Hosel | Crown-Toe | Sole-Hosel | Sole-Toe |
|---|---|---|---|---|
| Example 6 | 14° | 21° | 10° | 6° |
| Example 7 | 14° | 14° | 10° | 6° |
| Example 8 | 15° | 15° | 16° | 15° |
| Example 9 | 18° | 18° | 9° | 10° |
| Example 10 | 18° | 17° | 8° | 2° |

In Table 4, the crown-hosel surface is a portion of the front-ledge ablated surface 179A of the body 102 that is closer to the crown portion 119 than the sole portion 117, and closer to the hosel 120 than the toe portion 114; the crown-toe surface is a portion of the front-ledge ablated surface 179A of the body 102 that is closer to the crown portion 119 than the sole portion 117, and closer to the toe portion 114 than the hosel 120; the sole-hosel surface is a portion of the front-ledge ablated surface 179A of the body 102 that is closer to the sole portion 117 than the crown portion 119, and closer to the hosel 120 than the toe portion 114; and the sole-toe surface is a portion of the front-ledge ablated surface 179A of the body 102 that is closer to the sole portion 117 than the crown portion 119, and closer to the toe portion 114 than the hosel 120. Accordingly, with reference to Table 4, in some examples, the second-part ablated surface 526, or any laser ablated surface of the golf club head 100, has a water contact angle between 2° and 25°, or between 5° and 18°. According to yet certain examples, the water contact angle of an ablated surface of the golf club head 100 is less than 50°, less than 45°, less than 40°, less than 35°, less than 30°, less than 25°, or less than 20°. In some examples, the water contact angle of an ablated surface of the golf club head 100 is greater than zero degrees and less than 30° or greater than zero degrees and less than 25°. In certain examples, the water contact angle of an ablated surface of the golf club head 100 is between 1° and 18°.

Figure 38:
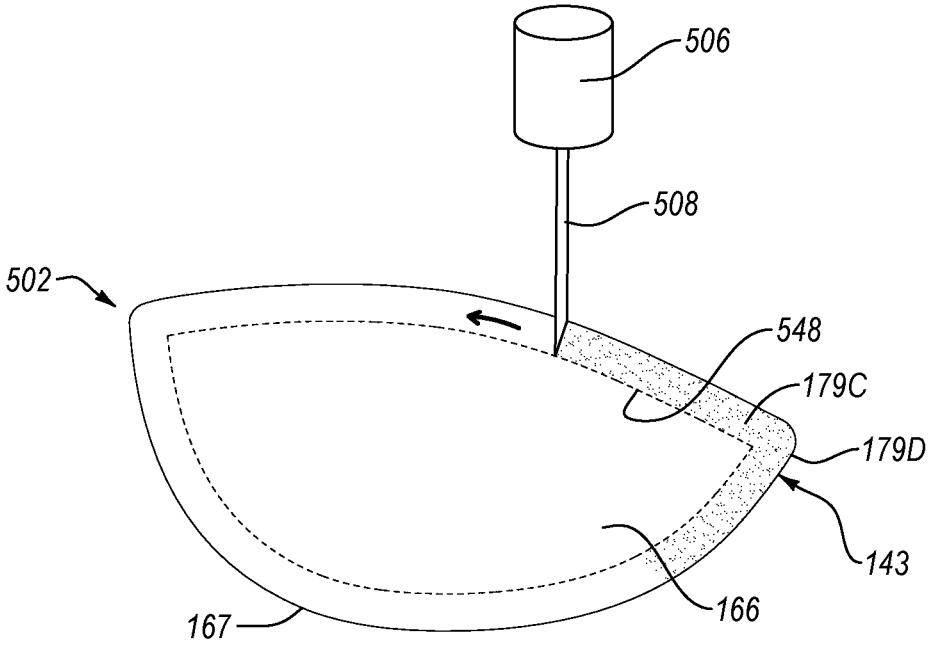
FIG. 38 is a schematic, perspective view of a strike plate of a golf club head being laser ablated by a laser, according to one or more examples of the present disclosure.
Figure 40:
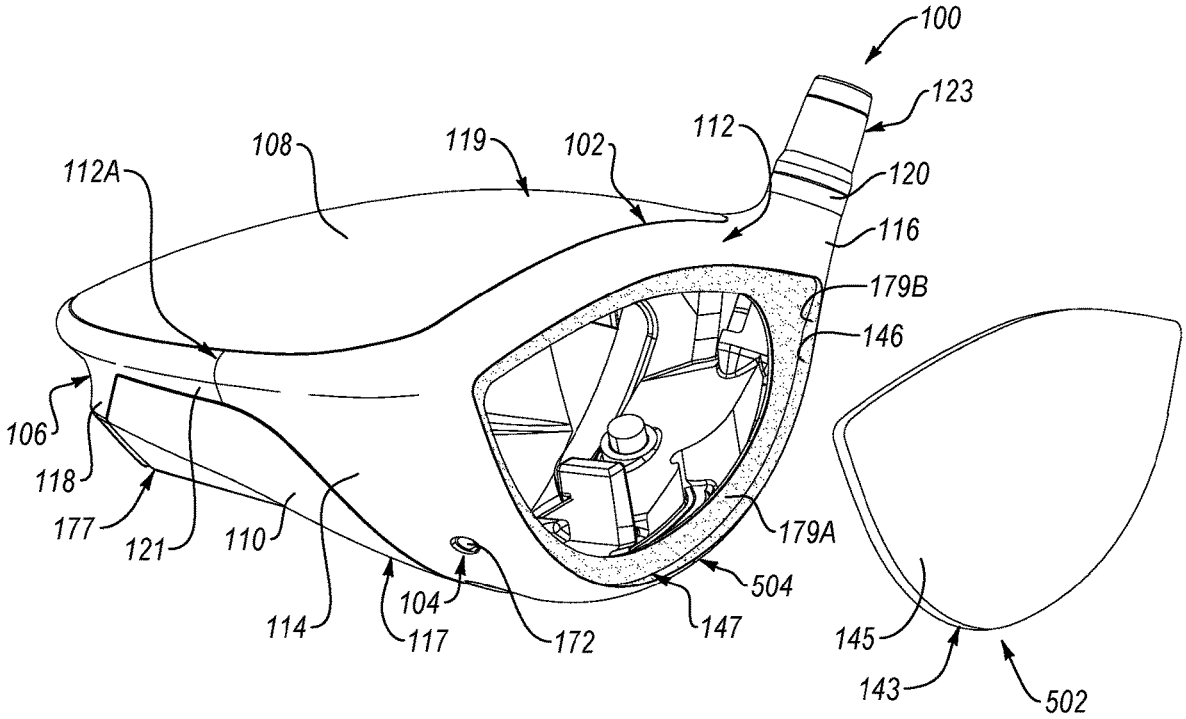
FIGS. 40 and 41 are schematic, perspective, exploded views of a strike plate and a body of a golf club head, according to one or more examples of the present disclosure.

Referring to FIGS. 38, 40, and 41, in some examples, the first part 502 is the strike plate 143 of the golf club head 100 and the second part 504 is the body 102 of the golf club head 100. In certain examples, the strike plate 143 can be made of a fiber-reinforced polymeric material and the body 102 can be made of a different material, such as a cast titanium material, non-cast titanium material, an aluminum material, a steel material, a tungsten material, a plastic material, and/or the like. The strike plate 143 is made of a plurality of stacked plies of fiber-reinforced polymeric material in certain examples. In one example, the strike plate 143 is made of between 35-70 stacked plies of fiber-reinforced polymeric material (each having continuous fibers at a given angle) and has a thickness between 3.5 mm and 6.0 mm, inclusive. The angle of the fibers of the plies can vary from ply-to-ply. Alternatively, the strike plate 143 can be made of a metallic material, such as a titanium alloy, and the body 102 can be made of the same metallic material or a different metallic material, such as a different titanium alloy. Also, the body 102, as presented above, can be made of multiple, separately formed and subsequently attached, pieces where each piece is made of a different material.

When the first part 502 is the strike plate 143 of the golf club head 100, the first-part surface 520 includes the interior surface 166 or rear surface of the strike plate 143, which is opposite the strike face 145 of the strike plate 143. Accordingly, as shown in FIG. 38, the first laser 506 generates the first-part laser beam 508 and directs the first-part laser beam 508 to impact the interior surface 166 within and along a designated first-part bond area 548, at least partially on the interior surface 166, to form a strike-plate-interior ablated surface 179C. Accordingly, only a portion (e.g., outer peripheral portion) of the entire interior surface 166 of the strike plate 143 is laser ablated, with the remaining portion of the interior surface 166 being non-ablated. The first-part ablated surface 522 includes, at least partially, the strike-plate-interior ablated surface 179C. In some examples, the first-part surface 520 also includes a peripheral edge surface 167 of the strike plate 145 and the first laser 506 generates the first-part laser beam 508 and directs the first-part laser beam 508 to impact (e.g., an entirety of) the peripheral edge surface 167 such that a strike-plate-edge ablated surface 179D is formed. Accordingly, the first-part ablated surface 522 can further include the strike-plate-edge ablated surface 179D and the designated first-part bond area 548 can further include the peripheral edge surface 167. The strike-plate-interior ablated surface 179C and the strike-plate-edge ablated surface 179D have the same ablation pattern in certain examples. In some examples, an orientation of the strike plate 143 relative to the first-part laser 506 is adjusted when laser ablating the peripheral edge surface 167, compared to when laser ablating the interior surface 166, because of the angle of the peripheral edge surface 167 relative to the interior surface 166.

Figure 39:
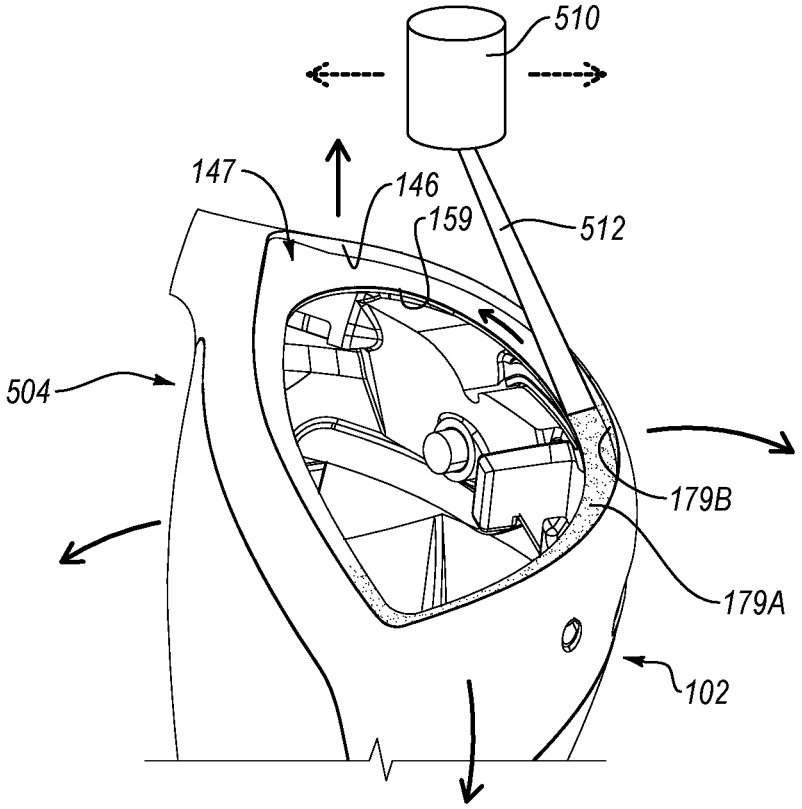
FIG. 39 is a schematic, perspective view of a body of a golf club head being laser ablated by a laser, according to one or more examples of the present disclosure.

When the second part 504 is the body 102, the second-part surface 524 includes the plate-opening recessed ledge 147 of the body 102. Accordingly, as shown in FIG. 39, the second laser 510 generates the second-part laser beam 512 and directs the second-part laser beam 512 to impact the plate-opening recessed ledge 147, within and along a designated second-part bond area, to form a front-ledge ablated surface 179A. The second-part ablated surface 526 includes, at least partially, the front-ledge ablated surface 179A. In some examples, the second-part surface 524 also includes the sidewall 146, extending about the plate-opening recessed ledge 147, and the second laser 510 generates the second-part laser beam 512 and directs the second-part laser beam 512 to impact (e.g., an entirety of) the sidewall 146 such that a front-sidewall ablated surface 179B is formed. Accordingly, the second-part ablated surface 526 can further include the front-sidewall ablated surface 179B and the designated second-part bond area can further include the sidewall 146. The front-ledge ablated surface 179A and the front-sidewall ablated surface 179B have the same ablation pattern in certain examples. In some examples, an orientation of the body 102 relative to the second-part laser 510 is adjusted when laser ablating the sidewall 146, compared to when laser ablating the plate-opening recessed ledge 147, because of the angle of the sidewall 146 relative to the plate-opening recessed ledge 147.

In view of the foregoing, according to some examples, such as with the golf club head 300 of FIG. 18, the second-part ablated surface 526 is defined by the ablated surfaces of two sub-components (e.g., the upper cup piece 304A and the lower cup piece 304B) made of different materials. Therefore, when the second-part ablated surface 526 is laser ablated, the different materials defining the second-part ablated surface 526 can be laser ablated in a single, continuous step. A first material of the different materials can define a first surface area of the second-part ablated surface 526 and the second material of the different materials can define a second surface area of the second-part ablated surface. The first surface area and the second surface area can be different in some examples. According to certain examples, the first surface area is greater than the second surface area, and the first material, defining the first surface area, has a lower density than the second material, defining the second surface area. Both the upper cup piece 304A and the lower cup piece 304B include a front ledge and a sidewall (similar to the plate opening recessed ledge 147 and the sidewall 146), which can be laser ablated to define the second-part ablated surface 526.

Referring to FIGS. 10-13, in some examples, the first part 502 is one of the crown insert 108 or the sole insert 110, and the second part 504 is the body 102. In certain examples, the crown insert 108 and/or the sole insert 110 can be made of a fiber-reinforced polymeric material and the body 102 can be made of a different material, such as a cast titanium material, non-cast titanium material, an aluminum material, a steel material, a tungsten material, a plastic material, and/or the like. Alternatively, the crown insert 108 and/or the sole insert 100 can be made of a metallic material, such as a titanium alloy, and the body 102 can be made of the same metallic material or a different metallic material, such as a different titanium alloy.

When the first part 502 is the crown insert 108, the first-part surface 520 includes an interior surface 108A of the crown insert 108. Accordingly, the first laser 506 generates the first-part laser beam 508 and directs the first-part laser beam 508 to impact the interior surface 108A of the crown insert 108 within and along a designated first-part bond area 548, at least partially on the interior surface 108A of the crown insert 108, to form a crown-insert ablated surface 108B. The first-part ablated surface 522 includes, at least partially, the crown-insert ablated surface 108B. Accordingly, only a portion (e.g., outer peripheral portion) of the entire interior surface of the crown insert 108 is laser ablated, with the remaining portion of the interior surface of the crown insert 108 being non-ablated. In some examples, the bond area on the interior surface 108A of the crown insert 108 will range from 2,000 $mm^2$ to 2,500 $mm^2$, such as at least 2,248 $mm^2$. Moreover, in certain examples, a total surface area of the interior surface 108A of the crown insert 108 is between 7,000 $mm^2$ and 12,000 $mm^2$ or between 9,000 $mm^2$ and 11,000 $mm^2$ (e.g., a minimum surface area between 7,000 $mm^2$ and 9,000 $mm^2$), such as between 9,379 $mm^2$ and 10,366 $mm^2$ (e.g., around 9,873 $mm^2$). In some examples, a percentage of the total surface area of the interior surface 108A occupied by the bond area on the interior surface 108A of the crown insert 108 is no more than 25%, 30%, 35%, or 40% and no less than 10%, 15%, 20%, or 25%. According to certain examples, the percentage of the total surface area of the interior surface 108A occupied by the bond area on the interior surface 108A of the crown insert 108 is between 20% and 25%, such as 22%, between 20% and 27%, or between 22% and 25%.

In some examples, the bond area on the interior surface 110A of the sole insert 110 will range from 1,800 $mm^2$ to 2,200 $mm^2$, such as at least 2,076 $mm^2$. Moreover, in certain examples, a total surface area of the interior surface 110A of the sole insert 110 is between 7,000 $mm^2$ and 12,000 $mm^2$ or between 9,000 $mm^2$ and 11,000 $mm^2$ (e.g., a minimum surface area between 7,000 $mm^2$ and 9,000 $mm^2$), such as between 8,182 $mm^2$ and 9,043 $mm^2$ (e.g., around 8,613 $mm^2$). In some examples, a percentage of the total surface area of the interior surface 110A occupied by the bond area on the interior surface 110A of the sole insert 110 is no more than 25%, 30%, 35%, or 40% and no less than 10%, 15%, 20%, or 25%. According to certain examples, the percentage of the total surface area of the interior surface 110A occupied by the bond area on the interior surface 110A of the sole insert 110 is between 20% and 27%, between 22% and 25%, or between 21% and 26%, such as 24%.

In some examples, the bond area on the interior surface of the strike plate 143 will range from 1,770 $mm^2$ to 2,170 $mm^2$, such as at least 1,976 $mm^2$. Moreover, in certain examples, a total surface area of the interior surface of the strike plate 143 is less than 7,000 $mm^2$, such as between 1,500 $mm^2$ and 7,000 $mm^2$, between 3,200 $mm^2$ and 4,700 $mm^2$, or between 3,572 $mm^2$ and 3,949 $mm^2$ (e.g., around 3,761 $mm^2$). In some examples, a percentage of the total surface area of the interior surface of the strike plate 143 occupied by the bond area on the interior surface of the strike plate 143 is no more than 55%, 60%, 65%, or 70% and no less than 30%, 35%, 40%, or 45%. According to certain examples, the percentage of the total surface area of the interior surface of the strike plate 143 occupied by the bond area on the interior surface of the strike plate 143 is between 47% and 58%, such as 52%.

In some examples, the first-part surface 520 also includes a peripheral edge surface of the crown insert 108 and the first laser 506 generates the first-part laser beam 508 and directs the first-part laser beam 508 to impact (e.g., an entirety of) the peripheral edge surface of the crown insert 108 such that a crown-insert-edge ablated surface 108C is formed. Accordingly, the first-part ablated surface 522 can further include the crown-insert-edge ablated surface 108C and the designated first-part bond area 548 can further include the peripheral edge surface of the crown insert 108. The crown-insert ablated surface 108B and the crown-insert-edge ablated surface 108C can have the same ablation pattern in certain examples. In some examples, an orientation of the crown insert 108 relative to the first-part laser 506 is adjusted when laser ablating the peripheral edge surface of the crown insert 108, compared to when laser ablating the interior surface 108A, because of the angle of the peripheral edge surface relative to the interior surface 108A.

When the first part 502 is the crown insert 108, the second-part surface 524 includes the top plate-opening recessed ledge 168. Accordingly, the second laser 510 generates the second-part laser beam 512 and directs the second-part laser beam 512 to impact the top plate-opening recessed ledge 168 within and along a designated second-part bond area, at least partially on the top plate-opening recessed ledge 168, to form a top-ledge ablated surface 141A. The second-part ablated surface 526 includes, at least partially, the top-ledge ablated surface 141A. In some examples, the second-part surface 520 also includes a top recessed-ledge sidewall, circumferentially surrounding and defining a depth of the top plate-opening recessed ledge 168, and the second laser 510 generates the second-part laser beam 512 and directs the second-part laser beam 512 to impact (e.g., an entirety of) the top recessed-ledge sidewall such that a top-sidewall ablated surface 141B is formed. Accordingly, the second-part ablated surface 526 can further include the top-sidewall ablated surface 141B and a designated second-part bond area can further include the top recessed-ledge sidewall. The top-ledge ablated surface 141A and the top-sidewall ablated surface 141B can have the same ablation pattern in certain examples. In some examples, an orientation of the body 102 relative to the second-part laser 506 is adjusted when laser ablating the top recessed-ledge sidewall, compared to when laser ablating the top plate-opening recessed ledge 168, because of the angle of the top recessed-ledge sidewall relative to the top plate-opening recessed ledge 168.

In view of the foregoing, according to some examples, the second-part ablated surface 526 is defined by the ablated surfaces of two sub-components (e.g., the cast cup 104 and the ring 106) made of different materials. Therefore, when the second-part ablated surface 526 is laser ablated, the different materials defining the second-part ablated surface 526 can be laser ablated in a single, continuous step.

When the first part 502 is the sole insert 110, the first-part surface 520 includes an interior surface 110A of the sole insert 110. Accordingly, the first laser 506 generates the first-part laser beam 508 and directs the first-part laser beam 508 to impact the interior surface 110A of the sole insert 110 within and along a designated first-part bond area 548, at least partially on the interior surface 110A of the crown insert 110, to form a sole-insert ablated surface 110B. The first-part ablated surface 522 includes, at least partially, the sole-insert ablated surface 110B. Accordingly, only a portion (e.g., outer peripheral portion) of the entire interior surface of the sole insert 110 is laser ablated, with the remaining portion of the interior surface of the sole insert 110 being non-ablated. In some examples, the first-part surface 520 also includes a peripheral edge surface of the sole insert 110 and the first laser 506 generates the first-part laser beam 508 and directs the first-part laser beam 508 to impact (e.g., an entirety of) the peripheral edge surface of the sole insert 110 such that a sole-insert-edge ablated surface 110C is formed. Accordingly, the first-part ablated surface 522 can further include the sole-insert-edge ablated surface 110C and the designated first-part bond area 548 can further include the peripheral edge surface of the sole insert 110. The sole-insert ablated surface 110B and the sole-insert-edge ablated surface 110C can have the same ablation pattern in certain examples. In some examples, an orientation of the sole insert 110 relative to the first-part laser 506 is adjusted when laser ablating the peripheral edge surface of the sole insert 110, compared to when laser ablating the interior surface 110A, because of the angle of the peripheral edge surface relative to the interior surface 110A.

Furthermore, when the first part 502 is the sole insert 110, the second-part surface 524 includes the sole-opening recessed ledge 170. Accordingly, the second laser 510 generates the second-part laser beam 512 and directs the second-part laser beam 512 to impact the sole-opening recessed ledge 170 within and along a designated second-part bond area, at least partially on the sole-opening recessed ledge 170, to form a bottom-ledge ablated surface 142A. The second-part ablated surface 526 includes, at least partially, the bottom-ledge ablated surface 142A. In some examples, the second-part surface 524 also includes a bottom recessed-ledge sidewall, circumferentially surrounding and defining a depth of the sole-opening recessed ledge 170, and the second laser 510 generates the second-part laser beam 512 and directs the second-part laser beam 512 to impact (e.g., an entirety of) the bottom recessed-ledge sidewall such that a bottom-sidewall ablated surface 142B is formed. Accordingly, the second-part ablated surface 526 can further include the bottom-sidewall ablated surface 142B and the designated second-part bond area can further include the bottom recessed-ledge sidewall. The bottom-ledge ablated surface 142A and the bottom-sidewall ablated surface 142B can have the same ablation pattern in certain examples. In some examples, an orientation of the body 102 relative to the second-part laser 510 is adjusted when laser ablating the bottom recessed-ledge sidewall, compared to when laser ablating the sole-opening recessed ledge 170, because of the angle of the bottom recessed-ledge sidewall relative to the sole-opening recessed ledge 170.

As disclosed above, in some examples, an orientation of a part being laser ablated can be adjusted relative to the laser that is ablating the part. In one example, as shown by directional arrows, with dashed lines, in FIG. 39, the part is held stationary and the orientation of the laser or the directionality of the laser beam is changed relative to the part. The orientation of the laser can be changed by moving the laser, such as via a numerically-controlled robot, or adjusting the directionality of the laser beam generated by the laser, such as by using electronically controllable optical components.

According to another example, as shown by directional arrows, with solid lines, in FIG. 39, the laser is held stationary (or the directionality of the laser beam is held constant), and the orientation of the part is adjusted or the part is moved relative to the laser beam. The orientation of the part can be adjusted by fixing the part to an adjustable platform, that can be translationally moved or rotated to translationally move or rotate the part relative to the laser beam.

Although in some examples, the methods disclosed herein may be performed manually, in other examples, the methods are automated. As used herein, automated means operated at least partially by automatic equipment, such as computer-numerically-controlled (CNC) machines. The process of controlling the laser, including the directionality and/or characteristics of the laser beam, and/or controlling the orientation/position of the part relative to the laser beam is automated in some examples. For example, an electronic controller can control the laser and part-adjustment components (e.g., motors, cylinders, gears, rails, etc.) that hold and adjust the orientation/position of the part.

Because the golf club head 100 has both a crown insert 108 and a sole insert 110 attached to the body 102, in some examples, the method 550 can be performed to make a golf club head that has more than one first part 502 coupled to the second part 504. In other words, in at least one example, the golf club head 100 includes at least two first parts 502 coupled to the second part 504. Moreover, because the golf club head 100 also includes a strike plate 148 attached to the body 102, in certain examples, the method 550 can be performed to make a golf club head that has at least three first parts 502 coupled to the second part 504.

As described above, the body 102 of the golf club head 100 includes multiple pieces that are attached together to form a multi-piece construction. For example, referring to FIGS. 14 and 15, the body 102 of the golf club head 100 includes the cast cup 104 and the ring 106. Accordingly, in some examples, the method 550 can be performed to make a body of a golf club head that includes the first part 502 and the second part 504. The first part 502 is the ring 106 and the second part 504 is the cast cup 104 in certain examples. As disclosed above, the ring 106 and the cast cup 104 can be made of different materials. For example, the ring 106 can be made of a metallic material or a plastic material having a relatively lower density that the material of the cast cup 104, which can be made of a cast titanium material.

When the first part 502 is the ring 106 and the second part 504 is the cast cup 104, the first-part surface 520 includes the toe cup-engagement surface 152A and the heel cup-engagement surface 152B. Accordingly, the first laser 506 generates the first-part laser beam 508 and directs the first-part laser beam 508 to impact the toe cup-engagement surface 152A and the heel cup-engagement surface 152B within and along a designated first-part bond area, at least partially on the toe cup-engagement surface 152A and the heel cup-engagement surface 152B, to form a toe cup-engagement ablated surface 148C and a heel cup-engagement surface 148D, respectively. The first-part ablated surface 522 includes, at least partially, the toe cup-engagement ablated surface 148C and the heel cup-engagement surface 148D. The toe cup-engagement ablated surface 148C and the heel cup-engagement surface 148D can have the same ablation pattern in certain examples.

Correspondingly, when the first part 502 is the ring 106 and the second part 504 is the cast cup 104, the second-part surface 524 includes the toe ring-engagement surface 150A and the heel ring-engagement surface 150B. Accordingly, the second laser 510 generates the second-part laser beam 512 and directs the second-part laser beam 512 to impact the toe ring-engagement surface 150A and the heel ring-engagement surface 150B within and along a designated second-part bond area, at least partially on the toe ring-engagement surface 150A and the heel ring-engagement surface 150B, to form a toe ring-engagement ablated surface 148A and a heel ring-engagement surface 148B, respectively. The first-part ablated surface 522 includes, at least partially, the toe ring-engagement ablated surface 148A and the heel ring-engagement surface 148B. The toe ring-engagement ablated surface 148A and the heel ring-engagement surface 148B can have the same ablation pattern in certain examples.

After the ring 106 is bonded to the cast cup 104, the ring 106 and the cast cup 104 can collectively define a second part 504 to which a first part 502 is bonded according to the method 550. In other words, the second part 504 can have a multi-piece construction. In fact, with reference to FIG. 18, the cast cup can have a multi-piece construction, such that one piece of the cast cup is the first part 502 and another piece of the cast cup is the second part 504, such that the multiple pieces (e.g., made of the same or different materials) of the cast cup have ablated surfaces bonded together after the manner of the method 550.

As used herein, dashed leader lines are used to indicate features in a prior state. For example, a surface referenced by a dashed leader line indicates that surface prior to being modified into a surface referenced by a solid leader line. This methodology is helpful in understanding the correlation between a surface before and after being ablated.

In some examples, the step of laser ablating the first-part surface 520 or the step of laser ablating the second-part surface 524 is performed to remove alpha case from a corresponding one of the first part 502 or the second part 504. In such examples, the corresponding one of the first part 502 or the second part 504 is made of a titanium alloy that is prone to developing a layer of alpha case on the first-part surface 520 or the second-part surface 524, respectively, during manufacturing (e.g., casting) of the corresponding part (see, e.g., U.S. Pat. No. 10,780,327, issued Sep. 22, 2020, which is incorporated herein by reference). The corresponding one of the first-part surface 520 or the second-part surface 524 is ablated to a depth sufficient to remove the layer of alpha case from the corresponding part. Using the laser ablation method disclosed herein enables the alpha case to be removed with more precision, efficiency, and lower waste materials that conventional methods, such as chemical etching, computer numerically-controlled (CNC) machine, or abrasion techniques.

Figure 43:
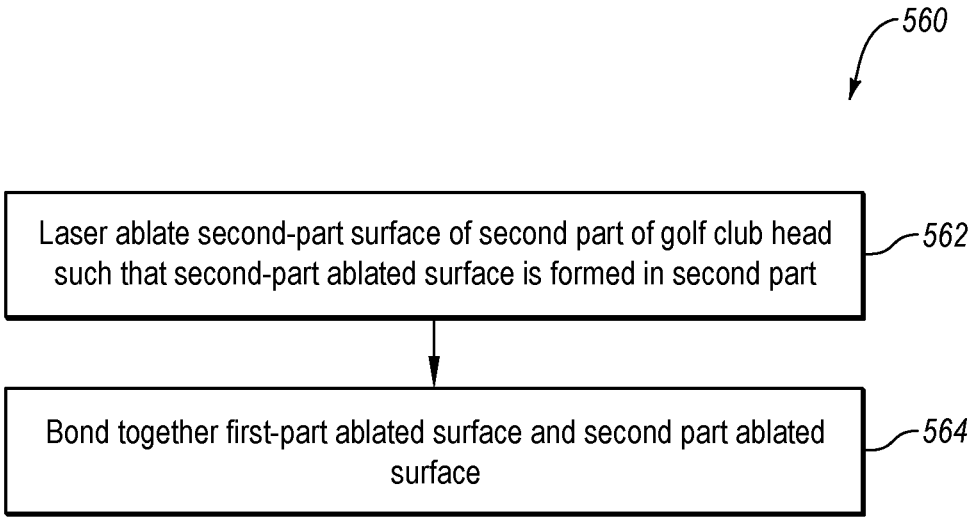
FIG. 43 is a schematic flow diagram of a method of making a golf club head, according to one or more examples of the present disclosure.
Figure 44:
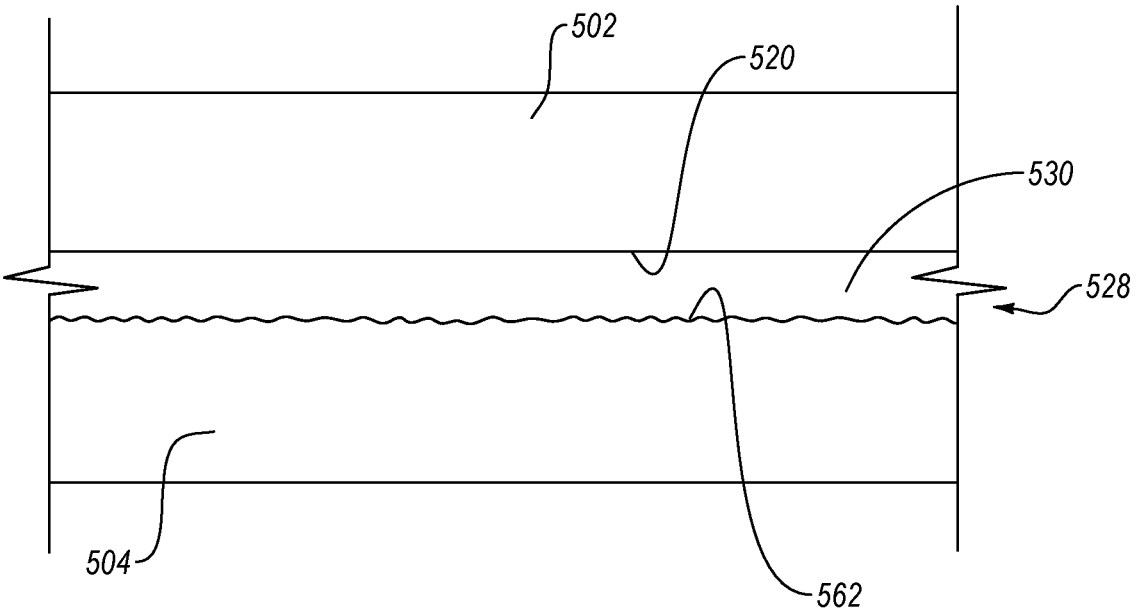
FIG. 44 is a schematic, side elevation view of a first part, of a golf club head, bonded to a second part, of the golf club head, according to one or more examples of the present disclosure.

Referring to FIGS. 43 and 44, in alternative examples, only one of the two surfaces forming the bondline 528 is laser ablated. According to one example, a method 560 of making the golf club heads of the present disclosure, such as the golf club head 100, includes (block 562) laser ablating the second-part surface 524 of the second part 504 of the golf club head 100 such that the second-part ablated surface 526 is formed in the second part 504. The method 560 additionally includes (block 564) bonding together the first-part surface 520, of the first part 502 of the golf club head 100, and the second-part ablated surface 526 of the second part 504. In other words, instead of the second-part ablated surface 526 being bonded to a first-part ablated surface of the first part 502, the second-part ablated surface 526 of the second part 504 is bonded to a non-ablated surface (i.e., the first-part surface 520) of the first part 502.

In certain examples, the second part 504 in the method 560 is made of a titanium alloy, such as a cast alloy, and the first part 502 in the method 560 is made of a fiber-reinforced polymeric material. For example, the first part 502 can be the strike plate 143, the second part 504 can be the body 102, and the second-part ablated surface 526 can define the plate-opening recessed ledge 147 of the body 102. However, unlike the strike plate 143 shown in FIG. 38, the interior surface 166 of the strike plate 143 used in the method 560 is not laser ablated. Instead, the interior surface 166 of the strike plate 143 is untreated or treated using a different type of surface treatment, such as media blasting or chemical etching. According to another example, the first part 502 can be one of the crown insert 108 or the sole insert 110, the second part 504 can be the body 102, and the second-part ablated surface 526 can define one of the top plate-opening recess ledge or the sole-opening recessed ledge.

According to some examples, the method 560 is used to make a golf club head similar to the golf club head 100, except the strike plate 143, the crown insert 108, and/or the sole insert 110 does not have a laser-ablated surface. Instead, in some examples, only the body 102, which can be made of a cast titanium alloy, includes laser-ablated surfaces. According to one example, the body 102 includes the top-ledge ablated surface 141A, the bottom-ledge ablated surface 141B, and the front-ledge ablated surface 179A, but the crown insert 108 does not include the crown-insert ablated surface 108B, the sole insert 110 does not include the sole-insert ablated surface 110B, and the strike plate 143 does not include the strike-plate-interior ablated surface 179C.

Each bonded joint of the golf club head 100 is defined by two bonded surfaces (e.g., faying surfaces). Because a bonded joint has two equal and opposite bonded surfaces, a surface area of each bonded joint (i.e., bond area of each bonded joint) is defined as the surface area of just one of the two bonded surfaces. In other words, as defined herein, the bond area of each bonded joint does not include the surface area of both bonded surfaces of the bonded joint. Accordingly, as used herein, the bond area of a bonded joint, defined between two surfaces of the golf club head disclosed herein, is the surface area of the portion of any one (but just one) of the two surfaces of the bonded joint that is covered by or in direct contact with an adhesive between the two surfaces. In view of this definition, the bond area is equal to the surface area of one of two surfaces of the adhesive (e.g., the adhesive 530) defining the bonded joint.

In some examples, at least one of the two bonded surfaces of at least one bonded joint of the golf club head 100 is a laser ablated surface. Accordingly, the bond area of a bonded joint defined by a laser ablated surface can be the surface area of the laser ablated surface. Therefore, unless otherwise noted, a surface area of an ablated surface is equal to the bond area of the bonded joint defined by the laser ablated surface. Moreover, the bond area of a bonded joint defined by a non-ablated surface (e.g., the first-part surface 520 of FIG. 44) and an ablated surface is the surface area of the portion of the non-ablated surface that is bonded to the ablated surface or the portion of the non-ablated surface that is covered by or in direct contact with the adhesive 530. Accordingly, a non-ablated surface can have a total surface area that is larger than the surface area of the portion of the non-ablated surface bonded to the ablated surface of a bonded joint.

As defined herein, the surface area of a laser ablated surface is the area of the portion of the surface covered by the pattern of peaks and valleys formed by the laser beam. Accordingly, the surface area of a laser ablated surface can be calculated as a length times a width of the portion of the surface that includes the pattern of peaks and valleys, or calculated by the combined surface area of the peaks and valleys of the pattern of peaks and valleys. Moreover, because in some examples, the bonded surfaces of a bonded joint are contoured, to provide a more convenient way of calculating the area of the bonded surfaces, as defined herein, the surface area of a surface is a projected surface area, which is the surface area of the surface projected onto a hypothetical plane substantially facing the surface.

Generally, a total bond area of the golf club head 100 is higher than conventional golf club heads. Moreover, a high percentage, such as 50%-100%, of the total bond area of the golf club head 100 is defined by laser ablated surfaces. According to one example, the second-part ablated surface 526 of the golf club head 100 has a surface area between 800 $mm^2$ and 2,880 $mm^2$. In this, or other examples, the second-part ablated surface 526 of the golf club head 100 has a surface area of at least 1,560 $mm^2$, of at least 1,770 $mm^2$, of at least 2,062 $mm^2$, or of at least 2,600 $mm^2$. As defined previously, the first-part surface 520 or the first-part ablated surface 522 of the golf club head 100 can have corresponding surface areas because they would define the side of a bonded joint opposite the second-part ablated surface 526. Referring to Table 5 below, areas of some features and the bond area (in $mm^2$) of bonded surfaces of bonded joints of several examples of the golf club heads disclosed herein, which can be the same as or different than the examples of Table 4, is shown.

TABLE 5

| | Example 1 | Example 2 | Example 3 |
|---|---|---|---|
| Plate Opening Area | 2266 | 1674 | 1330-2720 |
| Front-Ledge Ablated Surface Area | 1010 | — | 800-1220 |
| Front-Sidewall Ablated Surface Area | 806 | — | 640-970 |
| Strike Face Ablated Surface Area | 1073 | 1073 | 850-1290 |
| Lower Cup Piece Ablated Surface Area | — | 599 | 470-720 |
| Lower Cup Piece Ledge Ablated Surface Area | — | 267 | 210-330 |
| Lower Cup Piece Sidewall Ablated Surface Area | — | 222 | 170-270 |
| Ring-Engagement Ablated Surface Area | 80 | — | 60-100 |
| Cup-Engagement Ablated Surface Area | 112 | — | 80-140 |
| Cup Top-Ledge Ablated Surface Area | 1424 | — | 1130-2000 |
| Cup Bottom-Ledge Ablated Surface Area | 1000 | — | 800-1200 |
| Ring Top-Ledge Ablated Surface Area | 935 | — | 740-1130 |
| Ring Bottom-Ledge Ablated Surface Area | 1420 | — | 1130-1710 |

In some examples, the forward sole-opening recessed ledge 170A (e.g., the cup bottom-ledge ablated surface area of Table 5) defines a bond area of about 1,054 $mm^2$, the forward crown-opening recessed ledge 168A (e.g., the cup top-ledge ablated surface area of Table 5) defines a bond area of about 1,910 $mm^2$, the toe ring-engagement surface 150A and the heel ring-engagement surface 150B (e.g., the ring-engagement ablated surface area of Table 5) or the toe cup-engagement surface 152A and the heel cup-engagement surface 152B (e.g., the cup-engagement ablated surface area of Table 5) are about 98 $mm^2$, the plate-opening recessed ledge 147 and the sidewall 146 (e.g., the front-ledge ablated surface area and the front-sidewall ablated surface area) define a bond area of about 2,240 $mm^2$, a total bond area defined by the cast cup 104 is 5,300 $mm^2$. According to the same or alternative examples, the rearward crown-opening recessed ledge 168B (e.g., the ring top-ledge ablated surface area of Table 5) defines a bond area of about 928 $mm^2$, the rearward sole-opening recessed ledge 170B (e.g., the ring bottom-ledge ablated surface area of Table 5) defines a bond area of about 1,222 $mm^2$, and a total bond area defined by the ring 106 is 2,250 $mm^2$.

In view of the foregoing, in some examples, the golf club head 100 includes a single component or piece (e.g., the ring 106) that is bonded to three other components or pieces of the golf club head 100 where a total bonded area between these four components or pieces of the golf club head 100 is between 1,950 $mm^2$ and 2,500, $mm^2$, or more preferably between 2,100 $mm^2$ and 2,400 $mm^2$. According to some examples, the golf club head 100 includes a single component or piece (e.g., the cast cup 104) that is bonded to three other components or pieces of the golf club head 100 where a total bonded area between these four components or pieces of the golf club head 100 is between 2,250 $mm^2$ and 3,400, $mm^2$, or more preferably between 2,900 $mm^2$ and 3,200 $mm^2$. According to yet some examples, the golf club head 100 includes a single component or piece (e.g., the cast cup 104) that is bonded to four other components or pieces of the golf club head 100 where a total bonded area between these five components or pieces of the golf club head 100 is between 4,750 $mm^2$ and 6,200, $mm^2$, or more preferably between 4,900 $mm^2$ and 5,500 $mm^2$. In certain examples, the golf club head includes a single component or piece (e.g., the upper cup piece 304A) that is bonded to five other components or pieces of the golf club head 100 where a total bonded area between these six components or pieces of the golf club head 100 is between 5,500 $mm^2$ and 7,000, $mm^2$, or more preferably between 5,700 $mm^2$ and 6,300 $mm^2$.

The golf club heads of the present disclosure have a high bond area, between multiple pieces of the golf club heads, relative to a volume of the golf club heads. In other words, for a given size of a golf club head, the amount of bonded area is significantly higher than for conventional golf club heads. According to some examples, the volume of a golf club head, such as the golf club head 100, disclosed herein is between 450 cc and 600 cc, and more preferably between 450 cc and 470 cc. Moreover, in certain examples, a bond-volume ratio, or a ratio of a combined bond area of the plurality of bonded joints of the golf club head to a volume of the golf club head is at least 3.75 $mm^2$/cc and at most 15.5 $mm^2$/cc (e.g., at least 9.1 $mm^2$/cc and at most 14.0 $mm^2$/cc). In some examples, the bond-volume ratio of at least some of the examples of golf club heads disclosed herein is at least 7.9 $mm^2$/cc and at most 13.7 $mm^2$/cc (e.g., at least 8.1 $mm^2$/cc and at most 12.2 $mm^2$/cc). In yet some examples, the bond-volume ratio of at least some of the examples of golf club heads disclosed herein is at least 3.75 $mm^2$/cc and at most 7.5 $mm^2$/cc (e.g., at least 4.8 $mm^2$/cc and at most 7.1 $mm^2$/cc).

According to some alternative examples, a bond-volume ratio, or a ratio of a combined bond area of the plurality of bonded joints of the golf club head to a volume of the golf club head is at least 10 $mm^2$/cc and at most 18.8 $mm^2$/cc (e.g., at least 10 $mm^2$/cc and at most 15.5 $mm^2$/cc or at least 11.6 $mm^2$/cc and at most 17.7 $mm^2$/cc). In some examples, the bond-volume ratio of at least some of the examples of golf club heads disclosed herein is at least 10.5 $mm^2$/cc and at most 15.3 $mm^2$/cc, at least 11.6 $mm^2$/cc and at most 18.8 $mm^2$/cc, or at least 12.1 $mm^2$/cc and at most 17.5 $mm^2$/cc.

The golf club head disclosed herein is made of multiple pieces adhesively bonded together. Accordingly, in some examples, the golf club head disclosed herein includes multiple pieces coupled together via an adhesive such that no portions or pieces of the golf club head are welded together.

The bond area of a bonded joint is defined by a width ($W_{BA}$) and a length ($L_{BA}$) of the bonded joint (see, e.g., FIG. 15). The width $W_{BA}$ can be variable along the length $L_{BA}$ of a bonded joint. Generally, the length $L_{BA}$ of the bond area of a bonded joint is greater than the width $W_{BA}$ of the bond area of the bonded joint. The bonded joint can be continuous such that a length $L_{BA}$ of the bond area of the bonded joint is continuous. However, in some examples, the bonded joint is non-continuous or intermittent such that the length $L_{BA}$ of the bond area of the bonded joint is a summation of the lengths of the intervals of the bonded joint. Although the width $W_{BA}$ and the length $L_{BA}$ of the bonded area of only two bonded joints (e.g., the bonded area associated with the forward crown-opening recessed ledge 168A and the rearward crown-opening recessed ledge 168B) are shown in FIG. 15, it is recognized that, although not specifically labeled, the bonded area of each one of the bonded joints of the golf club head 100 has a corresponding width $W_{BA}$ and length $L_{BA}$, similar to those shown in FIG. 15, that are not labeled for ease in showing and labeling other features of the golf club head 100. Additionally, regarding the length $L_{BA}$, as defined herein, the length $L_{BA}$ of the bond area of a bonded joint is the maximum length of the bond area. Accordingly, where a bond area can be considered to have two different lengths, such as a maximum length (e.g., along an outer perimeter of the bond area, such as shown in FIG. 15) and a minimum length (e.g., along an inner perimeter of the bond area), the length $L_{BA}$ of the bond area is defined herein to be the largest or maximum length of the bond area.

According to some examples, the bond area of at least one bonded joint of the golf club head 100 has a continuous length $L_{BA}$ of between 174 mm and 405 mm, such as at least 250 mm. For example, the combined bond area defined by the forward crown-opening recessed ledge 168A and the rearward crown-opening recessed ledge 168B has a continuous length $L_{BA}$ of at least 268 mm, of at least 300 mm, at least 316 mm, at least 353 mm, or at least 370 mm. As another example, the combined bond area defined by the forward sole-opening recessed ledge 170A and the rearward sole-opening recessed ledge 170B has a continuous length $L_{BA}$ of at least 281 mm, of at least 314 mm, at least 331 mm, at least 350 mm, or at least 367 mm. According to yet another example, the bond area defined by the plate-opening recessed ledge 147 has a continuous length $L_{BA}$ of at least 174 mm, of at least 194 mm, at least 205 mm, at least 250 mm, or at least 262 mm. According to some examples, a combined length of the plurality of bonded joints is at least 723 mm and at most 1,094 mm, such as between 852 mm and 953 mm.

In some examples, a length-area ratio, equal to a ratio of the length $L_{BA}$ to the bond area of a bonded joint, of the bond defined by the forward crown-opening recessed ledge 168A and the rearward crown-opening recessed ledge 168B is between 0.13 and 0.16, such as around 0.15. In yet some examples, the length-area ratio of the bond defined by the forward sole-opening recessed ledge 170A and the rearward sole-opening recessed ledge 168B is between 0.13 and 0.16, such as around 0.15.

In yet some examples, the length-area ratio of the bond defined by the forward sole-opening recessed ledge 170A and the rearward sole-opening recessed ledge 168B is between 0.13 and 0.16, such as around 0.15.

In yet some examples, the length-area ratio of the bond defined by the plate-opening recessed ledge 147 is between 0.10 and 0.13, such as around 0.11.

Although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one embodiment, a method of making a golf club head, such as the golf club head 100, includes one or more of the following steps: (1) forming a body having a sole opening, forming a composite laminate sole insert, injection molding a thermoplastic composite head component over the sole insert to create a sole insert unit, and joining the sole insert unit to the body; (2) forming a body having a crown opening, forming a composite laminate crown insert, injection molding a thermoplastic composite head component over the crown insert to create a crown insert unit, and joining the crown insert unit to the body; (3) forming a weight track, capable of supporting one or more slidable weights, in the body; (4) forming the sole insert and/or the crown insert from a thermoplastic composite material having a matrix compatible for bonding with the body; (5) forming the sole insert and/or the crown insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (6) forming both the sole insert and the weight track from thermoplastic composite materials having a compatible matrix; (7) forming the sole insert from a thermosetting material, coating a sole insert with a heat activated adhesive, and forming the weight track from a thermoplastic material capable of being injection molded over the sole insert after the coating step; (8) forming the body from a material selected from the group consisting of titanium, one or more titanium alloys, aluminum, one or more aluminum alloys, steel, one or more steel alloys, polymers, plastics, and any combination thereof; (9) forming the body with a crown opening, forming the crown insert from a composite laminate material, and joining the crown insert to the body such that the crown insert overlies the crown opening; (10) selecting a composite head component from the group consisting of one or more ribs to reinforce the golf club head, one or more ribs to tune acoustic properties of the golf club head, one or more weight ports to receive a fixed weight in a sole portion of the golf club head, one or more weight tracks to receive a slidable weight, and combinations thereof; (11) forming the sole insert and the crown insert from a continuous carbon fiber composite material; (12) forming the sole insert and the crown insert by thermosetting using materials suitable for thermosetting, and coating the sole insert with a heat activated adhesive; and (13) forming the body from titanium, titanium alloy or a combination thereof to have the crown opening, the sole insert, and the weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the body such that the crown insert overlies the crown opening.

Inserts with Vibration-Reducing Features

In embodiments in which the body of the golf club head comprises relatively large crown and/or sole openings covered by inserts, the inserts can have relatively low frequency vibration modes that are excited upon striking a golf ball. For example, in embodiments in which the body of the golf club head comprises a cup (e.g., a cast metal cup) and a rear ring, one or both of the sole insert and the crown insert can have a first mode frequency that is less than 4,000 Hz, such as 3,500 Hz or less, that is excited upon striking a golf ball. Vibration in this frequency range can result in relatively large amplitude oscillations of the insert, which can be problematic at the perimeter edges of the insert where the insert is coupled to the rear ring. Depending upon factors including the geometry of the rear ring, the geometry of the inserts, the materials of the rear ring and the inserts, etc., the vibration characteristics of the rear ring and the inserts may differ such that relatively large stresses are developed at the interface between the rear ring and the inserts. Where the inserts are joined to the rear ring by resin or other adhesive bonding, this can lead to premature failure and debonding of the inserts from the rear ring. Such inserts can also develop relatively high stresses in the body of the insert away from the perimeter edges, which can also lead to premature failure.

One approach to addressing this problem involves including vibration-reducing features on the inserts. The vibration-reducing features can include a variety of structures including ribs, pillars, areas of varying thickness, areas of varying material types, and/or combinations of such features, that are sized, shaped, and/or located to change the vibrational properties of the insert, including the frequency of resonance modes. In certain embodiments, the structural features of the sole insert can change the vibration characteristics of the sole insert to more closely match those of the rear ring, thereby limiting stresses on the adhesive bond between the sole insert and the rear ring.

Figure 57:
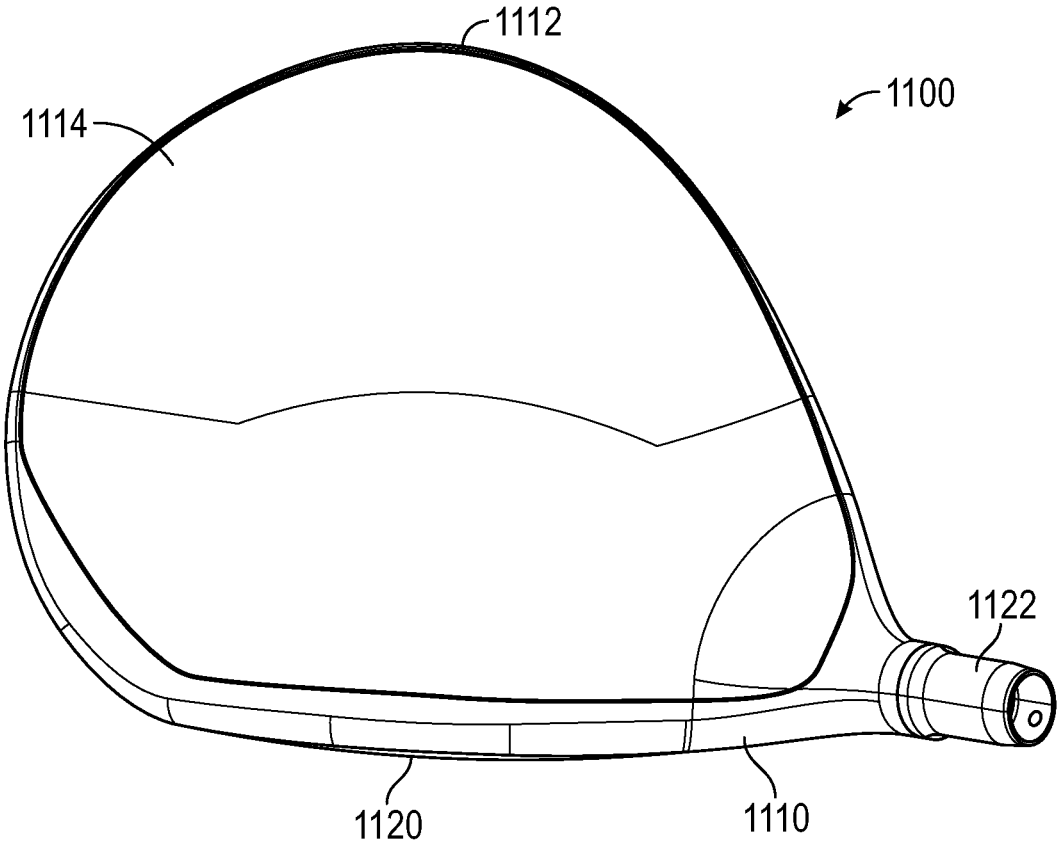
FIG. 57 is a top view of another embodiment of a golf club head.

For example, FIGS. 47-55 illustrate an embodiment of a golf club head 1000. Similar to other club heads disclosed herein, the club head 1000 comprises a cast cup 1010 coupled to a separately formed rear ring 1012, along with a crown insert 1014, a sole insert 1016, a face insert 1020, and an adjustable head-shaft connection assembly 1022 including a screw 1021. The cast cup 1010 can define a sole channel 1024 (FIG. 50), and a plug 1070 can be received in the sole channel 1024. The golf club head can also include a rear weight 1028 with a screw 1029, and an anti-rotation nut 1031 (FIG. 54) to secure the rear weight to the rear ring 1012. The club head 1000 can comprise any combination of the variations disclosed herein for the cast cup, face insert, rear ring, rear weight, etc. For example, with reference to FIG. 57, the club head 1000 includes a non-sliding front weight/sole weight received in an associated weight port 1032 defined in the cast cup 1010, but can also include an adjustable weight assembly similar to the adjustable weight assemblies described in U.S. Publication No. 2021/0113896 incorporated by reference above.

The club head 1000 can have any type of rear ring and rear weight, such as any of the rear ring and rear weight combinations disclosed elsewhere herein. In the illustrated example, the club head 1000 comprises an externally attachable rear weight 1028 that is coupled to the rear ring 1012 with an external screw 1029 (see FIGS. 49 and 54), such that the rear weight is removable and interchangeable with other rear weights having different masses, colors, etc. The club head 1000 can also include an anti-rotation nut 1031 that is received within the rear ring 1012 and receives the screw 1029. In certain embodiments, the anti-rotation nut 1031 can be a threaded insert that is co-molded with the rear ring 1012.

The rear ring 1012 can comprise metallic materials (e.g., Ti alloy, steel, aluminum, etc.), polymeric materials, composite materials, and/or any other materials and coatings disclosed herein, and any method of formation and attachment disclosed herein. In particular embodiments, the rear ring 1012 can comprise a thermoplastic material, such as fiber-reinforced thermoplastic. In certain embodiments, the rear ring can comprise a polyamide material such as nylon. Particular examples include polyphthalamide (PPA) resin, polycarbonate resin, etc., reinforced with carbon fibers (e.g., chopped fibers). The composite material can include 20% to 60% fiber by mass, or by volume. Particular examples include 20% to 50% fiber, 30% to 40% fiber, 60% fiber or less, 50% fiber or less, 40% fiber or less, 30% fiber or less, etc., by mass or by volume. In certain embodiments, the rear ring 1012 can be injection molded. Where the rear ring includes a metal film deposited on its surface, the rear ring can comprise PPA or similar resins compatible with primer materials for metal film deposition.

The crown insert 1014 and the sole insert 1016 can be made from a variety of composite and/or polymeric materials, such as fiber-reinforced composite materials including a resin. The resin can be a thermoplastic material and/or thermosetting material. The fiber reinforcement can include carbon fibers, glass fibers, aramid fibers, or combinations thereof. The fibers can be woven and/or unidirectional. For example, the inserts can comprise one or more layers of unidirectional fibers in combination with one or more layers of woven fabric. The woven fabric can have any number of woven bundles or tows, and can comprise any number of filaments in each tow/bundle. Representative examples include woven carbon fiber fabric including 1,000 filaments per tow ("1 k fabric"), 1,500 filaments per tow ("1.5 k fabric"), 3,000 filaments per tow ("3 k fabric"), 6,000 filaments per tow ("6 k fabric"), 12,000 filaments per tow ("12 k fabric"), etc.

Representative examples of thermoplastic resins that can be used to fabricate the crown insert 1014 and the sole insert 1016 include PPS (polyphenylene sulfide), thermoplastic urethane (TPU), polysulfone, polycarbonate, polyimide (e.g., nylon), etc. In certain examples, selected fiber sheets impregnated with a selected resin can be placed in a two-piece (male/female) matched molding tool, heated past the melt temperature of the resin, and formed to a specified shape when the tool is closed. Once the crown or sole insert is formed, the insert can be cooled and removed from the tool. This process may be referred to as thermoforming and is well-suited for forming the sole and crown inserts. In certain embodiments, the fiber sheets (also referred to as plies) can be pre-impregnated with a selected resin (e.g., a thermoplastic resin or thermosetting resin), known as "prepreg."

Representative examples of thermosetting resins that can be used to form the crown insert and/or the sole insert include polyester resin, polyurethane resin, epoxy resin, vinyl ester resin, polyimide resin, and the like. In certain examples, selected fiber sheets impregnated with a selected resin (e.g., pre-impregnated, or at the time of layup) can be placed in a two-piece (male/female) matched molding tool. The tool can be closed to apply heat and pressure until the material has cured. Once the crown or sole insert is formed, the insert can be cooled and removed from the tool. This process may be referred to as compression molding and is also well-suited for forming the sole and crown inserts.

Figure 52:
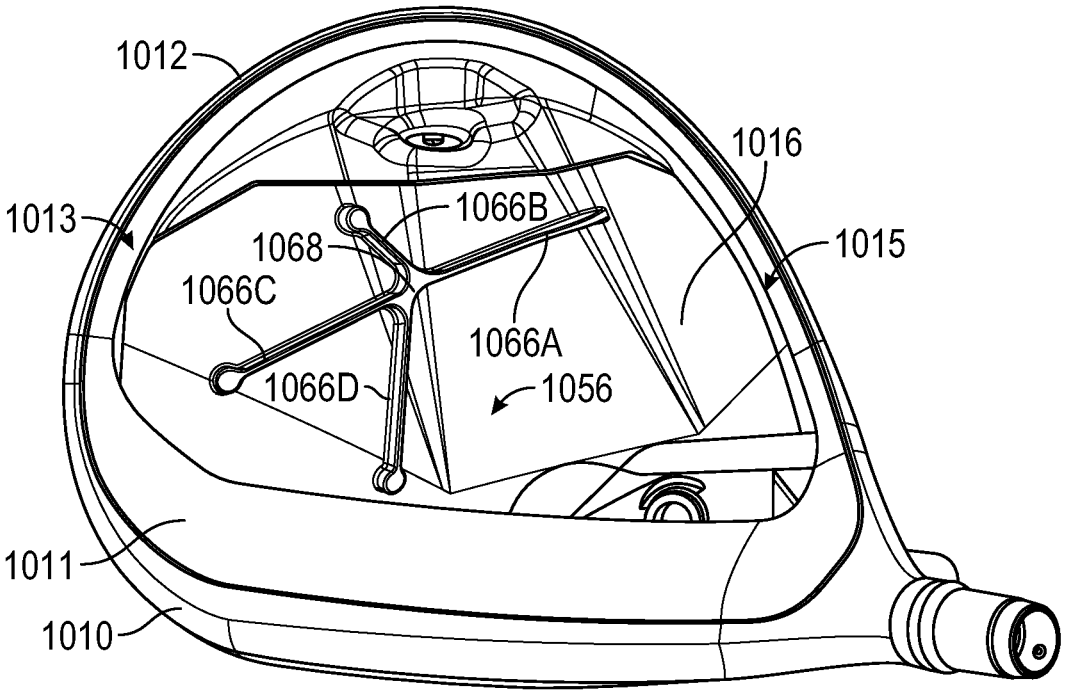
FIG. 52 is a top perspective view of the golf club head of FIG. 47 with the crown insert removed for purposes of illustration.
Figure 54:
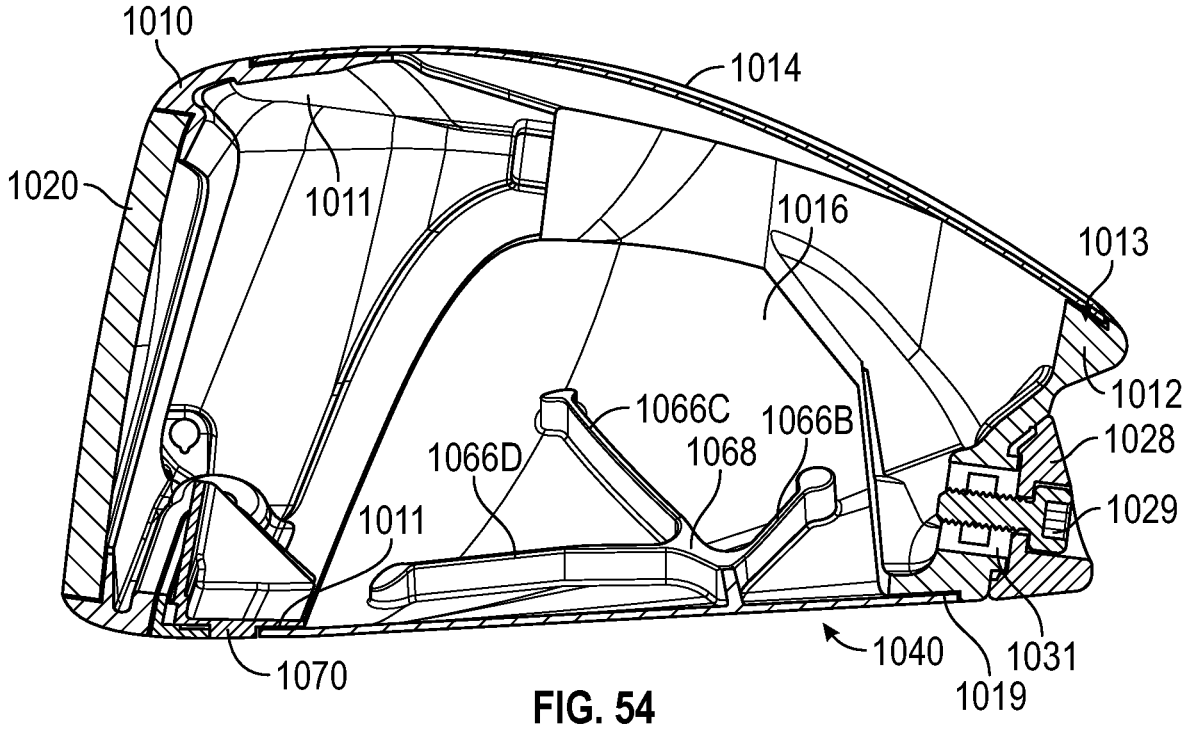
FIG. 54 is a cross-sectional side elevation view of the golf club head of FIG. 47.
Figure 55:
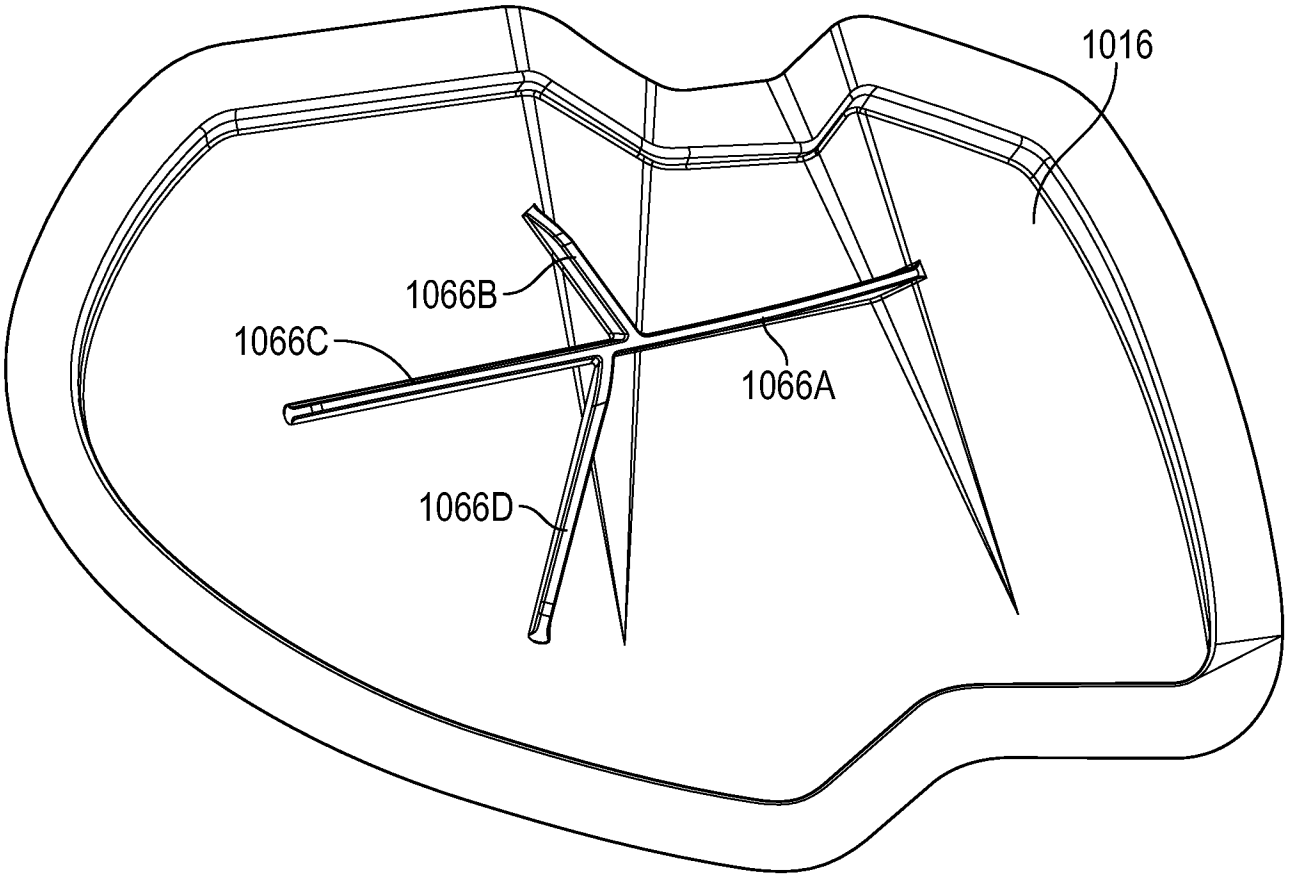
FIG. 55 is a perspective view of another embodiment of sole insert.
Figure 56:
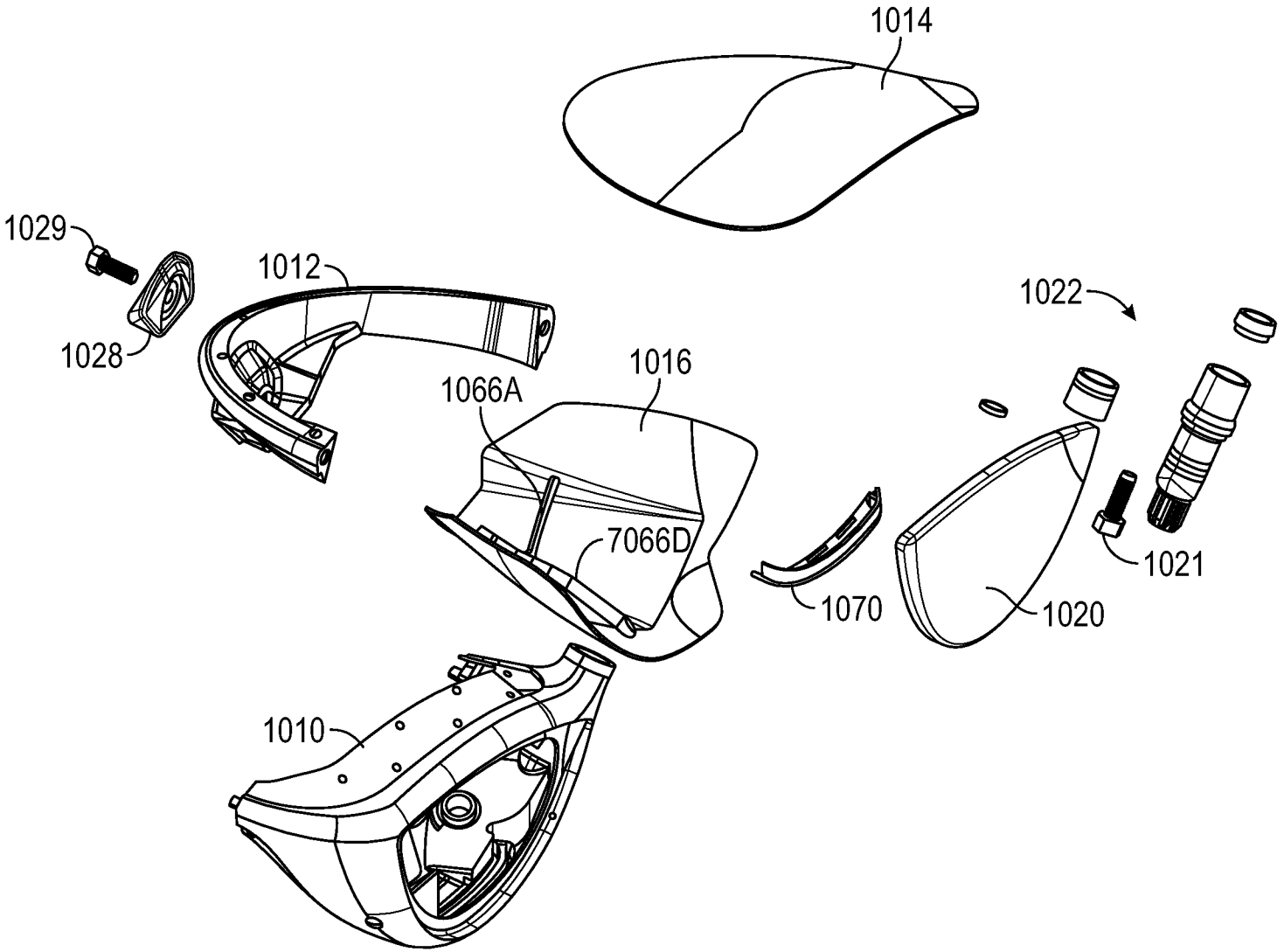
FIG. 56 is an exploded view of the golf club head of FIG. 47.

Referring to FIG. 52, in the illustrated embodiment, the crown insert 1014 can be secured (e.g., by adhesive) to an upper surface of a rear lip 1011 of the cast cup 1010, and to an upper perimeter surface 1013 of the rear ring 1012. The crown insert can thus enclose a crown opening 1015 defined by the cast cup 1010 and the rear ring 1012. As best shown in FIG. 54, the sole insert 1016 can be secured (e.g., by adhesive) to a lower surface of the rear lip 1011 of the cast cup 1010, and to a lower perimeter surface 1019 of the rear ring 1012 such that the sole insert covers a sole opening collectively defined by the cast cup and the rear ring.

Figure 50:
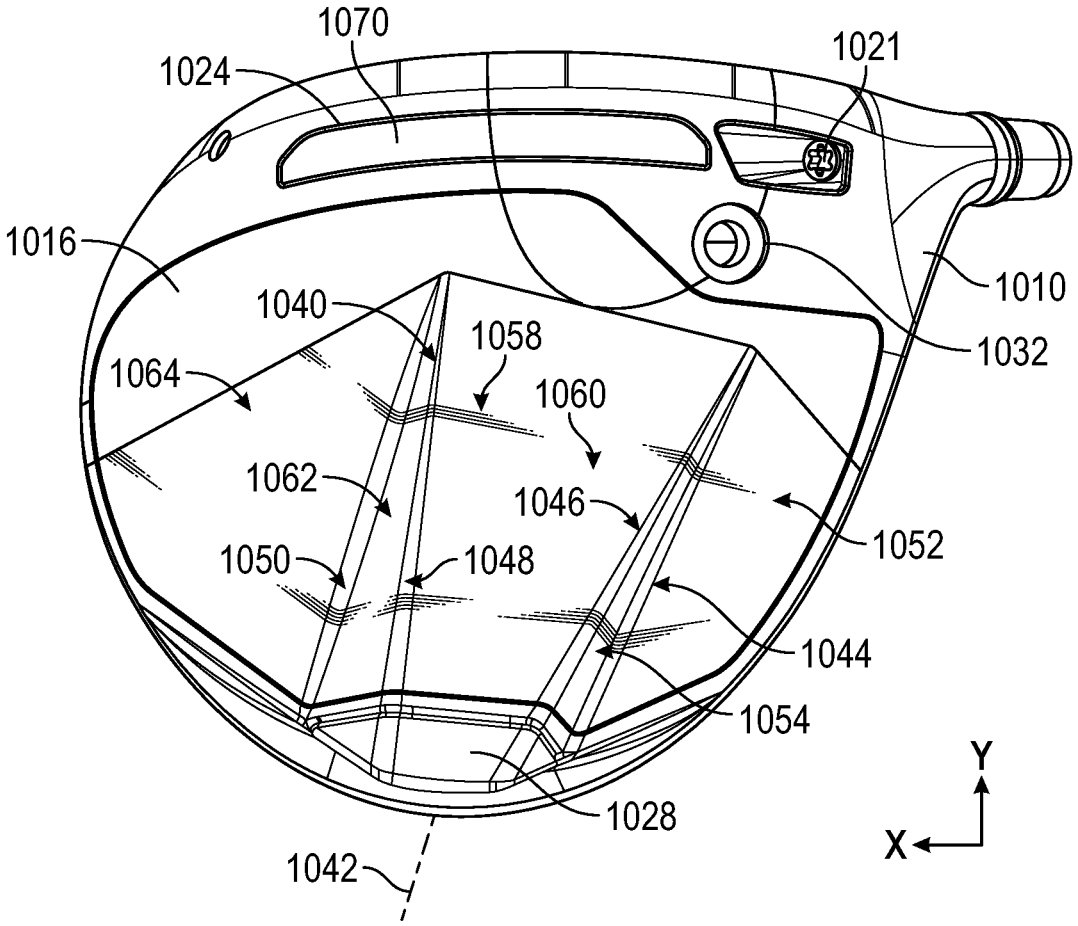
FIG. 50 is a bottom view of the golf club head of FIG. 47.

In the illustrated embodiment, the golf club head 1000 can also include an inertia generator 1040 (also referred to as an inertia generating feature, an aft winglet, and a CG lowering platform), which can be configured as described above with reference to FIGS. 1-15. Referring to FIG. 50, a longitudinal axis 1042 of the inertia generator 1040 can also be oriented at an angle to an axis that is perpendicular to the face, such as the y-axis in FIG. 50. In addition to moving discretionary mass rearward and lowering the CG projection lower on the face, the inertia generator 1040 can also be configured to reduce the volume of the club head (e.g., to meet USGA volume constraints). Thus, in certain embodiments the inertia generator 1040 can comprise a relatively narrow protrusion in the sole that extends aft from near the center of the golf club head. In the illustrated embodiment, the rear weight 1028 can be positioned at the aft end of the inertia generator 1040. Thus, the body of the inertia generator 1040 can act as a fairing for the rear weight 1028.

In the illustrated embodiment, the inertia generator 1040 can be defined by a plurality of curved portions (also referred to as bends) in the various components of the golf club head that make up the inertia generator (e.g., the sole insert, the rear ring, and/or the rear weight). The curved portions can have relatively small radii, and can demarcate larger-area regions of the sole, particularly on the sole insert.

Figure 51:
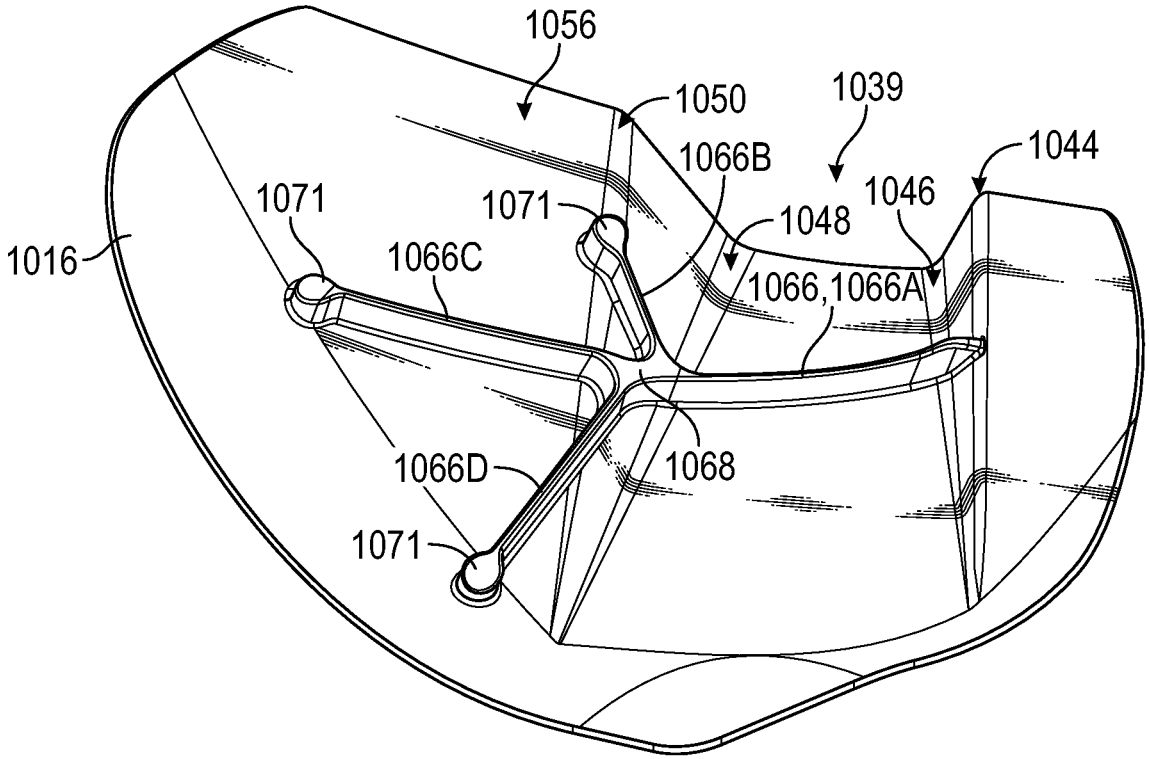
FIG. 51 is a perspective view of a sole insert of the golf club head of FIG. 47 including ribs, according to one embodiment.

For example, moving from right to left in FIG. 50, the inertia generator 1040 (and the sole insert 1016) can comprise a first curved portion 1044, a second curved portion 1046, a third curved portion 1048, and a fourth curved portion 1050. Referring to FIGS. 50 and 51, and looking at the sole of the club head, the first curved portion 1044 can be concave such that the outside of the bend is on the interior-facing surface 1056 of the sole insert (e.g., the outside of the bend is on the inside of the golf club head, as shown in FIGS. 51 and 52). The first curved portion 1044 forms a boundary between a heel portion 1052 of the sole insert 1016 and a first side wall 1054 of the inertia generator 1040. The plurality of curved portions 1044-1050 thus define a protrusion 1039 in the sole insert 1016 that increases in height moving in a direction toward the rear of the club head.

Looking at the sole of the club head, the second curved portion 1046 can be convex such that the outside of the bend is on the exterior surface 1058 of the sole insert. The third curved portion 1048 can be convex as well. The second and third curved portions 1046, 1048 can form the boundaries of a lower portion or lower wall 1060 of the inertia generator. The fourth curved portion 1050 can be a concave bend that forms the boundary between a second side wall 1062 of the inertia generator 1040 and a toe portion 1064 of the sole insert 1016. Thus, the inertia generator 1040 can be at least partially defined by a plurality of bends or curves formed in the sole insert that have a different concavity (e.g., concave or convex as viewed from the exterior of the sole) moving in the heel-to-toe direction across the sole insert.

Figure 53:
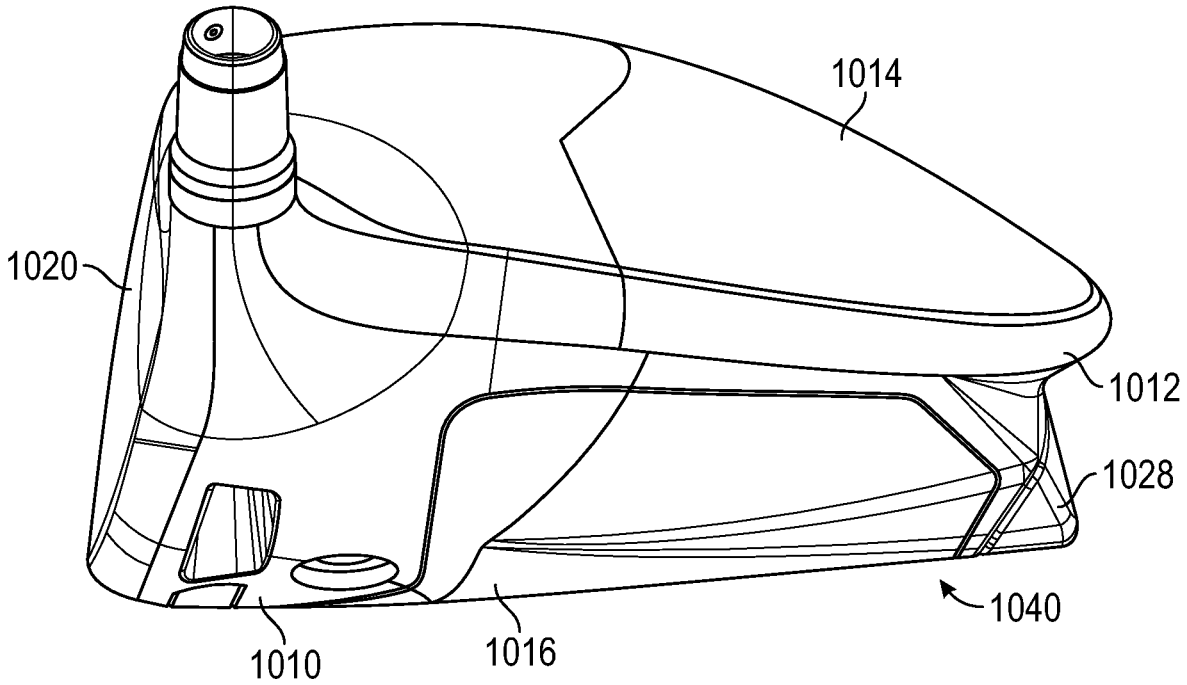
FIG. 53 is a side elevation view golf club head of FIG. 47.

Referring to FIG. 53, in certain embodiments the sole insert 1016 can comprise one or a plurality of vibration-reducing features configured as rib members 1066 referred to hereinafter as "ribs." The ribs 1066 can be coupled to the interior-facing surface 1056 of the sole insert 1016, and can extend into the hollow interior of the club head. The ribs 1066 can intersect, or can be spaced apart and non-intersecting. Certain embodiments can comprise a plurality of ribs that intersect, and one or more ribs that do not intersect other ribs. Referring to FIGS. 51 and 52, the sole insert 1016 can comprise four ribs 1066A-1066D that intersect at a common hub 1068. The rib 1066A can extend from the hub 1068 generally in the direction of the heel of the golf club head (e.g., toward the hosel). The rib 1066B can extend generally in a direction toward the rear of the golf club head. The rib 1066C can extend generally in a direction toward the toe of the golf club head, and the rib 1066D can extend generally in the direction of the face of the golf club head. The ribs 1066 can be located between the front weight and the rear weight 1028.

In certain embodiments, one or more of the ribs 1066A-1066D can comprise round (e.g., cylindrical) end portions referred to hereinafter as pillars 1071. In the illustrated embodiment, the ribs 1066B-1066D can comprise pillars 1071. In certain embodiment, the pillars 1071 can be configured (e.g., sized, shaped, and/or located) to aid in changing the vibration characteristics of the sole insert in specified ways, such as by increasing the frequency of the fundamental mode of the sole insert and/or decreasing the amplitude of vibrations at the edges of the sole insert in response to a stimulus force (e.g., striking a golf ball). For example, the pillars 1071 can act as mass concentrations located on relatively large panels or regions of the sole insert that reduce the amplitude of vibration of those regions. The pillars 1071 can also serve to relieve stress concentration at the ends of the ribs, and/or facilitate bonding between the ribs and the sole insert 1016.

Figure 58:
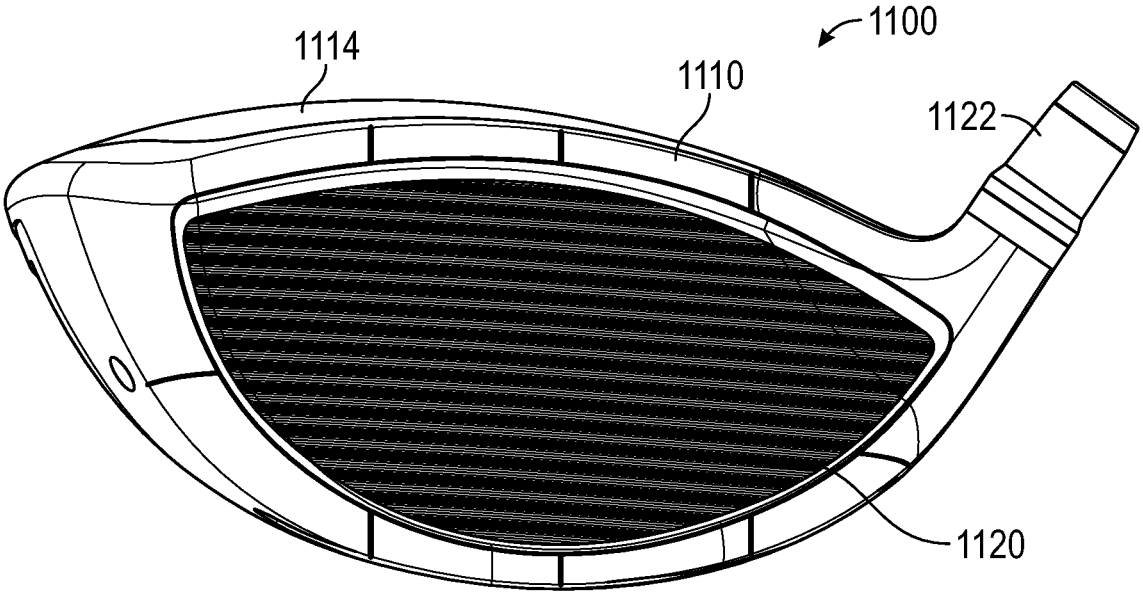
FIGS. 58-64 are additional views of the golf club head of FIG. 57.

In other embodiments, the ribs need not include a hub, and/or need not include pillars. For example, FIG. 58 illustrates another configuration of the sole insert 1016 in which the ribs 1066A-1066D intersect one another, but do not include a thickened hub region. Thus, the ribs 1066A and 1066C form a single continuous rib member of generally uniform thickness. The ribs also lack pillars at their ends.

At least one of the ribs can be positioned in the protrusion 1039 of the sole insert (e.g., in the recess or well formed on the interior surface of the sole insert that defines the protrusion 1039 on the exterior of the club head body). For example, in the illustrated embodiment each rib 1066A-1066D can extend across at least one curved portion of the protrusion 1039. One or more of the ribs can extend across a plurality of curved portions of the protrusion 1039. One or more of the ribs can extend completely across the protrusion 1039 (e.g., can be draped across the recess in the sole insert that forms the protrusion 1039 and positioned in it). For example, referring again to FIG. 51 the rib 1066A can extend from the hub 1068 across the curved portion 1048, across the curved portion 1046, and up the first side wall 1054 of the protrusion 1039 to the curved portion 1044. Stated differently, at least one rib can be positioned in the inertia generator 1040, and/or can extend across the inertia generator. Referring to the ribs 1066A-1066D collectively as a rib network, the ribs of the rib network extend across multiple curved portions of the sole insert 1016 where the curvature of the recess changes from concave to convex (also referred to as concavity transitions) and vice versa. Treating the ribs 1066A and 1066C as a single rib, the single rib extends across the protrusion 1039 of the sole insert 1016.

In certain embodiments, the ribs 1066A-1066D can have a thickness of 0.3 mm to 3 mm, such as 1 mm to 20 mm, such as 1 mm to 15 mm, 1 mm to 12 mm, 1 mm to 10 mm, 1 mm to 5 mm, 1 mm to 3 mm, 2.5 mm to 5 mm, 2.5 mm to 8 mm, 20 mm or less, 15 mm or less, 10 mm or less, 5 mm or less, 3 mm or less, 2 mm or less, etc. In certain embodiments the ribs can have a height of 1 mm to 50 mm, such as 1 mm to 30 mm, 1 mm to 20 mm, 1 mm to 10 mm, 1 mm to 5 mm, 1 mm to 3 mm, 50 mm or less, 30 mm or less, 20 mm or less, 10 mm or less, 5 mm or less, etc. In certain embodiments, the height and/or thickness of the ribs can vary along their length depending upon the particular vibration characteristics sought. For example, a relatively large aspect ratio can be advantageous because tall ribs confer stiffness without the increased mass associated with increased thickness. In certain embodiments, the ribs described herein can have an aspect ratio (e.g., height per unit width) of 1:1, at least 2:1, 2:1 or greater, 3:1 or greater, such as 5:1 or greater, and as high as 10:1. The aspect ratio may be calculated as a rib height as measured from a base of a rib (where the rib meets the sole insert) to an end portion of a rib and dividing this by a minimum rib thickness as measured at the end portion of the rib. If the height of a rib is variable then an average height may be used which would be calculated using a maximum rib height plus a minimum rib height divided by 2 $(h_{ribmax}+h_{ribmin})/2$, this may be repeated for several ribs to find the average height for each rib. Similarly, if the thickness is variable then an average may be calculated using known averaging techniques. Additionally, an average thickness may be calculated for each rib.

The ribs are generally tapered such that a base of the rib (e.g., the portion of the rib closest to the sole insert) is thicker than an end portion of the rib (e.g., a free end portion of the rib). The ribs are generally tapered for manufacturability reasons to include draft and will preferably have a draft angle of 0.5 degrees to 4 degrees. For example, an end portion of a rib may have a thickness of 0.3 mm to 0.7 mm and a base portion of a rib (proximate the sole insert) may have a thickness of 0.8 mm to 4.5 mm or even larger. Generally the minimum rib thickness will occur at the end of the rib and the maximum rib thickness will occur at the base of the rib. Large buildup of rib mass such as rib intersections, rib hubs 1068, and rib pillars 1071 (see, e.g., sole insert 1016 and FIG. 51, for example) would be excluded from any of the average rib thickness and average rib height calculations. Also, the sole insert thickness would be excluded from the height and thickness measurements and calculations.

In certain embodiments, the ribs 1066A-1066D can comprise a fiber-reinforced polymeric composite material, such as a fiber-reinforced thermoplastic material or a fiber-reinforced thermosetting material. The ribs can be formed and joined to the sole panel in a variety of ways. For example, in certain embodiments the ribs can be separately formed from the sole insert 1016 and joined to the sole insert using any of a variety of joining processes depending upon the materials and the particular characteristics sought. For example, in certain embodiments the ribs can be molded using a composite material comprising a thermoplastic resin and chopped fibers. The sole insert can comprise a plurality of layers of fabric as described above, and a thermoplastic resin that is compatible with the thermoplastic resin of the ribs (e.g., the same thermoplastic resin, or a different thermoplastic resin with a similar melting temperature), such as any of the thermoplastic resins described herein. The ribs can then be joined to the sole insert in a co-forming process in which the sole insert layup and the pre-formed ribs are placed in a molding tool and heated. The sole insert is formed in the mold (e.g., by thermoforming), and the thermoplastic resin of the ribs melts and fuses with the thermoplastic resin of the sole insert to join the ribs to the sole insert. The resulting sole insert and thermally welded ribs are integrally formed as a unitary body.

In another embodiment, the ribs can be formed on the sole insert in an overmolding process (also referred to as co-molding). For example, in certain embodiments the ribs can comprise an injection moldable thermoplastic material such as polysulfone (PSU), polyethersulfone (PES), polyphenylene sulfone (PPSU), and the like. The thermoplastic material of the ribs can comprise fibers, or can be fiber-free depending on the particular characteristics sought. The pre-formed sole insert can be placed in a mold, and the ribs can be overmolded onto the sole insert, for example, by injection molding. In another embodiment, the molding of the sole insert and the injection molding of the ribs can be performed in the same mold (e.g., a two-piece die including ports for injection molding the ribs onto the sole insert). In yet another embodiment, the sole insert and the ribs can be formed in the same compression molding step, such as by laying up the sole insert in a mold and placing the rib material on the sole insert layup such that the rib material is forced into cavities in the mold to form the ribs on the sole insert at the same time that the sole insert layup is shaped in the forming/compression step.

In another embodiment, the sole insert can comprise a fiber-reinforced thermosetting material, such as any of the thermosetting resins described above. The ribs can be overmolded onto the sole insert, co-formed with the sole insert, and/or compression molded onto the sole insert. For example, in an overmolding process the sole insert can be formed in a thermosetting process in a first mold, placed into a second mold, and the ribs can be overmolded (e.g., by injection molding) onto the sole insert in the second mold. In such processes, the ribs can comprise a compatible thermosetting material such as fiber-reinforced polycarbonate. The fibers can comprise glass, carbon, and/or aramid fibers, and can comprise 10% to 50% of the material by mass, such as 30% by mass. In other embodiments, the sole insert can be laid up in a mold including channels for forming ribs, and the ribs can be injection-molded onto the sole insert in the mold similar to the insert molding process described above.

In a representative co-molding process, the sole insert can comprise any of the fiber-reinforced thermosetting materials described above, and the ribs can be molded together with the sole insert in a sheet molding compound (SMC) process. In an SMC process, a mold for the sole insert can include cavities for forming the ribs. Chopped fiber strands (or other reinforcement) can be inserted in the rib cavities (e.g., with a resin), the sole insert can be laid up over the ribs, and the sole insert and ribs can be cured together. In such a process the ribs can also be pre-formed separately and placed in the mold cavities. In certain embodiments, the ribs can be coated with an adhesive film that improves bonding between the ribs and the body of the sole insert.

In a representative compression molding process, fiber-reinforced thermosetting material can be placed in a mold including cavity features configured to form the sole insert and the ribs. The mold can be closed, and heat and pressure can be applied to force the material into contact with the cavity features and cure the thermosetting resin resulting in a sole panel with integrally-formed ribs. Representative thermosetting materials that can be used in this process include TORAYCA® ET40 pre-preg. In certain examples, compression molding the ribs together with the sole insert using these and similar materials can facilitate the formation of relatively high aspect ratio ribs on the sole insert surface, such as a rib height to thickness ratio as high as 10:1.

In another embodiment, the sole insert, the ribs, the crown insert, and/or the rear ring, or any combination thereof, can be formed together (e.g., co-molded) in a suitable molding apparatus. For example, the sole insert and/or the crown insert can be laid up in a mold (e.g., using pre-preg), and the rear ring can be injection molded around the sole insert and/or the crown insert. The ribs can be injection molded on the sole insert in the same or in a different molding step.

Figure 61:
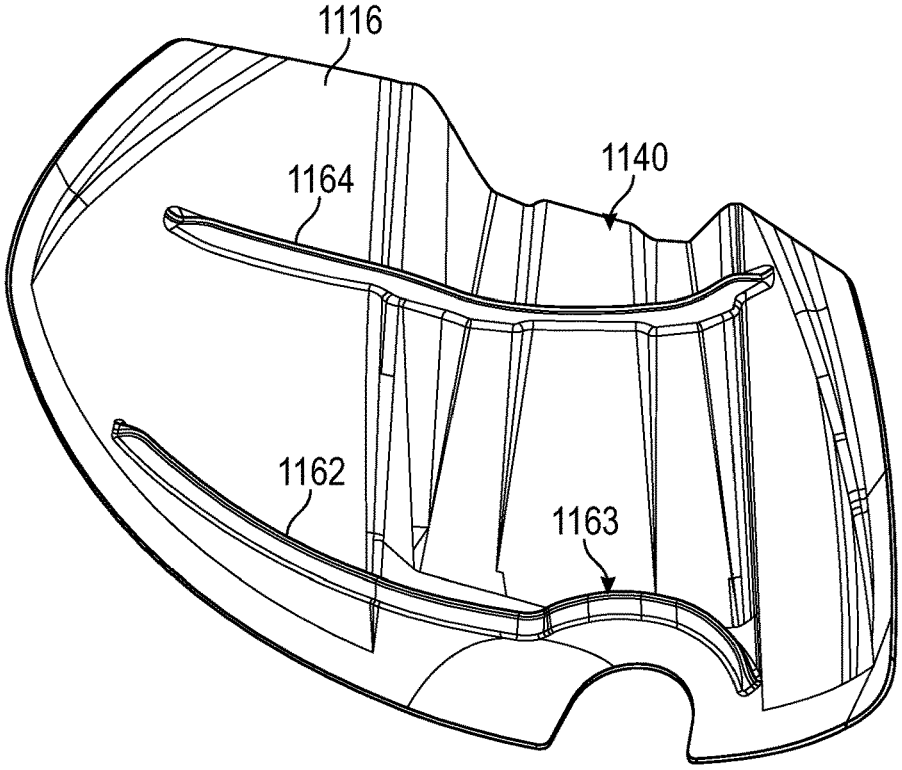
Figure 62:
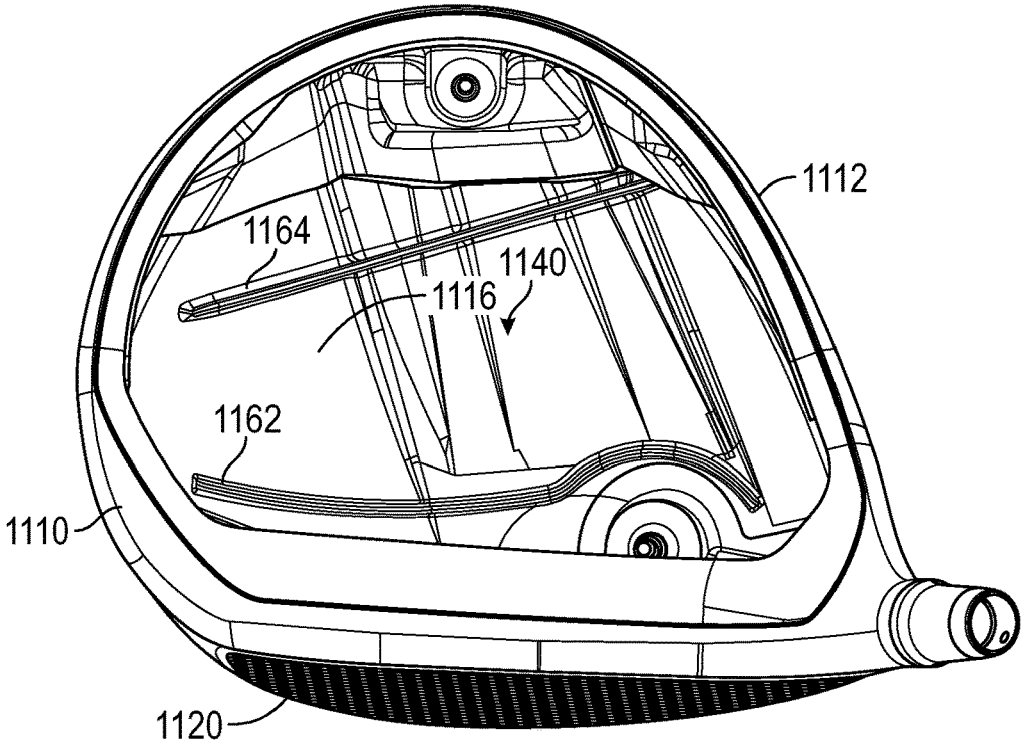
Figure 63:
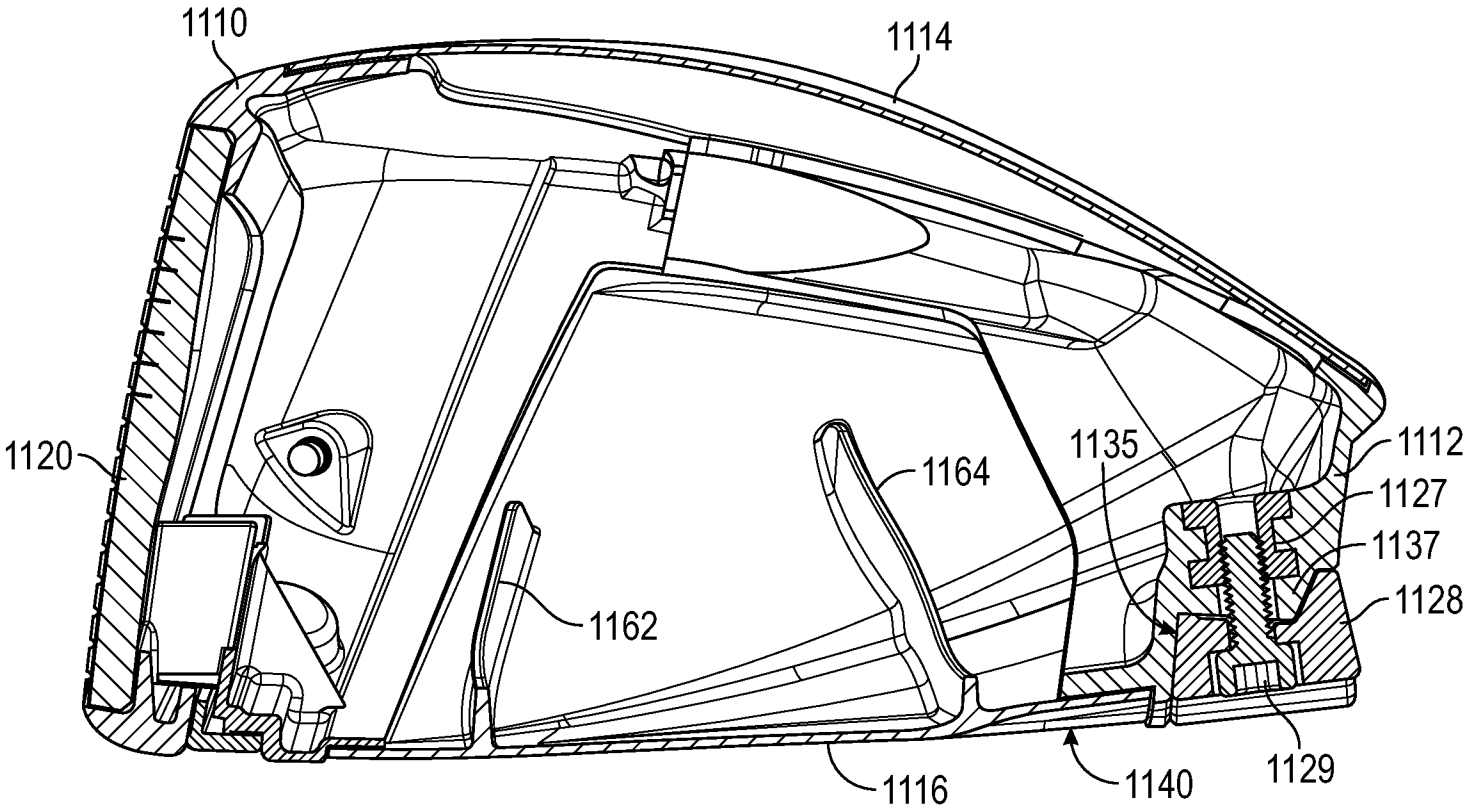

FIGS. 57-64 illustrate another embodiment of a golf club head 1100. Similar to other club heads disclosed herein, the club head 1100 comprises a cast cup 1110 coupled to a separately formed rear ring 1112, along with a crown insert 1114, a sole insert 1116, a face insert 1120, an adjustable head-shaft connection assembly 1122 including screw 1121, a sole channel 1124 and plug 1170 (FIG. 60), and a rear weight 1128 with screw 1129 and nut 1127 (FIG. 63). The club head 1100 can comprise any combination of the variations disclosed herein for the cast cup, face insert, rear ring, rear weight, etc. For example, in the illustrated embodiment the club head 1100 includes a non-sliding front weight/sole weight 1130 (FIG. 60) received in an associated weight port 1132 defined in the cast cup 1110, but can alternatively include an adjustable weight assembly as described above in lieu of or in addition to the front weight 1130.

The club head 1100 can have any type of rear ring and rear weight, such as any of the rear ring and rear weight combinations disclosed elsewhere herein. In the illustrated example, the club head 1100 comprises an externally attachable rear weight 1128 that is coupled to the rear ring 1112 with an external screw 1129 (see FIGS. 59, 60, and 63), such that the rear weight is removable and interchangeable with other rear weights having different masses, colors, etc. The club head 1100 can also include an anti-rotation nut 1127 (FIG. 63) that is received in the rear ring 1112 and receives the screw 1129 to secure the weight 1128 to the ring 1112. The rear weight 1128 can form one end (e.g., the aft end) of an inertia generator 1140 similar to those described above.

The crown insert 1114 can be adhesively joined to the cast cup and the rear ring to enclose a crown opening, and the sole insert 1116 can be adhesively joined to the cast cup and the rear ring to enclose a sole opening as described above with reference to golf club head 1000.

Figure 64:
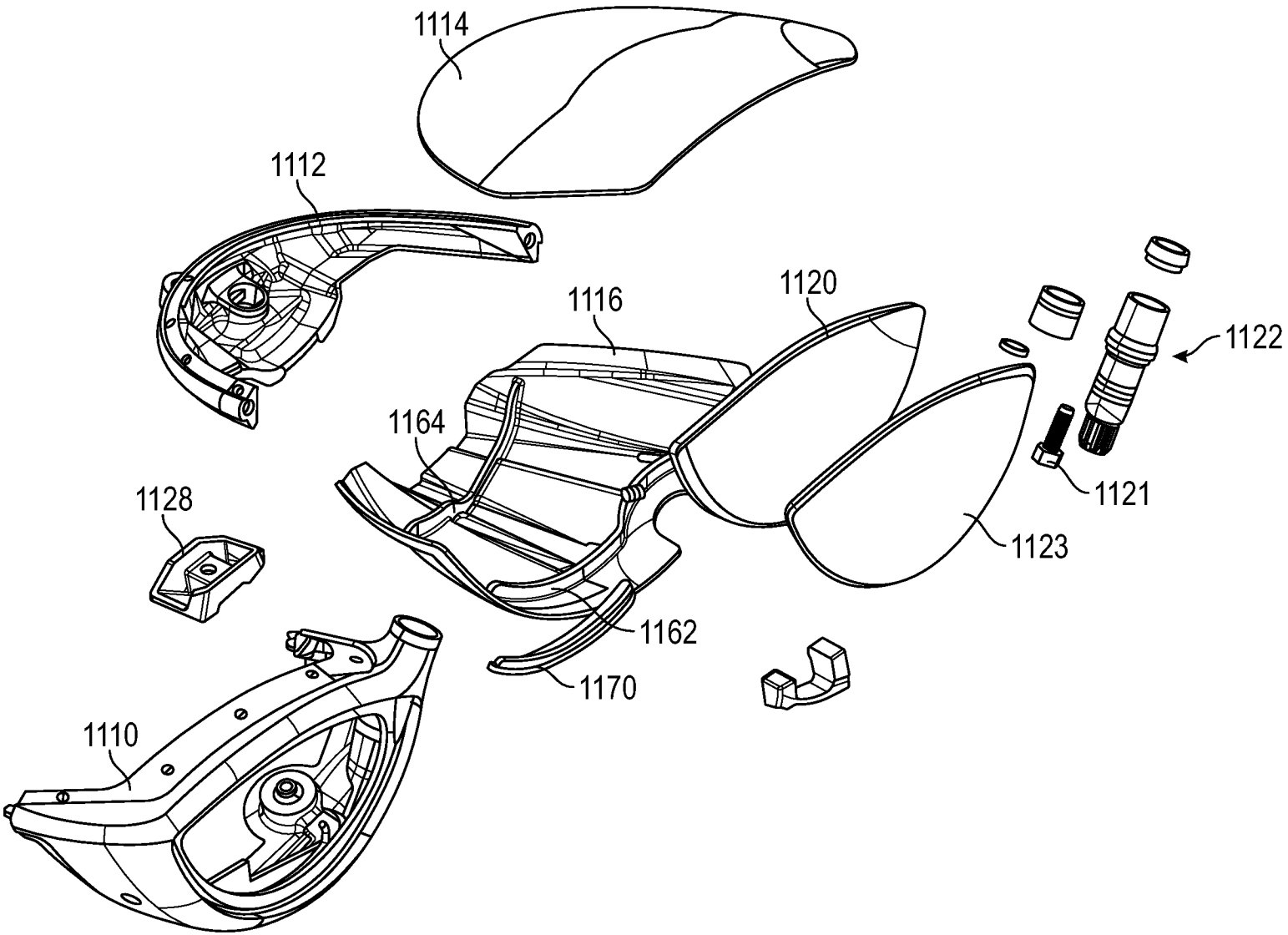
Figure 65:
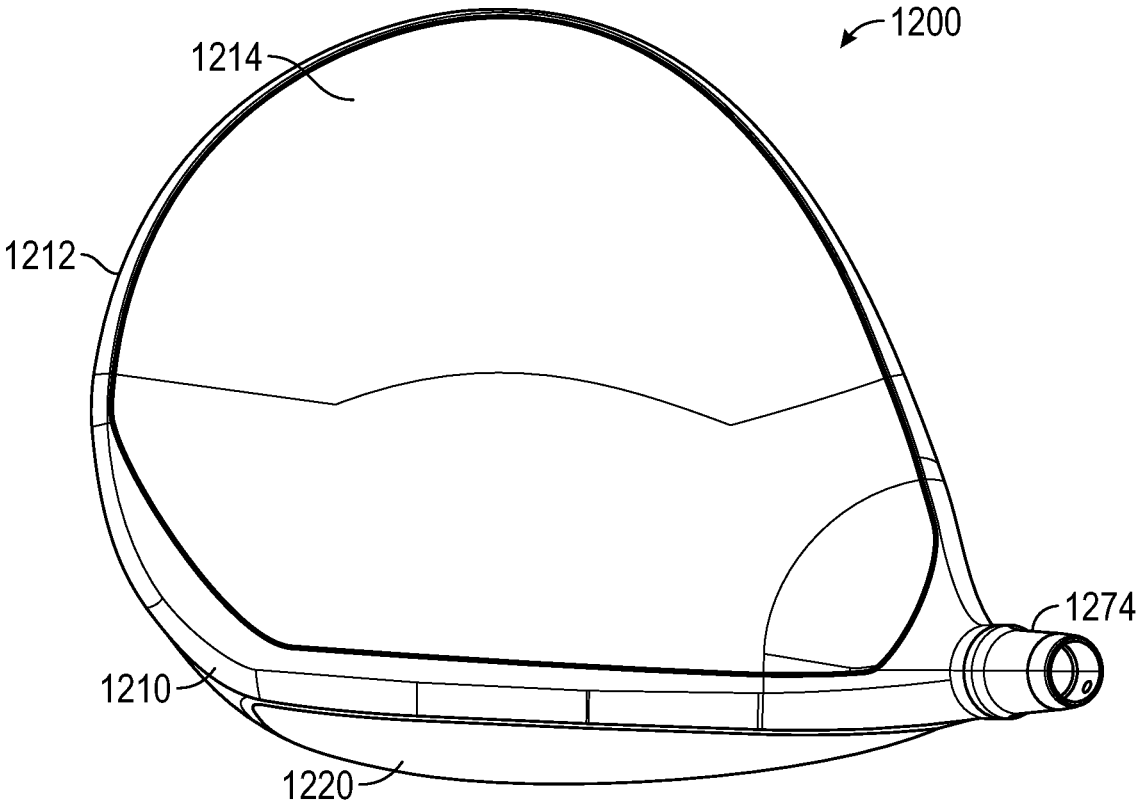
FIG. 65 is a top view of another embodiment of a golf club head.
Figure 66:
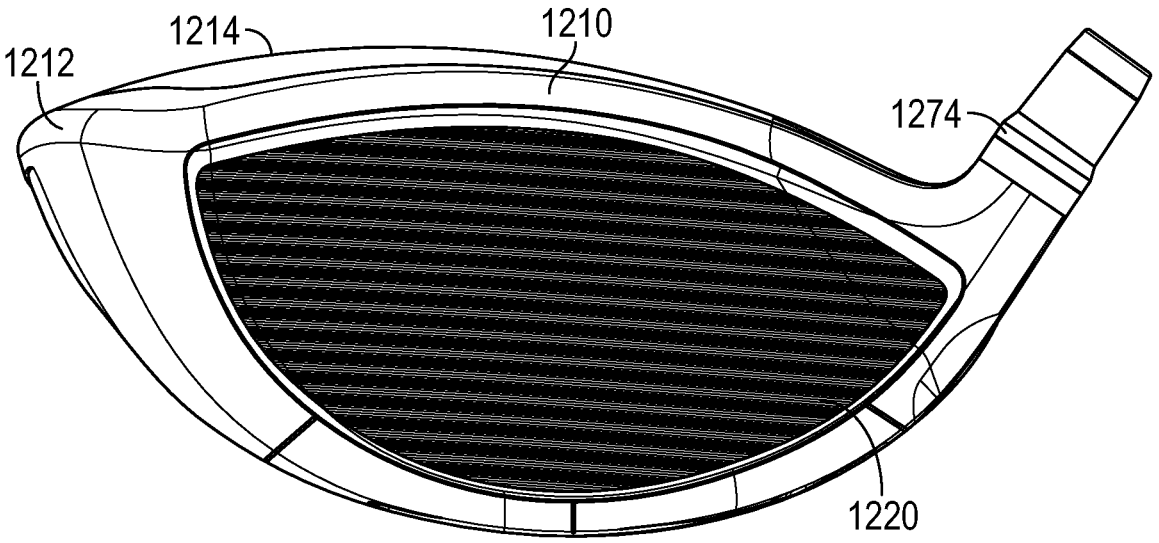
FIG. 66 is a is a front end view of the golf club head of FIG. 65.
Figure 67:
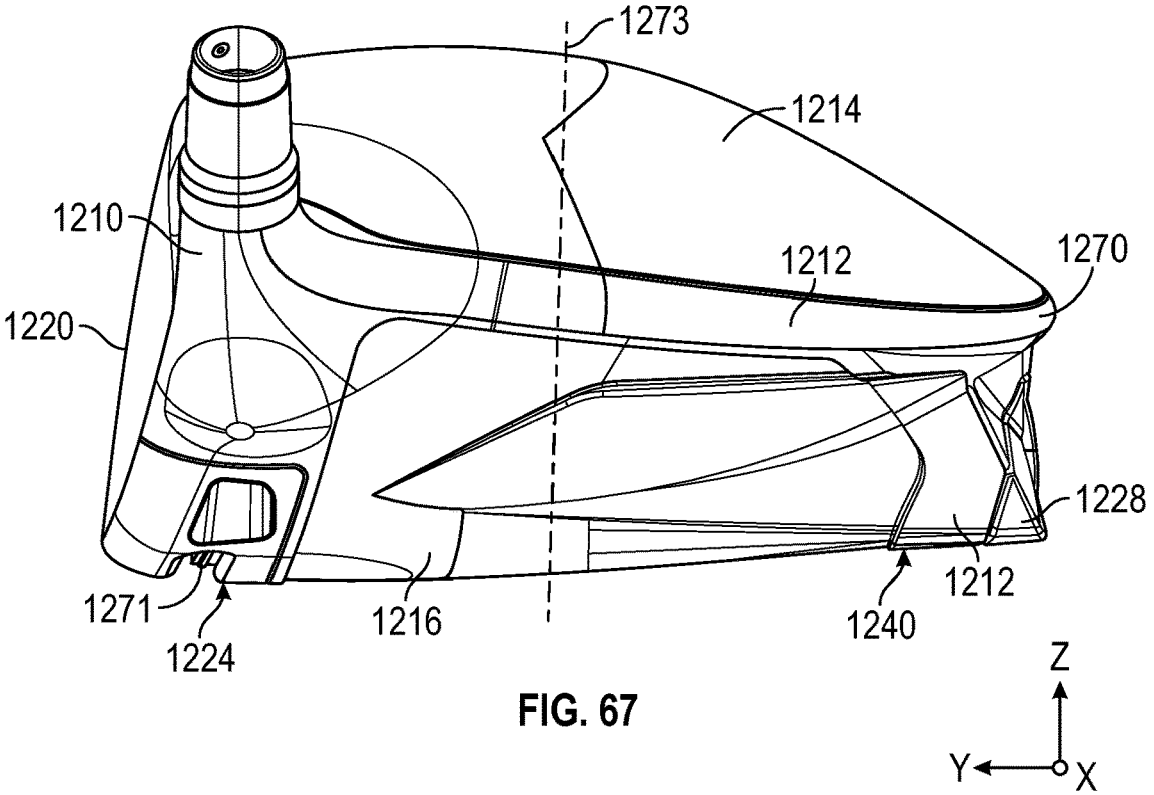
FIG. 67 is a side elevation view of the golf club head of FIG. 65.

With reference to FIG. 64, the face insert 1120 can also comprise an external coating layer 1123 on the front striking surface, which can comprise polyurethane or other materials disclosed herein.

Figure 59:
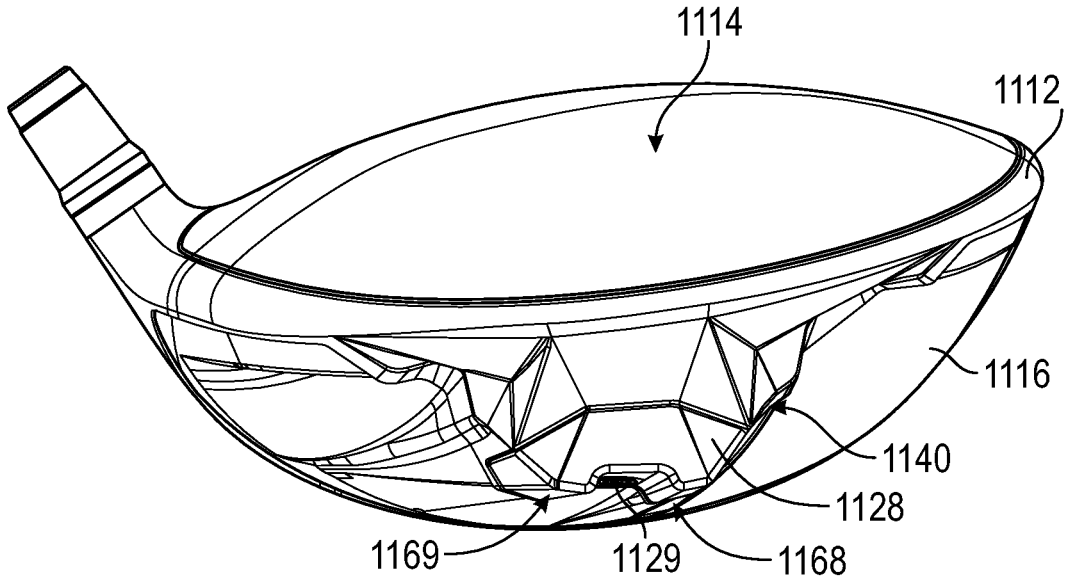
Figure 60:
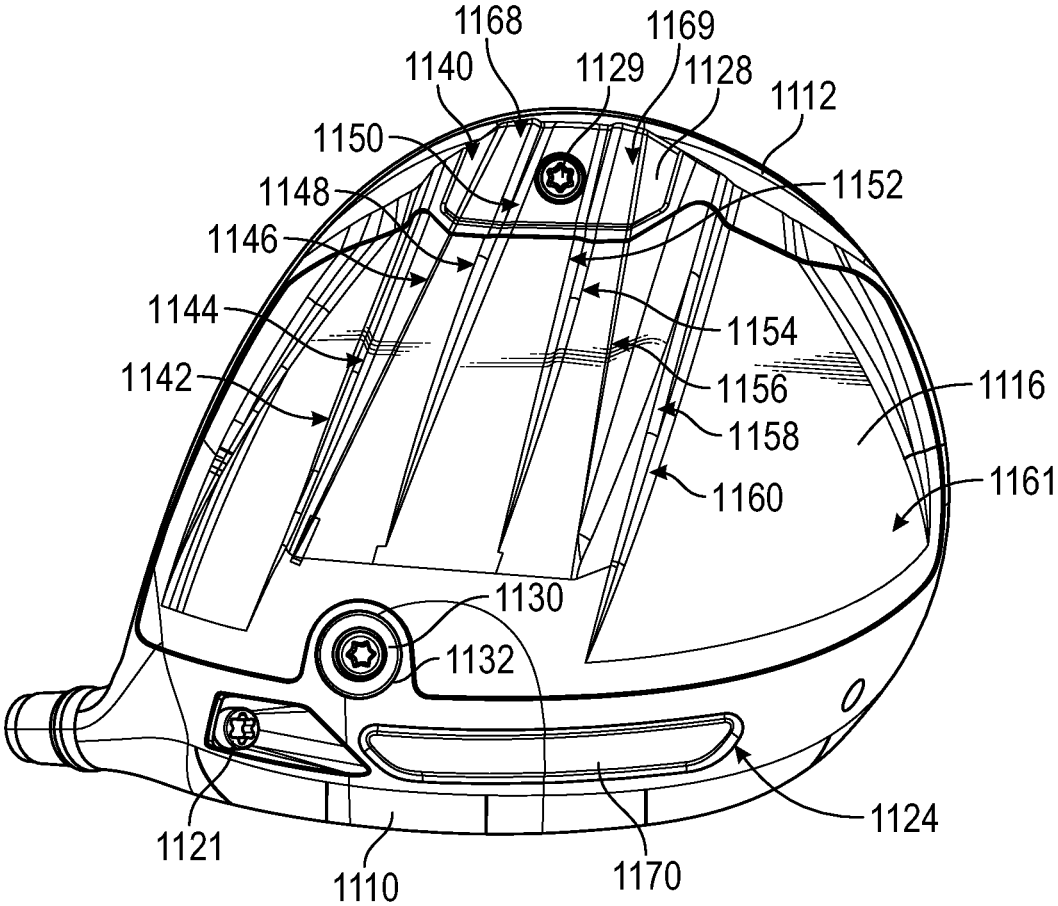

With reference to FIGS. 59, 60, and 63, in the illustrated embodiment the golf club head 1100 can be configured such that the rear weight 1128 is attached to the sole of the club head. Accordingly, as best shown in FIG. 63, the rear ring 1112 can comprise an external recess 1135 on its aft sole aspect that is sized and shaped to receive the rear weight 1128. The anti-rotation nut 1127 can be received in a cavity defined in the rear ring 1112 above the recess 1135 and separated from the recess by a wall 1137. The wall 1137 can define an opening to receive the shank of the screw 1129. The screw 1129 can be inserted through the rear weight 1128, through the opening in the wall 1137, and into the anti-rotation nut 1127 generally in the direction of the crown of the club head to secure the rear weight to the sole of the club head.

In the illustrated embodiment, the inertia generator 1140 can comprise a protrusion formed in the sole of the club head, as described above. More particularly, the inertia generator 1140 can be partially defined by a plurality of curved portions or bends formed in the sole insert 1116 and the various other components of the golf club head that make up the inertia generator (e.g., the rear ring 1112 and/or the rear weight 1128). For example, moving in a direction from the heel toward the toe of the club head in FIG. 60, in the illustrated embodiment the inertia generator 1140 can comprise a first (concave) curved portion 1142, a second (convex) curved portion 1144, a third (convex) curved portion 1146, a fourth (convex) curved portion 1148, a fifth (concave) curved portion 1150, a sixth (concave) curved portion 1152, a seventh (convex) curved portion 1154, an eighth (convex) curved portion 1156, a ninth (convex) curved portion 1158, and a tenth (concave) curved portion 1160 where the inertia generator transitions to the toe portion 1161 of the sole insert 1116. The inertia generator 1140 (and thus the sole insert 1116) thereby comprises a plurality of ribs, fins, prominences, and/or peaks (from a perspective looking at the exterior of the sole as in FIG. 60) that extend lengthwise along the inertia generator. In the illustrated embodiment, the inertia generator has two fins 1168 and 1169 that extend along the length of the inertia generator and converge in the aft direction with the screw 1129 received in the valley between the fins. The fins 1168 and 1169 can be continuous along the sole insert 1116, the rear ring 1112, and the rear weight 1128. Located between the fins 1168 and 1169 is a well, trough, depression, or recessed surface that helps to reduce the overall volume of the club head. The fins 1168 and 1169 can continue from the sole insert onto the rear ring and onto the rear weight, which further helps with volume reduction. As shown in FIG. 60, the well is at least partially formed by the sole insert, rear ring, and rear weight. A width of the well as measured in between fins 1168 and 1169 can vary from 5 mm to 20 mm, preferably 7 mm to 15 mm, and a depth of the well can progressively increase from a front to back direction such that the depth of the well at the rearmost portion of the club head is greatest. A maximum depth of the well at the rear portion of the club head may vary from 1.25 mm to 5 mm.

Referring to FIGS. 61 and 62, the sole insert 1116 can comprise a plurality of ribs formed on the interior surface. The ribs can be shaped, sized, and/or arranged to reduce the amplitude of vibration of the perimeter edges of the sole insert and/or increase the frequency of the first mode of the sole insert. In the illustrated embodiment, the sole insert 1116 comprises two ribs 1162 and 1164. The ribs 1162 and 1164 do not intersect, but in other embodiments the ribs can be configured to intersect. At least the rib 1164 extends across the protrusion formed in the sole insert 1116 (e.g., across the inertia generator 1140), and crosses a plurality of the curved portions of the sole insert. For example, in the illustrated embodiment the rib 1164 extends across all of the curved portions 1140-1160 (FIG. 60) of the sole insert, although in other embodiments the rib can extend across a subset of the curved portions. The rib 1162 can comprise a curved portion 1163 to accommodate the forward sole weight 1130.

In certain embodiments, parameters of the ribs including the number of ribs, the size, shape, and/or location of the ribs, the material of the ribs, whether the ribs intersect and the location of such intersection(s), etc., can be determined in the following exemplary manner. In certain embodiments, one or more of the following process steps can be performed by a computer-implemented design system referred to hereinafter as a design tool. For example, based at least in part on parameters, criteria, and/or constraints including the shape and/or size of the sole insert, the shape and/or size of the rear ring, the overall shape, size, and/or volume of the golf club head, the fiber and resin material type, manufacturing criteria including the manufacturing method of the sole insert and/or the ribs, the shape and/or size of manufacturing tooling such as molds, dies, etc., the design tool can determine one or a plurality of regions on the sole insert (or other component) where ribs can be formed. In certain embodiments, a three-dimensional model of a golf club head can be created, and a finite element analysis (FEA) simulation of striking a golf ball can be carried out (e.g., using ANSYS® or another FEA simulation tool). Vibration mode frequencies and amplitudes of the sole insert (or other component of the club head) can be determined based at least in part on the FEA simulation. In certain embodiments, one or a plurality of mode frequencies and/or frequency ranges to be altered and/or suppressed can be identified and selected. For example, relatively low frequency modes such as vibration modes with a frequency of less than 4,000 Hz can be identified by the system, and selected for suppression or alteration by changing the structural properties of the sole insert, such as by adding ribs. In certain embodiments, vibration modes with a frequency of 4,000 Hz or greater can be identified and selected for preservation or enhancement in subsequent design changes.

Based at least in part on the above parameters, the design tool can then determine a number, size, shape, and/or location of ribs to be formed on the sole insert (or other component) within the identified region(s) where ribs can be formed. In certain embodiments, the design tool can configure the rib(s) to meet the specified manufacturing criteria. In certain embodiments, the design tool can configure the rib(s) such that the frequency of a first vibration mode of the sole insert increases as compared to the sole insert without the rib(s). In certain embodiments, the design tool can configure the rib(s) such that the amplitude of oscillations at the perimeter of the sole insert where the sole insert is connected to the rear ring is reduced. In certain embodiments, the design tool can determine other structural features of the sole insert, such as the thickness (e.g., the number of fiber plies) of one or a plurality of regions of the sole insert, the shape and/or volume of the sole insert, etc., that increase the frequency of the first mode and/or reduce the amplitude of vibration of the sole insert. One or more of such structural features can be incorporated into the sole insert design in combination with the rib(s), depending upon the particular characteristics sought.

Figure 72A:
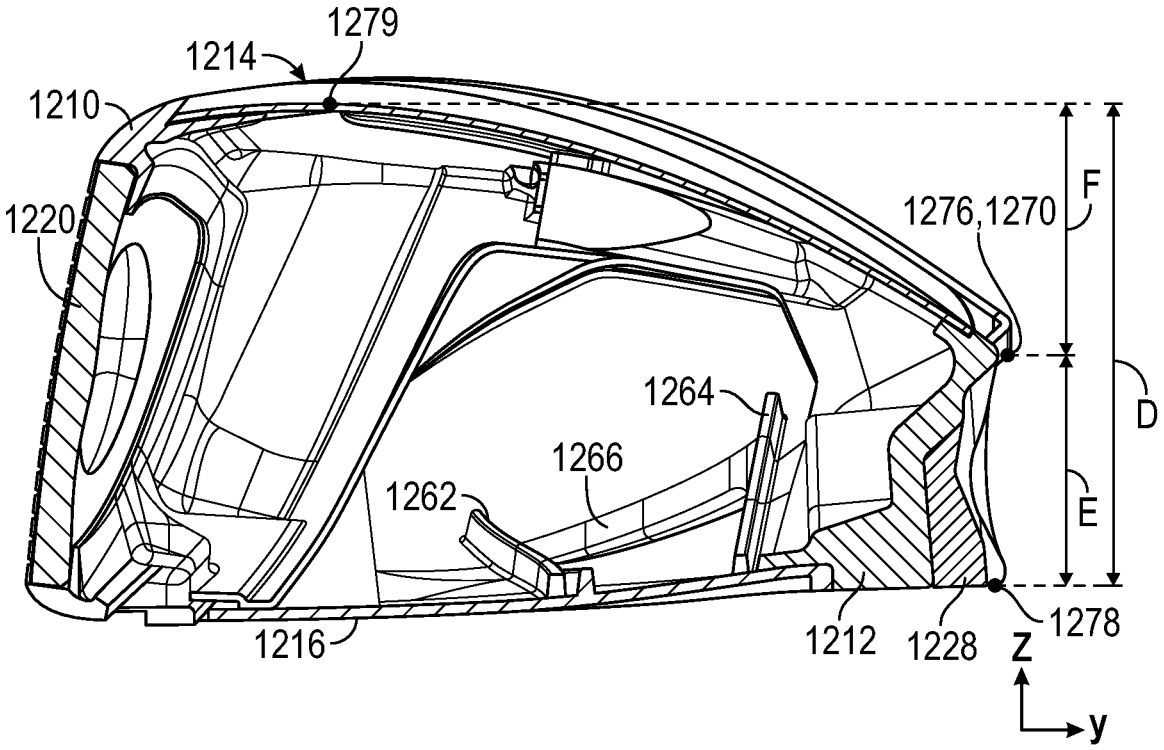
FIG. 72A is a cross-sectional side elevation view taken along plane A of FIG. 71.
Figure 72B:
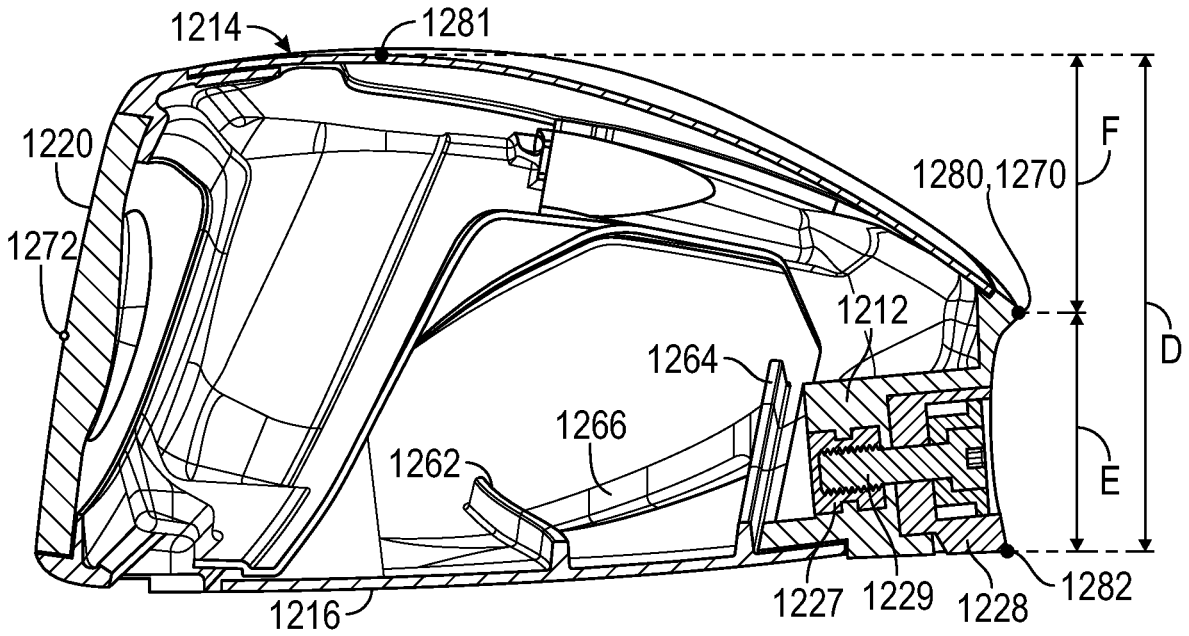
FIG. 72B is a cross-sectional side elevation view taken along plane B of FIG. 71.
Figure 72C:
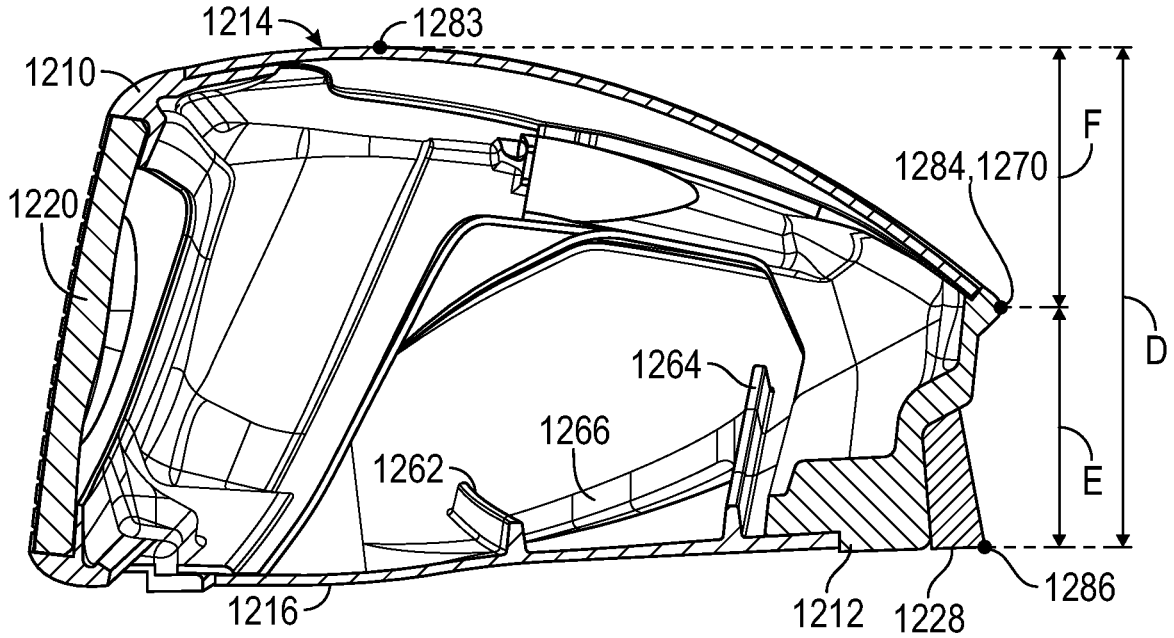
FIG. 72C is cross-sectional side elevation view taken along plane C of FIG. 71.
Figure 73:
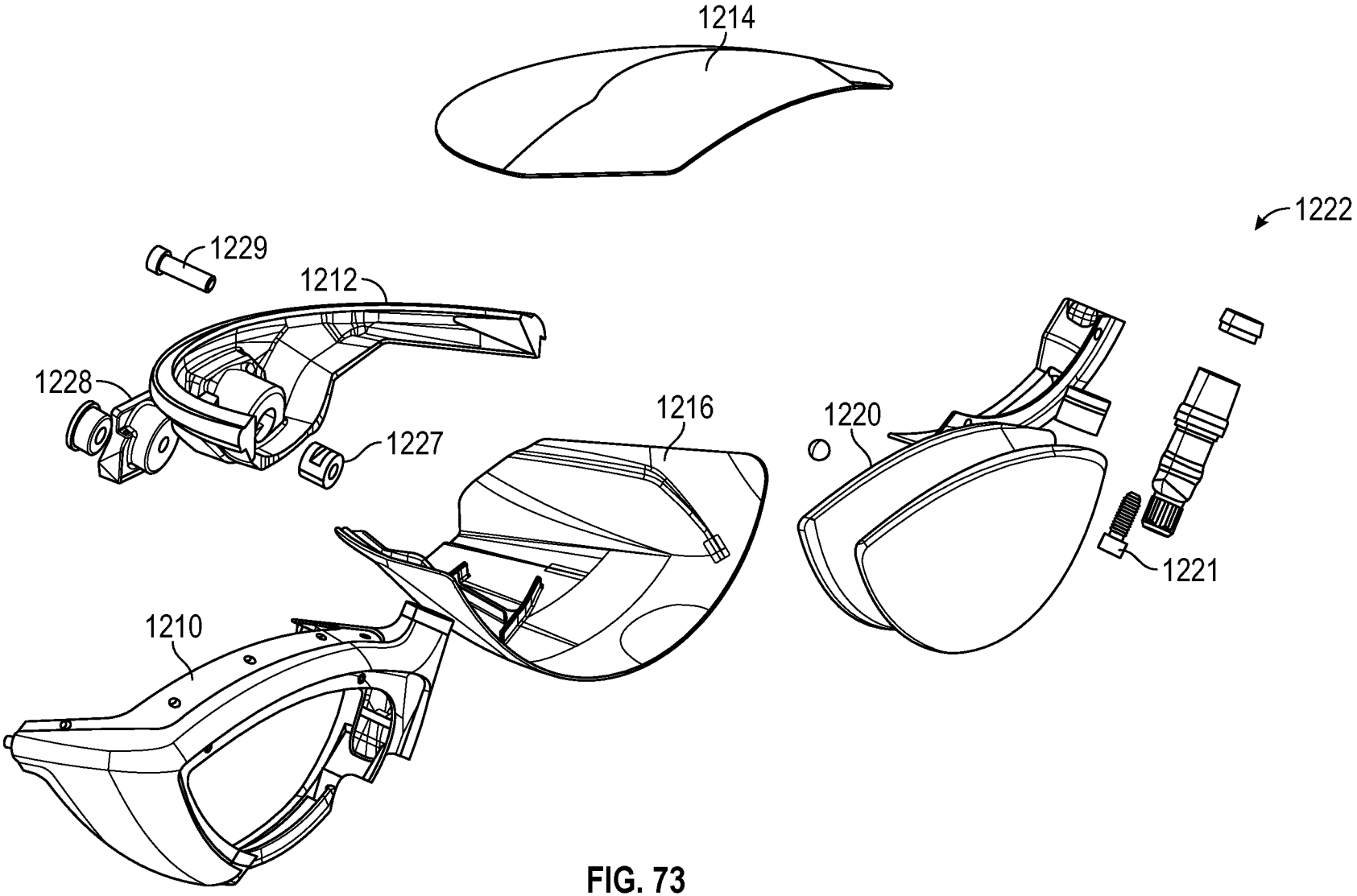
FIG. 73 is an exploded view of the golf club head of FIG. 65.

FIGS. 65-73 illustrate another embodiment of a golf club head 1200. Similar to other club heads disclosed herein, the club head 1200 comprises a cast cup 1210 coupled to a separately formed rear ring 1212, along with a crown insert 1214, a sole insert 1216, a face insert 1220, an adjustable head-shaft connection assembly 1222 (FIG. 73) including a screw 1221, a sole channel 1224 and plug 1271 (FIG. 67), and a rear weight 1228 with screw 1229 and nut 1227 (FIG. 73). The club head 1200 can comprise any combination of the variations disclosed herein for the cast cup, face insert, rear ring, rear weight, etc. For example, in the illustrated embodiment the club head 1200 does not include a front weight, but in other embodiments can include a non-sliding front weight/sole weight (e.g., received in an associated weight port defined in the cast cup 1210), and/or can include an adjustable weight assembly as described in 2021/0113896 incorporated by reference above.

The club head 1200 can have any type of rear ring and rear weight, such as any of the rear ring and rear weight combinations disclosed elsewhere herein. In the illustrated example, the club head 1200 comprises an externally attachable rear weight 1228 that is coupled to the rear ring 1212 with an external screw 1229 (see FIGS. 71 and 72B), such that the rear weight is removable and interchangeable with other rear weights having different masses, colors, etc. The club head 1200 can also include an anti-rotation nut 1227 (FIG. 72B) that is received in the rear ring 1212 and receives the screw 1229 to secure the weight 1228 to the ring 1212. The rear weight 1228 can form one end (e.g., the aft end) of an inertia generator 1240 similar to those described above.

The crown insert 1214 can be adhesively joined to the cast cup and the rear ring to enclose a crown opening, and the sole insert 1216 can be adhesively joined to the cast cup and the rear ring to enclose a sole opening as described above with reference to golf club head 1000.

With reference to FIG. 64, the face insert 1220 can also comprise an external coating layer 1223 on the front striking surface, which can comprise polyurethane or other materials disclosed herein.

In the illustrated embodiment, the inertia generator 1240 can comprise a protrusion formed in the sole of the club head, as described above. More particularly, the inertia generator 1240 can be partially defined by a plurality of curved portions or bends formed in the sole insert 1216 and the various other components of the golf club head that make up the inertia generator (e.g., the rear ring 1212 and/or the rear weight 1228). For example, moving in a direction from the heel toward the toe of the club head in FIG. 68, in the illustrated embodiment the inertia generator 1240 can comprise a first (concave) curved portion 1242, a second (convex) curved portion 1244, a third (convex) curved portion 1246, a fourth (concave) curved portion 1248, a fifth (concave) curved portion 1250, a sixth (convex) curved portion 1252, a seventh (convex) curved portion 1254, and an eighth (concave) curved portion 1256 where the inertia generator transitions to the toe portion 1261 of the sole insert 1216. The inertia generator 1240 (and thus the sole insert 1216) thereby comprises a plurality of ribs, fins, prominences, and/or peaks (from a perspective looking at the exterior of the sole as in FIG. 68) that extend lengthwise along the inertia generator similar to the embodiment of FIG. 60. In the illustrated embodiment, the inertia generator 1240 has two fins 1268 and 1269 that extend along the length of the inertia generator and converge in the aft direction. The fins 1268 and 1269 can be continuous along the sole insert 1216, the rear ring 1212, and the rear weight 1228. In the illustrated embodiment the rear ring 1212 can comprise a ramped surface 1258 facing in the fore-and-aft direction, and which is at the aft end of a recess defined between the two fins 1268 and 1269. The ramped surface 1258 can extend to the height of the fins 1268 and 1269 such that the fins blend into the aft end of the rear ring 1212 and the rear weight 1228.

Figure 69:
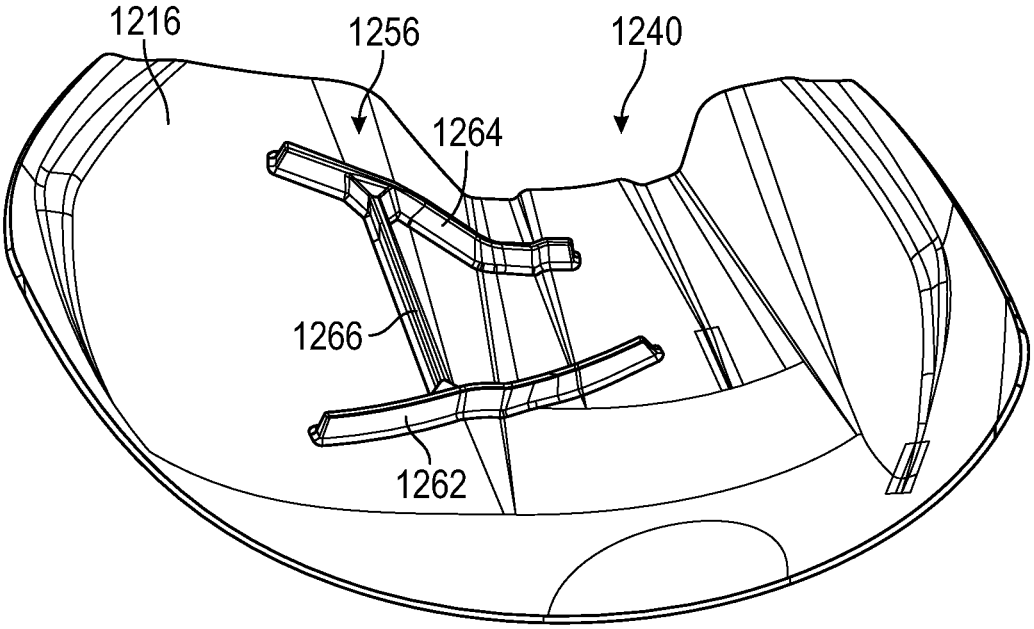
FIG. 69 is a perspective view of a sole insert of the golf club head of FIG. 65 including ribs, according to one embodiment.
Figure 70:
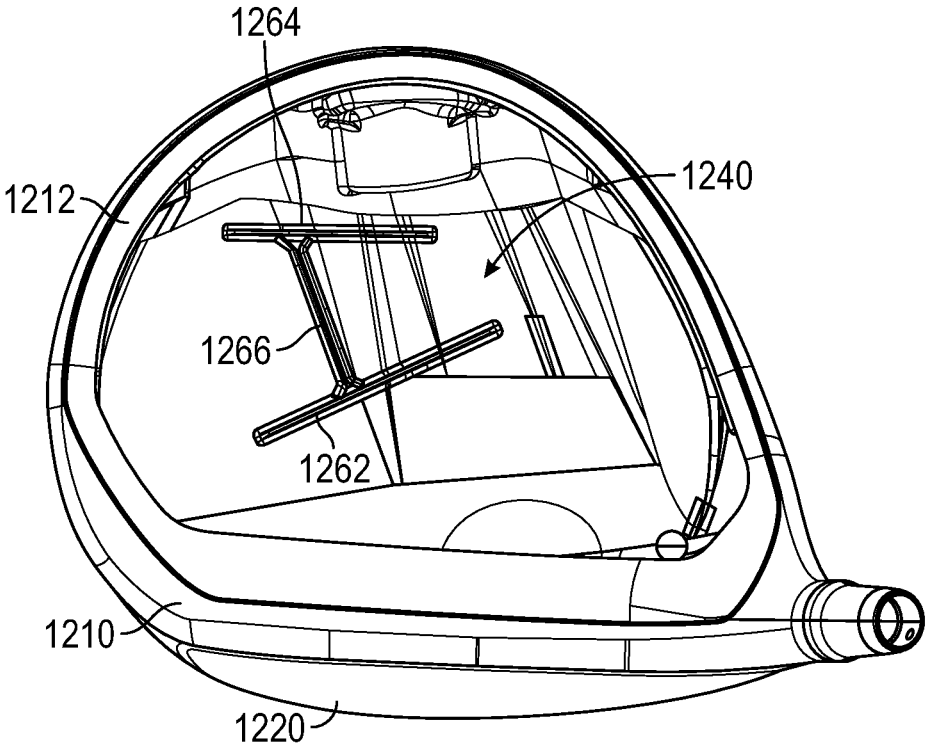
FIG. 70 is a top perspective view of the golf club head of FIG. 65 with the crown insert removed for purposes of illustration.

Referring to FIGS. 69 and 70, the sole insert 1216 can comprise a plurality of ribs formed on the interior surface. As in other embodiments described herein, the ribs can be shaped, sized, and/or arranged to reduce the amplitude of vibration of the perimeter edges of the sole insert and/or increase the frequency of the first mode of the sole insert. In the illustrated embodiment, the sole insert 1216 comprises three ribs 1262, 1264, and 1266. The ribs 1262 and 1264 extend generally in the heel-to-toe direction, and the rib 1266 extends generally in the fore-and-aft direction and interconnects the ribs 1262 and 1264. The ribs 1262 and 1264 can extend at least partially across the inertia generator 1240 (e.g., across the protrusion/recess formed in the sole insert 1216), and can cross a plurality of the curved portions of the sole insert. The rib 1266 can be oriented generally along the curved portion 1256 of the inertia generator on the toe-ward side of the inertia generator. In certain embodiments, at least a portion of a rib (e.g., a first rib, such as the rib 1264) can be positioned rearward of a center of gravity of the golf club head (see, e.g., FIG. 3 for CG location) and at least a portion of a second rib (e.g., the rib 1262) can be positioned forward of a center of gravity of the golf club head. In certain embodiments, at least one rib (e.g., the rib 1262 and/or the rib 1264) extends across the protrusion of the inertia generator and at least one rib (e.g., the rib 1266) extends from a toe portion to a heel portion of the golf club head.

Figure 71:
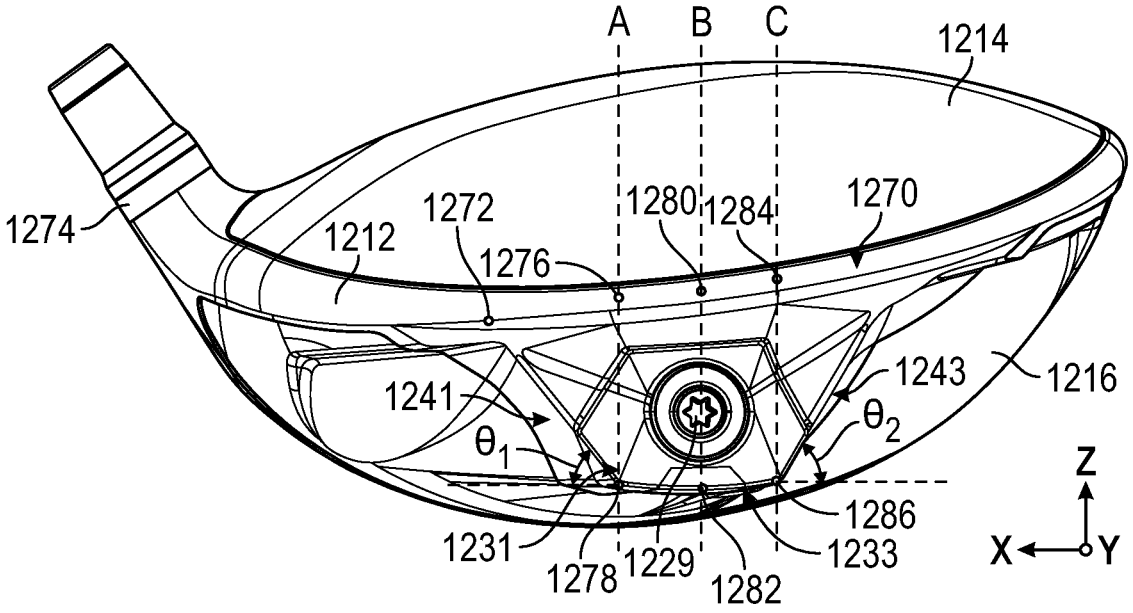
FIG. 71 is a rear end view of the golf club head of FIG. 65.

The lower edge/surface of the inertia generator 1240 can be vertically offset from the crown-to-skirt transition region (e.g., along the z-axis in FIG. 71). In the embodiment of FIGS. 67-73, the lower edge of the rear weight 1228, which forms the aft end of the inertia generator 1240, can be vertically offset from the crown-to-skirt transition region. In certain embodiments, the z-axis coordinate of the crown-to-skirt transition region can vary along the rear end of the golf club head. Stated differently, the vertical distance from the crown-to-skirt transition region to the lowermost edge of the inertia generator 1240 can vary moving in the heel-to-toe direction around the rear end of the golf club head.

Figure 68:
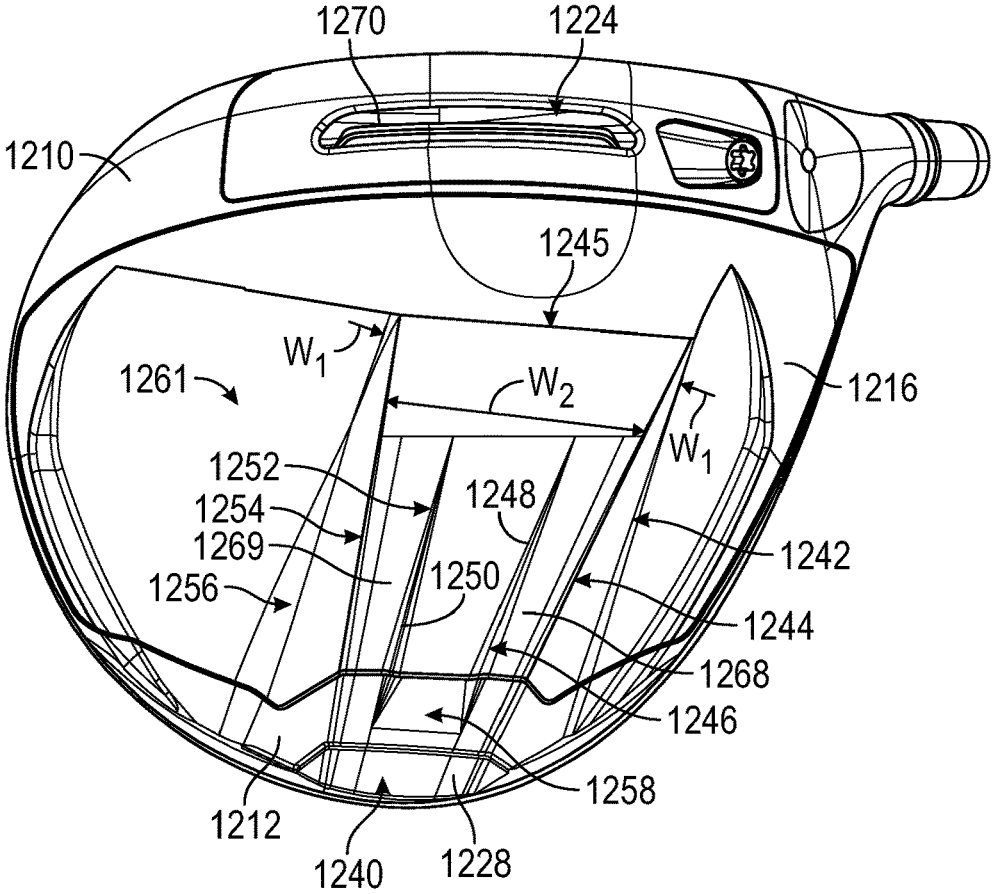
FIG. 68 is a bottom view of the golf club head of FIG. 65.

For example, referring to FIG. 71, for purposes of the following description the crown-to-skirt transition region is defined as the curved region indicated at 1270 on the rear ring 1212. Three exemplary vertical planes A, B, and C are defined in FIG. 71 extending in the y-z plane (e.g., in the fore-and-aft direction along the y-axis) through a rear-facing surface 1231 of the inertia generator 1240. The rear-facing surface 1231 of the inertia generator 1240 can be defined at least in part by the rear weight 1228, the rear ring 1212, the screw 1229, or any combination thereof. Vertical plane A is a heel side vertical plane offset in a direction toward the heel of the club head (e.g., along the positive x-axis toward the hosel 1274) relative to the center of the rear-facing surface 1231 (e.g., the screw 1229). Heel side vertical plane A also passes through the curved portion 1244 of the inertia generator 1240 (FIG. 68). Vertical plane B is a center vertical plane that passes through the center of the center of the rear-facing surface 1231 of the inertia generator (e.g., through the screw 1229 and bisecting the aft end of the inertia generator 1240). Vertical plane C is a toe side vertical plane that is offset in a direction toward the toe of the golf club head relative to the center of the rear-facing surface 1231 (and relative to the screw 1229). The toe side vertical plane C passes through the curved portion 1254 of the inertia generator 1240. As shown in FIG. 71, the heel side vertical plane A is positioned closest to the center face location 1272 of the face insert 1220 along the x-axis.

In the illustrated embodiment, the heel side vertical plane A can be offset from the central vertical plane B by 1 mm, 2 mm, 3 mm, 5 mm, 10 mm, 20 mm, etc., toward the heel of the golf club head (e.g., along the positive x-axis in FIG. 71 toward the hosel 1274). The toe side vertical plane C can be offset from the center vertical plane B toward the toe of the golf club head by a distance of 1 mm, 2 mm, 3 mm, 5 mm, 10 mm, 20 mm, etc., (e.g., along the negative x-axis in FIG. 71).

The heel side vertical plane A passes through a point 1276 on the crown-to-skirt transition region 1270 (referred to hereinafter as a crown-to-skirt transition point). Heel side vertical plane A also passes through a point 1278 on the inertia generator 1240, referred to hereinafter as an inertia generator point. In the illustrated embodiment, the inertia generator point 1278 is on a lower rear edge 1233 of the rear weight 1228 that divides a lower surface of the inertia generator from the rear-facing surface 1231 of the inertia generator. The crown-to-skirt transition point 1276 can be the point on the crown-to-skirt transition region 1270 that is farthest from the face insert 1220 along the y-axis in heel side vertical plane A. The inertia generator point 1278 can be the point on the inertia generator 1240 that is farthest from the face insert 1220 along the y-axis in heel side vertical plane A.

FIG. 72A is a cross-sectional view of the golf club head taken along heel side vertical plane A. As shown in FIG. 72A, the heel side vertical plane A also passes through a point 1279 that is the apex of the crown of the golf club head (e.g., on the crown insert) along the heel side vertical plane A. The point 1279 is referred to hereinafter as the crown apex point. The crown apex point 1279 can be the point farthest from the ground plane and/or the lower surface of the club head along the z-axis that lies in the heel side vertical plane A.

FIG. 72A illustrates various vertical dimensions of the golf club head measured along the z-axis (e.g., an axis extending in a direction between the crown and the sole of the golf club head) in heel side vertical plane A. A vertical dimension D is defined between the inertia generator point 1278 on the inertia generator 1240 and the crown apex point 1279 of the crown insert 1214 on the heel side vertical plane A. A vertical dimension E is defined between the inertia generator point 1278 on the inertia generator 1240 and the crown-to-skirt transition point 1276 on the crown-to-skirt transition region 1270. A vertical dimension F is defined between the crown-to-skirt transition point 1276 on the crown-to-skirt transition region 1270 and the crown apex point 1279 on the heel side vertical plane A.

In certain embodiments, vertical distance/dimension D as measured in the heel side vertical plane A can be 45 mm to 65 mm, such as 45 mm to 60 mm, 50 mm to 65 mm, 50 mm to 60 mm, 52 mm to 58 mm, etc. In the particular embodiment shown, the vertical dimension D as measured in the heel side vertical plane A can be 55.07 mm.

In certain embodiments, the vertical distance/dimension E as measured in the heel side vertical plane A can be 15 mm to 35 mm, such as 15 mm to 30 mm, 20 mm to 35 mm, 20 mm to 30 mm, 22 mm to 28 mm, etc. In the particular embodiment shown, the vertical dimension E as measured in the heel side vertical plane A can be 25.7 mm.

In certain embodiments, the vertical distance/dimension F as measured in the heel side vertical plane A can be 20 mm to 40 mm, such as 20 mm to 35 mm, 25 mm to 40 mm, 25 mm to 35 mm, 26 mm to 34 mm, etc. In the particular embodiment shown, the vertical dimension F as measured in the heel side vertical plane A can be 29.4 mm.

In certain embodiments, a ratio of the vertical dimension E to the vertical dimension $$F\left(\frac{E}{F}\right)$$

as measured in the heel side vertical plane A can be 65% to 95%, such as 70% to 90%, 75% to 95%, 75% to 90%, 80% to 90%, etc. In the illustrated embodiment, the ratio $$\frac{E}{F}$$

as measured in the heel side vertical plane A is 87%.

In certain embodiments, a ratio of the vertical dimension E to the vertical dimension $$D\left(\frac{E}{D}\right)$$

as measured in the heel side vertical plane A can be 20% to 65%, such as 25% to 60%, 30% to 55%, 35% to 55%, 40% to 60%, 40% to 55%, 40% to 50%, etc. In the illustrated embodiment, the ratio $$\frac{E}{D}$$

as measured in the heel side vertical plane A is 47%.

Referring again to FIG. 71, the central vertical plane B passes through a crown-to-skirt transition point 1280 on the crown-to-skirt transition region 1270, and an inertia generator point 1282 on the lower rear edge 1233 of the inertia generator 1240. The crown-to-skirt transition point 1280 can be the point on the crown-to-skirt transition region 1270 that is farthest from the face insert 1220 along the y-axis in the central vertical plane B. The inertia generator point 1282 can be the point on the inertia generator 1240 (e.g., on the lower rear edge 1233) that is farthest from the face insert 1220 along the y-axis in the central vertical plane B.

FIG. 72B is a cross-sectional view of the golf club head taken along the central vertical plane B. As shown in FIG. 72B, the central vertical plane B also passes through a crown apex point 1281 that is the apex of the crown of the golf club head along the central vertical plane B (e.g., the point farthest from the ground plane and/or the lower surface of the club head along the z-axis that lies in the central vertical plane B).

FIG. 72B illustrates various vertical dimensions of the golf club head measured along the z-axis in the central vertical plane B. A vertical dimension D is defined between the point 1282 on the lower rear edge 1233 of the inertia generator 1240 and the apex point 1281 of the crown insert 1214 on the central vertical plane B. A vertical dimension E is defined between the inertia generator point 1282 on the inertia generator 1240 and the crown-to-skirt transition point 1280 on the crown-to-skirt transition region 1270. A vertical dimension F is defined between the crown-to-skirt transition point 1280 on the crown-to-skirt transition region 1270 and the crown apex point 1281 in the central vertical plane B.

In certain embodiments, vertical dimension D as measured in the central vertical plane B can be 48 mm to 68 mm, such as 48 mm to 63 mm, 53 mm to 68 mm, 52 mm to 62 mm, 54 mm to 60 mm, etc. In the particular embodiment shown, the vertical dimension D as measured in the central vertical plane B can be 58.02 mm.

In certain embodiments, the vertical dimension E as measured in the central vertical plane B can be 15 mm to 40 mm, such as 17 mm to 37 mm, 17 mm to 32 mm, 22 mm to 37 mm, 20 mm to 30 mm, 22 mm to 32 mm, 25 mm to 30 mm, etc. In the particular embodiment shown, the vertical dimension E as measured in the central vertical plane B can be 27.7 mm.

In certain embodiments, the vertical dimension F as measured in the central vertical plane B can be 20 mm to 40 mm, such as 20 mm to 35 mm, 25 mm to 40 mm, 25 mm to 35 mm, 26 mm to 34 mm, etc. In the particular embodiment shown, the vertical dimension F as measured in the central vertical plane B can be 30.3 mm.

In certain embodiments, a ratio of the vertical dimension E to the vertical dimension $$F\left(\frac{E}{F}\right)$$

as measured in the central vertical plane B can be 70% to 110%, such as 75% to 100%, 80% to 100%, 80% to 95%, 85% to 95%, etc. In the illustrated embodiment, the ratio $$\frac{E}{F}$$

as measured in the heel side vertical plane A is 91%.

In certain embodiments, a ratio of the vertical dimension E to the vertical dimension $$D\left(\frac{E}{D}\right)$$

as measured in the central vertical plane B can be 20% to 65%, such as 25% to 60%, 30% to 55%, 35% to 55%, 40% to 60%, 40% to 55%, 40% to 50%, etc. In the illustrated embodiment, the ratio $$\frac{E}{D}$$

as measured m the central vertical plane B is 48%.

Referring again to FIG. 71, the toe side vertical plane C passes through a crown-to-skirt transition point 1284 in the crown-to-skirt transition region 1270 and a inertia generator point 1286 on the inertia generator 1240. The crown-to-skirt transition point 1284 can be the point on the crown-to-skirt transition region 1270 that is farthest from the face insert 1220 along the y-axis in the toe side vertical plane C. The inertia generator point 1286 can be the point on the inertia generator 1240 that is farthest from the face insert 1220 along the y-axis in the toe side vertical plane C.

FIG. 72C is a cross-sectional view of the golf club head taken along the toe side vertical plane C. As shown in FIG. 72C, the toe side vertical plane C also passes through a crown apex point 1283 that is the apex of the crown of the golf club head along the toe side vertical plane C (e.g., the point farthest from the ground plane and/or the lower surface of the club head along the z-axis that lies in the toe side vertical plane C).

FIG. 72C illustrates a vertical dimension D that is defined between the inertia generator point 1286 and the crown apex point 1283 in the toe side vertical plane C. A vertical dimension E is defined between the inertia generator point 1286 and the crown-to-skirt point 1284. A vertical dimension F is defined between the crown-to-skirt transition point 1284 and the crown apex point 1283 in the toe side vertical plane C.

In certain embodiments, vertical dimension D as measured in the toe side vertical plane C can be 48 mm to 68 mm, such as 48 mm to 63 mm, 53 mm to 68 mm, 52 mm to 62 mm, 54 mm to 60 mm, etc. In the particular embodiment shown, the vertical dimension D as measured in the toe side vertical plane C can be 57.9 mm.

In certain embodiments, the vertical dimension E as measured in the toe side vertical plane C can be 15 mm to 40 mm, such as 17 mm to 37 mm, 17 mm to 32 mm, 22 mm to 37 mm, 20 mm to 30 mm, 22 mm to 32 mm, 25 mm to 30 mm, etc. In the particular embodiment shown, the vertical dimension E as measured in the toe side vertical plane C can be 28.1 mm.

In certain embodiments, the vertical dimension F as measured in the toe side vertical plane C can be 20 mm to 40 mm, such as 20 mm to 35 mm, 25 mm to 40 mm, 25 mm to 35 mm, 26 mm to 34 mm, etc. In the particular embodiment shown, the vertical dimension F as measured in the central vertical plane B can be 29.8 mm.

In certain embodiments, a ratio of the vertical dimension E to the vertical dimension $$F\left(\frac{E}{F}\right)$$

as measured in the toe side vertical plane C can be 70% to 110%, such as 75% to 100%, 80% to 100%, 85% to 105%, 90% to 100%, etc. In the illustrated embodiment, the ratio $$\frac{E}{F}$$

as measured in the toe side vertical plane C is 94%.

In certain embodiments, a ratio of the vertical dimension E to the vertical dimension $$D\left(\frac{E}{D}\right)$$

as measured in the toe side vertical plane C can be 20% to 65%, such as 25% to 60%, 30% to 60%, 35% to 55%, 40% to 60%, 40% to 55%, 45% to 55%, etc. In the illustrated embodiment, the ratio $$\frac{E}{D}$$

as measured in the toe side vertical plane C is 49%.

Table 6 below includes measurements for D, E, and F in each of the vertical heel plane A, the vertical midplane B, and the vertical toe plane C, and ratios $$\frac{E}{F} \text{ and } \frac{E}{D}$$

for the particular embodiment shown in FIGS. 67-73. All dimensions in Table 6 are in mm. Golf club heads with dimensions and associated ratios within the ranges given herein combine advantageous aerodynamic properties due to the relatively high crown-to-skirt transition region 1270 with increased moment of inertia due to the mass concentration at the end of the relatively low inertia generator 1240. In addition to the club head 1200, the dimensions D, E, and F and associated ratios given herein can also be applicable to any of the other golf club heads described herein, and particularly to the club heads of FIGS. 47-64.

TABLE 6

| | | Heel (A) | Mid (B) | Toe (C) |
|---|---|---|---|---|
| D | lower surface to apex | 55.07 | 58.02 | 57.91 |
| E | lowest rearmost point distance to upper rearmost point | 25.68 | 27.7 | 28.09 |
| F | upper rearmost point to apex | 29.39 | 30.32 | 29.82 |
| | ratio E/F | 87% | 91% | 94% |
| | ratio E/D | 47% | 48% | 49% |

Returning to FIG. 71, in certain embodiments each of the crown-to-skirt transition points 1276, 1280, and 1284 (e.g., on the rear ring 1212) can be offset from the center face location 1272 along the positive z-axis. Stated differently, each of the crown-to-skirt transition points 1276, 1280, and 1284 is higher than the center face location 1272 when the club is at address. Because the height of the rear ring 1212 increases moving in the heel-to-toe direction from the heel side vertical plane A toward the toe side vertical plane C, the z-coordinate of the point 1276 is greater than the z-coordinate of the center face location 1272, the z-coordinate of the point 1280 is greater than the z-coordinate of the center face location 1272 and of the point 1276, and the z-coordinate of the point 1284 is greater than the z-coordinates of the center face location 1272, the point 1276, and the point 1280. In certain embodiments, 70% or more, 80% or more, or 90% or more of all points on the crown-to-skirt transition region 1270 (e.g., taken at 2 mm increments) around the crown-to-skirt transition region (or along the x-axis) can be above the center face location 1272 as measured relative to the z-axis up to an X-Z plane 1273 (FIG. 67) passing through the center of gravity of the club head.

The following exemplary dimensions are provided for a golf club head at a static loft of 9.5°, but may be applicable to other loft angles. In certain embodiments, the point 1276 can be 0.5 mm to 3 mm above the center face location 1272 along the z-axis, such as 1 mm to 3 mm or 1 mm to 2 mm. In the illustrated embodiment, the point 1276 can be 1.65 mm above the center face location 1272 along the z-axis.

In certain embodiments, the point 1280 can be 1 mm to 5 mm above the center face location 1272 along the z-axis, such as 1 mm to 4 mm or 2 mm to 3 mm. In the illustrated embodiment, the point 1280 can be 2.87 mm above the center face location 1272 along the z-axis.

In certain embodiments, the point 1284 can be 2 mm to 7 mm above the center face location 1272 along the z-axis, such as 2 mm to 6 mm or 3 mm to 5 mm. In the illustrated embodiment, the point 1284 can be 4.37 mm above the center face location 1272 along the z-axis.

The angle of the side walls of the inertia generator can influence the acoustics of the golf club head, along with the stresses on the sole insert (and/or other components of the club head) when striking a golf ball. For example, referring again to FIG. 71 the inertia generator 1240 can have a heel side wall 1241 oriented toward the heel of the club head and the hosel 1274, and a toe side wall 1243 oriented toward the toe of the club head. The heel side wall 1241 can define an angle $\theta_1$ with a plane parallel to the ground plane, and the toe side wall 1243 can define an angle $\theta_2$ with a plane parallel to the ground plane. In certain embodiments, the angles $\theta_1$ and $\theta_2$ can be the same or different, depending upon the particular characteristics sought. For example, in certain embodiments, the angles $\theta_1$ and $\theta_2$ can be 20° to 90°, such as 30° to 90°, 40° to 90°, 30° to 80°, 40° to 80°, 40° to 70°, etc. In the illustrated embodiment, the angle $\theta_1$ can be 50° and the angle $\theta_2$ can be 60°. In other embodiments, the angles $\theta_1$ and $\theta_2$ can be the same or different, The ratio of the width of the base of the inertia generator to the width of the lowermost surface of the inertia generator can also influence the acoustics and stresses on the club head body. In the illustrated example, the lowermost surface of the inertia generator can narrow traveling in a direction toward the rear of the golf club head. For example, referring to FIG. 68, at a location proximate the origin or root 1245 of the inertia generator 1240 (e.g., a location that is 10 mm or less from the origin 1245 of the inertia generator), the width $w_2$ of the lowermost surface 1247 of the inertia generator can be 80% or more of the width $w_1$ of the base, 85% or more of the width $w_1$ of the base, 90% or more of the width $w_1$ of the base, etc. At the aft end portion of the inertia generator, the width $w_2$ of the lowermost surface 1247 of the inertia generator (e.g., on the rear ring 1212 and/or the rear weight 1228) can be 20% or more of the width $w_1$ of the base, 30% or more of the width $w_1$ of the base, 40% or more of the width $w_1$ of the base, 50% or more of the width $w_1$ of the base, 60% or less of the width $w_1$ of the base, 50% or less of the width $w_1$ of the base, 40% or more of the width $w_1$ of the base, etc. In the illustrated embodiment, at the aft end of the rear weight 1228 the width $w_2$ of the lowermost surface 1247 is 40% of the width $w_1$ of the base.

One or more of the sole insert and rib embodiments described herein can provide significant advantages over known insert designs. For example, incorporating ribs into the sole inserts as described herein provides for a number of other changes, including reduced thickness and increased first mode vibration frequency. For example, without ribs, a sole insert similar to the sole insert 1216 shown in FIGS. 65-73 made of carbon fiber composite material had a thickness 1.06 mm and a mass of 15 g. Adding the ribs 1262-1266 described above stiffened the sole insert, and allowed a reduction in thickness to 0.86 mm. This, in turn, reduced the mass of the sole insert by 2 g. By adding the 2 g of "discretionary mass" to the rear ring 1228 (e.g., by increasing the thickness of the material), the moment of inertia of the golf club head could be advantageously increased. For example, adding the discretionary mass from the thinned sole insert to the rear ring proximate the rear weight 1228 (e.g., in the inertia generator 1240) resulted in an increase in the moment of inertia of the club head from I=877 g/cm$^2$ to I=888 g/cm$^2$, or 11 g/cm$^2$. Thus, incorporating ribs into the sole insert provides for a reduction in thickness and a corresponding reduction in overall mass of the sole insert, allowing that discretionary mass to be incorporated into the inertia generator at a relatively large distance from the center of gravity of the club head to increase the moment of inertia. Accordingly, the main panel body of each of the sole inserts with ribs described herein, and particularly the sole inserts of the club heads of FIGS. 47-73, can have a thickness of 0.45 mm to 1.3 mm, such as 0.45 mm to 1 mm, 0.5 mm to 1.1 mm, 0.6 mm to 0.95 mm, 1.3 mm or less, 1 mm or less, such as 0.95 mm or less, 0.9 mm or less, 0.8 mm or less, 0.7 mm or less, 0.6 mm or less, 0.5 mm or less, etc., facilitated by the stiffening configuration of the ribs.

The sole inserts with ribs described herein can also display improved vibration characteristics. For example, without ribs a sole insert similar to the sole insert 1216 shown in FIGS. 65-73 having a thickness of 0.86 mm had a first vibration mode frequency of 4004 Hz. After adding the ribs 1262-1266 described above, the first mode frequency of the sole insert 1216 increased to 4525 Hz, an increase of more than 13%. The increased first mode frequency can improve the acoustic properties of the club head, resulting in a relatively higher frequency "ring" upon striking a golf ball that resembles metal drivers.

The sole insert embodiments described herein can be especially advantageous in golf club heads where the rear ring is formed from a fiber-reinforced composite material, and which include a weight coupled to the rear ring. Rear rings comprising composite materials tend to have a higher stiffness than comparable rear rings made of metal materials such as aluminum, limiting the ability of the rear ring to flex with the sole insert at the interface. The ribs and other vibration reducing features described herein can more closely align the vibration mode frequencies and amplitudes of the sole insert to those of the rear ring, reducing stresses at the adhesive joint between the components as noted above. For example, off-center hits, such as hits on the toe side of the face insert relative to the center face location, are typically associated with the highest stresses and panel deflections of the sole insert.

Using FEA simulations, a carbon fiber sole insert similar to the sole insert 1216 having a thickness of 0.86 mm but without ribs was modeled and subjected to impact with a golf ball at a location offset from the center face location toward the toe of the club head by 20 mm. At the first mode frequency, the maximum deflection of the sole insert in the crown to sole direction (e.g., along the z-axis in FIG. 72A) was 0.53 mm. The region of maximum deflection coincided with the area of maximum stress, which was 306 MPa. The region of maximum deflection and stress was located along the toe side of the inertia generator 1240. Adding the ribs 1262-1266 reduced the maximum stress in the sole insert to 181 MPa, a reduction of more than 40%. The ribs also reduced the maximum deflection of the sole insert along the z-axis to 0.21 mm, a reduction of more than 60%. The reduction in amplitude advantageously reduces stresses in the adhesive joint between the sole insert and the rear ring, thereby prolonging the life of the joint and preventing premature delamination, in addition to the acoustic and MOI improvements noted above.

In certain embodiments, the sole insert embodiments with ribs described herein can be configured to exhibit a first mode frequency of 3,500 Hz or greater, such as 3,600 Hz or greater, 3,700 Hz or greater, 3,800 Hz or greater, 3,900 Hz or greater, 4,000 Hz or greater, 4,100 Hz or greater, 4,200 Hz or greater, 4,300 Hz or greater, 4,400 Hz or greater, 4,500 Hz or greater, etc., when assembled into a golf club head.

Although the ribs and other vibration-reducing features disclosed herein are described primarily in the context of the sole insert, such features can also be incorporated into the crown insert, which can provide for a relatively thin crown with similar sound/feel/stiffness/structural properties as the sole inserts described herein. For golf club heads including multiple sole inserts (e.g., to accommodate a sliding weight track), such features can also be incorporated on one or both sole inserts.

Explanation of Terms

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, examples in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A golf club head, comprising:

a cup comprising a forward portion of the golf club head, including a hosel, a forward portion of a crown of the golf club head, and a forward portion of a sole of the golf club head, wherein the cup comprises a metal alloy;

a face plate received in a forward opening of the cup;

a rear ring formed separately from the cup and coupled to heel and toe portions of the cup to form a club head body, the club head body defining a hollow interior region, a crown opening, and a sole opening, the rear ring comprising a polymeric material;

a crown insert coupled to the crown opening;

a sole insert coupled to the sole opening; and an inertia generator comprising an outwardly extending protrusion formed in the sole of the golf club head and a rear weight positioned at an aft end of the protrusion, the sole insert defining at least a portion of the protrusion of the inertia generator;

wherein the sole insert comprises a fiber-reinforced composite material having a thickness between 0.45 mm and 1 mm, and a plurality of ribs positioned along an internal surface of the sole insert and at least one of the plurality of ribs is positioned inside the protrusion of the inertia generator and extends into the hollow interior region of the golf club head; and wherein:

the inertia generator has a lower rear edge where a lower surface of the inertia generator meets a rear-facing surface of the inertia generator;

the rear ring defines a crown-to-skirt transition region;

a center vertical plane is defined in a fore-and-aft direction passing through a center of the rear-facing surface of the inertia generator;

the center vertical plane passes through a crown apex point on the crown of the golf club head that is the apex of the crown along the center vertical plane;

the center vertical plane passes through an inertia generator point on the lower rear edge of the inertia generator;

the center vertical plane passes through a crown-to-skirt transition point on the crown-to-skirt transition region that is the farthest point on the crown-to-skirt transition region from the face plate in the center vertical plane along a y-axis extending in the fore-and-aft direction;

a vertical distance D is defined between the crown apex point and the inertia generator point along a z-axis extending between the crown and the sole perpendicular to a ground plane;

a vertical distance E is defined between the inertia generator point and the crown-to-skirt transition point along the z-axis; and a vertical distance F is defined between the crown-to-skirt transition point and the crown apex point along the z-axis; and a ratio $$\frac{E}{F}$$

is 80% to 100%.

2. The golf club head of claim 1, wherein at least a portion of a first rib of the plurality of ribs is positioned rearward of a center of gravity of the golf club head and at least a portion of a second rib of the plurality of ribs is positioned forward of a center of gravity of the golf club head.

3. The golf club head of claim 2, wherein at least the first rib of the plurality of ribs extends across the protrusion of the inertia generator and at least the second rib of the plurality of ribs extends from a toe portion to a heel portion of the golf club head.

4. The golf club head of claim 3, wherein the first rib does not intersect the second rib.

5. The golf club head of claim 4, wherein the plurality of ribs further comprises a third rib and the third rib connects to the first rib and the second rib.

6. The golf club head of claim 5, wherein each of the first rib, the second rib, and the third rib have a height between 2 mm and 8 mm, and an aspect ratio of rib height to a minimum rib thickness is at least 2:1.

7. The golf club head of claim 1, wherein a ratio $$\frac{E}{D}$$

is 40% to 60%.

8. The golf club head of claim 1, wherein when the golf club head is at address, the crown-to-skirt transition point is above a center face location along the z-axis.

9. The golf club head of claim 8, wherein:

a point on the crown-to-skirt transition region that is 10 mm heelward of the crown-to-skirt transition point as measured along an x-axis extending in a heel-to-toe direction is above the center face location along the z-axis; and a point on the crown-to-skirt transition region that is 10 mm toe-ward of the crown-to-skirt transition point as measured along the x-axis is above the center face location along the z-axis.

10. The golf club head of claim 1, wherein the rear-facing surface of the inertia generator is at least partially defined by the rear weight.

11. A golf club head, comprising:

a cup comprising a forward portion of the golf club head, including a hosel, a forward portion of a crown of the golf club head, and a forward portion of a sole of the golf club head, wherein the cup comprises a metal alloy;

a face plate received in a forward opening of the cup;

a rear ring formed separately from the cup and coupled to heel and toe portions of the cup to form a club head body, the club head body defining a hollow interior region, a crown opening, and a sole opening, the rear ring comprising a polymeric material and defining a crown-to-skirt transition region;

a crown insert coupled to the crown opening;

a sole insert coupled to the sole opening; and an inertia generator comprising an outwardly extending protrusion formed in the sole of the golf club head and a rear weight positioned at an aft end of the protrusion, the sole insert defining at least a portion of the protrusion of the inertia generator;

an x-axis extends in a heel-to-toe direction from a heel of the golf club head to a toe of the golf club head, a y-axis extends in a fore-and-aft direction from the face plate to a rear of the golf club head, and a z-axis extends between the crown and the sole perpendicular to the x-axis and the y-axis;

a center vertical plane is defined in the fore-and-aft direction passing through a center of a rear-facing surface of the inertia generator;

the center vertical plane passes through a crown-to-skirt transition point on the crown-to-skirt transition region that is the farthest point on the crown-to-skirt transition region from the face plate in the center vertical plane along the y-axis;

the crown-to-skirt transition point is above a center face location along the z-axis;

a point on the crown-to-skirt transition region that is 10 mm heelward of the crown-to-skirt transition point as measured along the x-axis is above the center face location along the z-axis; and a point on the crown-to-skirt transition region that is 10 mm toe-ward of the crown-to-skirt transition point as measured along the x-axis is above the center face location along the z-axis; and wherein:

the inertia generator has a lower rear edge where a lower surface of the inertia generator meets the rear-facing surface of the inertia generator;

the center vertical plane passes through a crown apex point on the crown of the golf club head that is the apex of the crown along the center vertical plane;

the center vertical plane passes through an inertia generator point on the lower rear edge of the inertia generator;

a vertical distance D is defined between the crown apex point and the inertia generator point along the z-axis;

a vertical distance E is defined between the inertia generator point and the crown-to-skirt transition point along the z-axis; and a vertical distance F is defined between the crown-to-skirt transition point and the crown apex point along the z-axis; and a ratio $$\frac{E}{F}$$

is 80% to 100%.

12. The golf club head of claim 11, wherein a ratio $$\frac{E}{D}$$

is 40% to 60%.

13. The golf club head of claim 11, wherein the sole insert comprises a fiber-reinforced composite material having a thickness between 0.45 mm and 1 mm, and a plurality of ribs positioned along an internal surface of the sole insert and at least one of the plurality of ribs is positioned inside the protrusion of the inertia generator and extends into the hollow interior region of the golf club head.

14. The golf club head of claim 13, wherein at least a portion of a first rib of the plurality of ribs is positioned rearward of a center of gravity of the golf club head and at least a portion of a second rib of the plurality of ribs is positioned forward of a center of gravity of the golf club head.

15. The golf club head of claim 14, wherein at least the first rib of the plurality of ribs extends across the protrusion of the inertia generator and at least the second rib of the plurality of ribs extends from a toe portion to a heel portion of the golf club head.

16. The golf club head of claim 15, wherein the first rib does not intersect the second rib.

17. The golf club head of claim 16 wherein the plurality of ribs further comprises a third rib and the third rib connects to the first rib and the second rib.

18. The golf club head of claim 17, wherein each of the first rib, the second rib, and the third rib have a height between 2 mm and 8 mm, and an aspect ratio of rib height to a minimum rib thickness is at least 2:1.

19. The golf club head of claim 11, wherein the rear-facing surface of the inertia generator is at least partially defined by the rear weight.

* * * * *